US009243585B2

(12) United States Patent
Le Roux et al.

(10) Patent No.: US 9,243,585 B2
(45) Date of Patent: Jan. 26, 2016

(54) COMPRESSED GAS ENERGY STORAGE SYSTEM

(71) Applicant: LightSail Energy, Inc., Berkeley, CA (US)

(72) Inventors: Phillip Le Roux, Aliso Viejo, CA (US); Nicholas Peterson, Lake Forest, CA (US)

(73) Assignee: LightSail Energy, Inc., Berkeley, CA (US)

( * ) Notice: Subject to any disclaimer, the term of this patent is extended or adjusted under 35 U.S.C. 154(b) by 251 days.

(21) Appl. No.: 13/655,380

(22) Filed: Oct. 18, 2012

(65) Prior Publication Data

US 2013/0098027 A1 Apr. 25, 2013

Related U.S. Application Data

(60) Provisional application No. 61/548,611, filed on Oct. 18, 2011, provisional application No. 61/645,151, filed on May 10, 2012.

(51) Int. Cl.

| | |
|---|---|
| ***F03C 1/00*** | (2006.01) |
| ***F01K 1/00*** | (2006.01) |
| ***F02G 1/02*** | (2006.01) |
| ***F01L 1/46*** | (2006.01) |
| ***F04B 39/06*** | (2006.01) |
| *F01L 9/02* | (2006.01) |

(52) U.S. Cl.

CPC . *F02G 1/02* (2013.01); *F01L 1/465* (2013.01); *F04B 39/062* (2013.01); *F01L 2009/028* (2013.01); *F01L 2250/06* (2013.01)

(58) Field of Classification Search

CPC ..... F02G 1/02; F01L 1/465; F01L 2009/028; F01L 2250/06; F04B 39/062

USPC ..... 60/508–515, 530–531

See application file for complete search history.

(56) References Cited

U.S. PATENT DOCUMENTS

| | | | | |
|---|---|---|---|---|
| 1,669,780 | A * | 5/1928 | Ricardo | 123/81 R |
| 1,751,537 | A | 3/1930 | Vianello | |
| 2,049,421 | A | 9/1932 | Brelsford et al. | |

(Continued)

FOREIGN PATENT DOCUMENTS

| | | |
|---|---|---|
| CN | 1105103 A | 7/1995 |
| CN | 1432109 A | 7/2003 |

(Continued)

OTHER PUBLICATIONS

International Search Report and Written Opinion for PCT/US2015/011822, filed Jan. 16, 2015.

(Continued)

*Primary Examiner* — Hoang Nguyen

(57) ABSTRACT

Embodiments relate generally to energy storage systems, and in particular to energy storage systems using compressed gas as an energy storage medium. In various embodiments, a compressed gas storage system may include a plurality of stages to convert energy into compressed gas for storage, and then to recover that stored energy by gas expansion. In certain embodiments, a stage may comprise a reversible compressor/expander having a reciprocating piston. Pump designs for introducing liquid for heat exchange with the gas, are described. Gas flow valves featuring shroud and/or curtain portions, are also described.

24 Claims, 122 Drawing Sheets

(56) References Cited

U.S. PATENT DOCUMENTS

| | | | | |
|---|---|---|---|---|
| 1,929,350 | A | 10/1933 | Christensen | |
| 2,522,638 | A | 9/1950 | Ricardo et al. | |
| 3,192,705 | A | 7/1965 | Miller | |
| 3,877,229 | A | 4/1975 | Resler, Jr. | |
| 4,018,135 | A | 4/1977 | Lance et al. | |
| 4,055,951 | A * | 11/1977 | Davoud et al. | 60/514 |
| 4,393,653 | A | 7/1983 | Fischer | |
| 4,426,847 | A * | 1/1984 | Fischer | 60/514 |
| 4,432,203 | A | 2/1984 | Fischer | |
| 4,454,427 | A | 6/1984 | Sosnowski et al. | |
| 4,476,821 | A | 10/1984 | Robinson | |
| 4,702,273 | A | 10/1987 | Allen et al. | |
| 4,723,516 | A | 2/1988 | Slagley et al. | |
| 4,747,271 | A | 5/1988 | Fischer | |
| 4,777,915 | A | 10/1988 | Bonvallet | |
| 4,861,236 | A | 8/1989 | Kustes et al. | |
| 5,076,067 | A | 12/1991 | Prenger et al. | |
| 5,121,607 | A | 6/1992 | George, Jr. | |
| 5,174,253 | A | 12/1992 | Yamazaki et al. | |
| 5,176,164 | A | 1/1993 | Boyle | |
| 5,195,874 | A | 3/1993 | Odagiri | |
| 5,261,360 | A | 11/1993 | Voll et al. | |
| 5,491,969 | A | 2/1996 | Cohn et al. | |
| 5,537,822 | A | 7/1996 | Shnaid et al. | |
| 5,634,340 | A | 6/1997 | Grennan | |
| 5,680,764 | A | 10/1997 | Viteri | |
| 5,934,076 | A | 8/1999 | Coney | |
| 5,946,908 | A | 9/1999 | Motoyama et al. | |
| 6,082,324 | A | 7/2000 | Liu | |
| 6,158,465 | A | 12/2000 | Lambert et al. | |
| 6,206,660 | B1 | 3/2001 | Coney et al. | |
| RE37,603 | E | 3/2002 | Coney | |
| 6,817,185 | B2 | 11/2004 | Coney et al. | |
| 6,840,309 | B2 | 1/2005 | Wilson et al. | |
| 6,874,453 | B2 | 4/2005 | Coney et al. | |
| 6,883,775 | B2 | 4/2005 | Coney et al. | |
| 7,082,911 | B2 | 8/2006 | Ezaki et al. | |
| 7,086,231 | B2 | 8/2006 | Pinkerton | |
| 7,140,182 | B2 | 11/2006 | Warren | |
| 7,311,068 | B2 | 12/2007 | Jackson | |
| 7,802,426 | B2 | 9/2010 | Bollinger | |
| 7,832,207 | B2 | 11/2010 | McBride et al. | |
| 7,874,155 | B2 | 1/2011 | McBride et al. | |
| 7,958,731 | B2 | 6/2011 | McBride et al. | |
| 8,065,873 | B2 | 11/2011 | Fong et al. | |
| 8,146,354 | B2 | 4/2012 | Fong et al. | |
| 8,196,395 | B2 | 6/2012 | Fong et al. | |
| 8,912,684 | B2 | 12/2014 | Stahlkopf et al. | |
| 2003/0180155 | A1 | 9/2003 | Coney et al. | |
| 2004/0244580 | A1 | 12/2004 | Coney et al. | |
| 2005/0274334 | A1 | 12/2005 | Warren | |
| 2005/0279296 | A1 | 12/2005 | Coney et al. | |
| 2006/0171824 | A1 | 8/2006 | Nieter et al. | |
| 2006/0218924 | A1 | 10/2006 | Mitani | |
| 2007/0006586 | A1 | 1/2007 | Hoffman et al. | |
| 2007/0095069 | A1 | 5/2007 | Joshi et al. | |
| 2007/0283157 | A1 | 12/2007 | Yami et al. | |
| 2008/0006032 | A1 | 1/2008 | Robinson | |
| 2008/0201147 | A1 | 8/2008 | Han et al. | |
| 2008/0203347 | A1 | 8/2008 | Burrola et al. | |
| 2009/0100832 | A1* | 4/2009 | Loeffler | 60/512 |
| 2009/0283157 | A1 | 11/2009 | Hogan | |
| 2010/0083921 | A1 | 4/2010 | Ooyama | |
| 2010/0089063 | A1 | 4/2010 | McBride et al. | |
| 2010/0111713 | A1 | 5/2010 | Chatfield et al. | |
| 2010/0218500 | A1 | 9/2010 | Ruer | |
| 2010/0229544 | A1 | 9/2010 | Bollinger et al. | |
| 2010/0307156 | A1 | 12/2010 | Bollinger et al. | |
| 2011/0056368 | A1 | 3/2011 | McBride et al. | |
| 2011/0094231 | A1 | 4/2011 | Freund | |
| 2011/0100010 | A1 | 5/2011 | Freund et al. | |
| 2011/0115223 | A1 | 5/2011 | Stahlkopf et al. | |
| 2011/0131966 | A1 | 6/2011 | McBride et al. | |
| 2011/0197834 | A1 | 8/2011 | Gustafson | |
| 2011/0314803 | A1 | 12/2011 | McBride et al. | |
| 2013/0032743 | A1 | 2/2013 | Fong et al. | |
| 2013/0074949 | A1 | 3/2013 | McBride et al. | |
| 2013/0098027 | A1 | 4/2013 | Le Roux et al. | |

FOREIGN PATENT DOCUMENTS

| | | | |
|---|---|---|---|
| CN | 101146981 | A | 3/2008 |
| DE | 69329459 | T2 | 1/2001 |
| EP | 0647291 | B1 | 9/2000 |
| GB | 538034 | A | 7/1941 |
| JP | 56-085527 | | 7/1981 |
| JP | 56-132477 | A | 10/1981 |
| JP | 57-97006 | A | 6/1982 |
| JP | 9-166028 | A | 6/1997 |
| JP | 2000-314405 | | 11/2000 |
| JP | 2004-218436 | A | 8/2004 |
| JP | 2007-502389 | A | 2/2007 |
| JP | 2007-107490 | A | 4/2007 |
| KR | 20-1993-0011547 | | 6/1993 |
| KR | 10-2008-0024497 | A | 3/2008 |
| WO | WO 98/16741 | A1 | 4/1998 |
| WO | WO 03/021107 | A1 | 3/2003 |
| WO | WO 03/021702 | A1 | 3/2003 |
| WO | WO 2008/139267 | A1 | 11/2008 |
| WO | WO 2009/023080 | A1 | 2/2009 |
| WO | WO 2009/034421 | A1 | 3/2009 |
| WO | WO 2009/034548 | A2 | 3/2009 |
| WO | WO 2009/053593 | A1 | 4/2009 |
| WO | WO 2009/061866 | A2 | 5/2009 |

OTHER PUBLICATIONS

Stephenson et al., "Application of Liquid Sprays to Achieve Isothermal Compression, Part 1", Presented at the 17th Annual Conference on Liquid Atomization & Spray Systems (ILASS), Sep. 2-6, 2001, Zurich, Switzerland.

Linnemann et al., "The Isoengine—A Novel High Efficiency Engine with Optional Compressed Air Energy Storage (CAES)", Presented at the 2003 International Joint Power Generation Conference, Jun. 16-19, 2003, Atlanta, Georgia, USA.

Coney et al., "Engineering Aspects of a Novel High Efficiency Reciprocating Internal Combustion Engine", Presented at the 2002 International Joint Power Generation Conference, Jun. 24-26, 2002, Phoenix, Arizona, USA.

Coney et al., "Development of a Reciprocating Compressor Using Water Injection to Achieve Quasi-Isothermal Compression", Presented at the International Compressor Engineering Conference at Purdue, Jul. 16-19, 2002.

Malmgren et al., "Experiments and Simulations of a Quasi-Isothermal Compressor for a Novel High Efficiency Engine".

Stephenson et al., "Application of Liquid Sprays to Achieve Isothermal Compression, Part 2," Presented at the 17th Annual Conference on Liquid Atomization & Spray Systems (ILASS), Sep. 2-6, 2001, Zurich, Switzerland.

European Search Report and Written Opinion for PCT/US2012/060909, mailed Mar. 25, 2015.

* cited by examiner

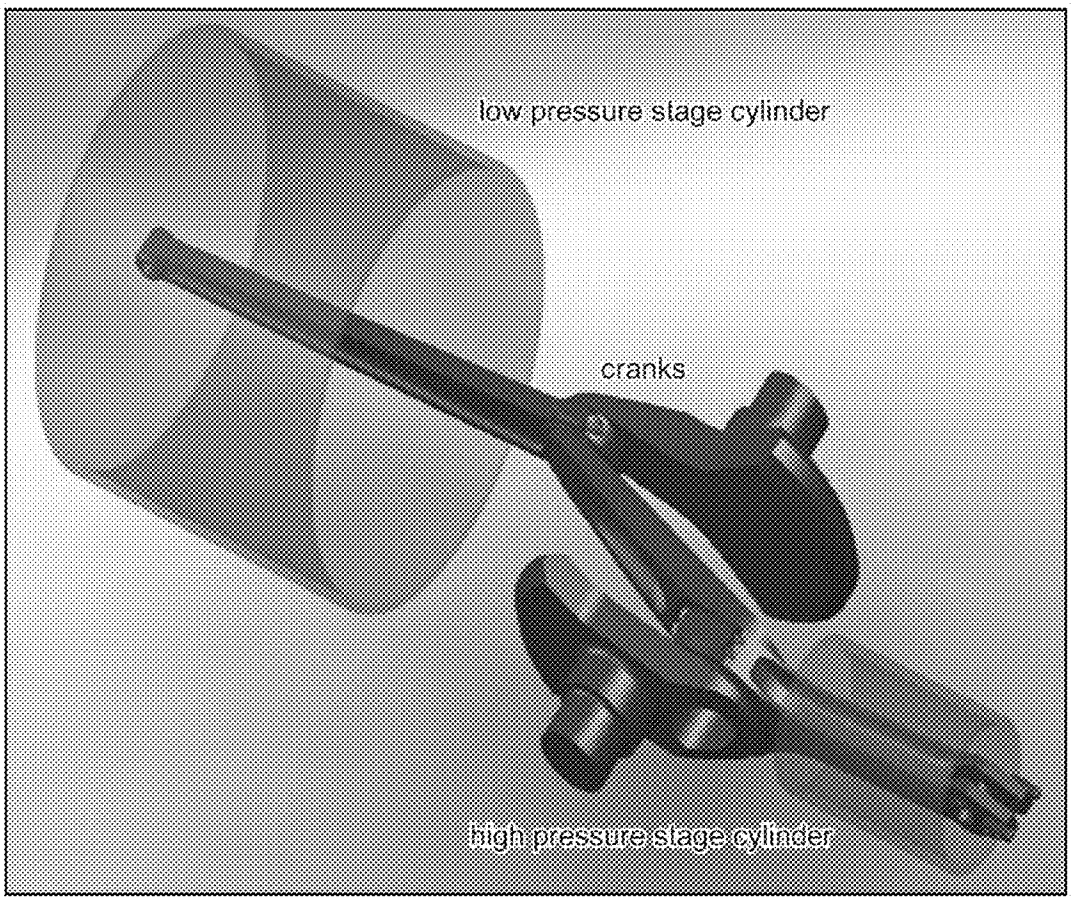
FIG. 2C1

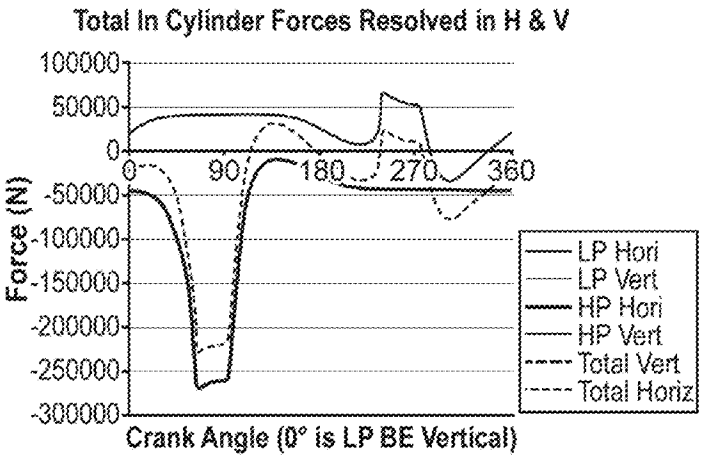
FIG. 2C2a1
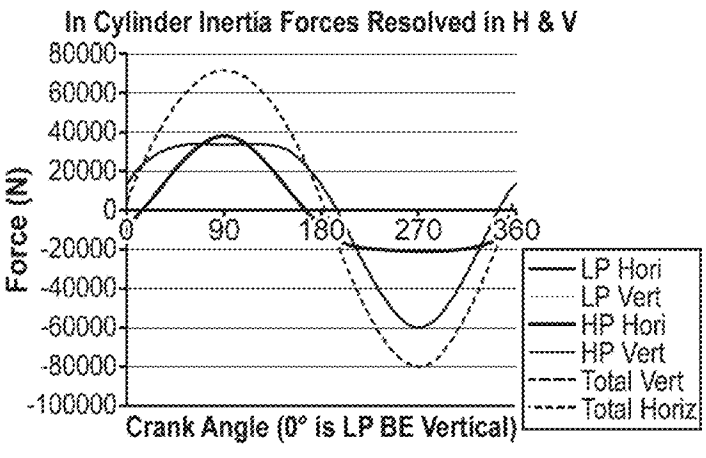
FIG. 2C2a2
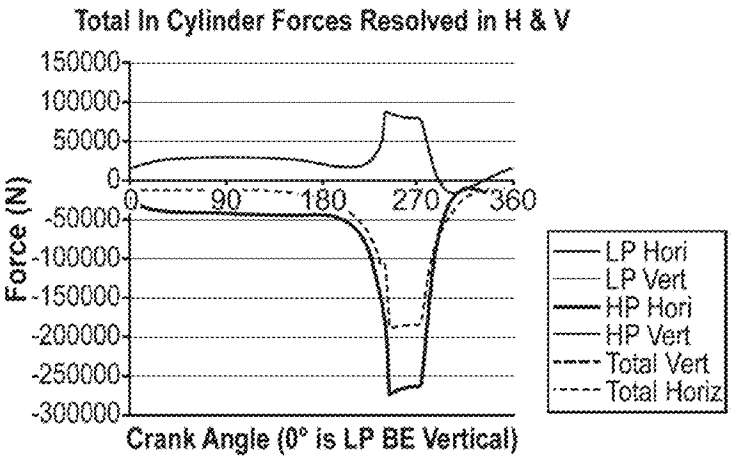
FIG. 2C2a3
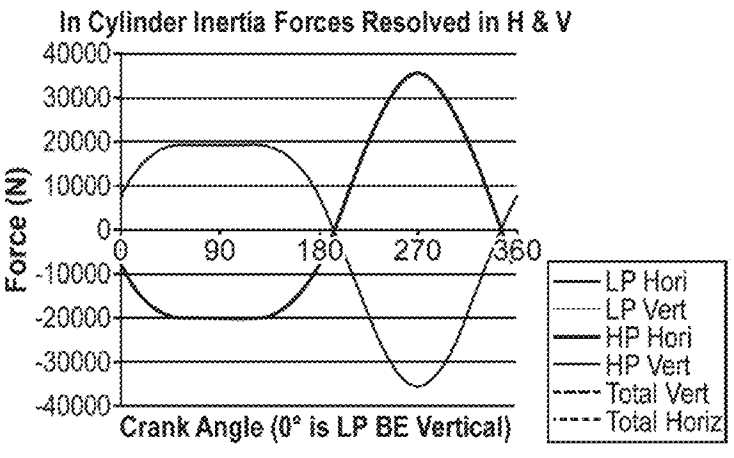
FIG. 2C2a4

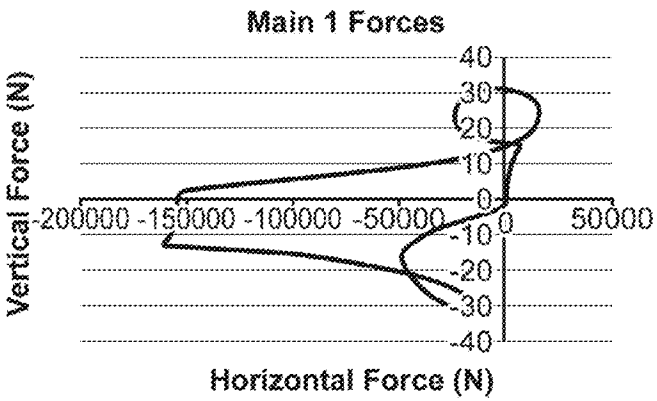
FIG. 2C2b1
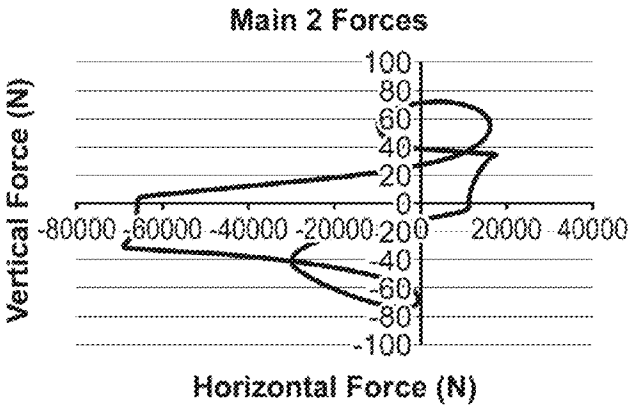
FIG. 2C2b2
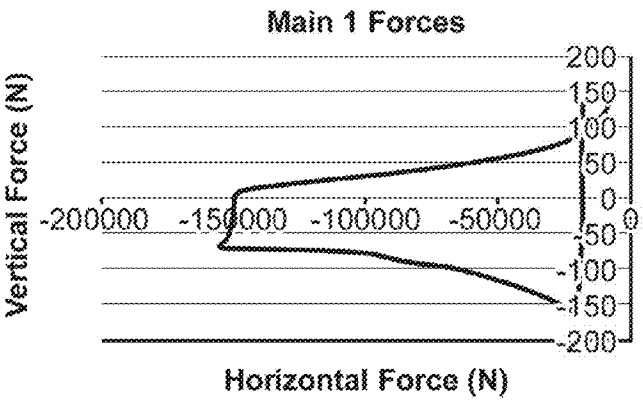
FIG. 2C2b3
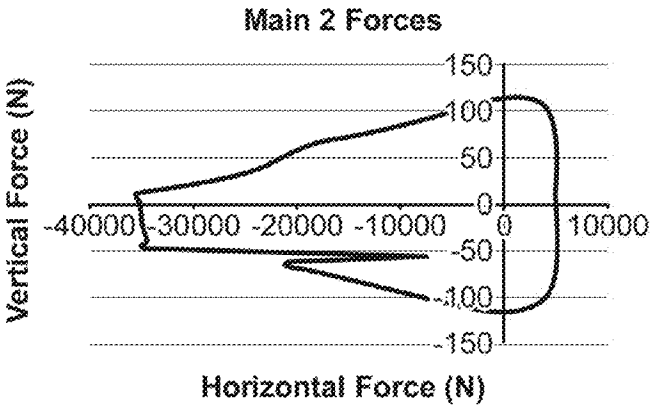
FIG. 2C2b4

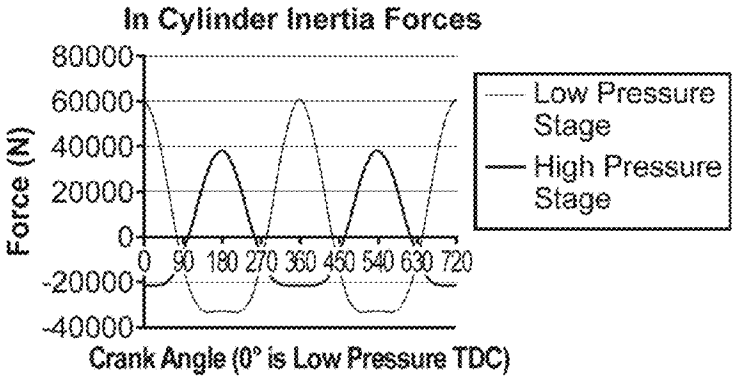
FIG. 2C3a
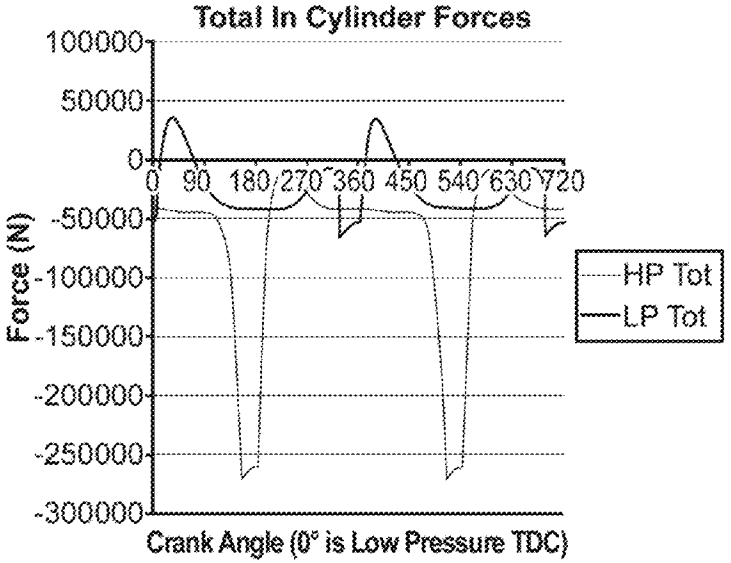
FIG. 2C3b
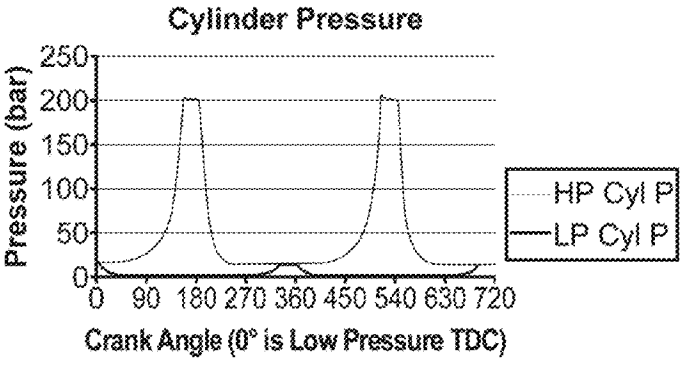
FIG. 2C3c
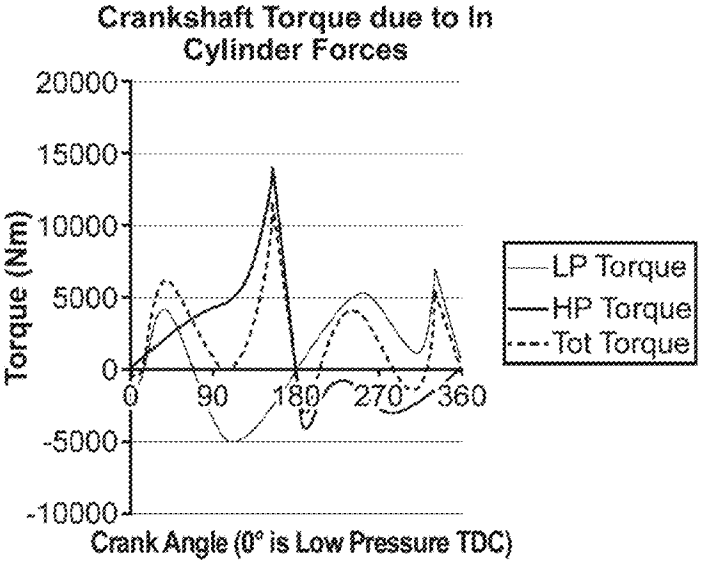
FIG. 2C3d

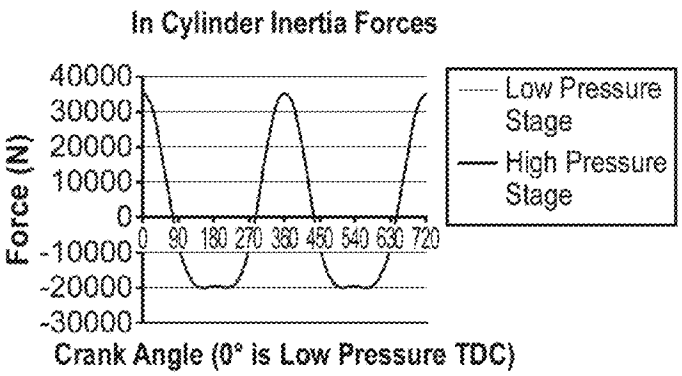
FIG. 2C4a
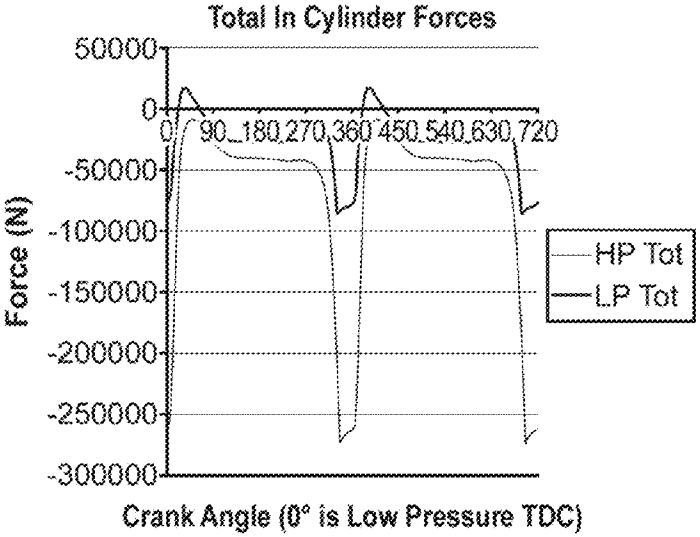
FIG. 2C4b
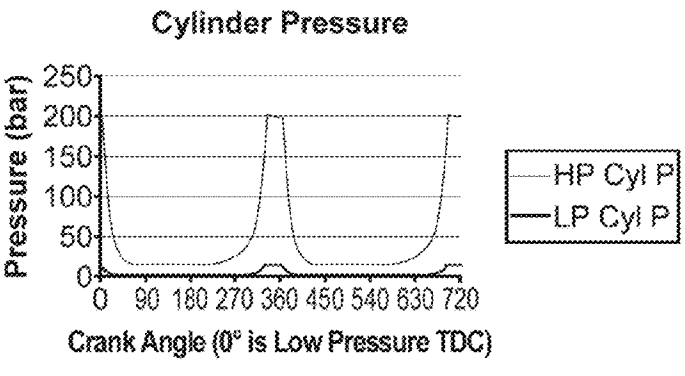
FIG. 2C4c
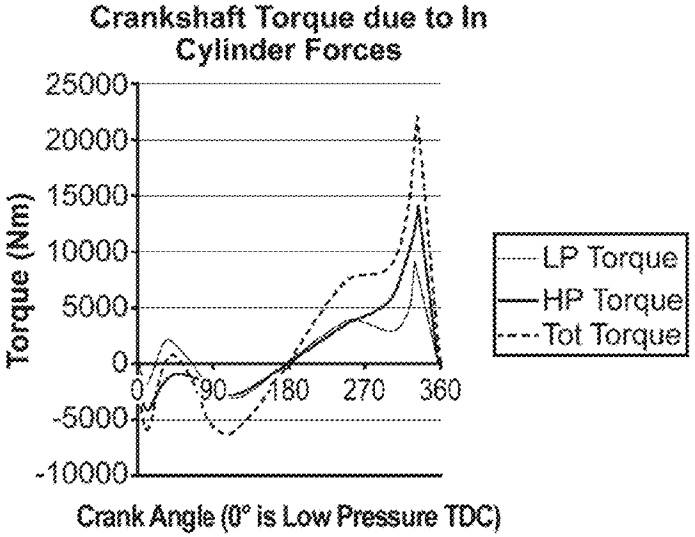
FIG. 2C4d

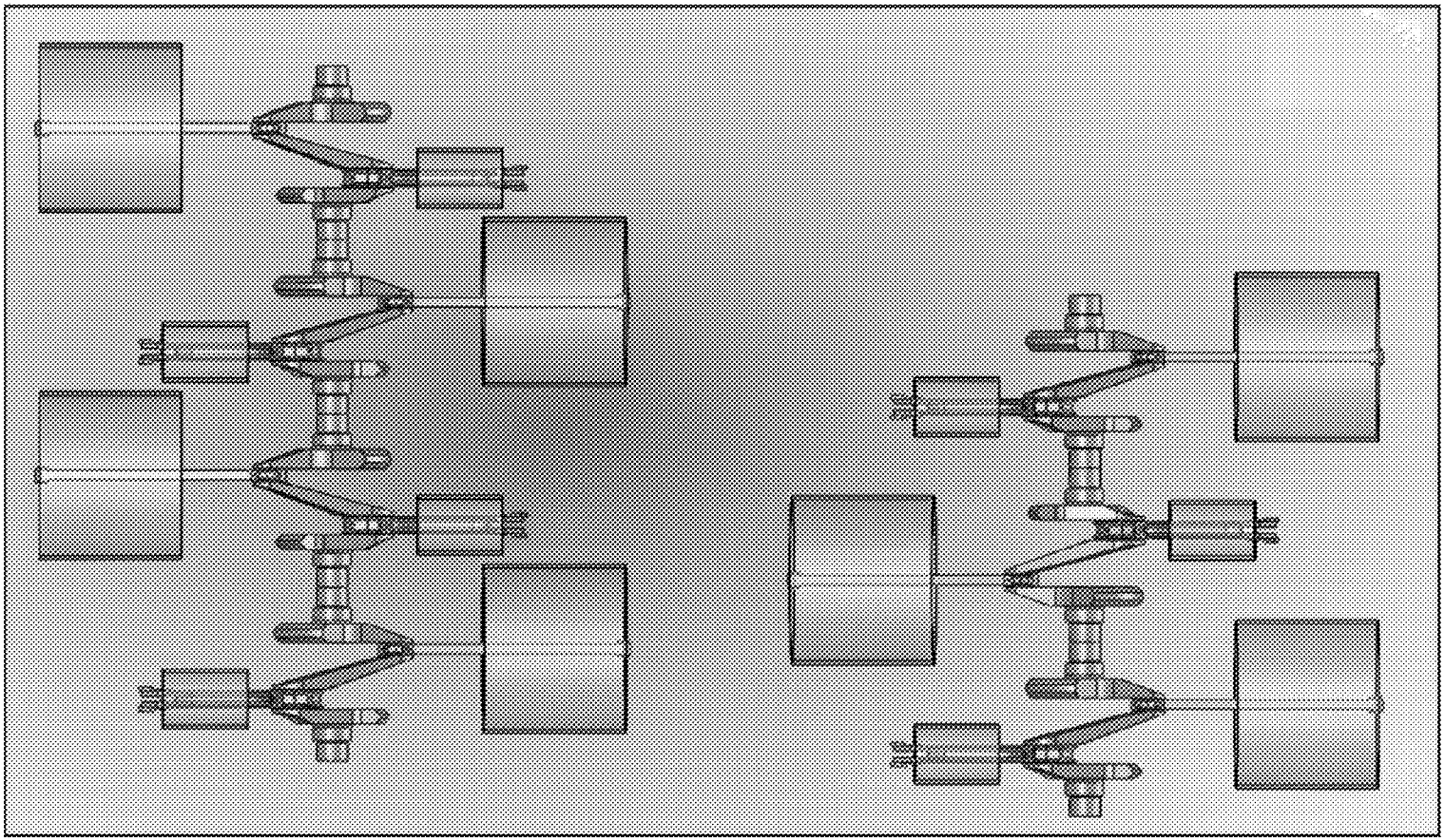
FIG. 2C5

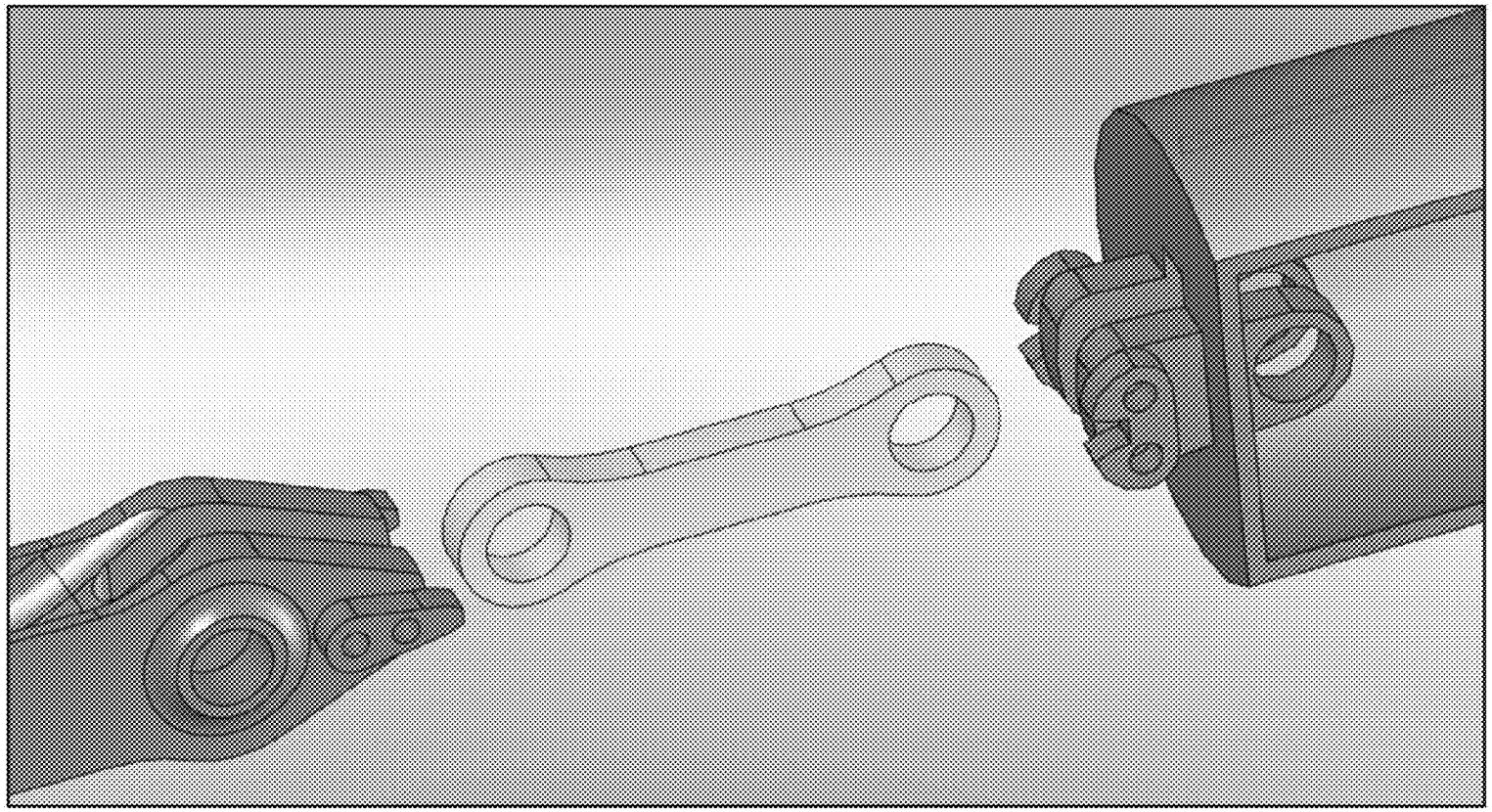
FIG. 2C6

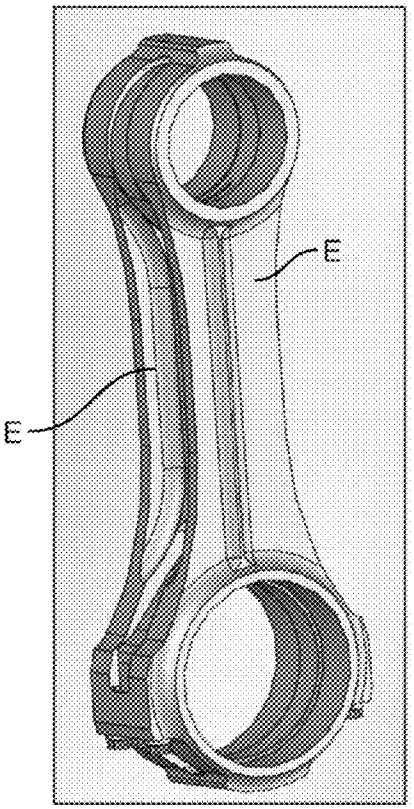
FIG. 2C7a
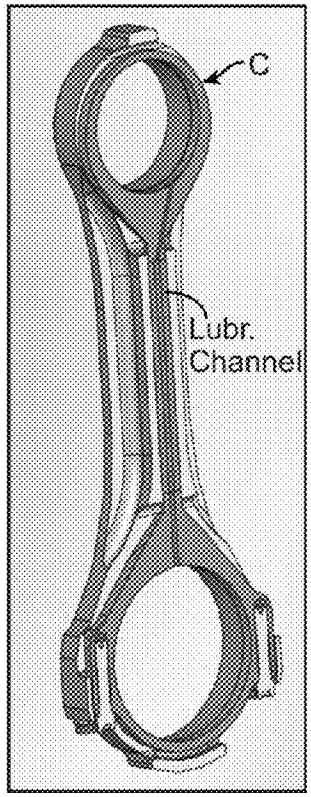
FIG. 2C7b
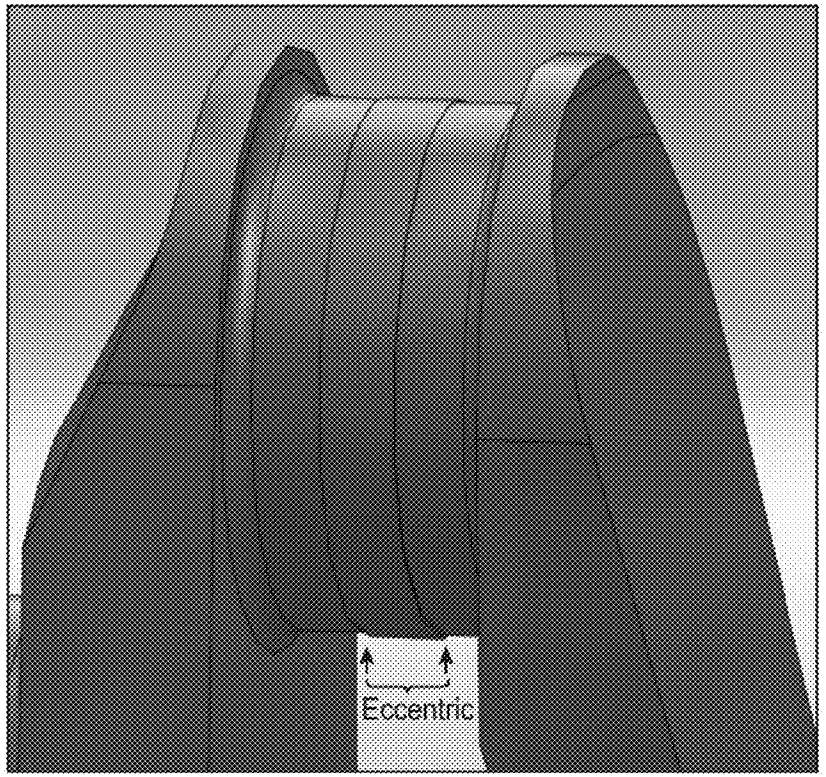
FIG. 2C7c

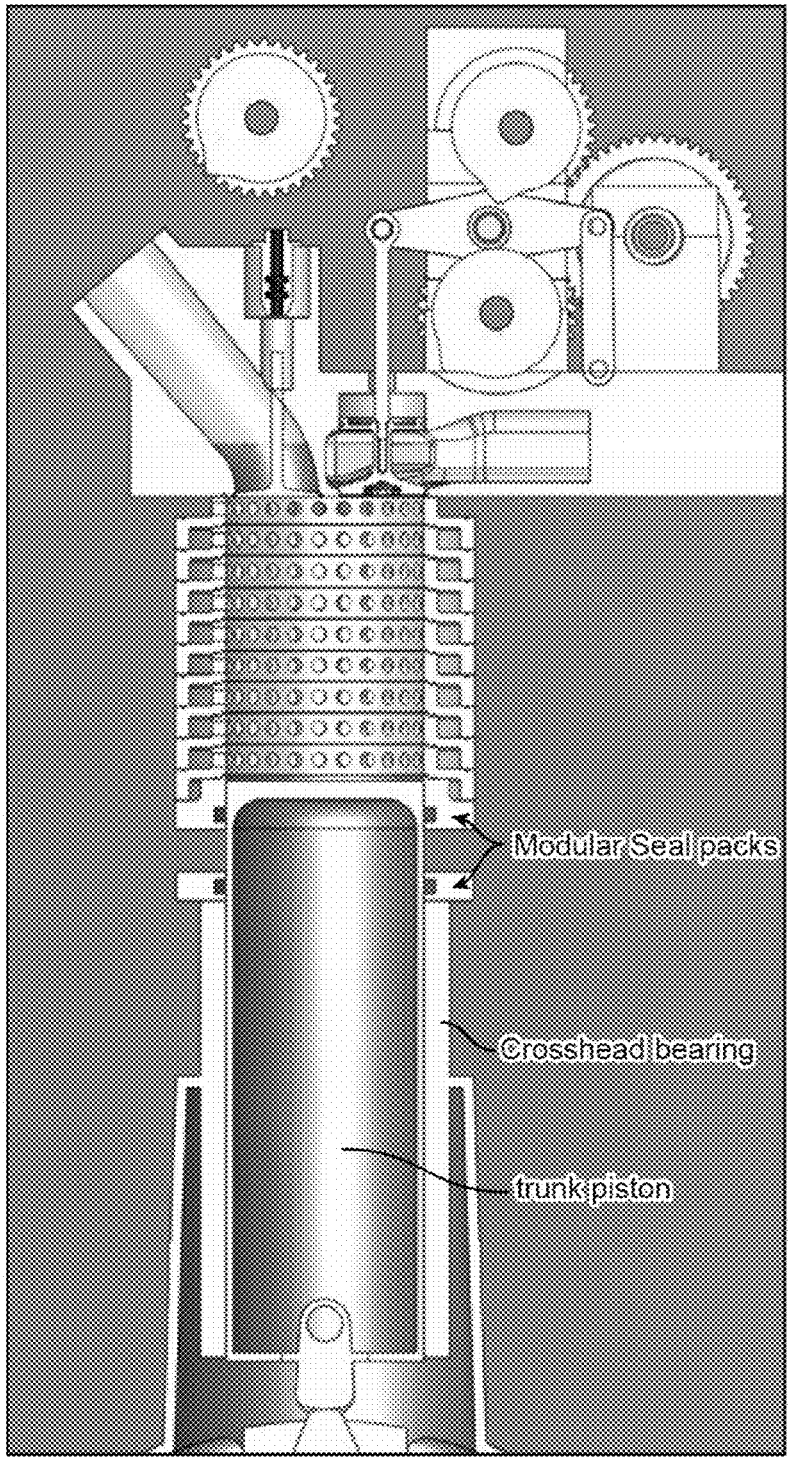
FIG. 2C8a

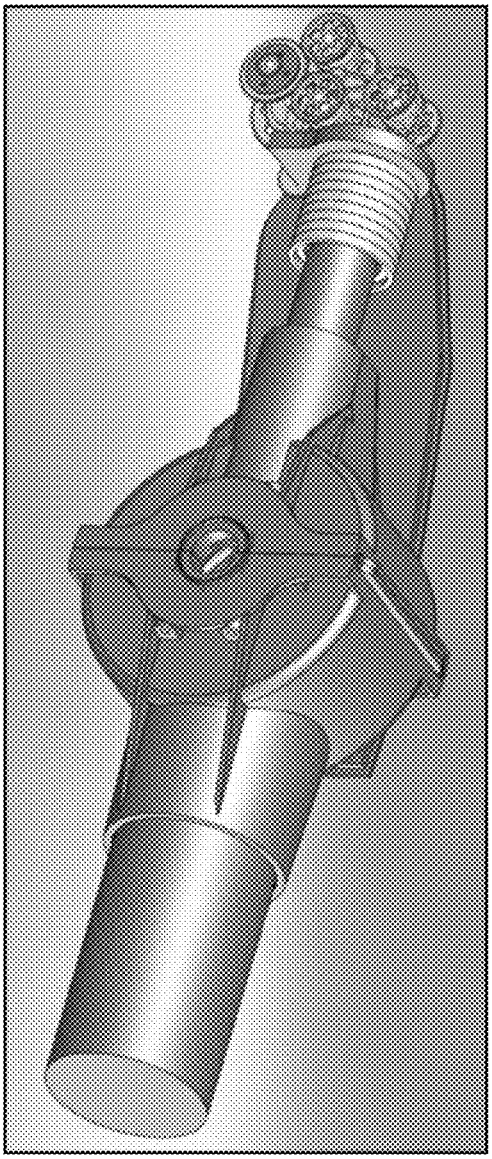
FIG. 2C8b
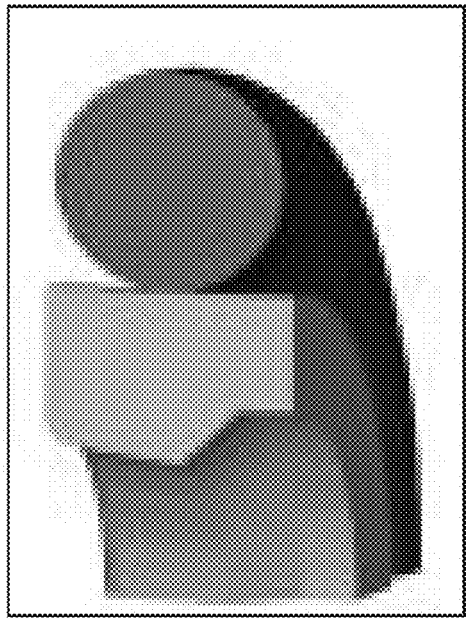
FIG. 2C8c

| | 1st Stage | 2nd Stage | 3rd Stage | | 1st Stage | 2nd Stage |
|---|---|---|---|---|---|---|
| kW | 83 | 83 | 83 | | 125 | 125 |
| RPM | 1200 | 1200 | 1200 | | 1200 | 1200 |
| compression ratio | 5.848 | 5.848 | 5.848 | | 14.142 | 14.142 |
| dead volume (fraction) | 0.003 | 0.03 | 0.03 | | 0.003 | 0.03 |
| intake pressure (bar) | 1 | 5.848 | 34.2 | | 1 | 14.142 |
| atmospheric air density (kg/m3) | 1.15 | 1.15 | 1.15 | | 1.15 | 1.15 |
| valve pressure drop (fraction) | 0.02 | 0.02 | 0.02 | | 0.02 | 0.02 |
| combined 1-way efficiency | 0.8 | 0.8 | 0.8 | | 0.8 | 0.8 |
| polytropic index | 1.05 | 1.05 | 1.05 | | 1.05 | 1.05 |
| piston stroke (mm) | 350 | 200 | 100 | | 350 | 200 |
| piston stroke (inches) | 13.78 | 7.87 | 3.94 | | 13.78 | 7.87 |
| Compression volumes / stage | 1 | 1 | 1 | | 1 | 1 |
| Valves per compression vol | 8 | 4 | 4 | | 4 | 2 |
| | | | | | | |
| liters/ s per kW at disch pressure | 0.928 | 0.159 | 0.027 | | 0.250 | 0.018 |
| l/s per kW at intake pressure | 5.427 | 0.928 | 0.159 | | 3.542 | 0.250 |
| intake air density (kg/m3) | 1.15 | 6.7252 | 39.33 | | 1.15 | 16.2633 |
| intake flow (liters/ s) * | 450.5 | 77.0 | 13.2 | | 442.7 | 31.3 |
| discharge flow (l/ s) | 77.0 | 13.2 | 2.3 | | 31.3 | 2.2 |
| volume swept / sec | 570.6 | 110.8 | 19.0 | | 573.1 | 59.6 |
| tot cylinder volume req / sec | 572.3 | 114.2 | 19.5 | | 574.8 | 61.4 |
| cylinder volume (liters) | 28.61 | 5.71 | 0.98 | | 28.74 | 3.07 |
| **piston bore (inches)** | **12.7** | **7.5** | **4.4** | | **12.7** | **5.5** |
| **piston bore (mm)** | **322.7** | **190.6** | **111.5** | | **323.4** | **139.9** |

FIG. 2C9

| | | | | | | |
|---|---|---|---|---|---|---|
| piston pos at disch valve open | 0.833 | 0.833 | 0.838 | | 0.833 | 0.833 |
| dischrg crank open angle (deg) | 131.9 | 131.8 | 132.7 | | 131.9 | 131.8 |
| dischrg open time fraction | 0.134 | 0.134 | 0.131 | | 0.134 | 0.134 |
| dischrg corrected flow (l/s) | 576.3 | 98.4 | 17.1 | | 234.2 | 16.5 |
| total dischrg area (cm2) | 97.71 | 40.36 | 16.99 | | 39.71 | 10.55 |
| **area per perfect discharge valve** | **24.43** | **20.18** | **8.49** | | **19.85** | **10.55** |
| valve diameter (cm) | 5.58 | 5.07 | 3.29 | | 5.03 | 3.67 |
| | | | | | | |
| piston pos at intake valve open | 0.016 | 0.162 | 0.162 | | 0.045 | 0.454 |
| intake crank open angle (deg) | 14.6 | 47.4 | 47.4 | | 24.6 | 84.8 |
| intake open time fraction | 0.041 | 0.132 | 0.132 | | 0.068 | 0.236 |
| intake corrected flow | 11095.7 | 584.6 | 100.0 | | 6471.6 | 132.9 |
| total intake area (cm2) | 1881.37 | 239.71 | 99.12 | | 1097.32 | 84.74 |
| **area per perfect intake valve** | **470.34** | **119.85** | **49.56** | | **548.66** | **84.74** |
| valve diameter (cm) | 24.48 | 12.36 | 7.95 | | 26.44 | 10.39 |

FIG. 2C9 (Cont.)

| | |
|---|---|
| Inputs | |
| Outputs | |

| | | |
|---|---|---|
| Ambient Temperature | 15 | °C |
| Heat Store Temperature | 30 | °C |
| Electrical Efficiency (%) | 94.0% | |
| Speed | 1200 | rpm |
| | 20.0 | Hz |

| | Expansion | | | Compression | | |
|---|---|---|---|---|---|---|
| | **HP Stage** | **MP Stage** | **LP Stage** | **HP Stage** | **MP Stage** | **LP Stage** |
| Top Pressure (bar) | 200.0 | 34.4 | 5.9 | 200.0 | 34.4 | 5.9 |
| Bottom Pressure (Pa) | 3.44E+06 | 5.90E+05 | 1.01E+05 | 3.44E+06 | 5.90E+05 | 1.01E+05 |
| Pressure Ratio, $r_p$ | 5.82 | 5.82 | 5.83 | 5.82 | 5.82 | 5.83 |
| Inlet Temperature (°C) | 30.00 | 30.00 | 30.00 | 15.00 | 15.00 | 15.00 |
| T_exit (°C) | 5.55 | 5.55 | 5.53 | 40.28 | 40.28 | 40.30 |
| Swept Volume ($m^3$) | 2.58E-03 | 1.50E-02 | 8.74E-02 | 2.58E-03 | 1.50E-02 | 8.74E-02 |
| Dead Volume Ratio (%) | 3.0% | 3.0% | 3.0% | 3.0% | 3.0% | 3.0% |
| Water to Air Mass Ratio, $r_m$ | 1.20 | 1.20 | 1.20 | 1.20 | 1.20 | 1.20 |
| $\alpha \approx (n-1)/n$ | 1.0501 | 1.0501 | 1.0501 | 1.0501 | 1.0501 | 1.0501 |
| Polytropic Index, n | 0.05 | 0.05 | 0.05 | 0.05 | 0.05 | 0.05 |
| Isothermal Efficiency (%) | 95.9% | 95.9% | 95.9% | 95.9% | 95.9% | 95.9% |
| Mechanical Efficiency - 1way (%) | 92.9% | 92.9% | 92.9% | 92.9% | 92.9% | 92.9% |
| Round Trip Efficiency (%) | 70.0% | 70.0% | 70.0% | 70.0% | 70.0% | 70.0% |
| Air Mass Flow Rate (Kg/s) | **1.926** | **1.927** | **1.925** | **1.863** | **1.864** | **1.862** |
| Mechanical Power Input or Output (kW) | **262.9** | **263.0** | **262.9** | **304.9** | **305.0** | **304.9** |
| Electrical Power Input or Output (kW) | **247.1** | **247.2** | **247.2** | **324.4** | **324.5** | **324.4** |

FIG. 2C9b

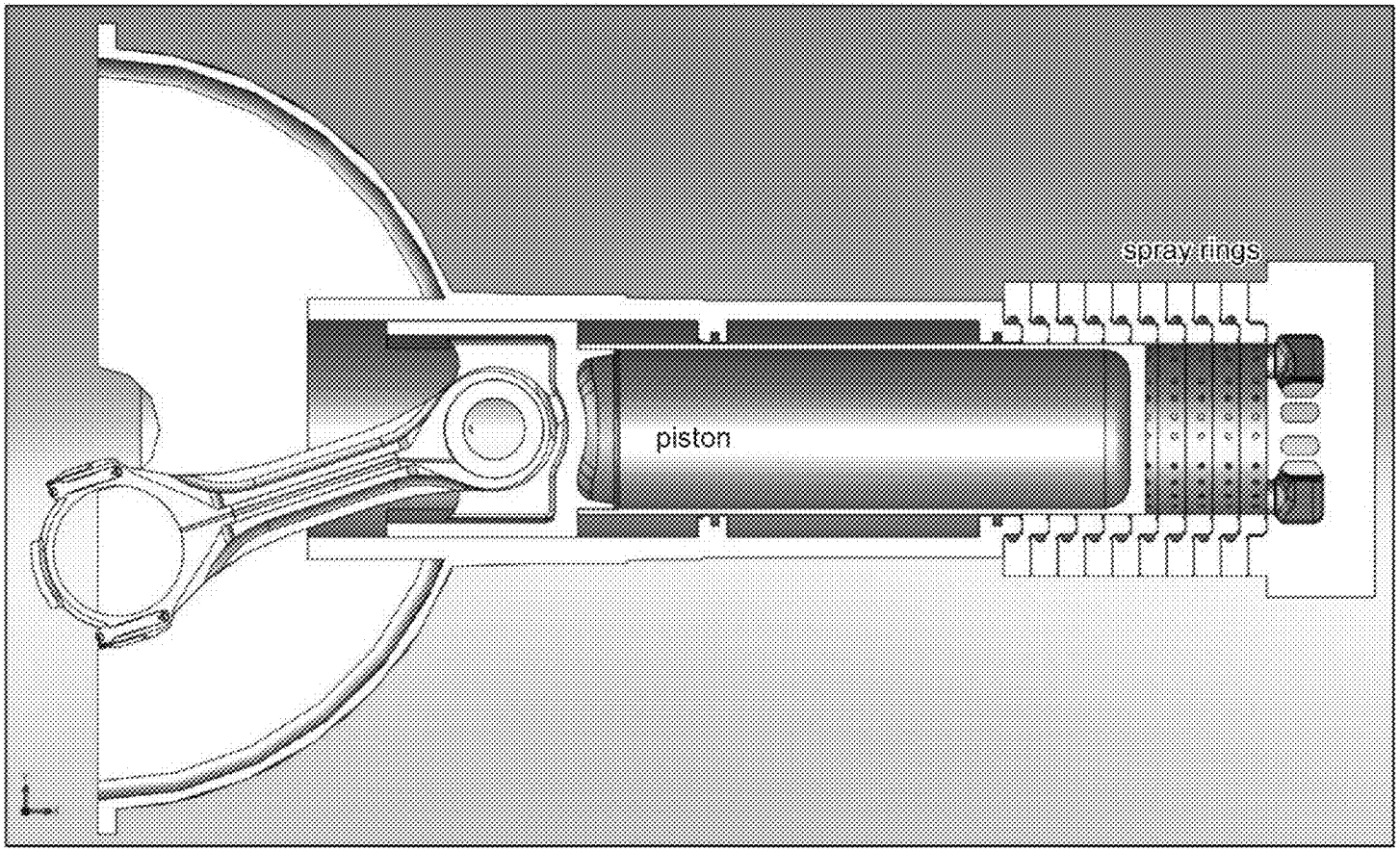
FIG. 2D1

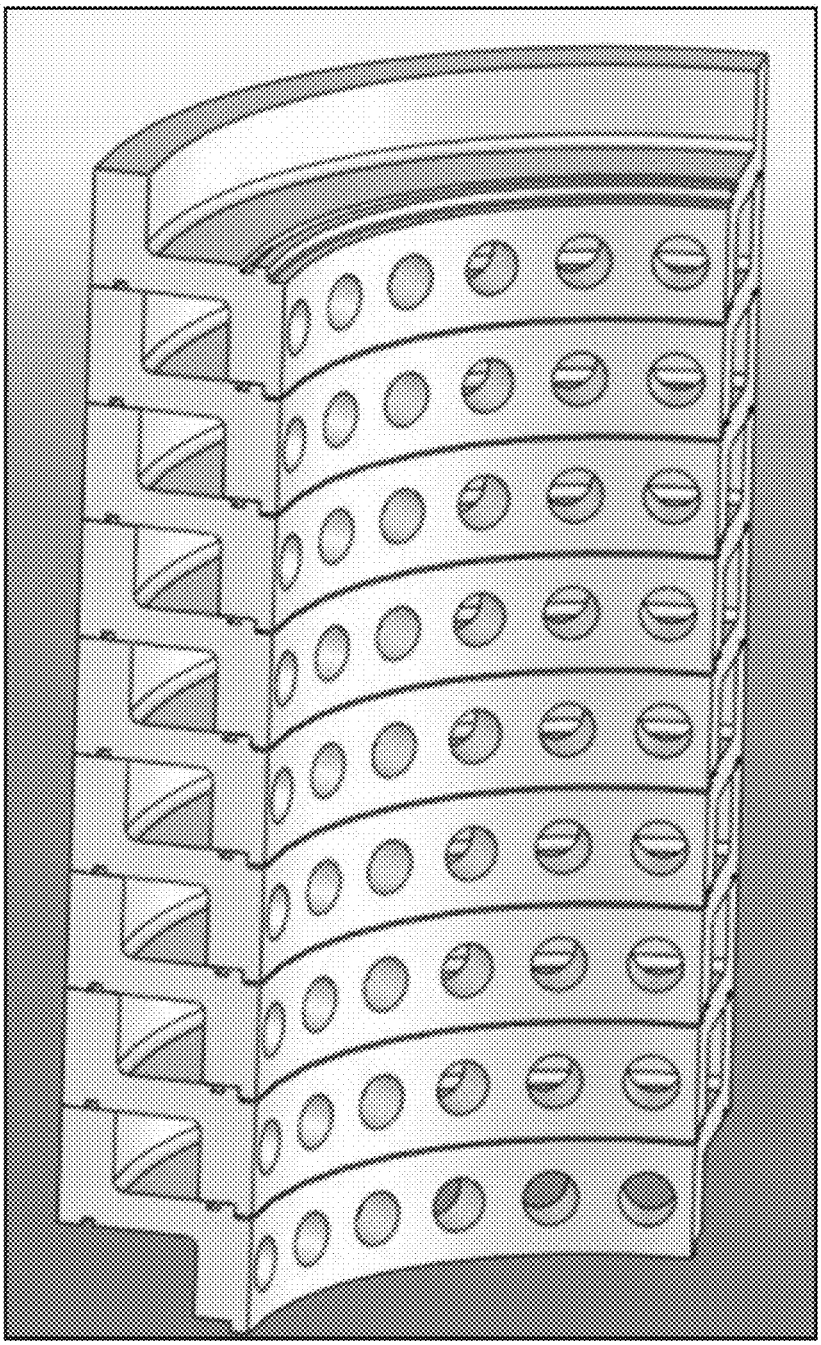
FIG. 2D2

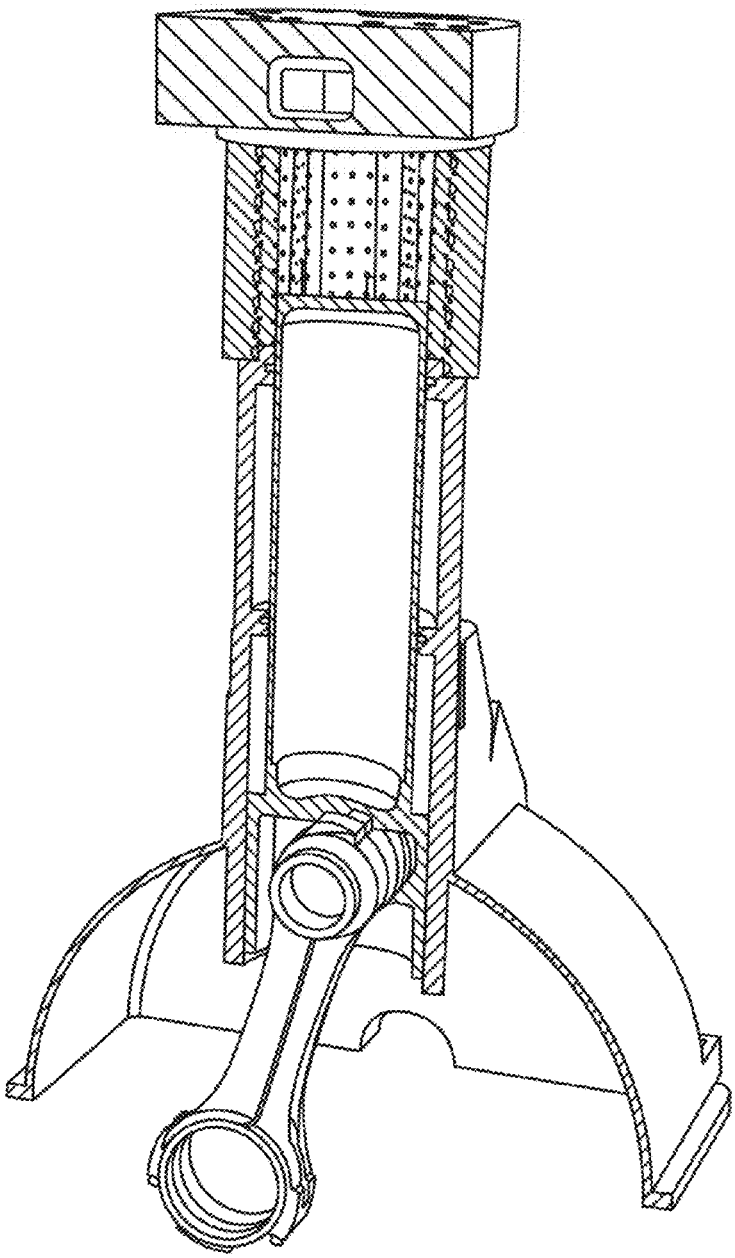
FIG. 2D3

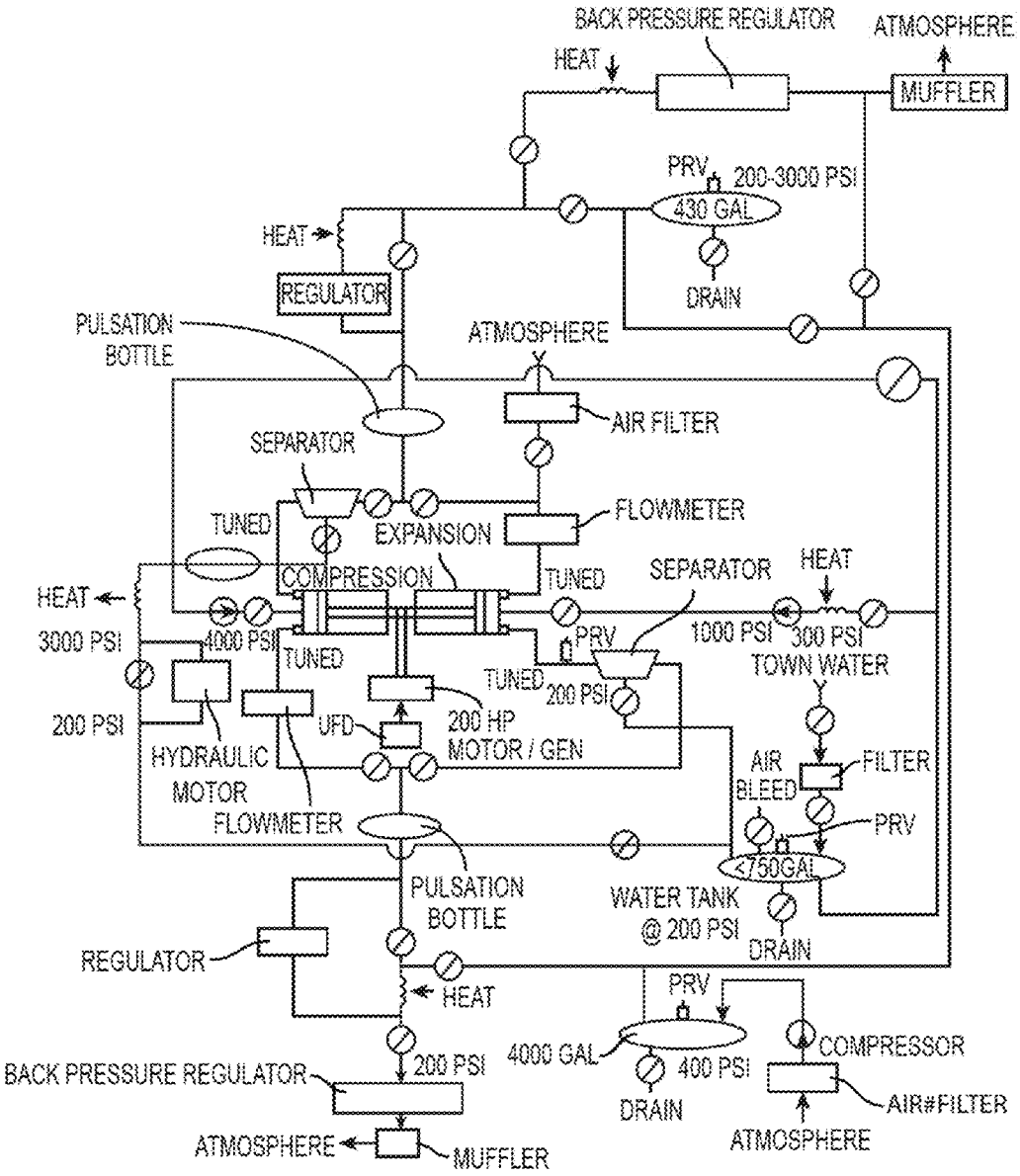
FIG. 2D4

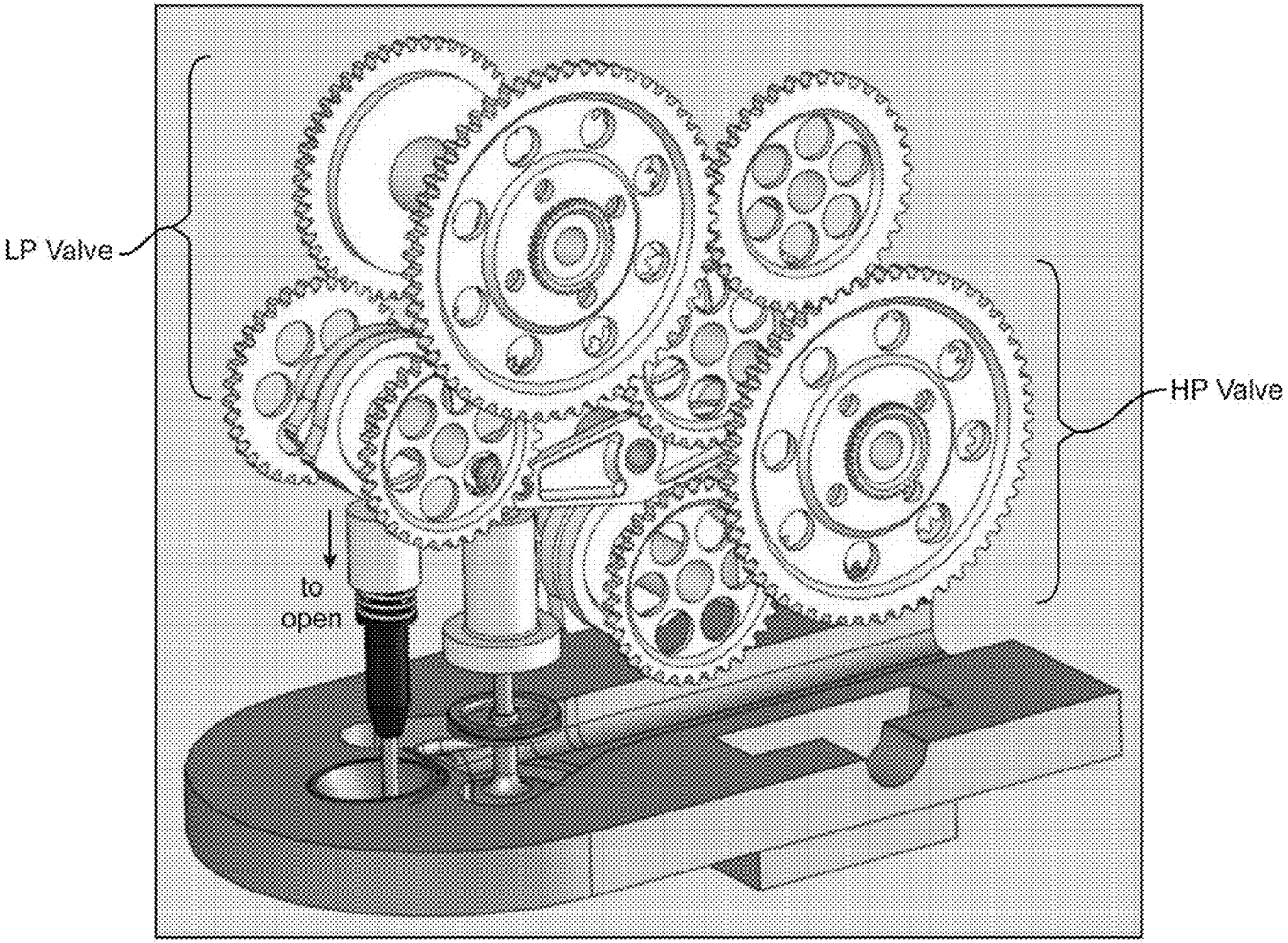
FIG. 3C1

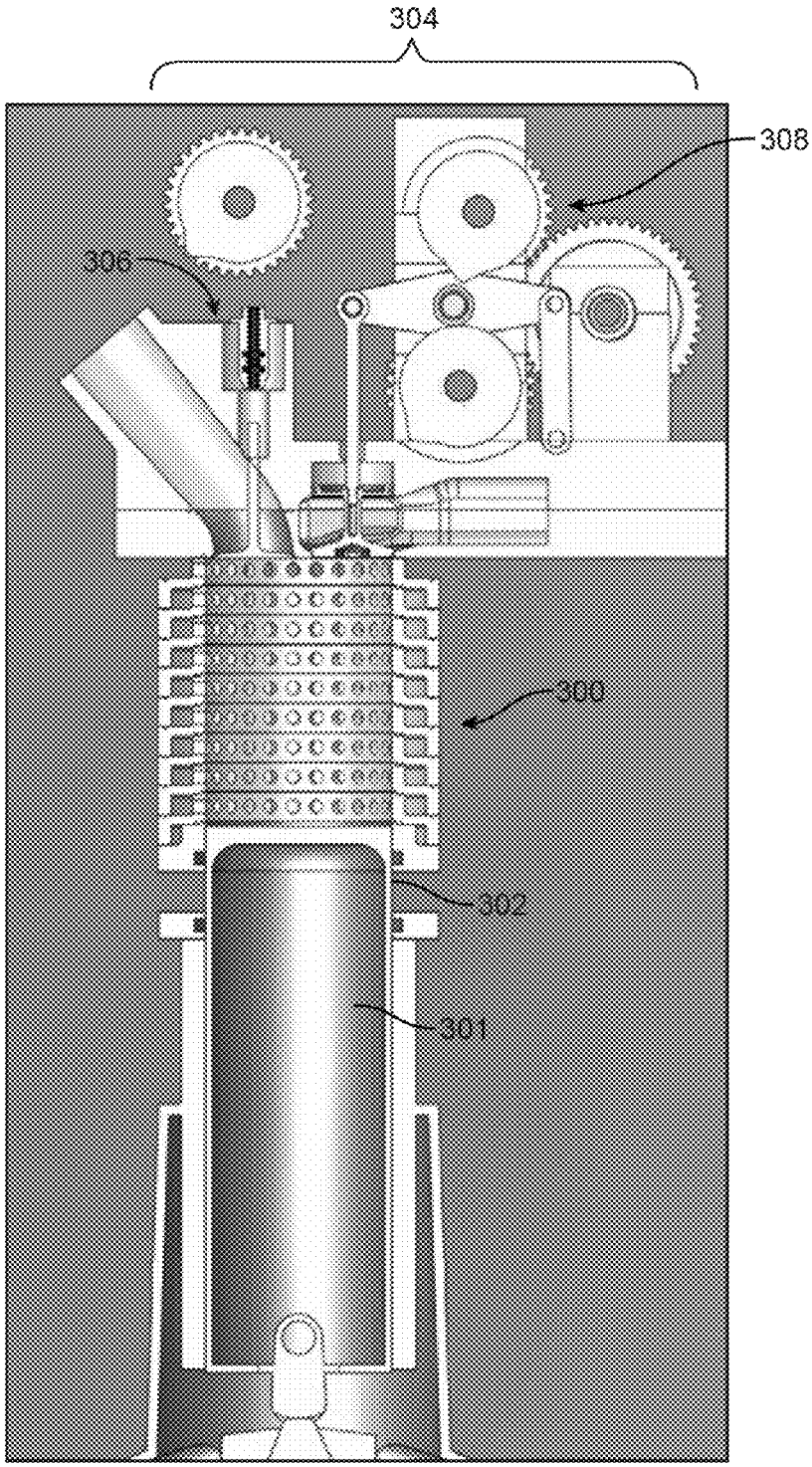
FIG. 3C2a

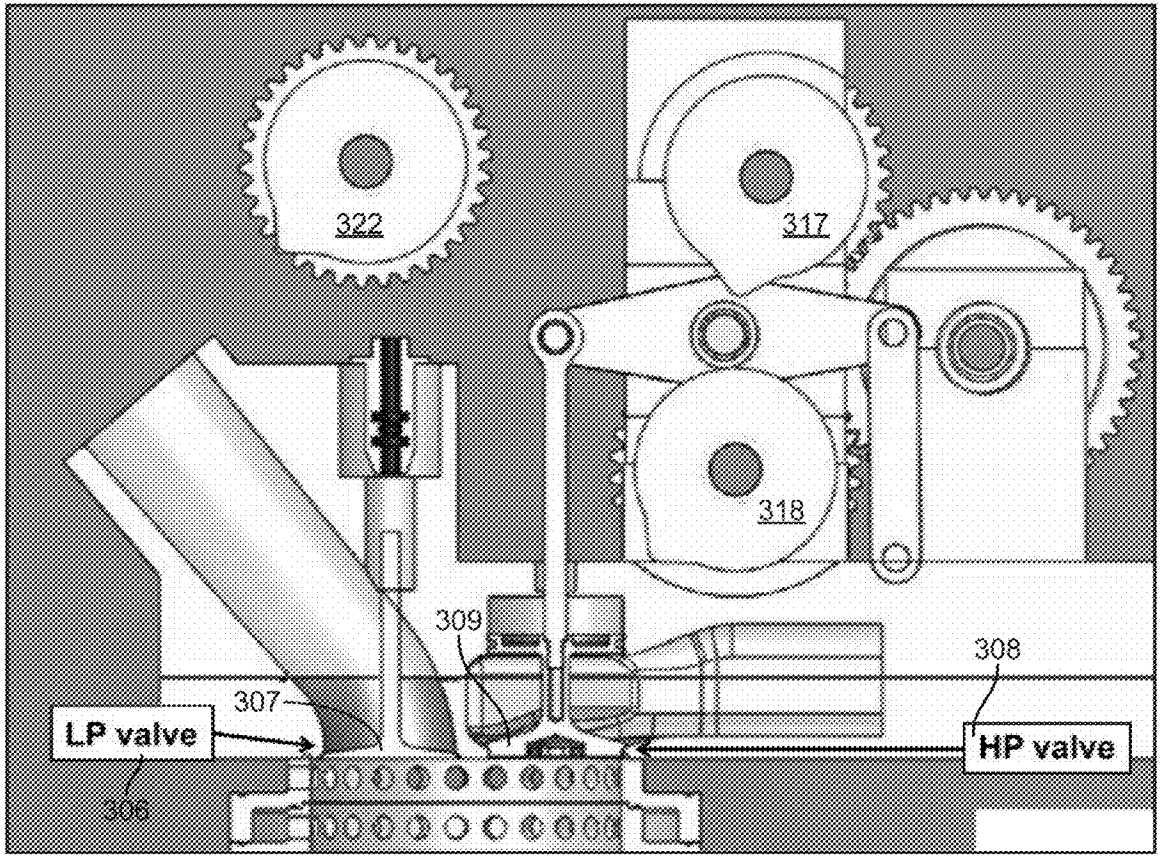
FIG. 3C2b

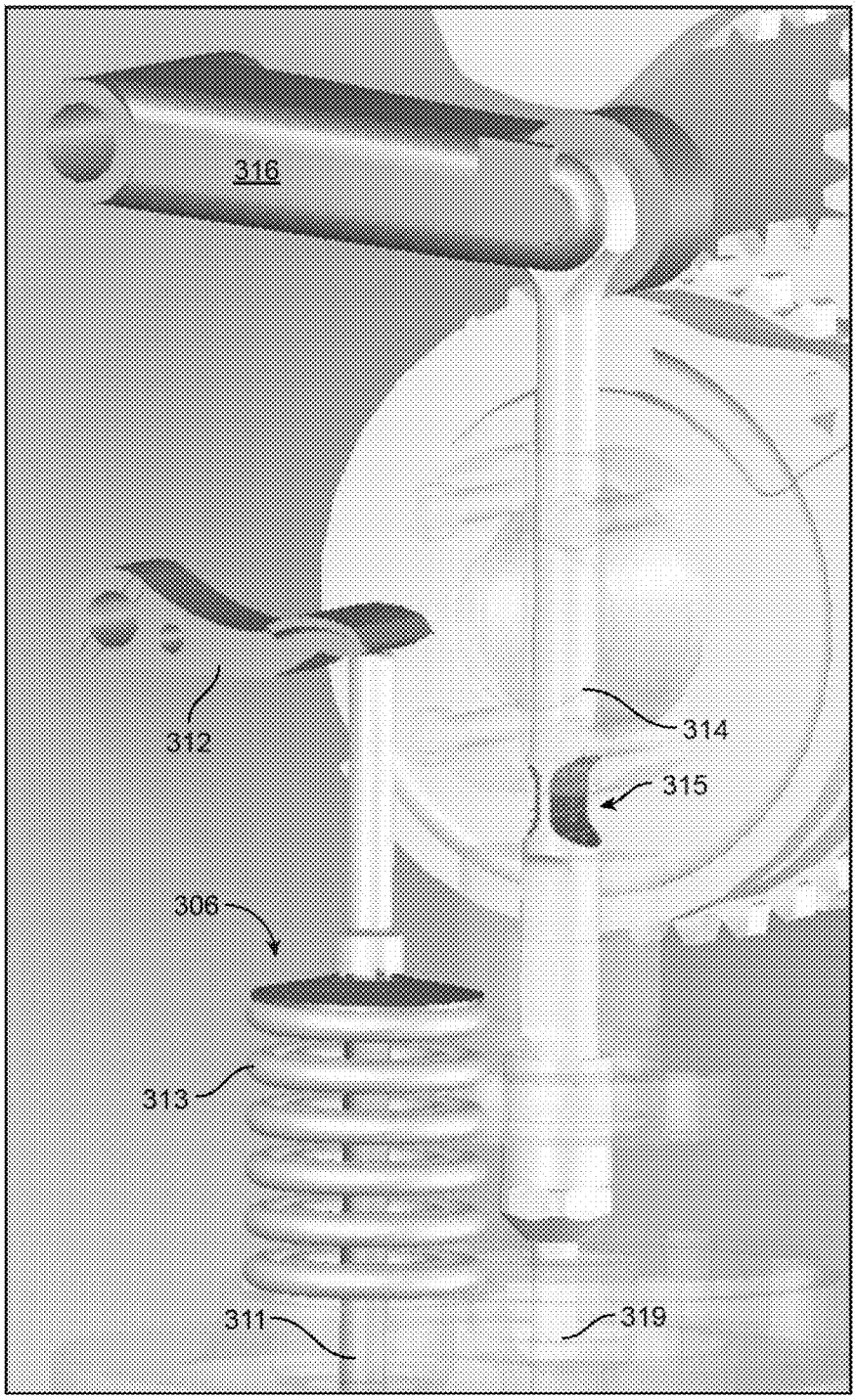
FIG. 3C3a

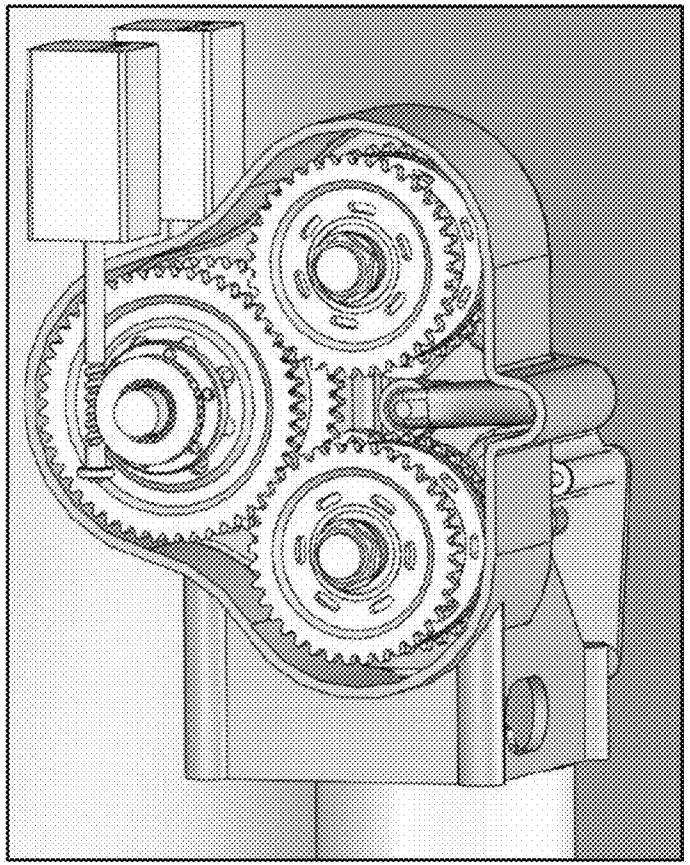
FIG. 3C3c
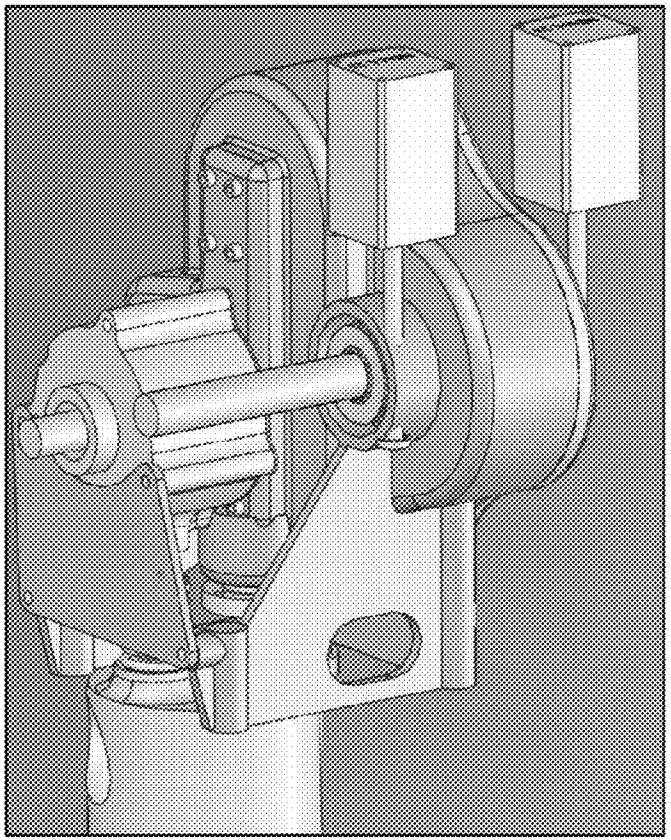
FIG. 3C3b

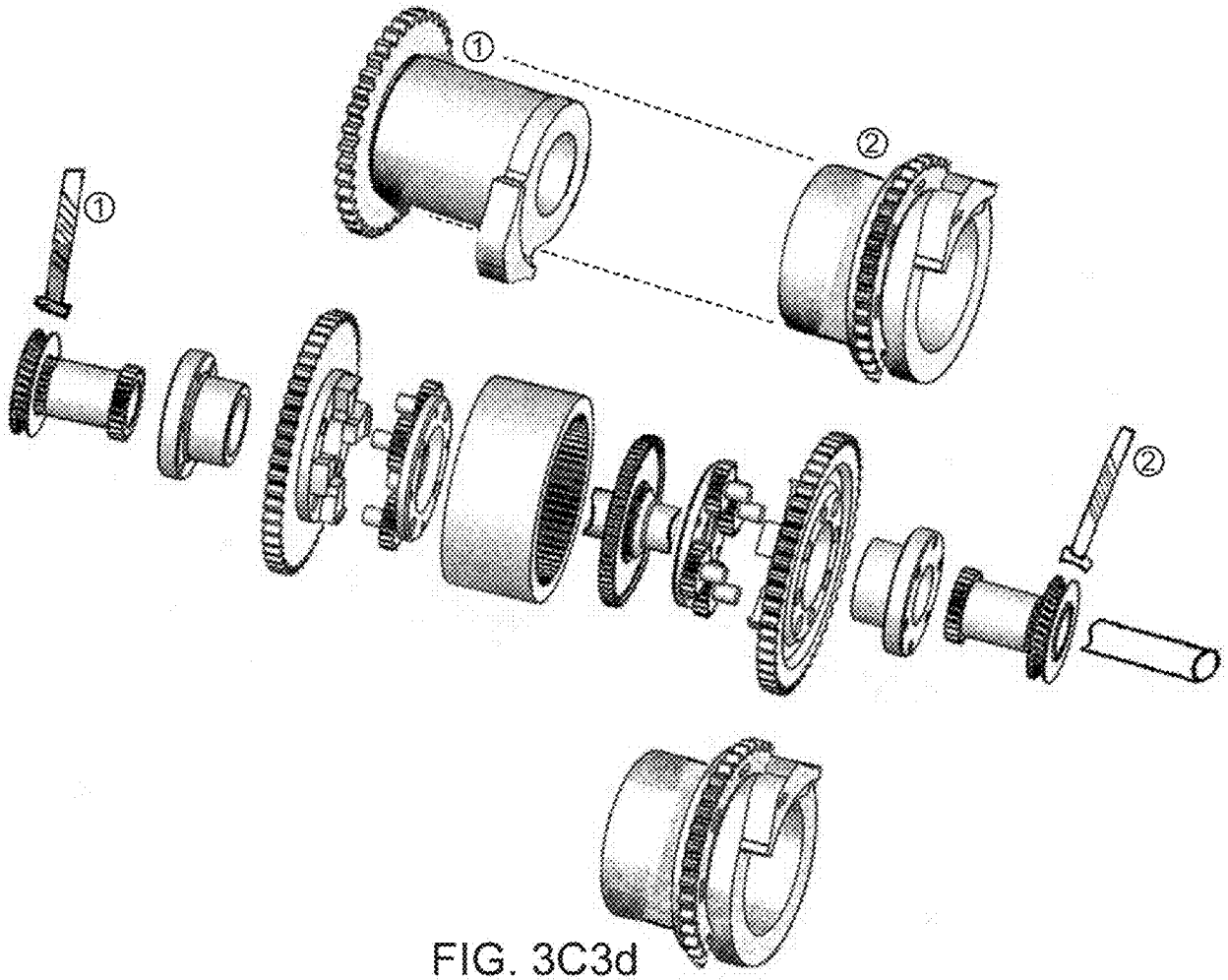
FIG. 3C3d

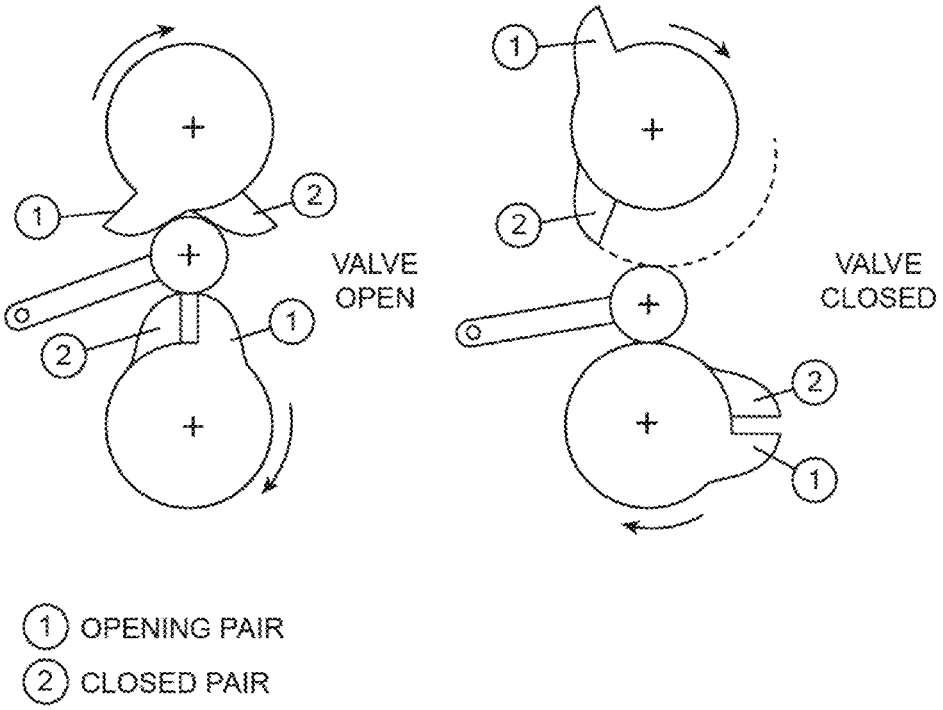
FIG. 3C3e

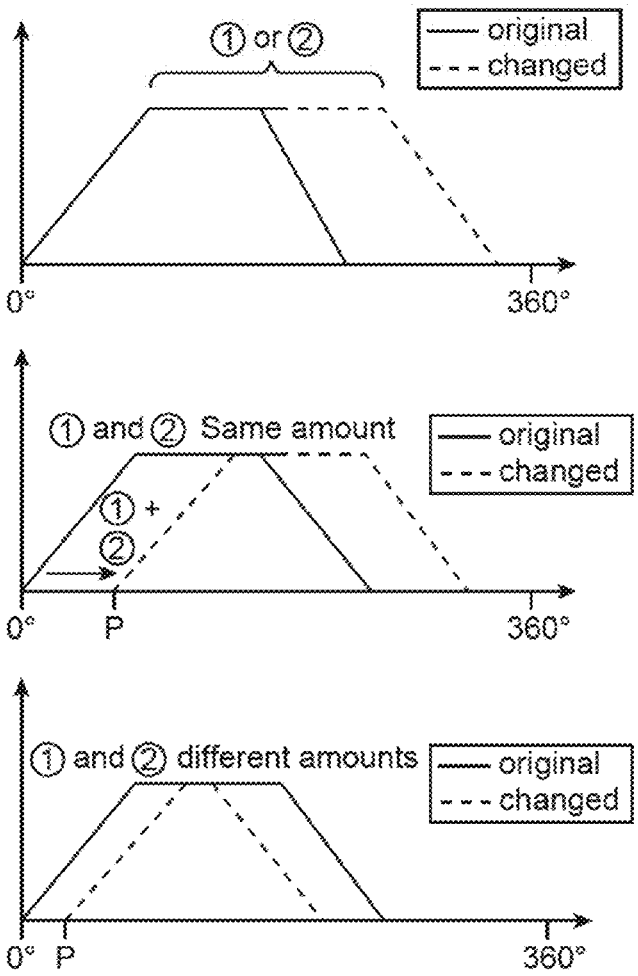
FIG. 3C3f

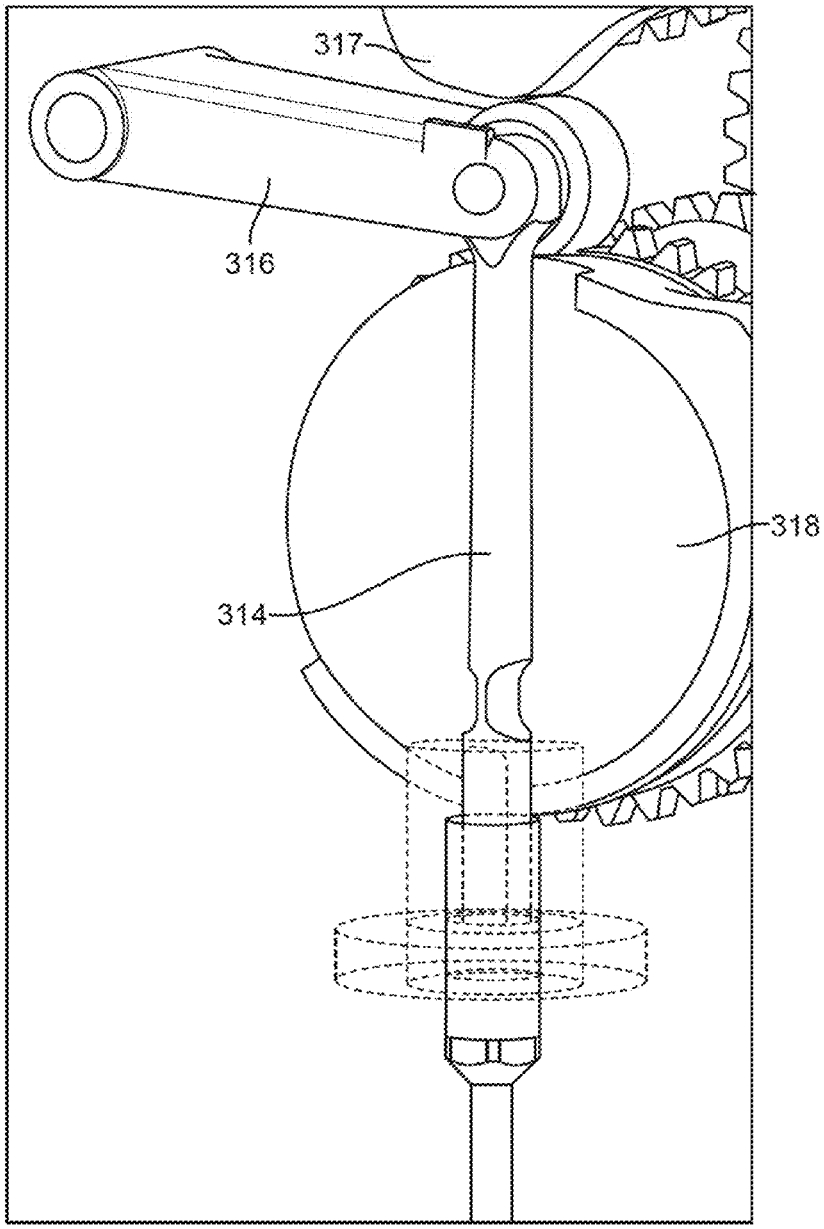
FIG. 3C4a

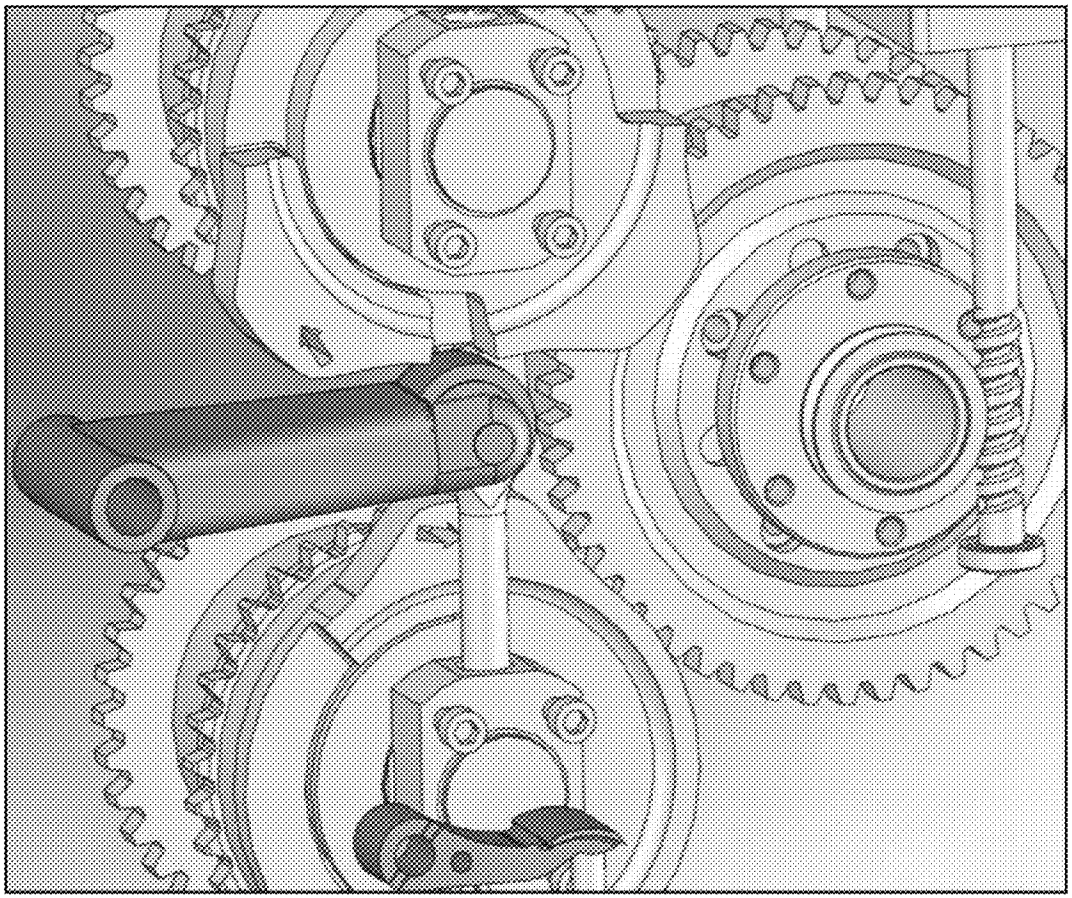
FIG. 3C4b

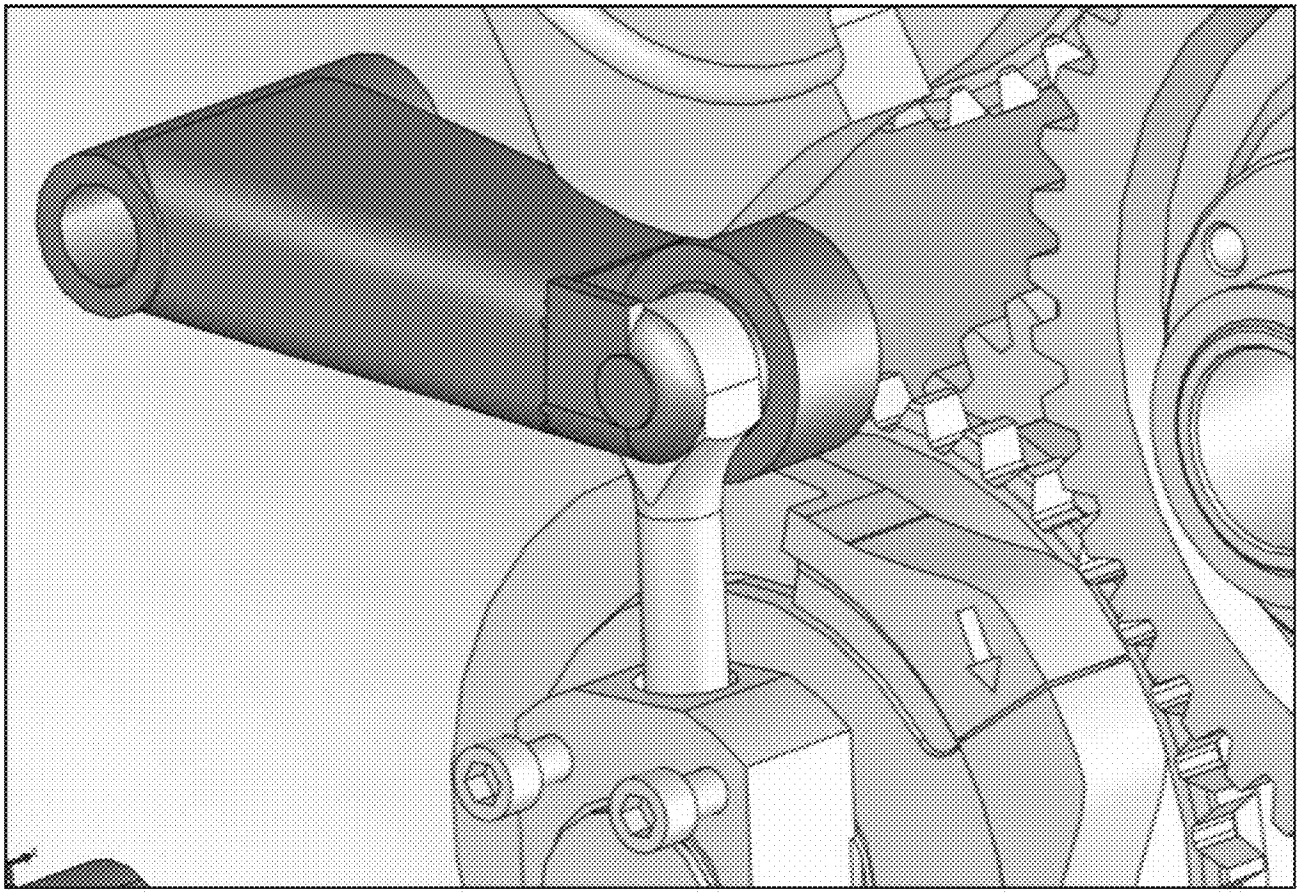
FIG. 3C4c

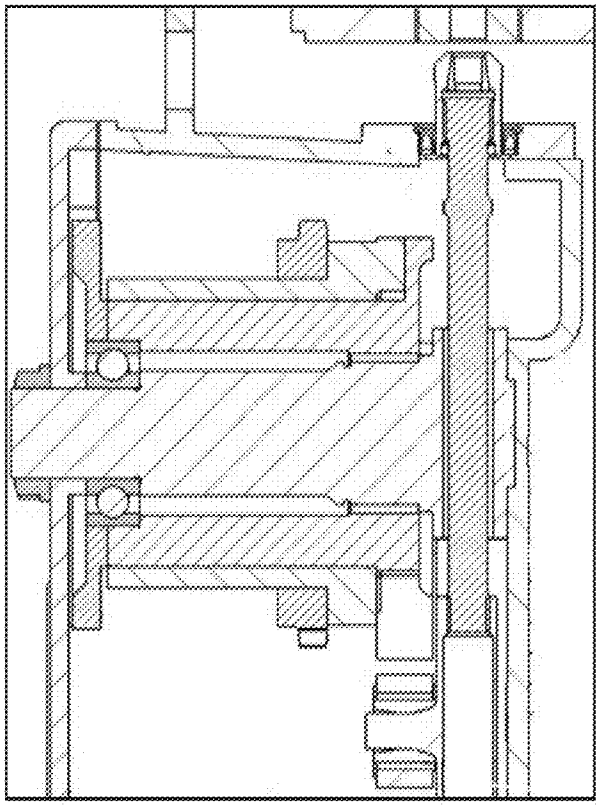
FIG. 3C4e
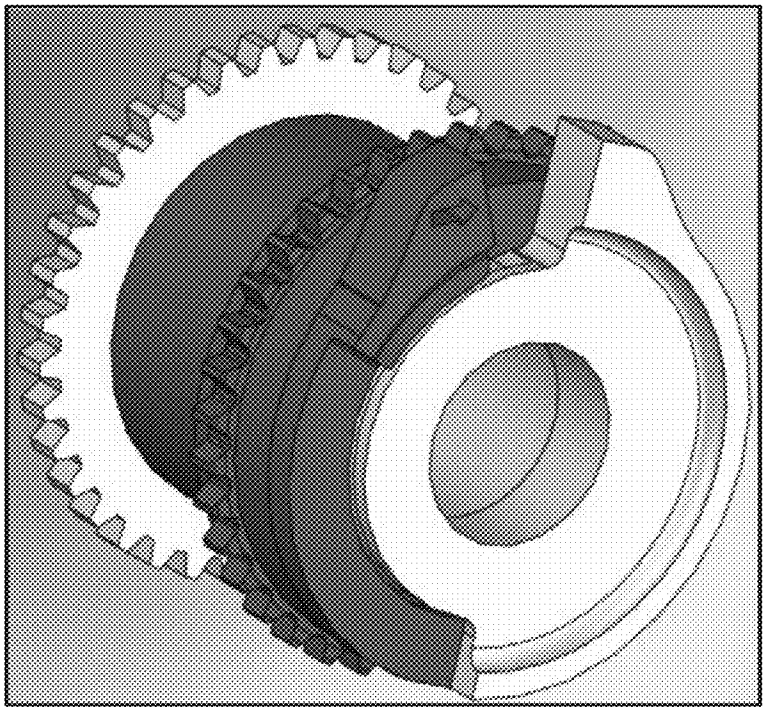
FIG. 3C4d

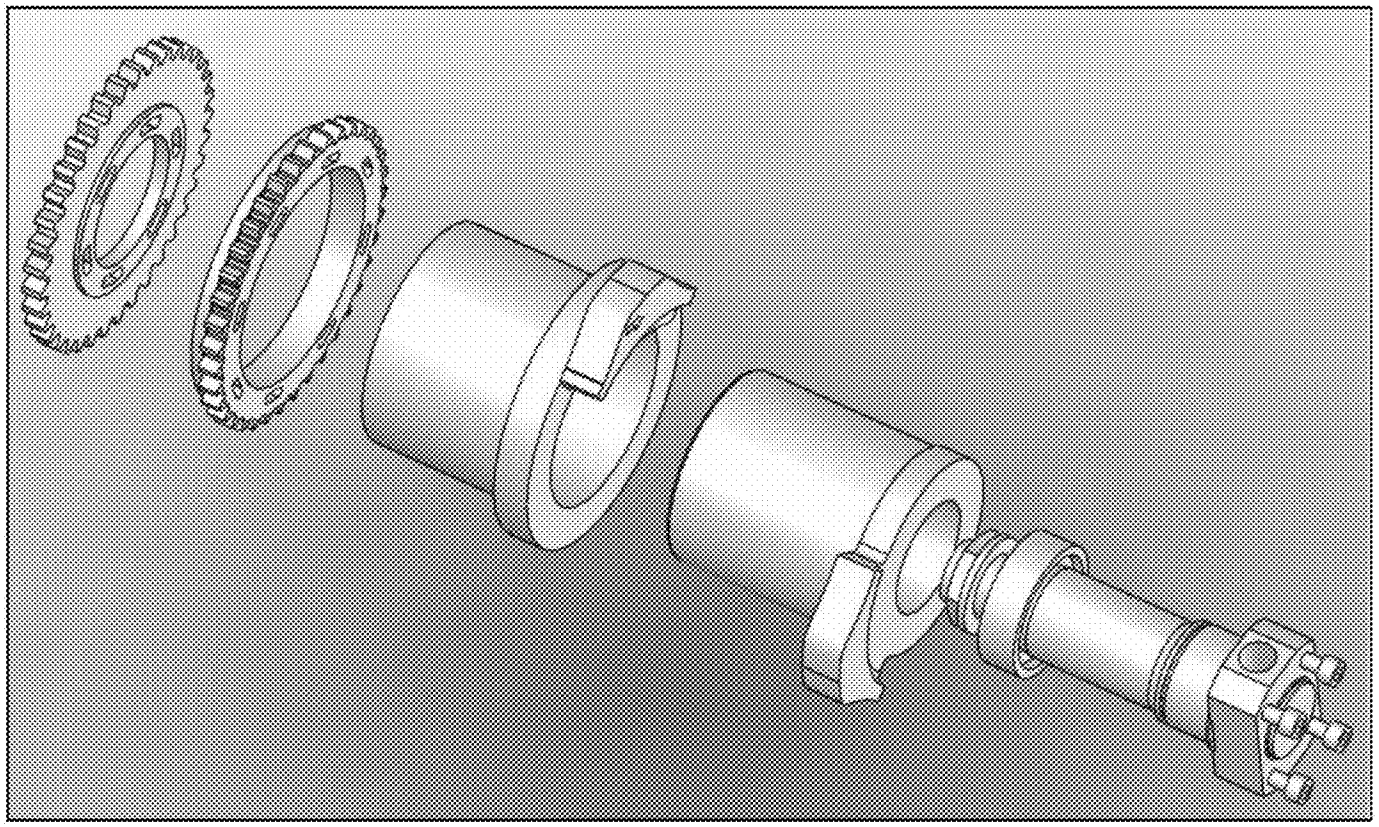
FIG. 3C4f

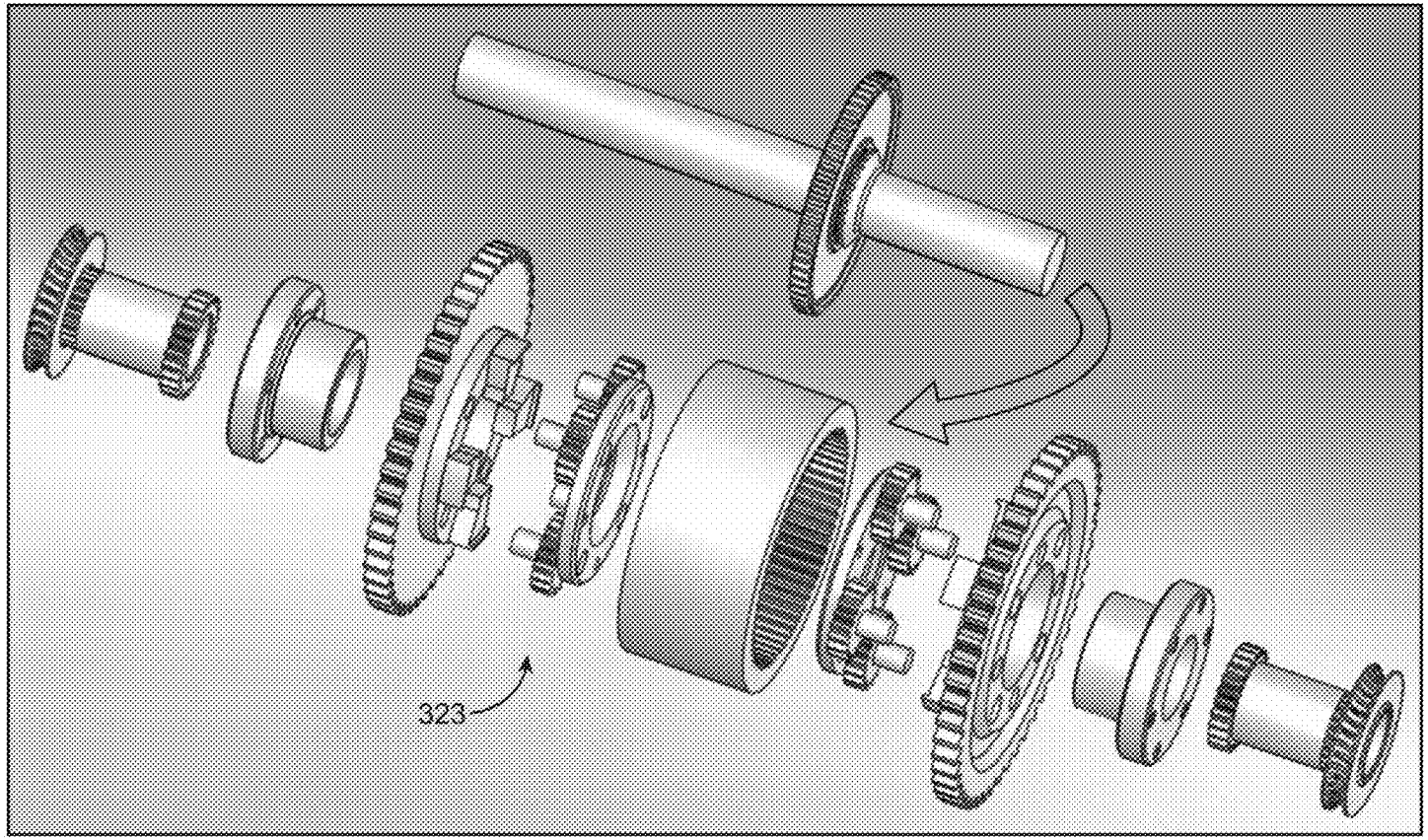
FIG. 3C4g

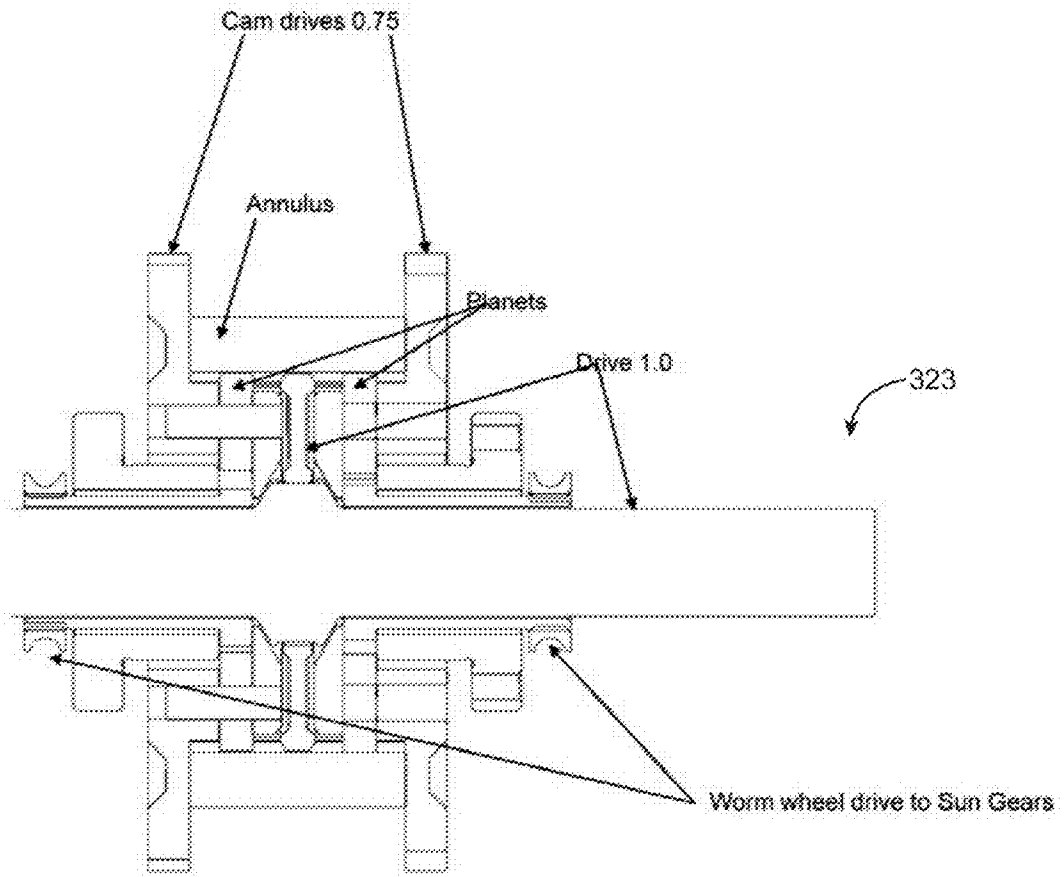
FIG. 3C4h

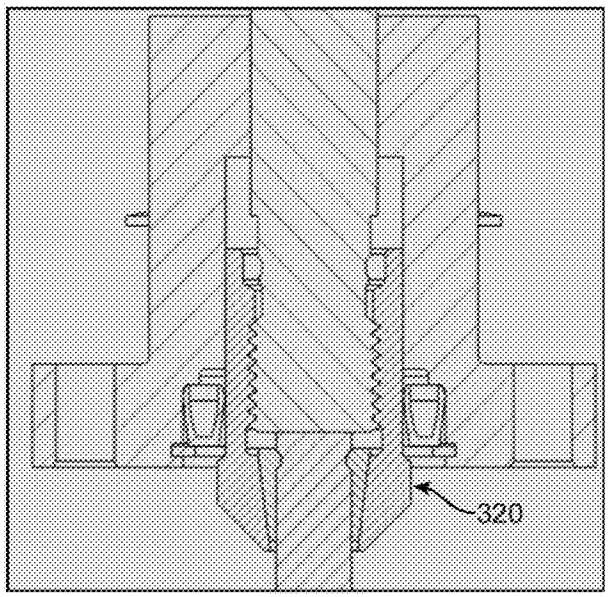
FIG. 3C4j
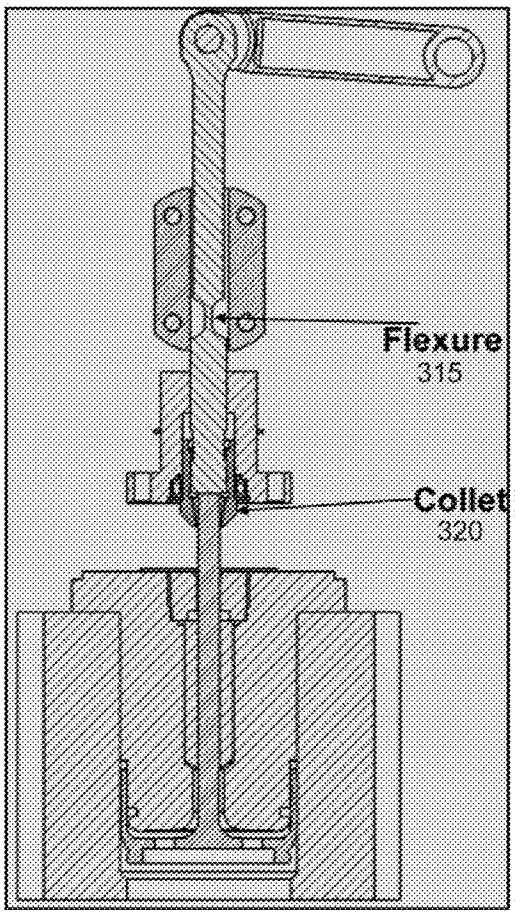
FIG. 3C4i

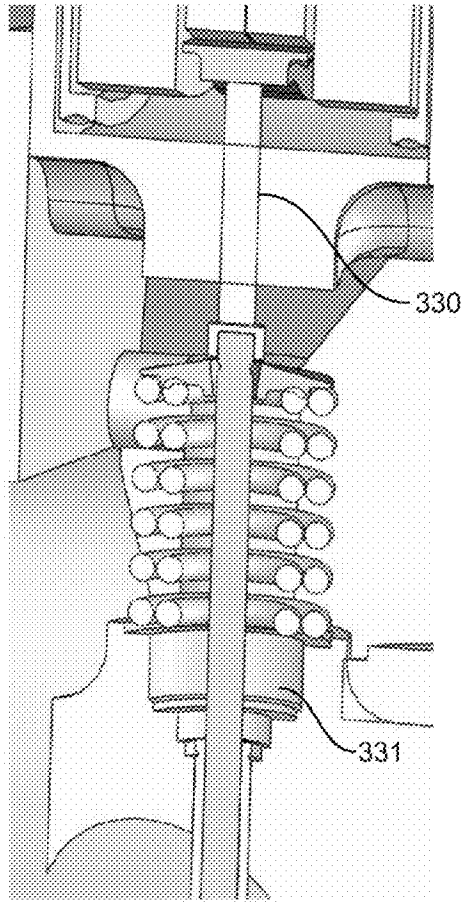
FIG. 3C5b
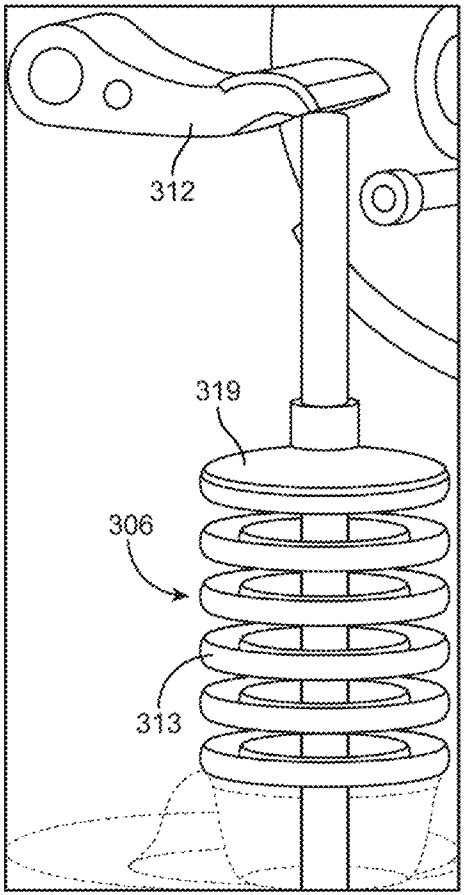
FIG. 3C5a

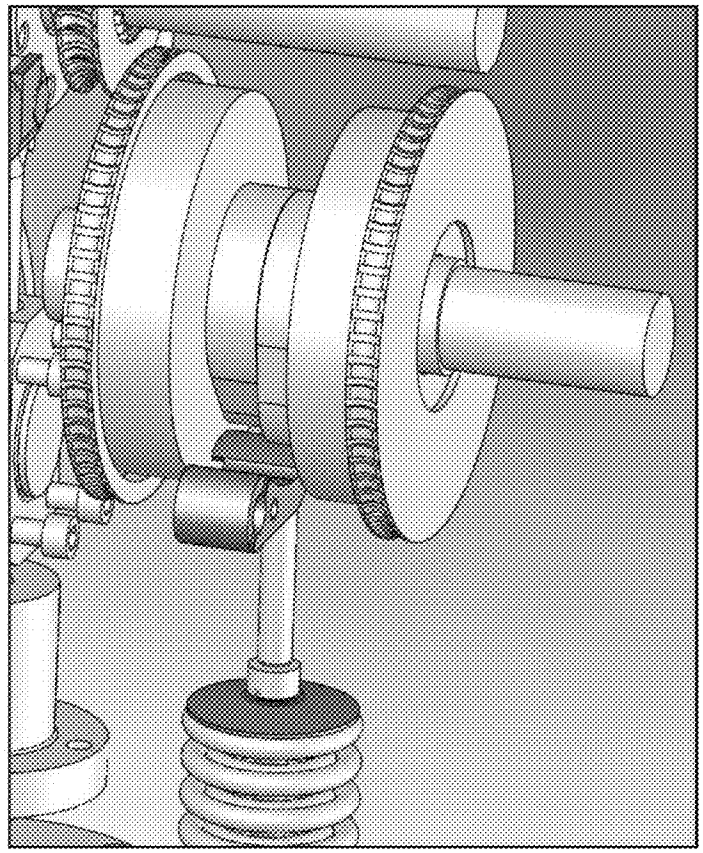
FIG. 3C5d
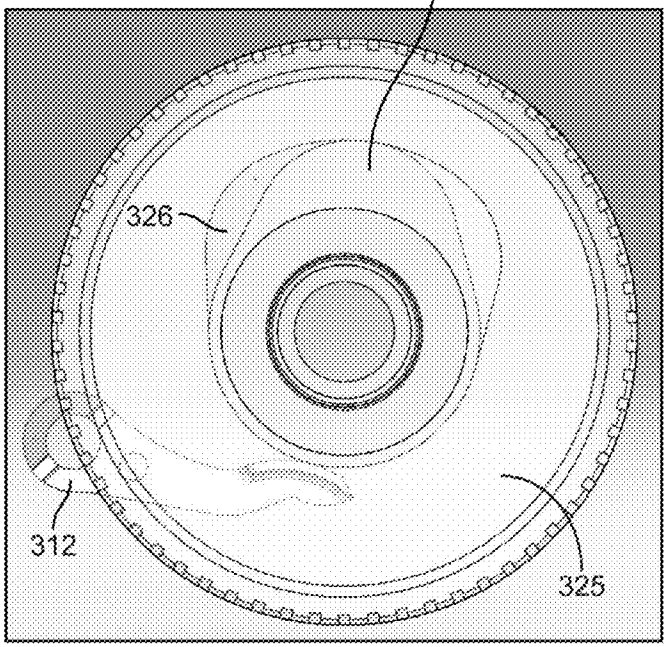
FIG. 3C5c

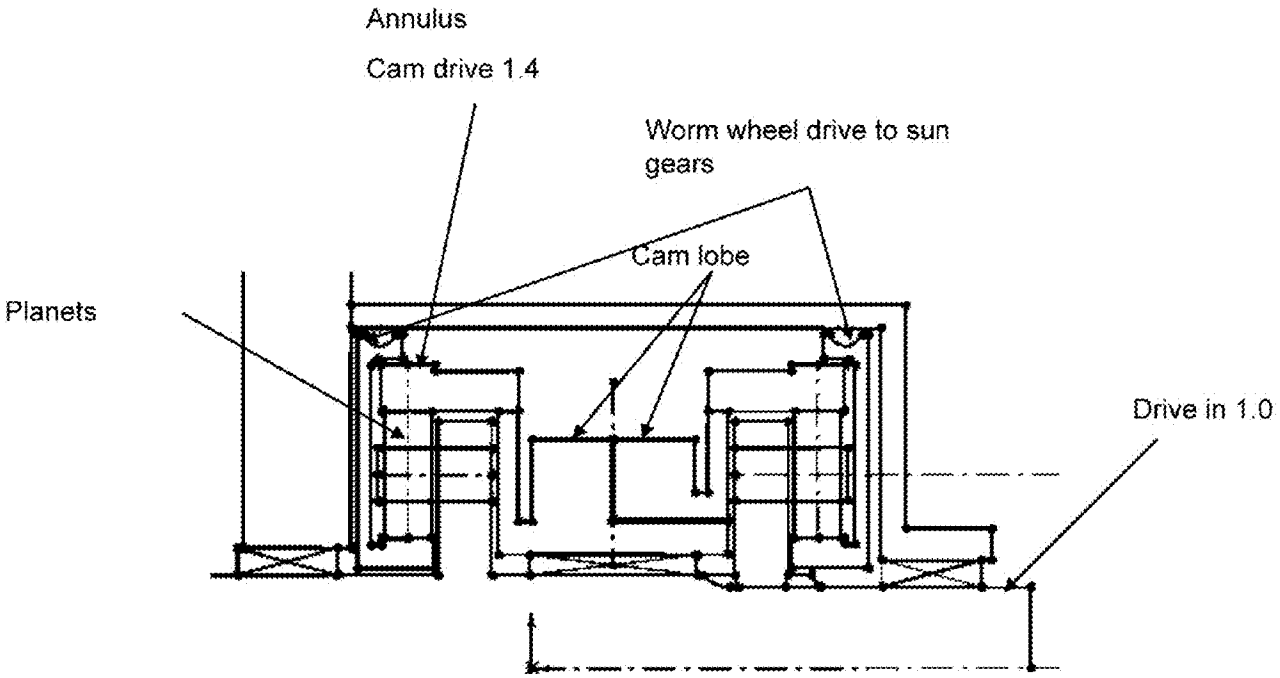
FIG. 3C5e

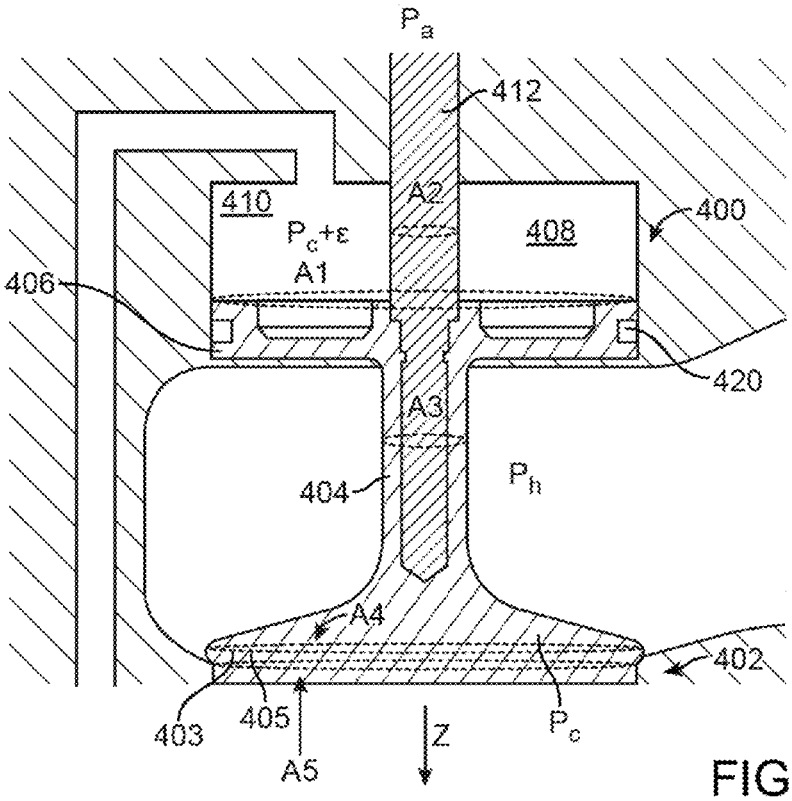
FIG. 4A1a
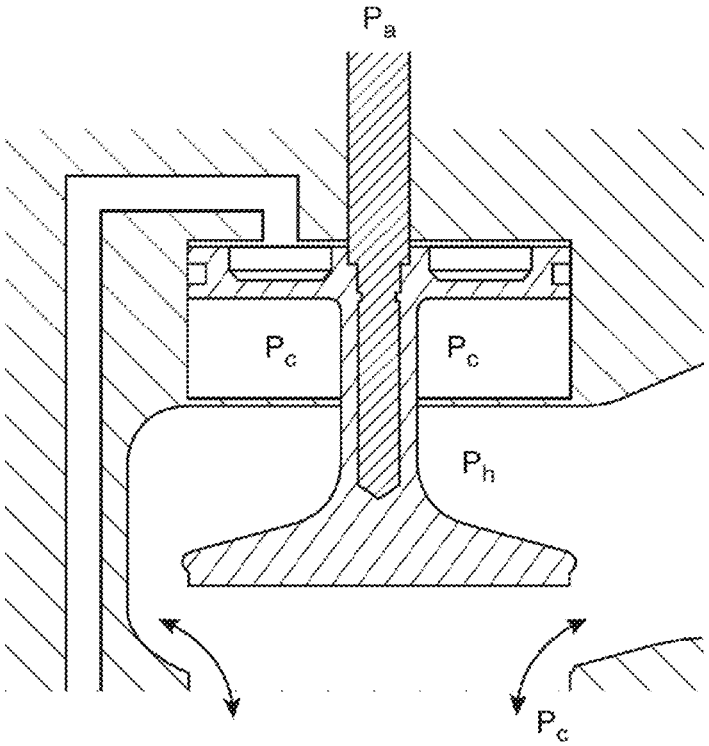
FIG. 4A1b

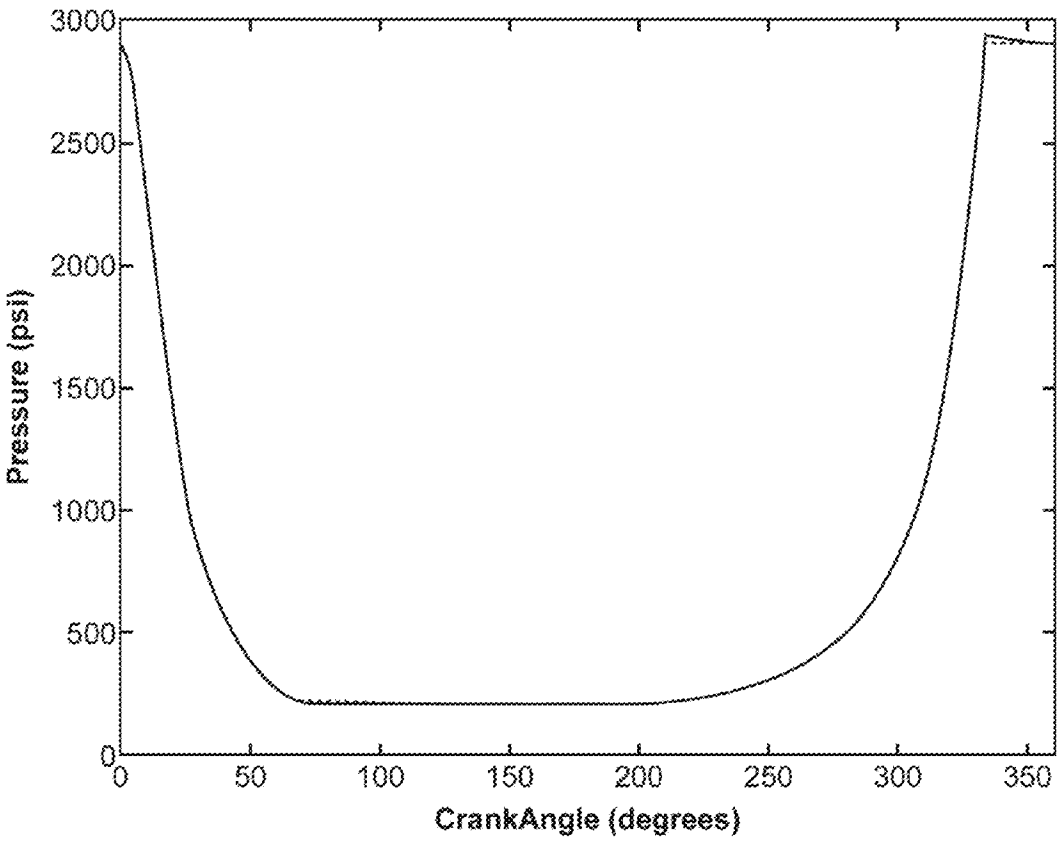
FIG. 4A1c

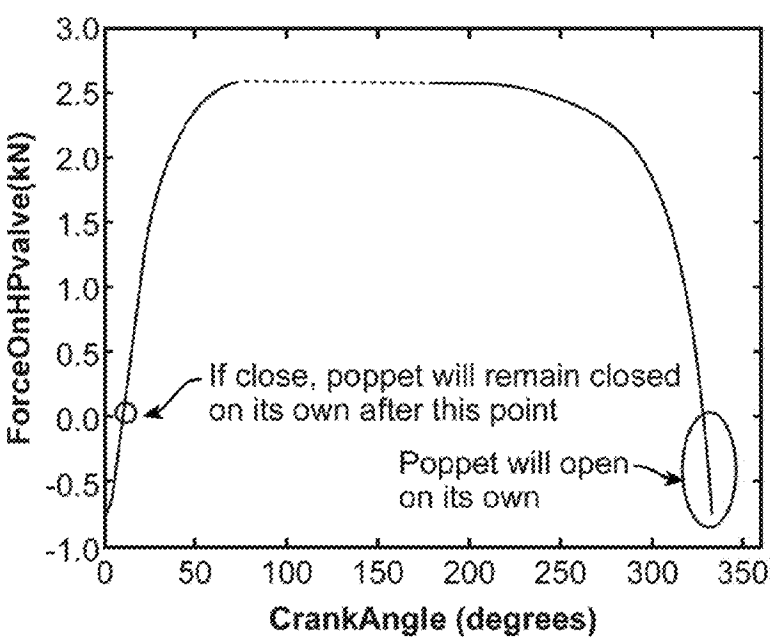
FIG. 4A1e
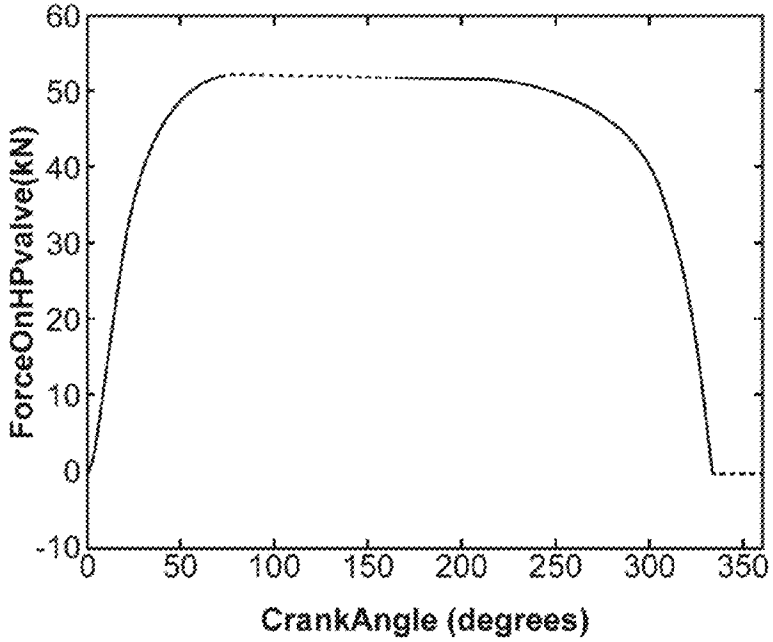
FIG. 4A1d

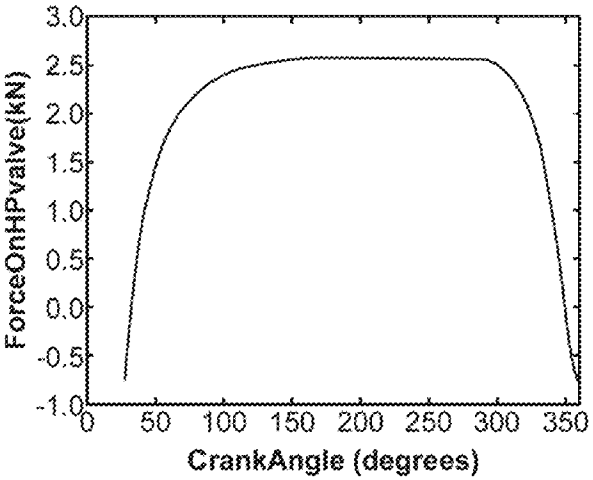
FIG. 4A1f
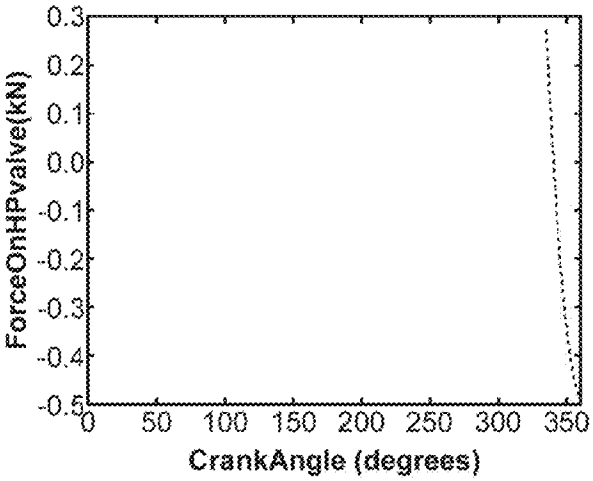
FIG. 4A1g
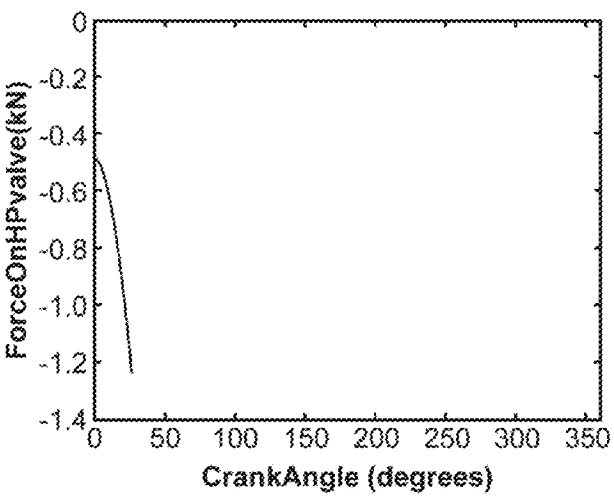
FIG. 4A1h

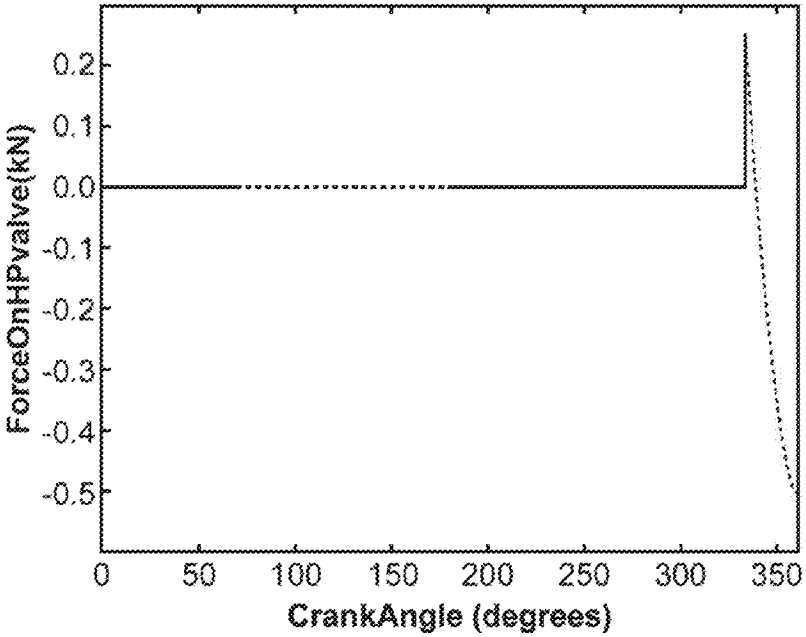
FIG. 4A1j
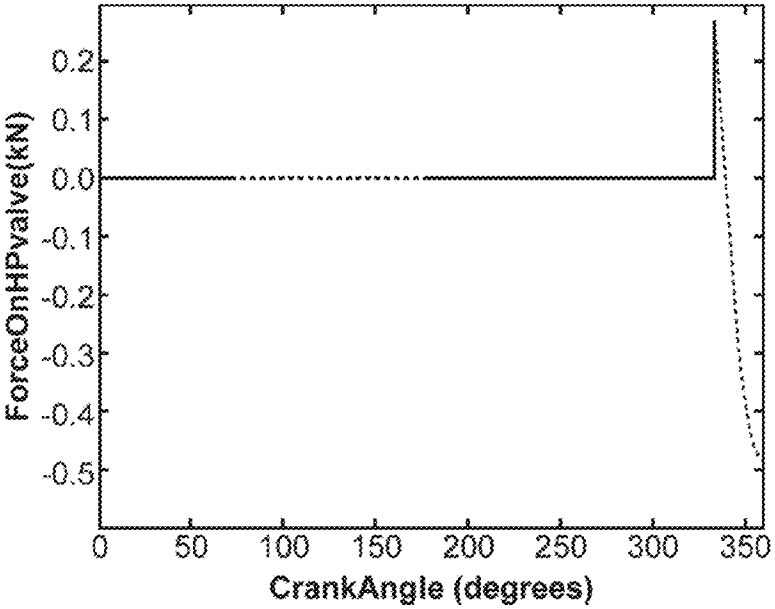
FIG. 4A1i

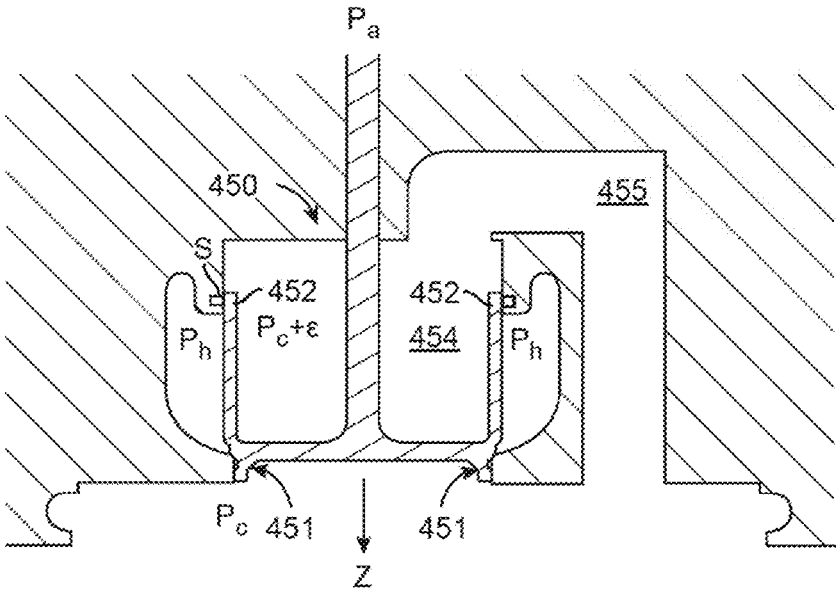
FIG. 4A2a
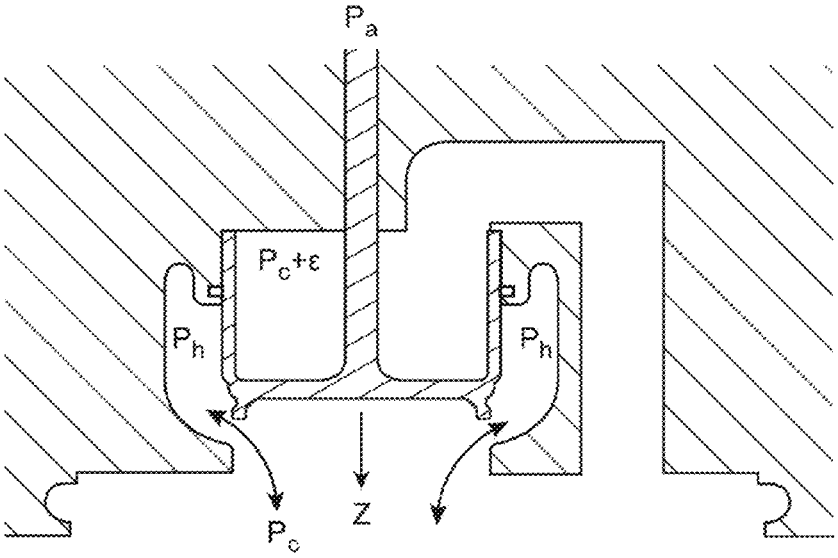
FIG. 4A2b

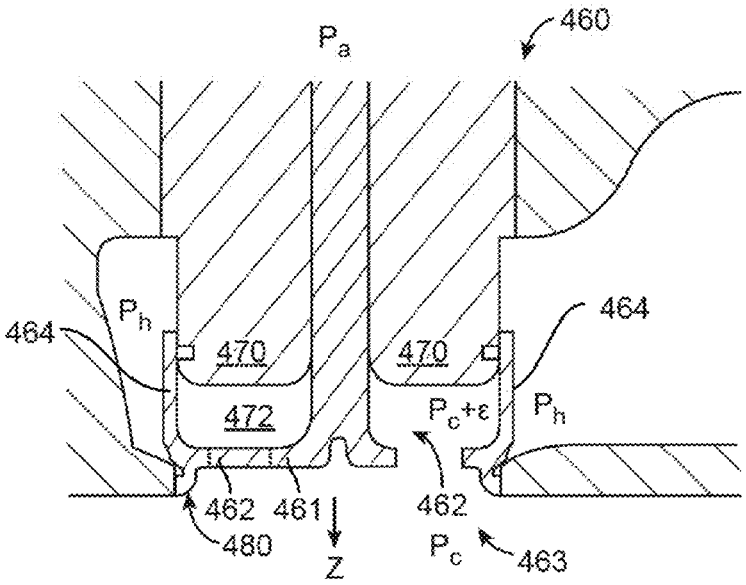
FIG. 4A3a
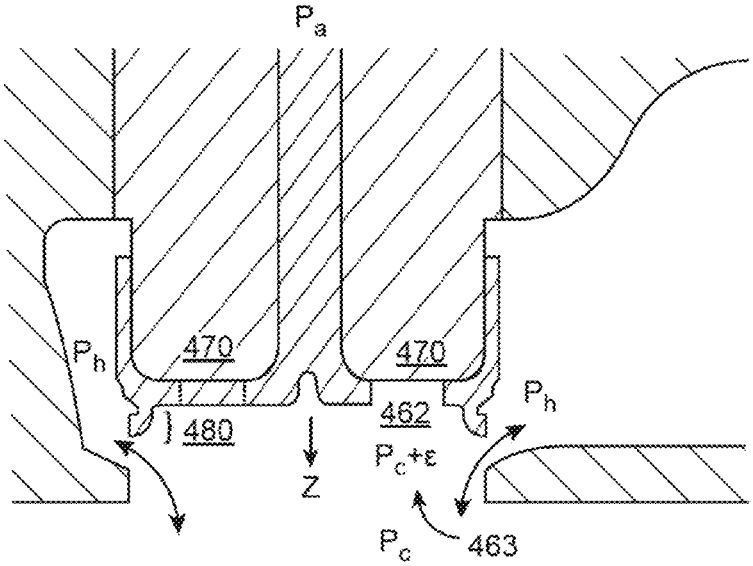
FIG. 4A3b

Crankcase assembled

Top view showing oil feed options

Main bearing and oil groove for rod supply

Main fastener scheme
and oil feeds

Oil scraper and drain

Outlet reed valve and backing plate

Reed locations

Gudgeon pin assembly tool

Gudgeon pin assy tool in action

Gudgeon Pin Assembly Tool

- Combinations of Configurations are Possible
- (Parenthesis) indicate optional functionality or optional presence of element

| Configuration | ID | 1 | 2 | 3 | 4 |
|---|---|---|---|---|---|
| | Description | Energy Storage | Energy Delivery | Heat Engine | Heat Engine |
| | Storage | to storage | from storage | No storage | No storage |
| | Gas Flow | Open System; Fig. 17BB; upward to storage | Open System; Fig. 17BC; downward from storage | Closed Circuit; Fig. 17BD; counter-clock-wise/clockwise | Open System; Fig. 17BE; Left→Right/ Right→Left |
| Cylinder No. | 17502 | Compressor | Expander | Compressor/ Expander | Compressor/ expander |
| | 17504 | Compressor | Expander | Expander/ Compressor | Expander/ compressor |
| Valve No. Connection: Port a - port _ | 17506 | b | c | d | b |
| | 17508 | c | b | d | d |
| | 17510 | b | c | d | d |
| | 17512 | c | b | d | b |
| Counterflow Heat Exchanger 14838 | Side 1 | N/A | N/A | Cold/Hot | N/A |
| | Side 2 | | | Hot/Cold | |
| Gas-Gas Heat Exchanger | 17514 | -- | -- | -- | -- |
| | 17516 | (act as heater) | (act as cooler) | (act as heater/ act as cooler) | (act as heater/ act as cooler) |
| | 17518 | -- | -- | -- | -- |
| | 17520 | (act as heater) | (act as cooler) | (act as cooler/ act as heater) | (act as cooler/ act as heater) |
| Liquid-Gas Heat Exchanger | 17522 | (act as heater) | (act as cooler) | (act as heater/ act as cooler) | (act as heater/ act as cooler) |
| | 17524 | (act as heater) | (act as cooler) | (act as cooler/ act as heater) | (act as cooler/ act as heater) |
| External Thermal Node | 17526 | (Heat Sink) | (Heat Source) | (Heat Sink/ Heat Source) | (Heat Sink/ Heat Source) |
| | 17528 | (Heat Sink) | (Heat Source) | Heat Sink/ Heat Source | Heat Sink/ Heat Source |
| | 17530 | (Heat Sink) | (Heat Source) | Heat Sink/ Heat Source | (Heat Sink/ Heat Source) |
| | 17532 | (Heat Sink) | (Heat Source) | (Heat Source/ Heat Sink) | (Heat Source/ Heat Sink) |
| | 17534 | (Heat Sink) | (Heat Source) | (Heat Source/ Heat Sink) | (Heat Source/ Heat Sink) |
| | 17536 | (Heat Sink) | (Heat Source) | (Heat Source/ Heat Sink) | (Heat Source/ Heat Sink) |
| | 17540 | N/A | N/A | Heat Sink or Heat Source | Heat Sink or Heat Source |

FIG. 17BA

Heat engine + Compressor (storage)

Heat engine + expander (energy delivery)

COMPRESSED GAS ENERGY STORAGE SYSTEM

CROSS-REFERENCE TO RELATED APPLICATIONS

The instant nonprovisional patent application claims priority to U.S. Provisional Patent Publication No. 61/548,611 filed Oct. 18, 2011 and incorporated by reference in its entirety herein for all purposes. The instant nonprovisional patent application also claims priority to U.S. Provisional Patent Publication No. 61/645,151 filed May 10, 2012 and incorporated by reference in its entirety herein for all purposes.

BACKGROUND

U.S. Patent Publication No. 2011/0115223 is hereby incorporated by reference in its entirety.

SUMMARY

Embodiments relate generally to energy storage systems, and in particular to energy storage systems using compressed gas as an energy storage medium. In various embodiments, a compressed gas storage system may include a plurality of stages to convert energy into compressed gas for storage, and then to recover that stored energy by gas expansion. In certain embodiments, a stage may comprise a reversible compressor/expander having a reciprocating piston. Pump designs for introducing liquid for heat exchange with the gas, are described. Gas flow valves featuring shroud and/or curtain portions, are also described.

BRIEF DESCRIPTION OF THE DRAWINGS

FIG. 1AA plots cylinder volume versus dead volume.

FIG. 1BA is another simplified perspective view of the embodiment of FIG. 1B.

FIG. 1BB is another simplified view of the embodiment of FIG. 1B.

FIG. 2C1 is a simplified schematic view showing the high- and low-pressure stages of an embodiment.

FIGS. 2C2*a*1-4 plot cylinder forces over crank angle for various embodiments.

FIGS. 2C2*b*1-4 plot vertical force versus horizontal force for various system embodiments.

FIGS. 2C3*a*-*d* and 2C4*a*-*d* plot different cylinder properties versus crank angle, for two different embodiments.

FIG. 2C5 shows different apparatus embodiments as modular machines.

FIG. 2C6 shows one embodiment of a cross-head bearing geometry.

FIGS. 2C7*a*-*c* show an embodiment of a piston rod and cross-head bearing geometry.

FIGS. 2C8*a*-*c* show views illustrating a piston sealing principle.

FIG. 2C9*a* lists in tabular form, properties of three- and two-stage embodiments.

FIG. 2C9*b* lists in tabular form, properties of other three-stage embodiment.

FIG. 2D1 is a simplified cross-sectional view showing an embodiment of a cylinder of a reversible compression/expansion stage.

FIG. 2D2 shows a portion of the spray rings of the stage of FIG. 2D1.

FIG. 2D3 is another simplified cross-sectional view of an embodiment of a reversible compression/expansion stage.

FIG. 2D4 is a simplified schematic diagram of a test cell.

FIG. 3A shows a simplified cross-section of one embodiment of a gas flow valve in a closed position.

FIG. 3B plots flow through the valve of FIG. 3A versus lift position.

FIG. 3C1 shows an embodiment of a valve actuation mechanism.

FIG. 3C2*a* is a simplified view of one stage according to an embodiment.

FIG. 3C2*b* is an enlarged view showing dedicated valves governing flow to and from the high and low pressure sides.

FIG. 3C3*a* shows actuator mechanisms for low pressure side valves and high pressure valves according to an embodiment.

FIG. 3C3*b* shows a perspective view of an embodiment of cylinder head gearbox.

FIG. 3C3*c* shows a perspective view of the gearbox of the embodiment of FIG. 3C3*b* for the high pressure side valve, with the cover removed.

FIG. 3C3*d* shows an exploded view showing interaction of a high pressure valve timing mechanism with the actuation cam assemblies.

FIG. 3C3*e* shows a simplified side view of the actuation cam assemblies interacting with the torsionally stiff pivoting cam follower of the high pressure valve.

FIG. 3C3*f* plots flow through the high pressure valve versus crank angle, for various operational configurations.

FIG. 3C4*a* shows a perspective view of an embodiment of a cam mechanism of the high pressure side valve.

FIG. 3C4*b* shows a perspective view of a torsionally stiff pivoting cam follower.

FIG. 3C4*c* shows an enlarged view of the pivoting cam follower.

FIG. 3C4*d* shows a cross-section of an embodiment of an upper cam assembly of the high pressure side valve.

FIG. 3C4*e* shows a cross-section of the upper cam assembly of FIG. 3C4*d*.

FIG. 3C4*f* shows an exploded view of the cam mechanism of FIG. 3C4*d*.

FIG. 3C4*g* shows an exploded view an embodiment of a cam timing mechanism for the high pressure side valve.

FIG. 3C4*h* shows a cross-section of an embodiment of the cam timing mechanism of FIG. 3C4*g*.

FIG. 3C4*i* shows an embodiment of a linkage to a cam follower including a flexure.

FIG. 3C4*f* shows an enlarged view of an embodiment of the collet of FIG. 3C4*i*.

FIG. 3C5*a* shows a perspective view of an embodiment of a low pressure side valve.

FIG. 3C5*b* is a cross-sectional view of the low pressure side valve of FIG. 3C5*a*.

FIG. 3C5*c* shows an end view of an embodiment of a timing mechanism for the low pressure side valve.

FIG. 3C5*d* shows a perspective view of the timing mechanism of FIG. 3C5*c*.

FIG. 3C5*e* shows a cross-sectional view of a valve timing mechanism.

FIGS. 3DA-DB plot various performance characteristics of a chamber equipped with high and low pressure valves in the compression and expansion cases, respectively.

FIG. 4A1*a* shows a simplified cross-section of one embodiment of an HP gas flow valve in a closed position.

FIG. 4A1*b* shows the gas flow valve embodiment of a 4A1*a* in the open position.

FIG. 4A1*c* plots cylinder pressure versus crank angle in compression.

FIG. 4A1*d* plots force on the valve versus crank angle in compression.

FIG. 4A1*e* indicates force needed to hold the valve closed during compression.

FIG. 4A1*f* plots force on the closed valve versus crank angle on expansion.

FIG. 4A1*g* plots force on the open valve versus crank angle on compression.

FIG. 4A1*h* plots force on the open valve versus crank angle on expansion.

FIG. 4A1*i* plots force on the open valve versus crank angle with line contact.

FIG. 4A1*j* plots force on the open valve versus crank angle with surface contact.

FIG. 4A2*a* shows a simplified cross-section of another embodiment of an HP gas flow valve in a closed position.

FIG. 4A2*b* shows a simplified cross-section of the gas flow valve embodiment of FIG. 4A2*a* in the open position.

FIG. 4A3*a* shows a simplified cross-section of yet another embodiment of an HP gas flow valve in a closed position.

FIG. 4A3*b* shows a simplified cross-section of the gas flow valve embodiment of FIG. 4A3*a* in the open position.

FIGS. 4BA-BB show views of valve embodiments equipped with spray nozzles.

FIGS. 4CA-CB show flow through valves having different port heights.

FIG. 4CC plots flow rate versus port height for different embodiments.

FIGS. 4DA-DC show flows through valves having different valve bodies.

FIG. 4DD plots flow rate versus valve body for different embodiments.

FIGS. 4EA-ED plot various chamber characteristics utilizing a valve embodiment.

FIGS. 4FA-FD plot various chamber characteristics utilizing a valve embodiment.

FIG. 5A is a PV curve for a compression case according to an embodiment.

FIG. 5B is an enlargement of a portion of the PV curve of FIG. 5A.

FIG. 5C is a PV curve for an expansion case according to an embodiment.

FIG. 5D shows a view of the low pressure (LP) valve, and active and passive high pressure (HP) valves of a cylinder head according to an embodiment.

FIG. 5DA is a PV curve for an expansion case with one type of HP valve.

FIG. 5DB is a PV curve for an expansion case with another type of HP valve.

FIG. 7A is a simplified diagram showing a liquid flow system according to one embodiment.

FIG. 7B is a simplified diagram showing a liquid flow system according to another embodiment.

FIG. 8A is a cross-sectional view of an embodiment of a high pressure water pump concept.

FIG. 8B is an enlarged view showing water pump size relative to the HP piston assembly.

FIG. 8C is a simplified cross-sectional view of a balanced plunger water pump arrangement.

FIG. 8DB shows a simplified cross-sectional view of an outlet pump valve according to an embodiment.

FIG. 9A is a simplified cross-section of half of an embodiment of a liquid pump.

FIG. 9B plots lift versus cam position for a liquid pump embodiment.

FIG. 16CA is a simplified schematic view of a system including a processor configured to coordinate operation of an energy system with a power supply network.

FIG. 17BB-BG show simplified views of the gas flow paths in various operational modes of the system of FIG. 17A.

DETAILED DESCRIPTION

Compressed air is capable of storing energy at densities comparable to lead-acid batteries. However, compressed gas does not involve issues associated with a battery such as limited lifetime, materials availability, or environmental friendliness.

A compressed gas energy storage system performs the functions of compressing a gas to store energy, and recovering the energy by restoring the gas to a lower pressure. To decrease size, complexity, and cost of such as system, it may be desirable to use the same equipment for both the compression and expansion phases of the process. Examples of such a system can be found in U.S. Patent Publication No. 2011/0115223 ("the Publication"), which is hereby incorporated by reference in its entirety. It should be appreciated that the designs discussed below may include one or more concepts discussed in the Publication.

Further examples of compressed gas energy storage systems are described in the U.S. Provisional Patent Application No. 61/548,611, which is also incorporated by reference in its entirety herein for all purposes. In general, that provisional application describes a system employing a piston reciprocating within a chamber defined within a plurality of liquid spray rings having orifices in fluid communication with a manifold.

Figure 1A:
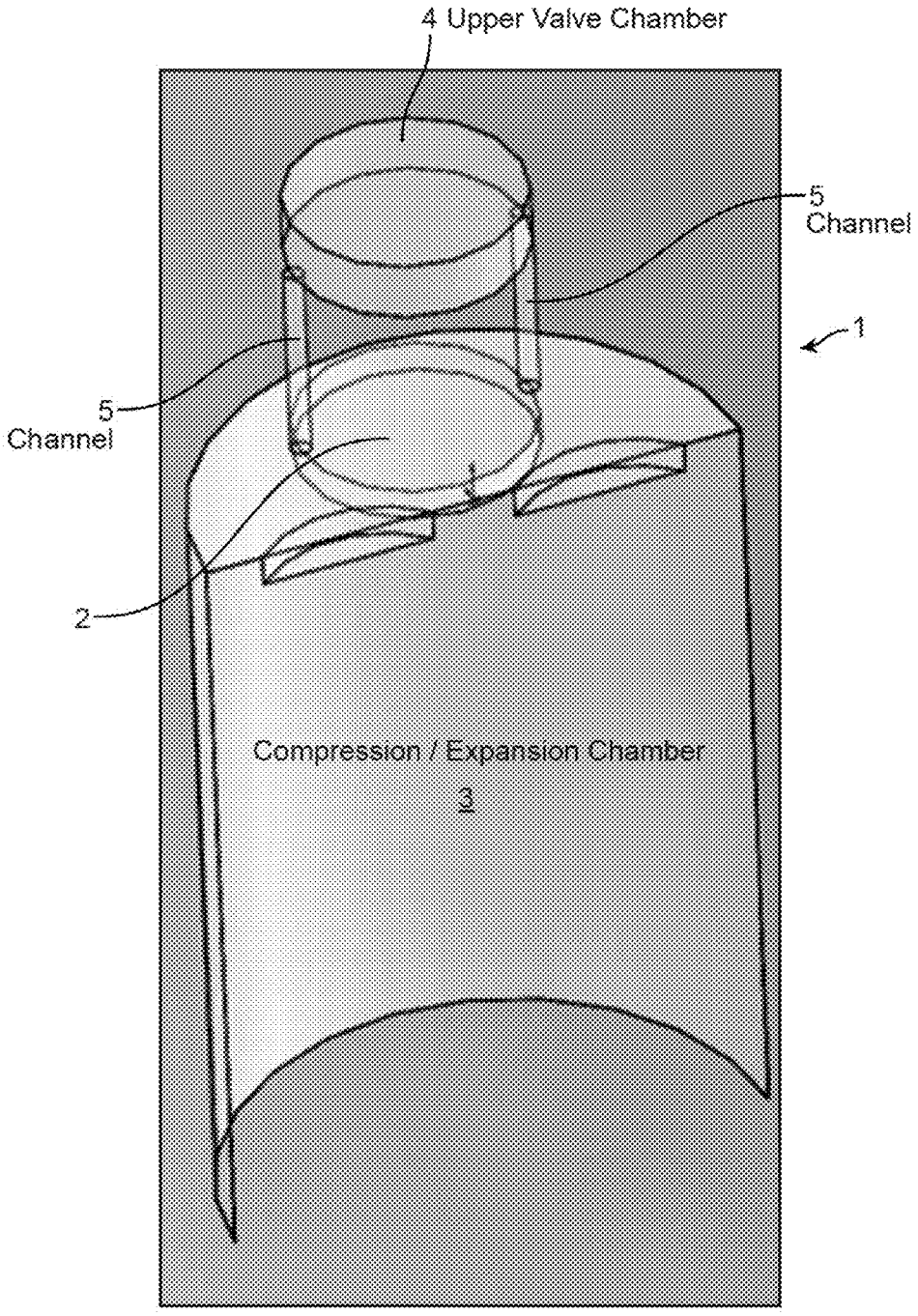
FIG. 1A shows a simplified diagram of a gas flow valve overlying a chamber.
Figure 1A:
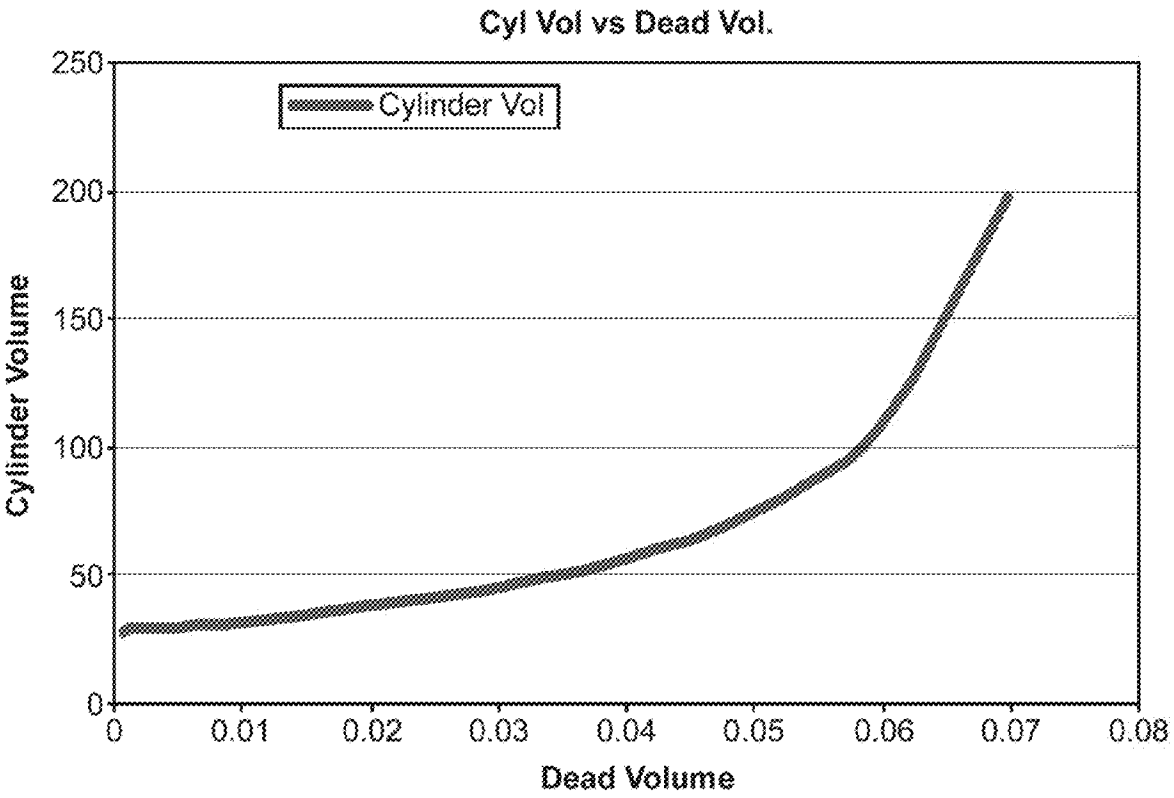

FIG. 1A shows a highly simplified view showing the dead volume of an embodiment of an apparatus comprising a gas flow valve 1 including a moveable member, that is positioned over a chamber 3 in which gas expansion or compression may occur. In FIG. 1A, the reference number 2 shows an allowance for the valve recess in the head. There are two smaller recesses in the piston for valve clearance allowance. Reference number 3 shows the cylindrical sheet volume between the plunger/piston and the wall and between the plunger/piston crown and the head at TDC.

The gas flow valve includes an upper chamber 4 that is in fluid communication with the compression/expansion chamber via channels 5. These channels provide for balancing of pressure across the moveable member as it is actuated, thereby reducing an energy consumed for valve actuation. Details of valve embodiments exhibiting this balanced force characteristic are provided in detail below, at least in connection with FIG. 3A, FIG. 4A1*a*-*b*, and FIGS. 4A2*a*-4A3*b*.

Embodiments according to the design shown in this FIG. 1A are more efficient in regards to dead volume than conventional gas compressors having valves arranged radially in the cylinder wall.

FIG. 1AA plots cylinder volume versus dead volume. This plot shows the effect of dead volume on cylinder size for a given power requirement. It illustrates the value of having a small dead volume, and the non-linear relationship between dead volume and cylinder size. In particular, increasing dead volume can have a large impact due to the shape of the curve.

The final stage cylinder size may be influenced by a number of factors. Dead volume may be increased to get a reasonable cylinder size that fits the required number of nozzles (~120 @3:1 MF) and gives a reasonable power density.

In certain embodiments it may be possible to increase the bore to accommodate valve area. Bore diameter may be reduced to reduce loads on the crank or cam gear. The bore may be reduced to minimize distance into volume for droplet travel.

Mean piston speed may be monitored as stroke increases. Dead volume may be adjustable in case bulk water reduces it and increases power, or not.

Packaging and mechanical complexity of various embodiments are shown and described in connection with the following.

Figure 1B:
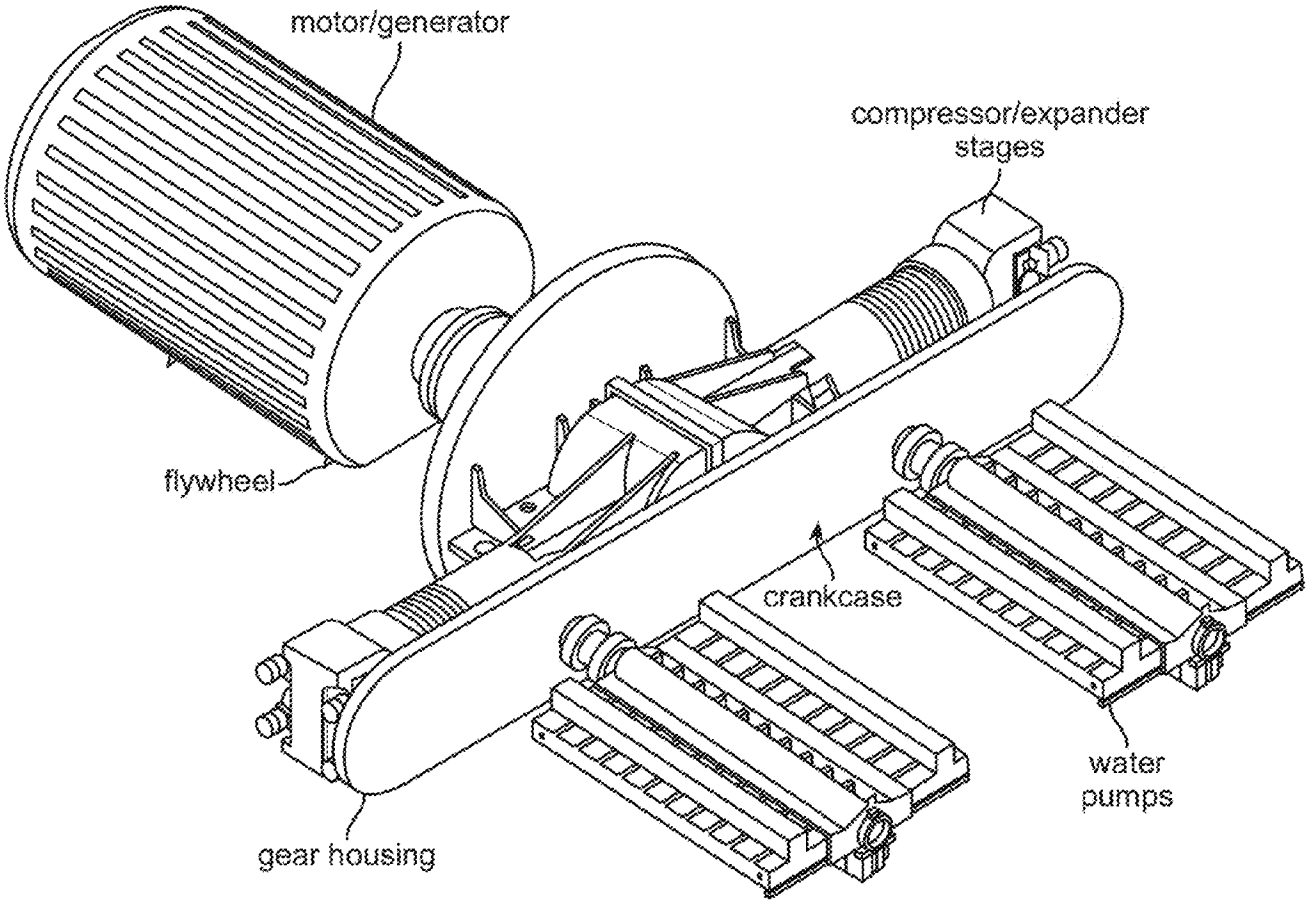
FIG. 1B is a simplified perspective view of an embodiment of an energy storage and recovery system.
Figure 1B:
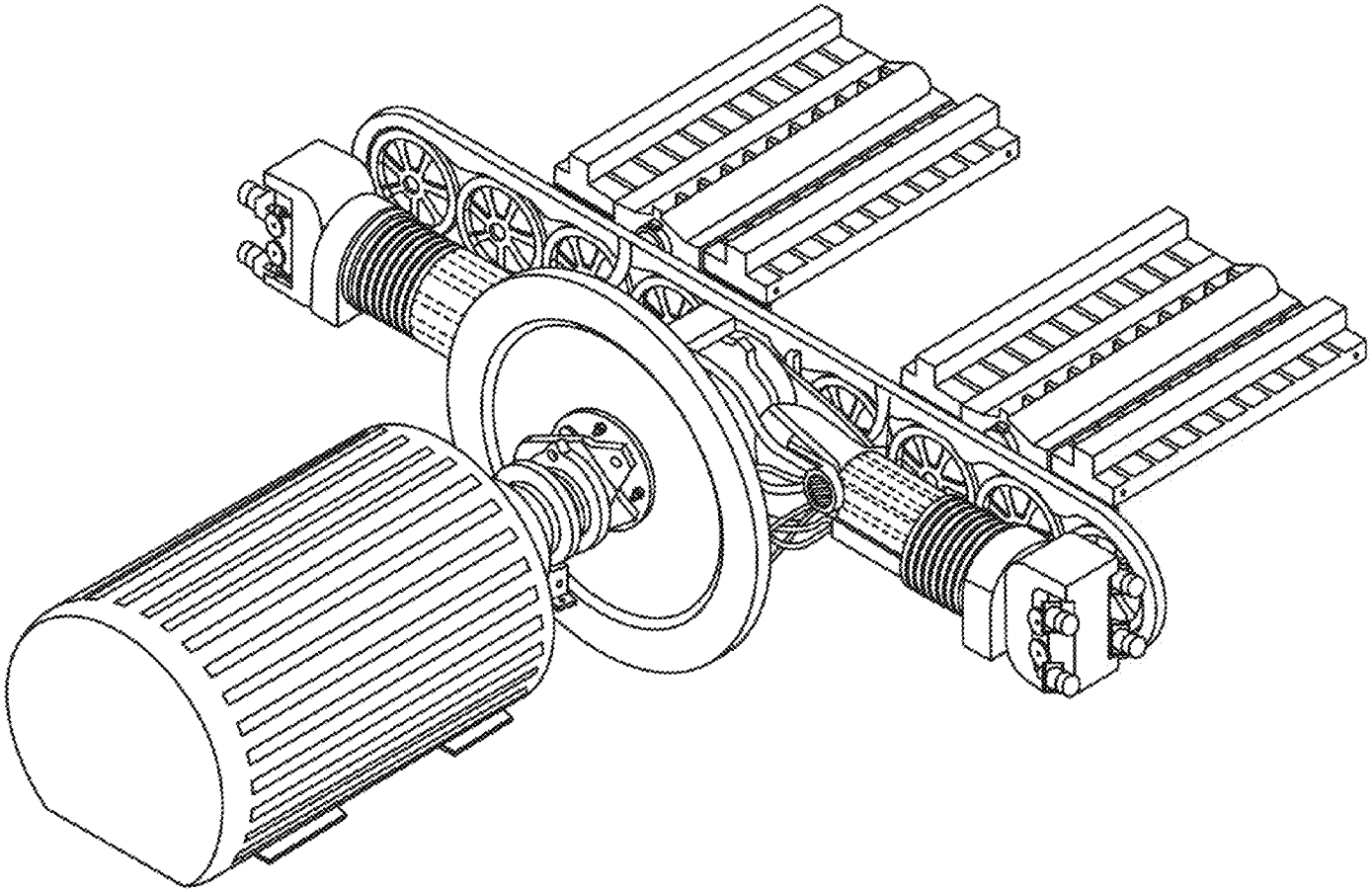
Figure 1B:
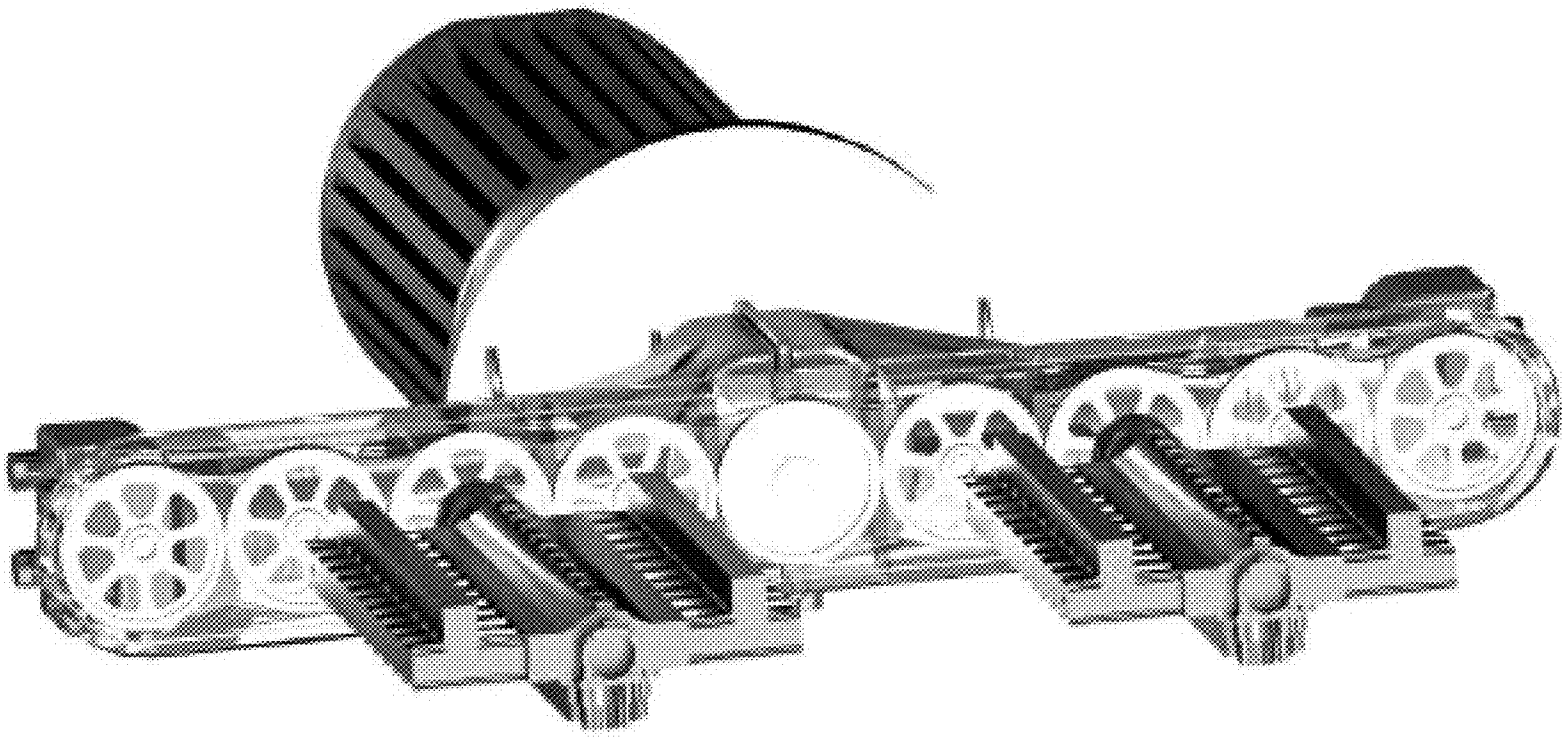
Figure 2:
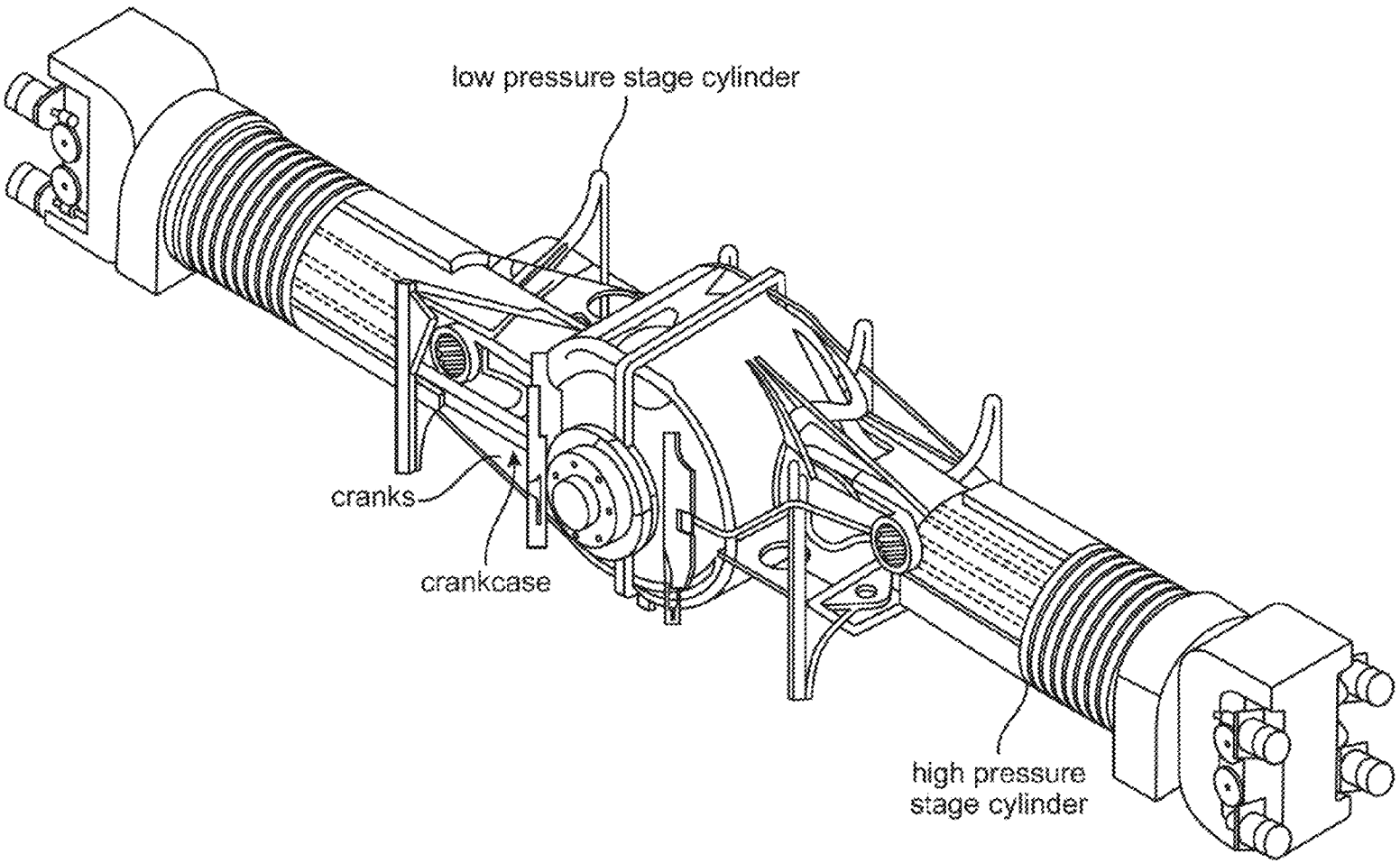
FIG. 2 is a simplified perspective view of two reversible compression/expansion stages according to an embodiment.

FIG. 1B is a simplified perspective view of an embodiment of an energy storage and recovery system. The system comprises a high pressure compression/expansion stage and a low pressure compression/expansion stage, connected by cranks to a common shaft as is shown in FIGS. 2-2C1.

FIG. 1B also shows a motor/generator in communication with the common shaft to transmit or receive energy from the motor/generator. A flywheel is present on the shaft between the compression/expansion stages and the motor/generator. This flywheel serves to even out the torque experienced by the motor during operation.

FIGS. 1BA-BB show other simplified views of the embodiment of FIG. 1B. In these views, a housing of the gears providing mechanical communication between the stages and a plurality of water pumps, is removed for purposes of illustration. This shows the series of gears allowing communication of the main shaft with valve cam drives at either end of the machine, and with the liquid pumps.

While FIGS. 1BA-BB show a drive relying on the use of gears, this is not necessarily required. Other embodiments could employ alternate drive methods comprising elements such as belts, shafts, and/or link rods.

Rotating to Reciprocating Mechanism

A crank or a cam may be used to convert between rotational and reciprocating motion. Min pressure to get 125 kW is 54 Bar and 3.84 Bar in 1st stage. Piston mass may be up to 25 kg. Hence a cam mechanism may work.

Offsetting the pin may make sense to increase compression time if the crank runs counter during expansion.

Figure 2A:
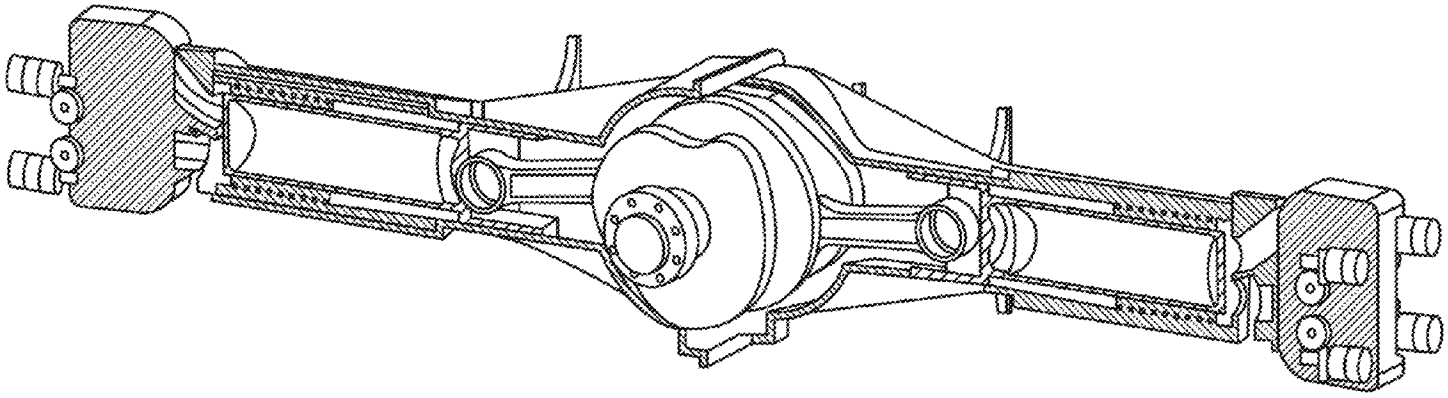
FIG. 2A is a simplified cross-sectional view of the two reversible compression/expansion stages of FIG. 2.

FIGS. 2A-2C1 show views of horizontally opposed crank configurations. In considering horizontally opposed embodiments versus "single cylinder" embodiments, the single cylinder approach may call for greater balance shaft complexity and greater rotating counterweight mass.

Figure 2B:
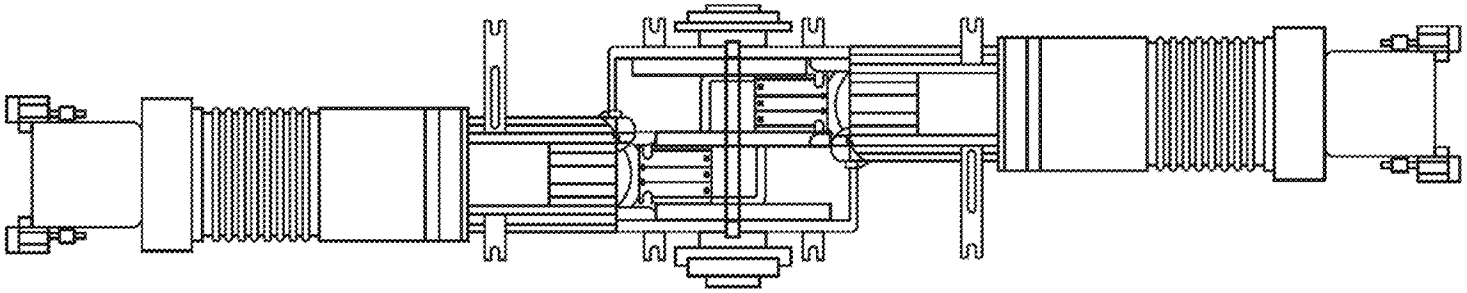
FIG. 2B is a simplified top view of the two reversible compression/expansion stages of FIG. 2.

The particular embodiment of FIGS. 2-2B shows the opposing cylinders as having a same volume. This allows testing of expansion and compression simultaneously with limited storage required. The particular embodiment of FIG. 2C1 shows the opposing cylinders as having different volumes. According to an embodiment a system might comprise two-stages with two different size cylinders. A system embodiment might also be three-stage with four cylinders.

Figure 3A:
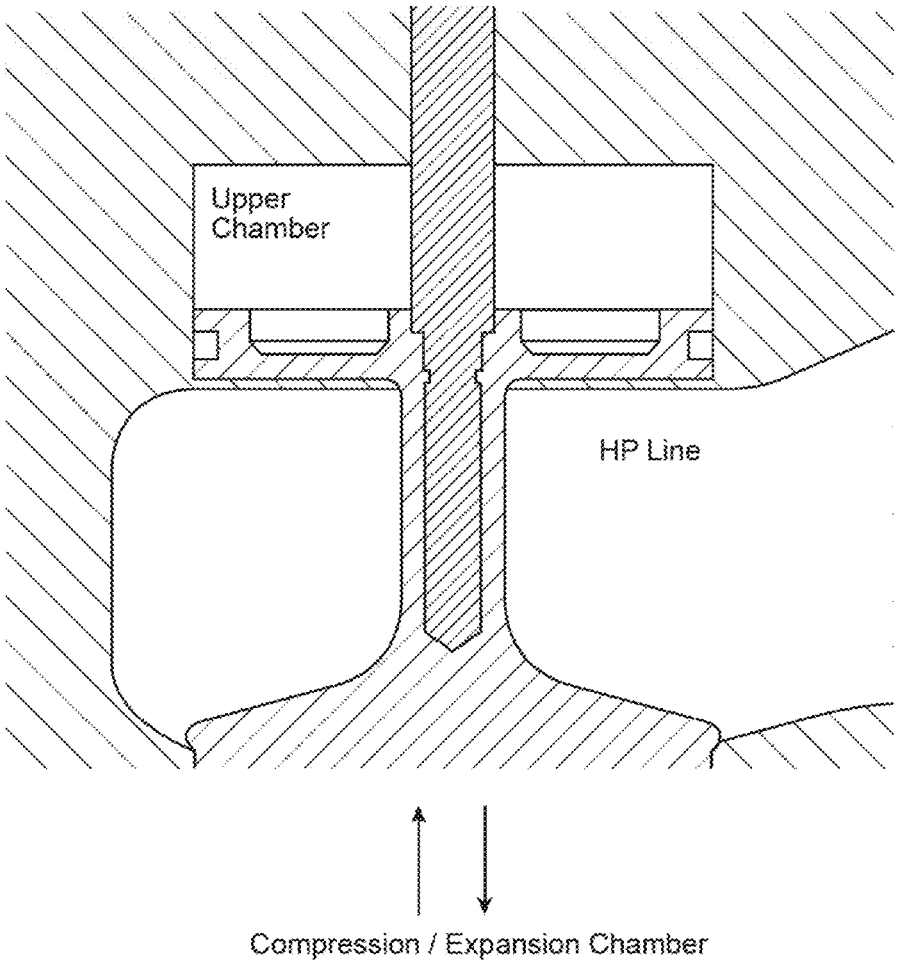
Figure 3B:
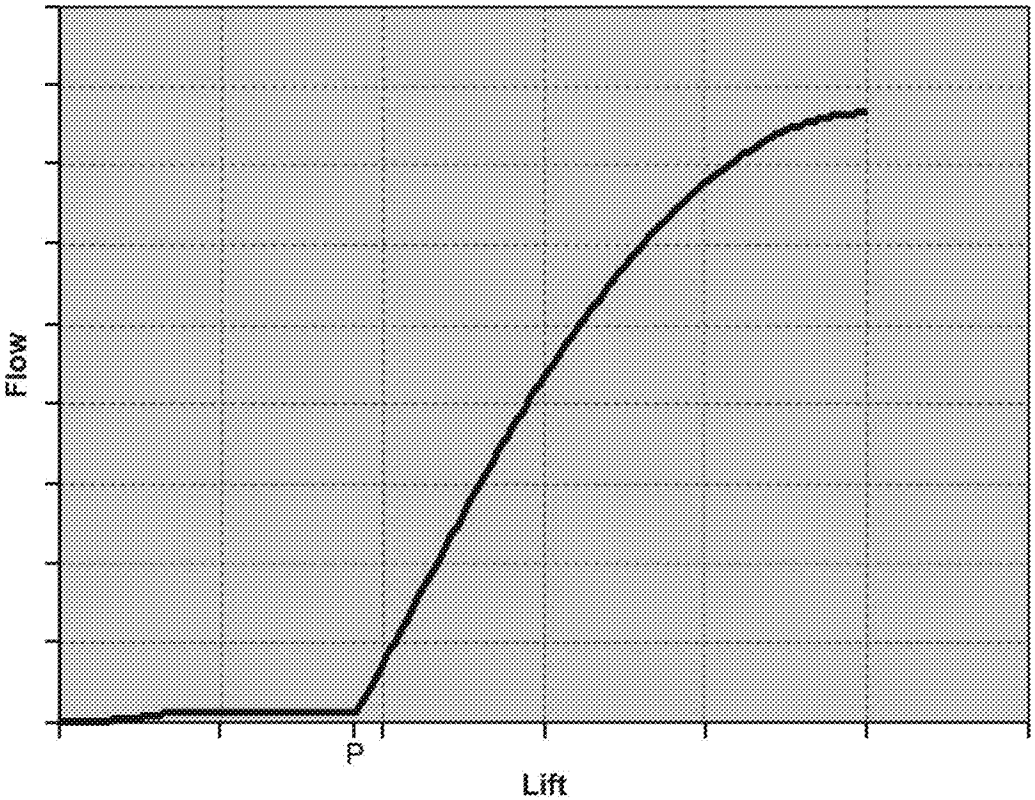
Figure 3D:
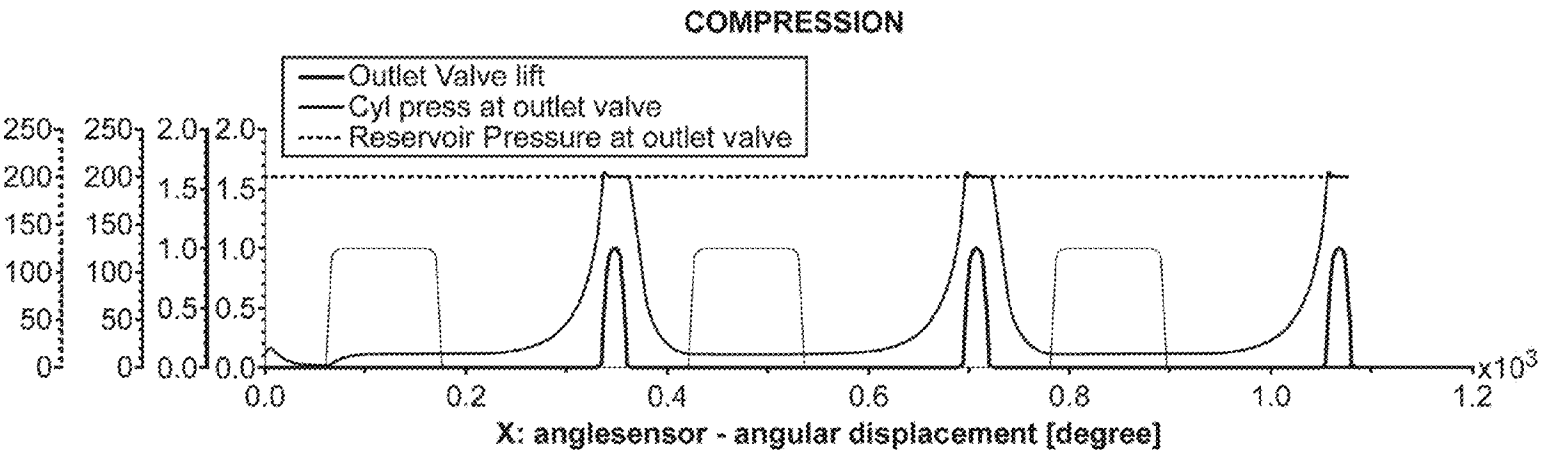
Figure 3D:
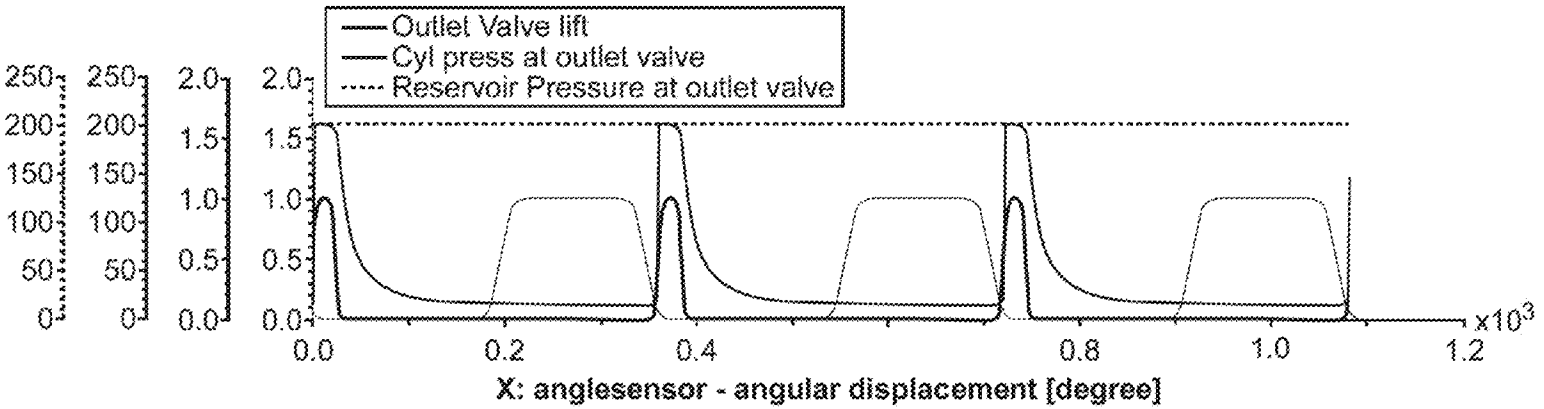
Figure 4B:
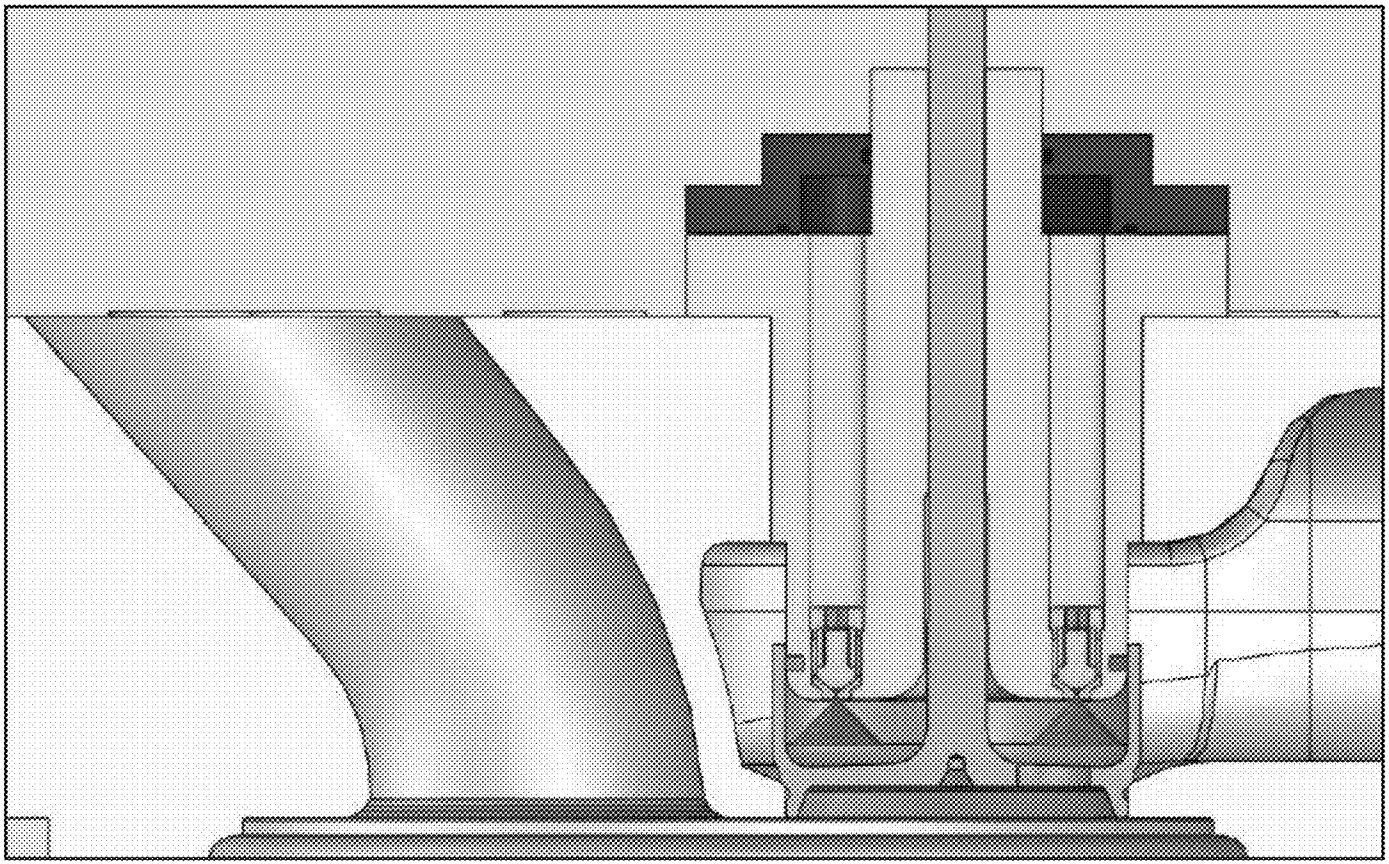
Figure 4B:
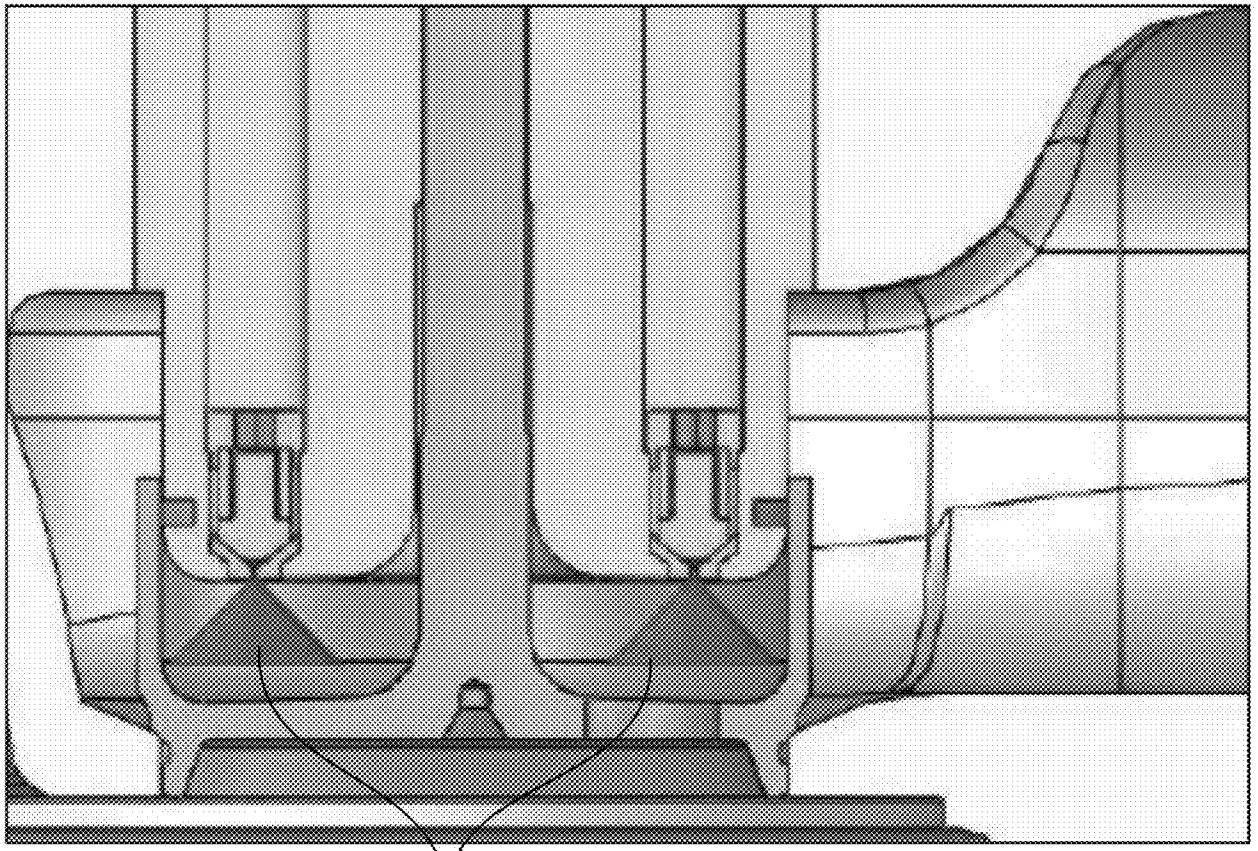
Figure 4C:
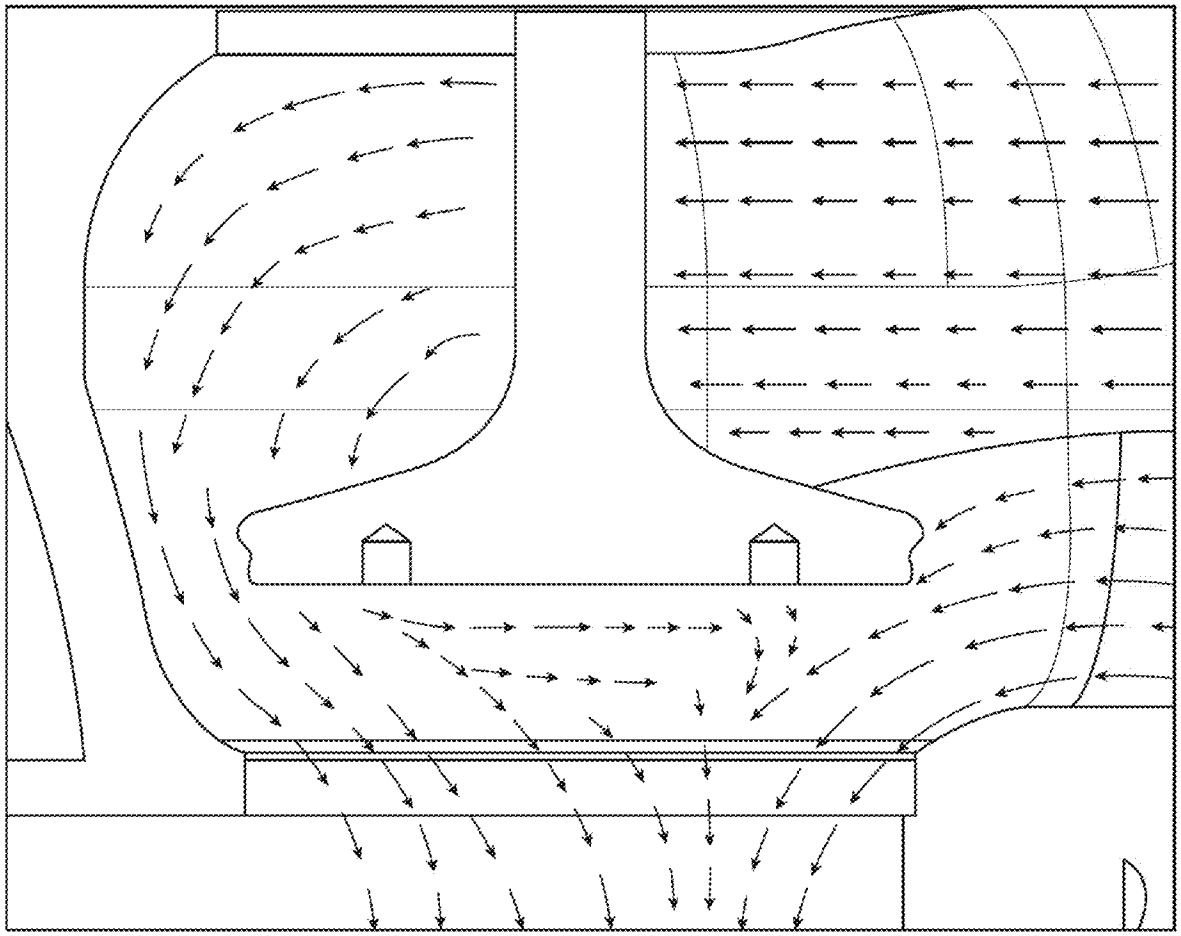
Figure 4C:
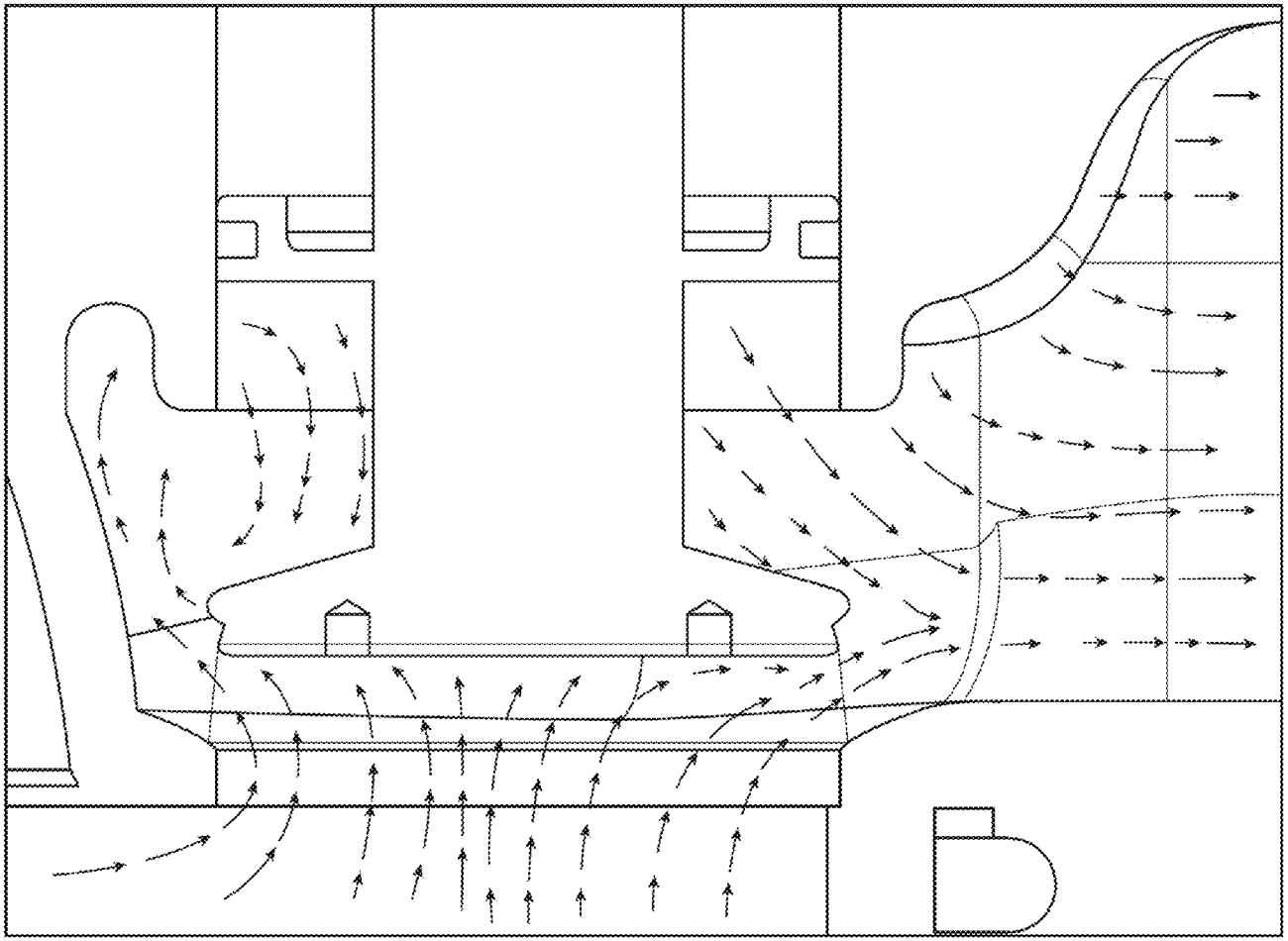
Figure 4C:
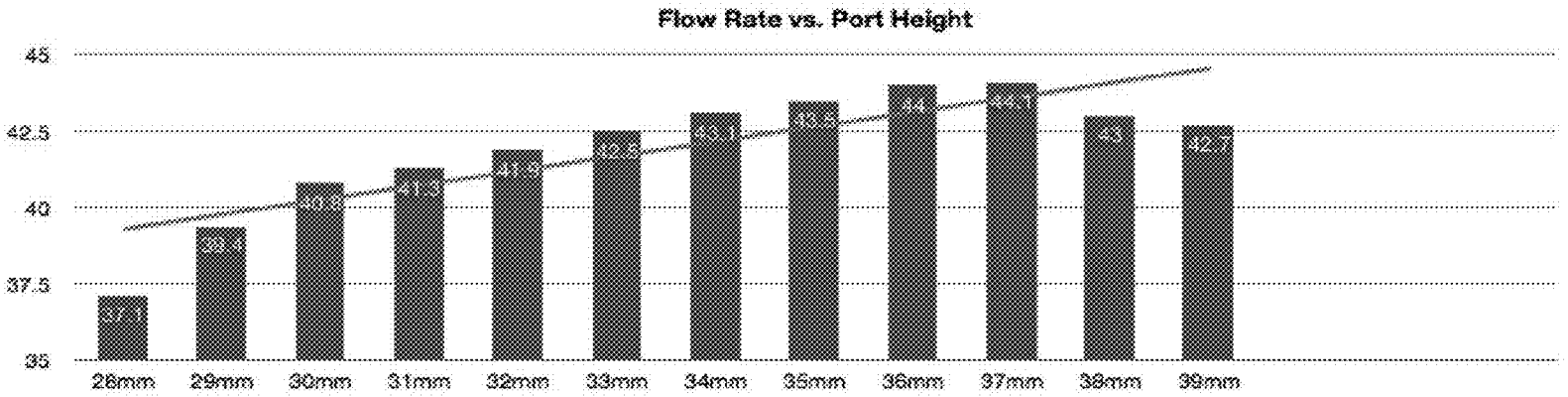
Figure 4D:
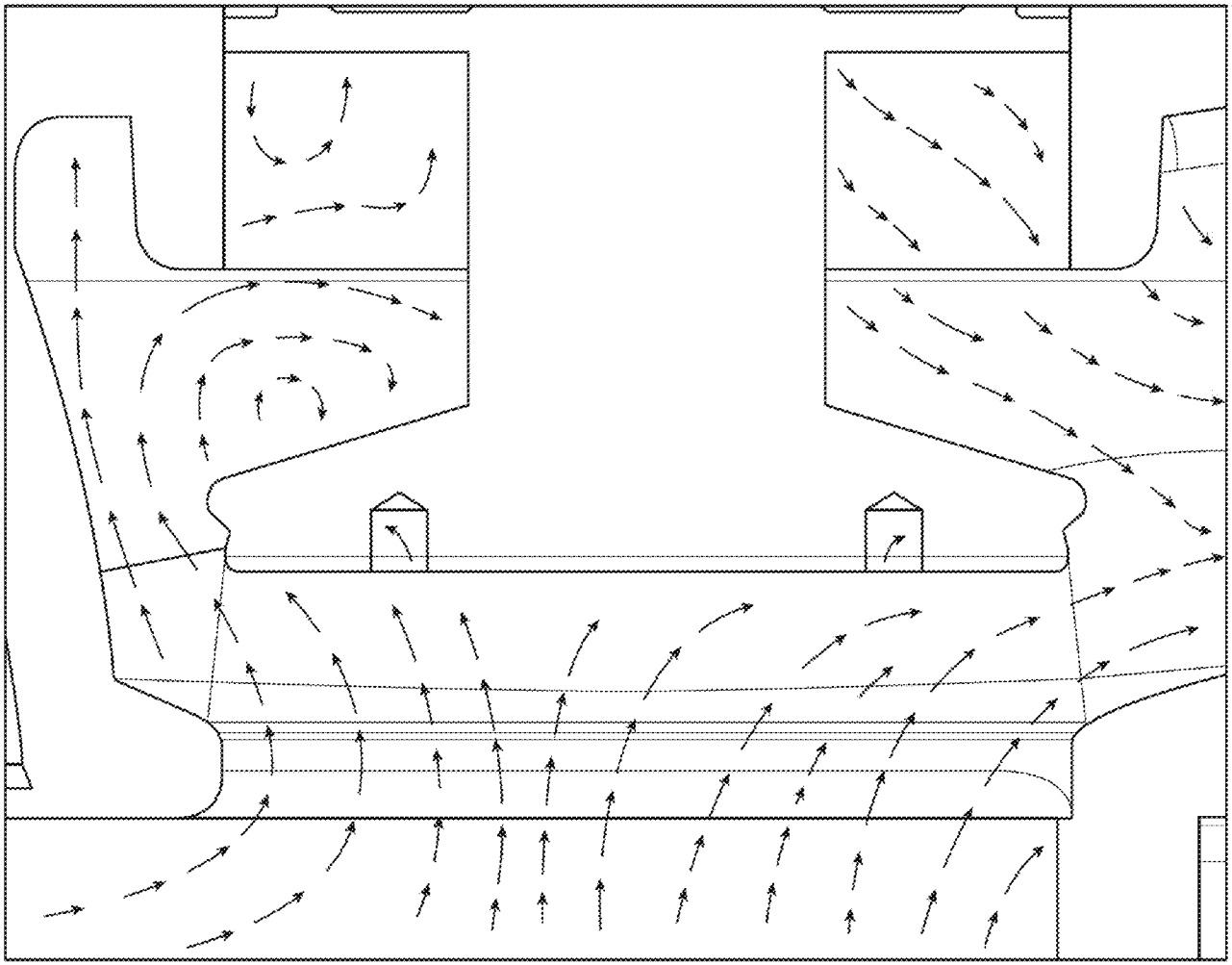
Figure 4D:
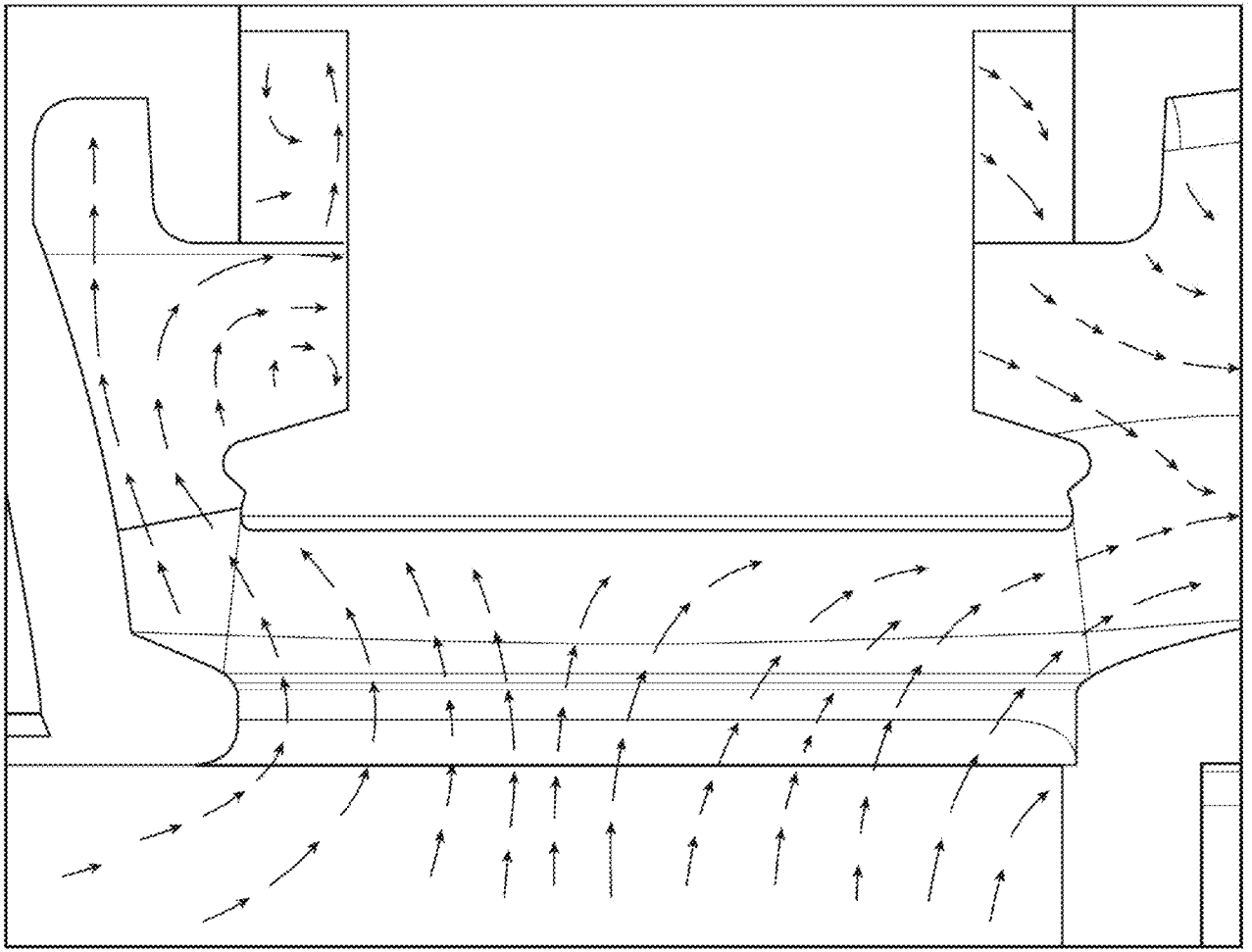
Figure 4D:
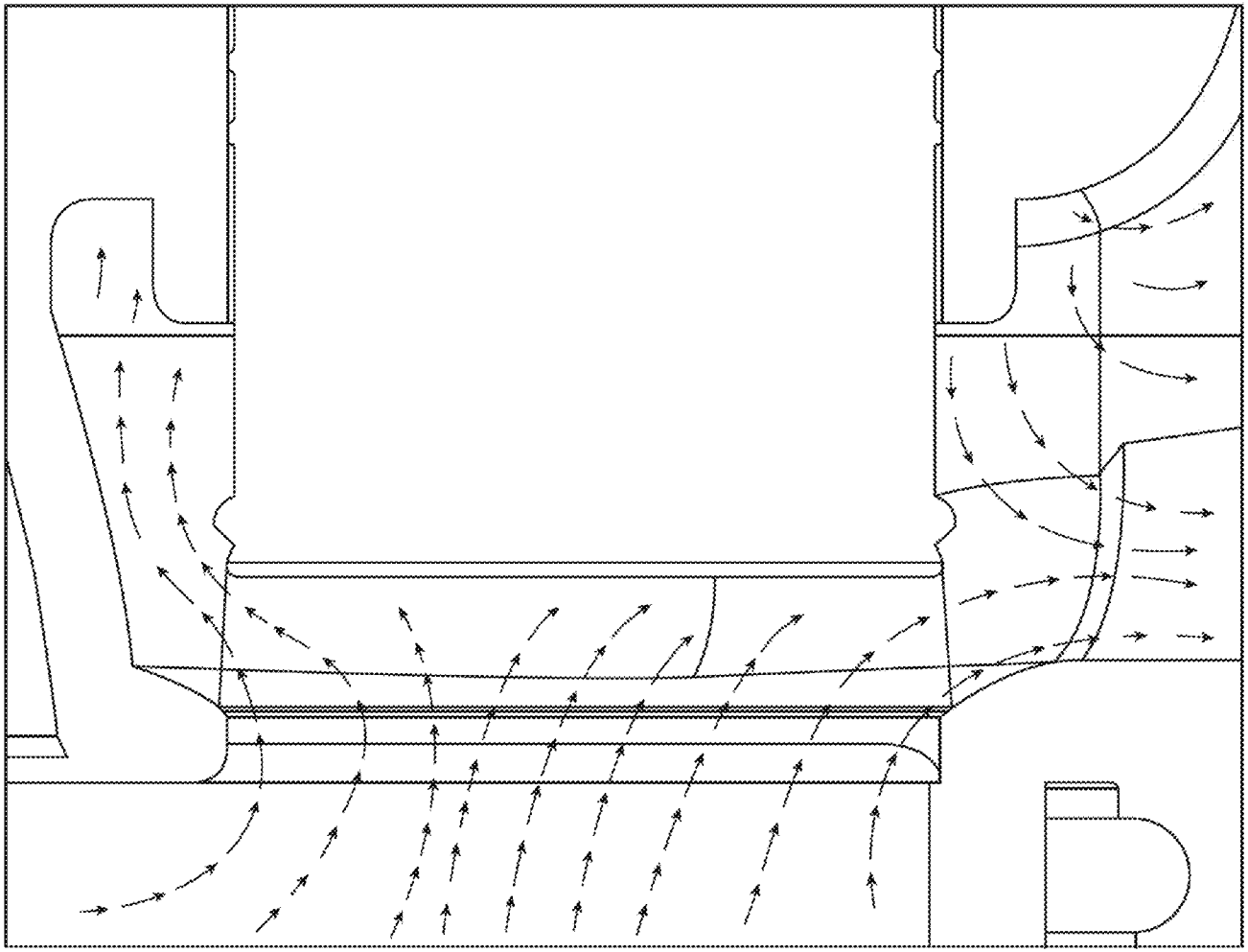
Figure 4D:
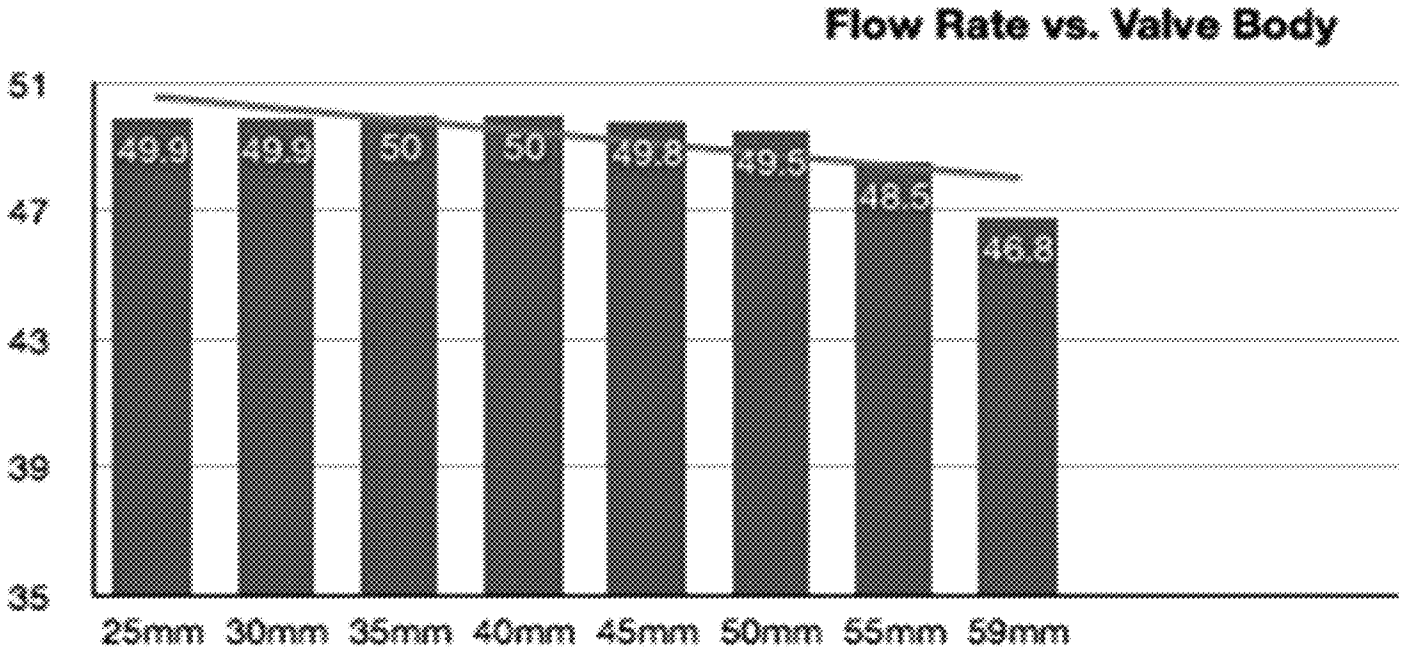

Crank considerations are summarized in the FIGS. 2C2*a*-2C4*d*. In particular, FIGS. 2C2*a*1-4 plot various cylinder forces resolved into horizontal and vertical, versus crank angle. FIGS. 2C2*b*1-4 plot Main 1 vertical forces and Main 2 vertical forces versus horizontal force, for systems having properties summarized as follows:

| | FIGS. 2C2a1-2; FIGS. 2C2b1-2 | FIGS. 2C2a3-4; FIGS. 2C2b3-4 |
|---|---|---|
| Vee Angle (°) | 180 | 180 |
| Crank Pin Phasing (°) | 0 | 180 |
| Layout, Strokes | Original layout, different Strokes | Horizontally Opposed, Pins at 180° |

Here, the Vee Angle refers to the angle between the pistons. The crank pin phasing refers to the angle of the elliptical long axis of the central eccentric portion of the crank pin. That eccentric portion is shown and discussed in connection with FIG. 2C7*c* below.

FIGS. 2C3*a-d* and 2C4*a-d* plot various properties versus crank angle, of systems having properties as summarized by the following table.

| Big End Bearing Sizing | FIGS. 2C3a-d | FIGS. 2C4a-d |
|---|---|---|
| Layout, Strokes | Original layout, different Strokes | Horizontally Opposed, Pins at 180° |
| Vee Angle (°) | 180 | 180 |
| Crank Pin Phasing (°) | 0 | 180 |
| Max Specific Load allowed (Mpa) | 60 | |
| Low pressure bearing diameter (mm) | 52.9 | 60.2 |
| Low pressure bearing width (mm) | 21.2 | 24.1 |
| High pressure bearing diameter (mm) | 106.6 | 107.0 |
| High pressure bearing width (mm) | 42.6 | 42.8 |
| Total Power (MW) | 0.29 | |

FIG. 2C5 shows that the apparatus may comprise a modular machine. The final layout would be driven by bearing loads and space considerations.

The Modular Unit is either the entire 2 or 3 stage machine assembly or just the cylinder assemblies. In which case 4 crankcase and crankshaft part numbers would cover the 1 MW power range in 250 kW steps. The particular embodiment of FIG. 2C5 shows the cylinders of high pressure stages having smaller volumes than the cylinders of low pressure stages.

Slightly different configurations are shown by the left hand apparatus, and the right-hand apparatus in FIG. 2C5. Specifically, in the left-hand apparatus the high- and low-pressure pistons alternate on the crankshaft. This can result in relatively tight spacing between the high and low pressure cylinders on the same side.

By contrast, in the right-hand apparatus of FIG. 2C5 the high- and low-pressure pistons are grouped together on the crankshaft. This can result in relatively wider spacing between the high and low pressure cylinders on the same side.

Under certain circumstances, potential failure of the crosshead pivot due to a lack of load reversal can occur. Specifically, in a reciprocating compressor high pressure occurs at TDC on every stroke. By contrast, in an engine this occurs only on every second stroke.

This can mean that the pin is always under load in one direction. Oil lubricating the pin may be squeezed out, resulting in possible eventual failure. Several embodiments can address this pin reversal issue.

FIG. 2C6 shows one embodiment featuring rolling contact between the end of the connecting rod and the lower face of the cross head. Also incorporated is a location member with an involute form so that the rolling elements are located to one another. To provide for occasional tensile loads between the cross head and connecting rod, a link member is provided with pivot pins at the center of the curved rolling contact surfaces.

Embodiments may utilize a crosshead pivot pin with modifications to the cross head pivot pin bore geometry in order to enhance lubrication opportunities, even though surface separation does not occur to allow oil ingress to the contacting areas.

A pin joint may be used with improved oiling, improved bore geometry, and/or a BDC unloading mechanism. FIGS. 2C7*a-c* show a simplified view of such a configuration according to an embodiment. In particular, the three rod assembly of this embodiment addresses the pin reversal issue by using the center or lifting rod to lift the piston assembly at BDC, thereby allowing oil to get into the pin joint again so it is ready for the next load event.

Figure 7A:
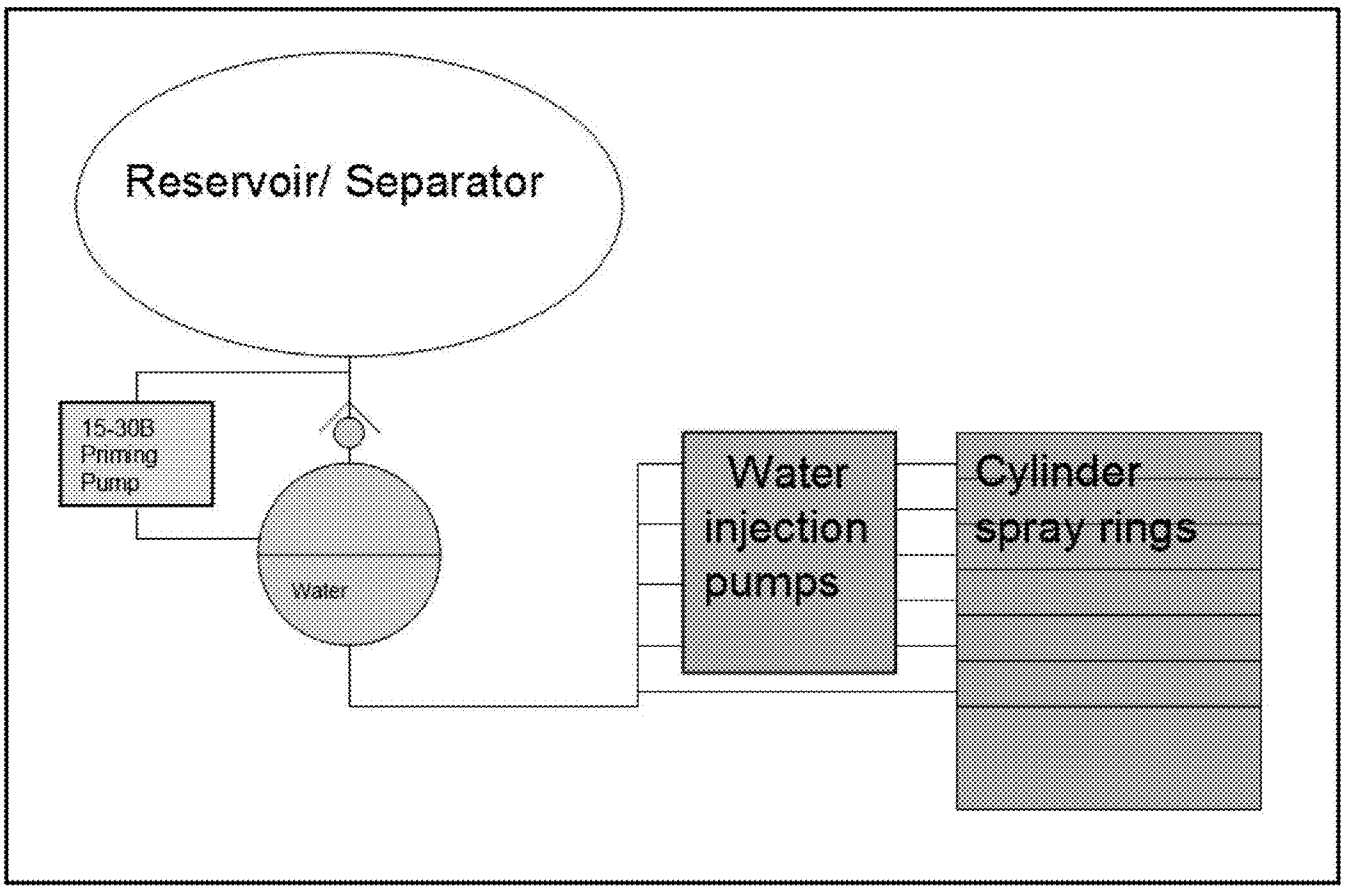
Figure 7B:
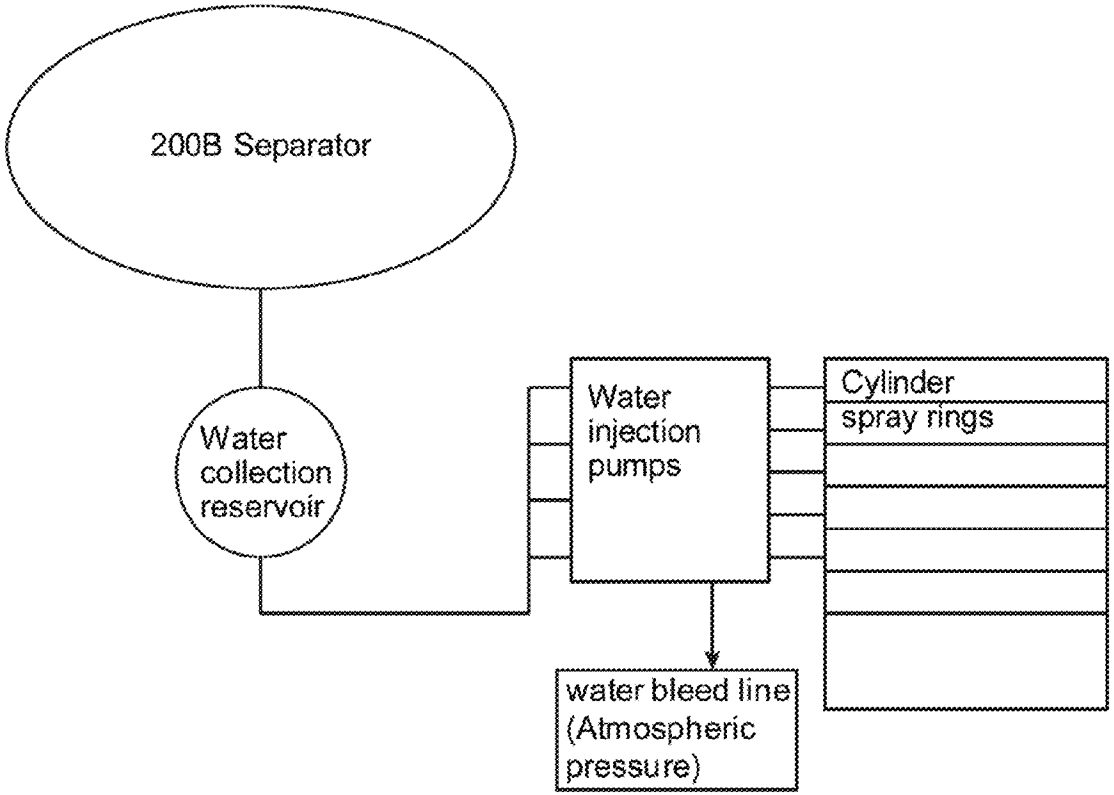

Specifically, FIG. 2C7*a* shows an assembled connecting rod comprising a center element C and end elements E. FIG. 2C7*b* shows just the center element C, which includes a channel configured to receive a lubricant. The element C may comprise a single part or multiple parts.

FIG. 2C7*c* shows an enlarged view of a connecting rod journal J. A middle portion of this rod journal defines an eccentric that is offset from the end portions. This eccentric is in contact with the element C in such a way as to cause C to lift the crosshead pivot pin relative to element E at the piston's lowest travel. This allows the ingress of oil to the contact surfaces between the cross head pivot pin and member E. Elements C and/or E may bear a channel to carry oil to the pivot pin interface.

Certain embodiments may employ a BDC unloading mechanism.

Figure 8A:
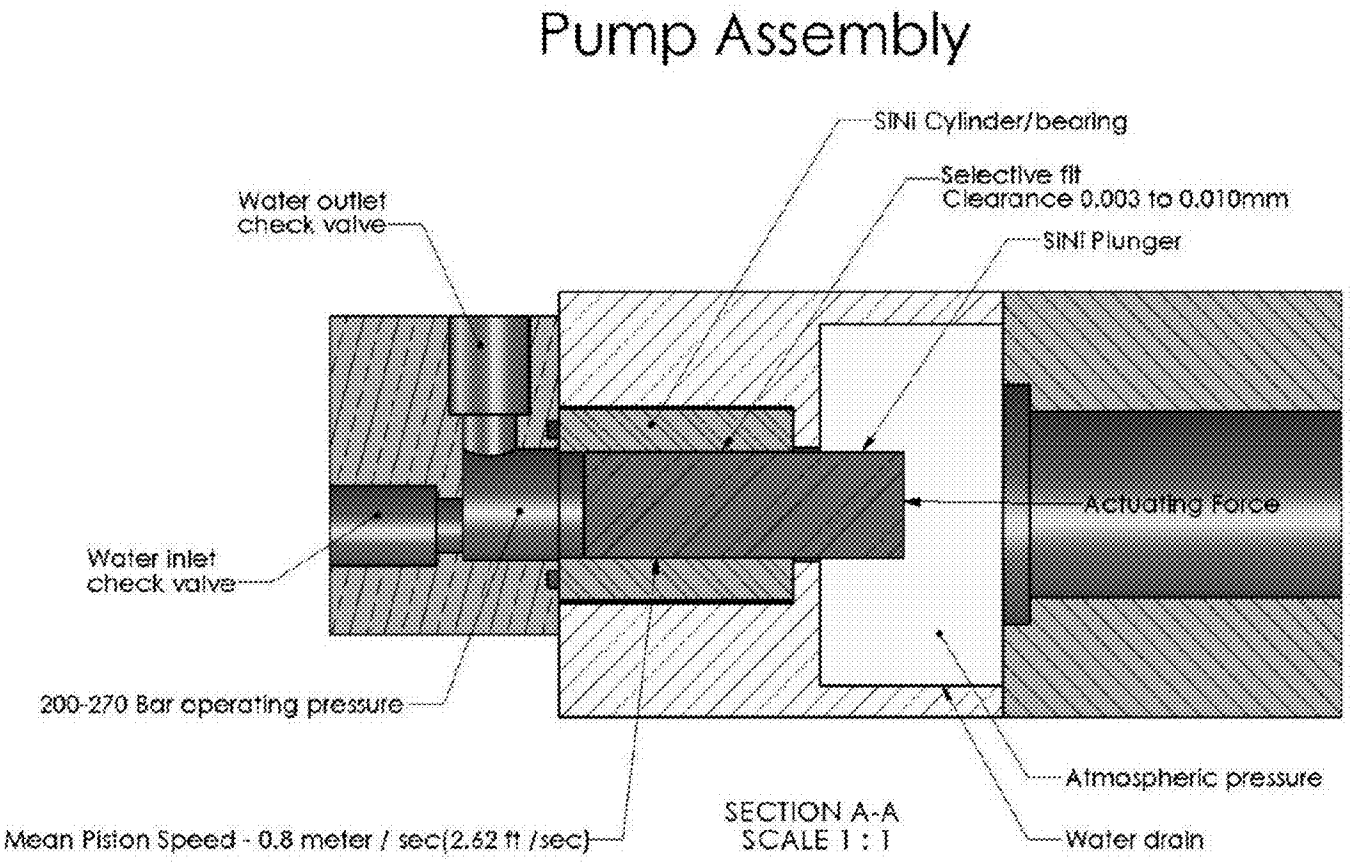
Figure 8B:
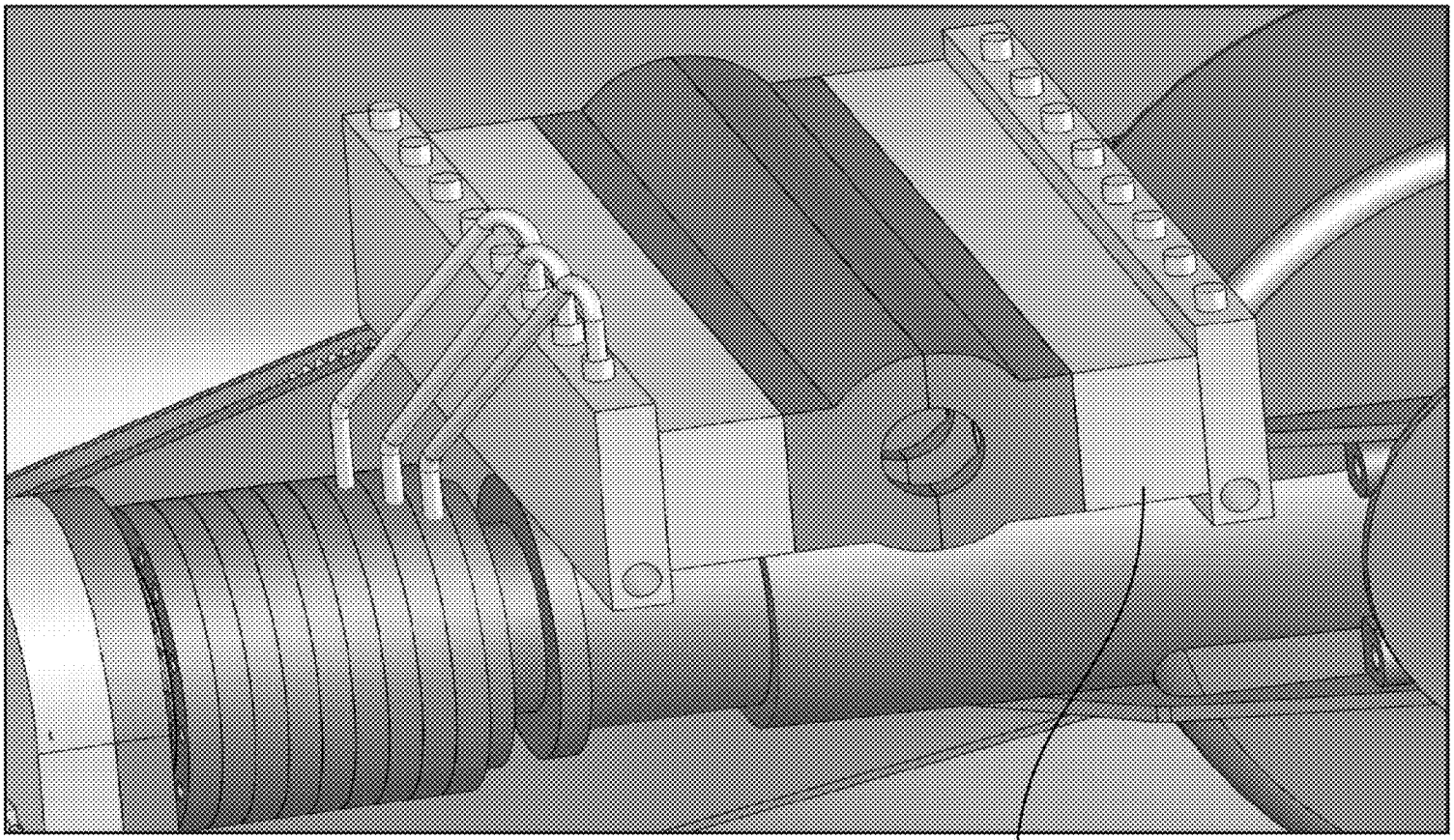
Figure 8C:
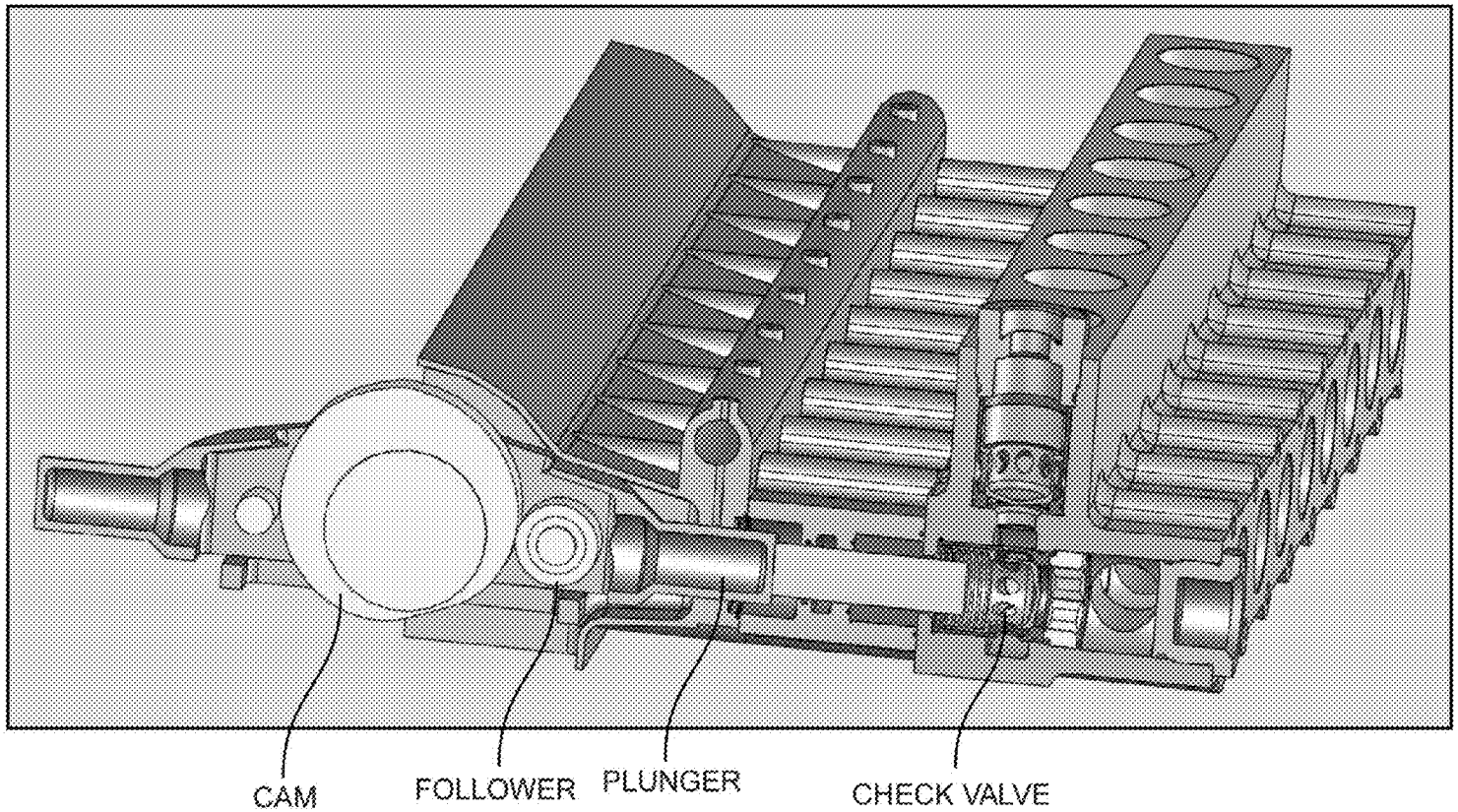

FIG. 2C8*a* shows a cross-sectional view illustrating a piston sealing principle. FIG. 2C8*b* shows the enclosed piston. FIG. 2C8*c* shows an enlarged view of one possible embodiment of a seal pack.

The use of a plunger, plus the crosshead design, separates side thrust loads from the sealing element (plunger), thereby prolonging seal lifetime. Placement of the seals as indicated also allows wall area to be used for spray nozzles, as it does not need to be continuous as if the seal was placed on the upper edge of the piston.

The following table lists sealing properties.

| Pressure | 6000 psi (400 bar) | |
|---|---|---|
| Speed | 16.5 ft/sec (5 m/s) | |
| Media-Temp compatibility | Min (F) | Max (F) |
| Hydraulic oil | −38 | 250 |
| Water based Emulsions | 40 | 140 |
| Water Glycol | −38 | 140 |
| Water | 40 | 210 |

Figure 9:
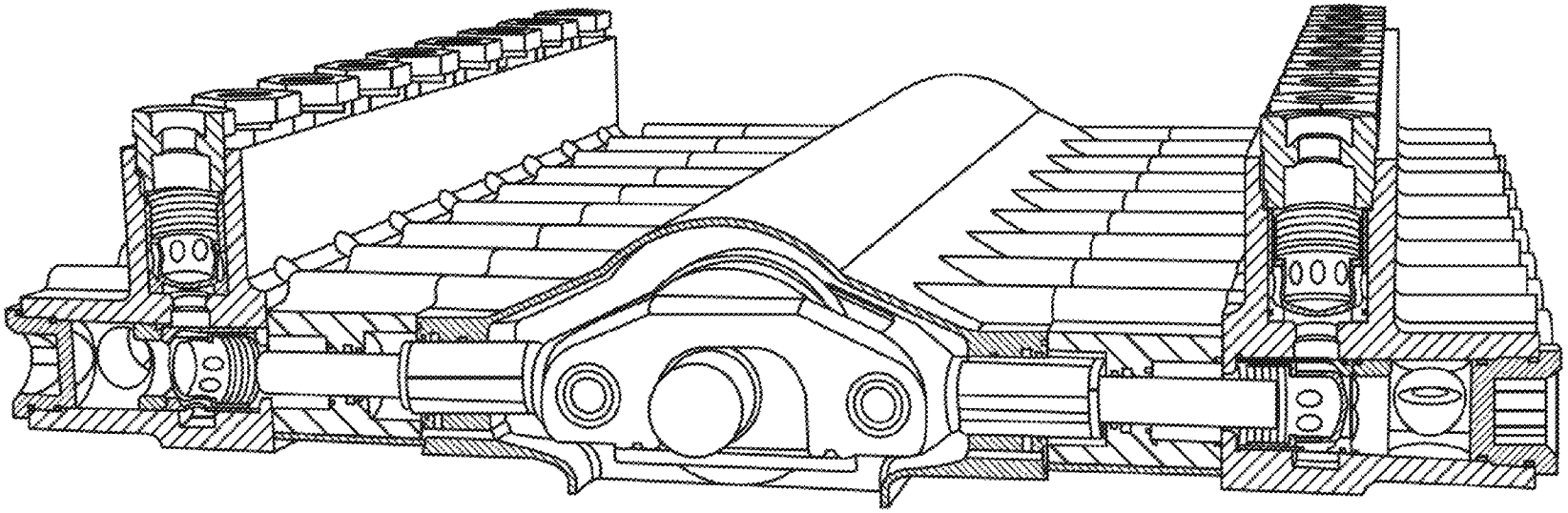
FIG. 9 is a simplified perspective view of an embodiment of a liquid pump.
Figure 9A:
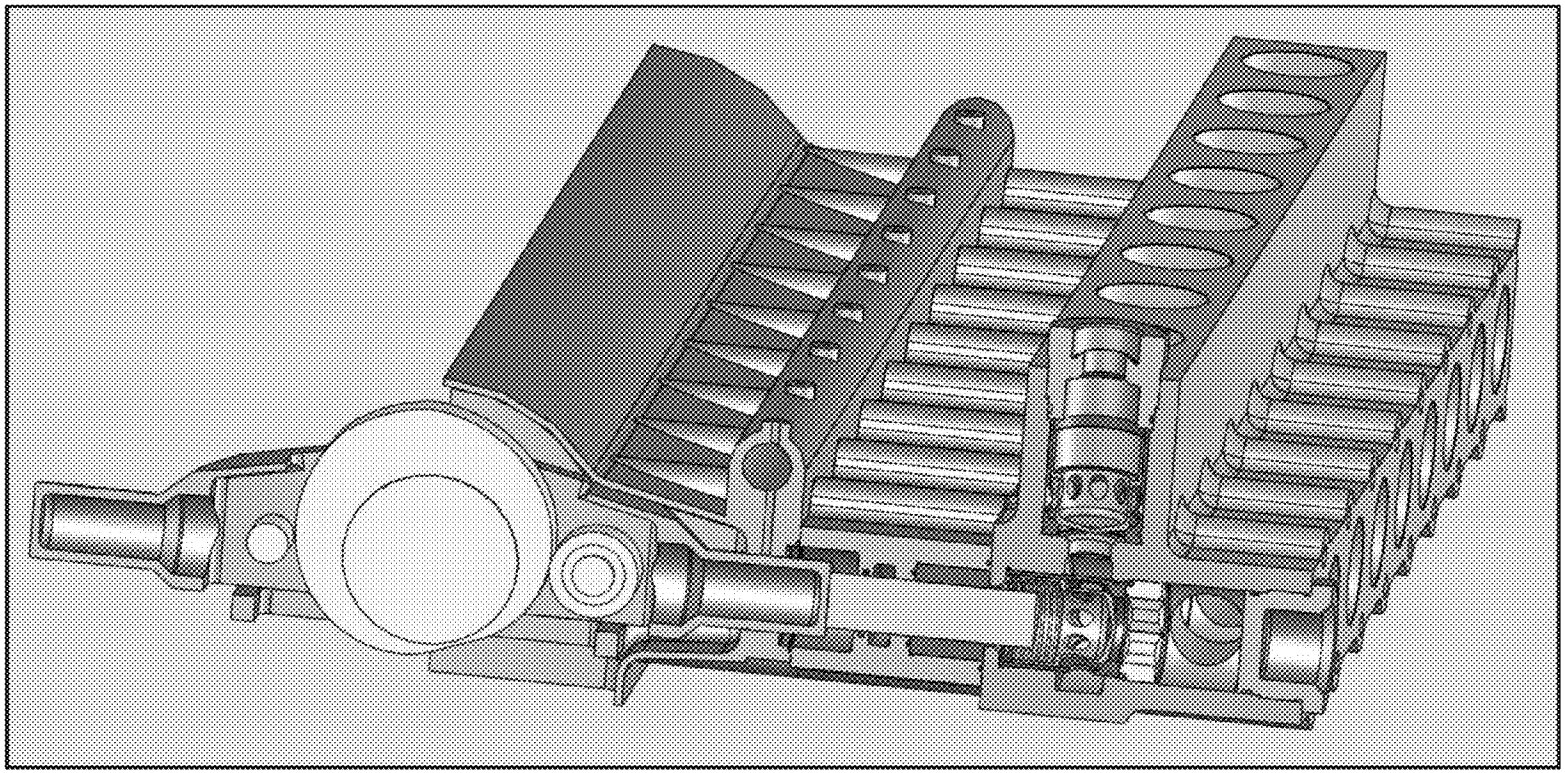

FIG. 2C9*a* lists in tabular form, properties of three- and two-stage embodiments under the following per-stage conditions:

RPM=1200; atmospheric air density=1.15 (kg/m$^3$);

valve pressure drop (fraction)=0.02; combined 1-way efficiency=0.8;

polytropic index=1.05; compression volumes/stage=1.

Figure 9B:
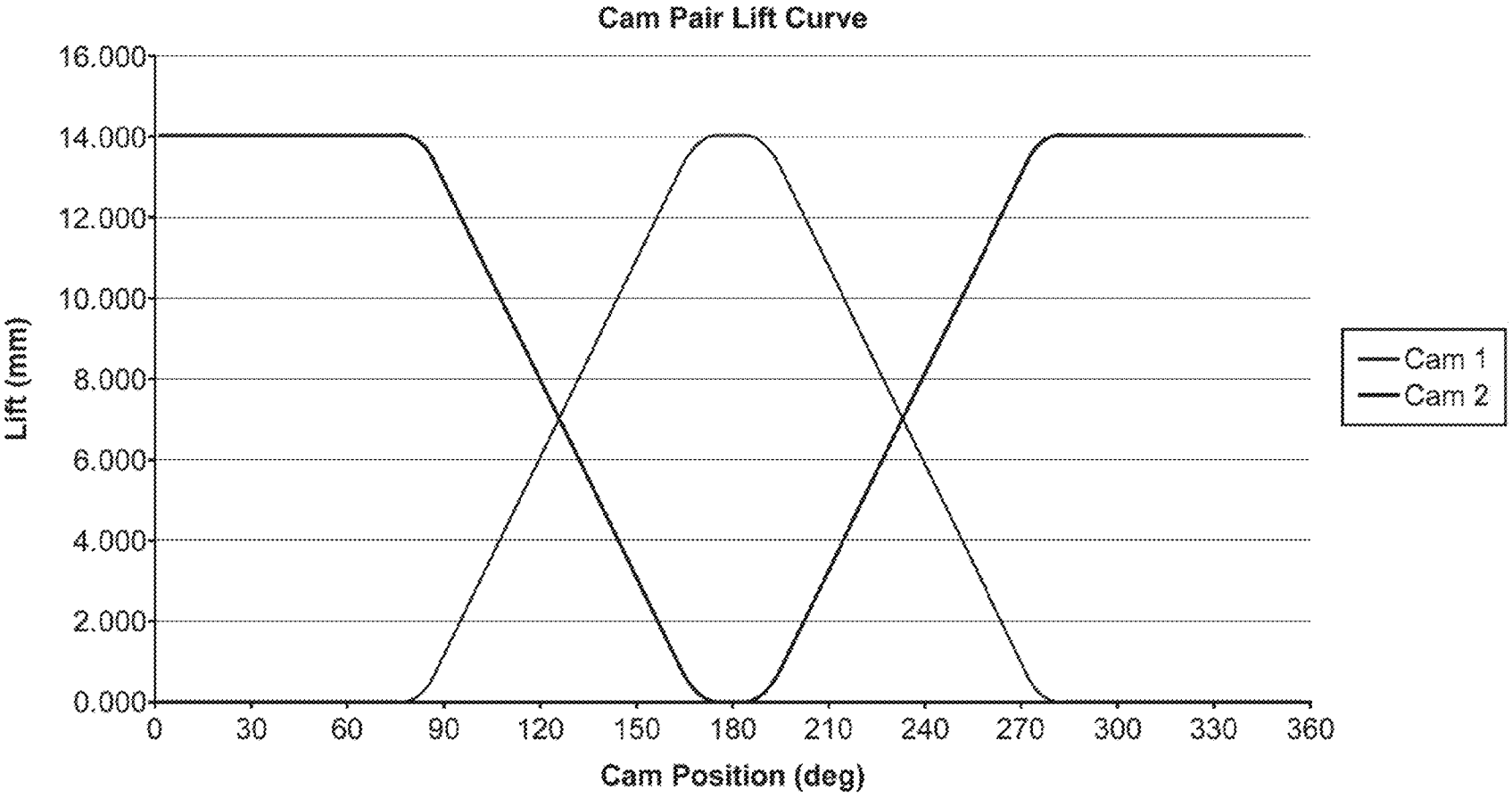

FIG. 2C9*b* lists in tabular form, properties of another three-stage embodiment. This embodiment features variable tank pressure, and six hours of expansion run time.

Charge Cooling or Aerosol Creation

FIG. 2D1 shows a compression/expansion stage comprising a piston reciprocating within a cylinder defined within a plurality of spray rings (right hand side) having spray orifices. These spray orifices are in fluid communication with a water gallery which is in communication with a respective liquid pump.

The use of a plunger piston and of a stationary seal in FIG. 2D1, provides a geometry which allows sufficient surface area for the number of nozzles within the spray rings, to correctly add the required water mass. The plunger plus the crosshead design, separates side thrust loads from the sealing element (plunger).

FIG. 2D2 shows a cut-away view of several spray rings within a cylinder according to an embodiment. An Ultimist™ nozzle available from BETE of Greenfield, Mass., or similar nozzle may offer a small package with high flow and potentially good droplet size <60 μm.

Spray Rings ease spray geometry changes, strengthen the part, allow development of timed sprays and make sprays flush mount. Use of a modular spray ring geometry allows different spray geometries in different portions of the cylinder and simple dead volume changes. The rings may be of variable thickness, for example ~200 mm or less. In particular embodiments a single spray ring may also be incorporated as one continuous cylindrical part perforated with spray nozzles, possibly surrounded by an outer water manifold.

Initially the charge is seeded with droplets during induction and compression, but timed sprays to reduce losses could be part of a development upgrade. Upstream seeding is also potentially possible, as are a few cylinder head mounted sprays. Rough calculations using Ultimist™ and 3:1 requires 120 nozzles.

One specific embodiment of a high pressure stage as in FIG. 2D1, allows a possible oil free geometry. This embodiment has a length of 1 m as shown, and is now oil free.

A larger cross head bore diameter allows better cross head support nearer the crank. The head bolts screw into cross head bore boss. The Rod to Piston connection is now deeper in the piston allowing a longer rod for the same overall machine dimensions.

FIG. 2D3 shows a different view of an embodiment of a high pressure stage.

FIG. 2D4 shows an overall view of a system level diagram of a test cell.

Valve Actuation

Gas may flow into and out of a chamber for compression or expansion, via a high pressure gas flow valve. FIG. 3A shows a simplified view of an embodiment of such a gas flow valve in the closed position. This specific valve embodiment employs shrouding, pressure balancing, four (4) cams, and valve forces as is discussed more in detail below.

In particular, details of the structure and operation of valve of FIG. 3A is provided below in FIGS. 4A1*a-b*. Briefly, the valve embodiment of FIG. 3A features an upper chamber that is in communication with the gas compression/expansion chamber via a channel (not shown in FIG. 3A, but shown in FIGS. 4A1*a-b*). The equilibration in pressure with the compression/expansion chamber afforded by the upper chamber and the connecting channels, provides a pressure balancing characteristic that reduces energy consumed for valve actuation. This approach also offers reduced actuation forces and seat contact stresses.

FIG. 3B plots flow through the valve of FIG. 3A, versus lift position (e.g. the height of the valve off of the seat. The desirable sharp transition of the curve at point P between a valve open and closed state, reflects the influence of the shrouding characteristic that is also discussed in detail below starting with FIG. 4A1*a*.

In this specific valve embodiment, Fpmax=60 kN no balance, Fopen=2.2 kN, and Fclosed=2.2 kN. Fpmax is the force acting on the valve stem and is partially balanced by the balance piston. Fclosed is the difference between the balance piston pressure force and the pressure force acting on the valve head. This force is holding the valve on the seat in the closed position. Fopen is the pressure force acting on the valve stem area holding the valve in the open position.

FIG. 3C1 is a perspective view showing the mechanism for actuation of the high pressure valve of FIG. 3A according to one possible embodiment. This valve actuation mechanism includes four cams and a rocker arm mechanism, and is discussed below. Another possible embodiment has a pivoted follower in place of the rocker follower.

FIG. 3C1 also shows the actuation mechanism for a low pressure valve. That low pressure valve actuation mechanism is further discussed below starting with FIG. 3C5*a*.

Discussion of the function and structure of various embodiments of gas flow valves to the high and low pressure sides, is now presented. FIG. 3C2*a* is a cross-sectional view of an embodiment of one stage 300 comprising a piston 301 configured to be moveable within a cylinder 302. In this view, the cylinder 300 is oriented vertically, with a cylinder head gearing 304 located at the top thereof. The cylinder head gearing includes gears for actuating both a dedicated low pressure side valve 306, and a dedicated high pressure side valve 308.

FIG. 3C2*b* is an enlarged view showing the dedicated valves governing flow to and from the high and low pressure sides of the embodiment of FIG. 3A. In this particular embodiment, the low pressure (LP) side valve 306 comprises a poppet 307 operated by a rotating cam 322. The high pressure (HP) side valve 308 comprises a poppet 309 that is operated between a pair of rotating cams 317 and 318.

The action of these cams relative to a crank of a piston reciprocating within the chamber, may be coordinated through physical connections. Examples of such physical connections include but are not limited to rotating shafts, gears (including multi-node gears), belts, chains, and rods etc.

FIG. 3C3*a* shows a perspective view of actuator mechanisms for embodiments of a dedicated low pressure side valve and a dedicated high pressure side valve. The low pressure side valve comprises poppet having a valve stem 311 that is actuated against an arm (follower) 312 by a spring 313. That arm may be actuated by a rotating cam not shown here, but illustrated and discussed in detail below in connection with FIGS. 3C5*a-e*.

Again, the action of the low pressure side valve may be coordinated relative to a crank of a piston reciprocating within the chamber, via one or more physical connections. Examples of such physical connections include but are not limited to rotating shafts, gears (including multi-node gears), belts, chains, and rods etc.

The high pressure side valve 308 comprises a poppet having a stem 319 connected to a linkage 314 featuring a flexure 315 (or pin joint), that is in communication with torsionally stiff pivoting cam follower 316 comprising a roller. Depending upon the specific embodiment, connection from the follower to the valve may be direct or via a link. The link may translate, or may translate and rotate.

While this particular embodiment of FIG. 3C3*a* employs a cam follower in the form of a roller, this is not required. In alternative embodiments the follower may be flat or curved, with a curved cam follower possibly reducing cam dimensions. Depending upon the particular embodiment, the cam follower may be of the pivoting or translating type.

Operation of the high pressure side valve is now discussed in detail. In particular, FIG. 3C3*b* shows a perspective view of an embodiment of cylinder head gearbox 320 for the embodiment of FIG. 3C3*a*. This view shows a demountable inlet mechanism unit.

FIG. 3C3*c* shows a perspective view of the gearbox of the embodiment of FIG. 3C3*a*, with the cover removed, for the high pressure side valve. This view shows the upper and lower cams of the high pressure valve are able to be removed, with the gearbox and shafts left in place so as to reduce overhaul time.

FIG. 3C3*d* is an exploded view showing interaction of a high pressure valve timing mechanism with the actuation cam assemblies. In this embodiment, valve phasing can be effected by electric actuators acting on the third element of the planetary gear train (or the position of a helical drive element in other embodiments). In particular, the independent operation of the stepper motor worm gears with the worm wheels via the planetary gears, allows movement of the concentric cams/cam lobes of the upper cam assembly relative to one another, while they are also being rotated by the shaft. Phasing of the high pressure valve could be dependent on factors such as reservoir pressure, power required, and/or operation in expander or compressor mode.

FIG. 3C3*e* shows a simplified side view of the upper and lower actuation cam assemblies employing a desmodromic (e.g. throw/catch) style of valve control over the torsionally stiff pivoting cam follower of the high pressure valve. This particular embodiment employs two (2) timed and phase-able cam pairs that independently control the valve opening and closing events.

The cam pairs are defined as follows. The opening cam pair comprises an upper and lower cam synchronized to rotate counter to one another and a similarly arranged closing cam pair.

In operation the opening event is executed by lifting the valve off the seat by the lower opening cam, and then slowing it and placing it onto the full open stop by the upper opening cam. After an adjustable delay (dwell time) the closing event takes place by first lifting the valve assembly off the full open stop with the upper closing cam, and then slowing the valve assembly before contact between the valve and the lower valve seat. By adjusting an amount of overlap of the cam lobes of the upper cam assembly, characteristics of the HP valve such as dwell time and opening time, can be controlled.

The opening cam pair can be timed to one another, but the timing may be moveable relative to the crank. This is also true for the closing cam pair.

Specifically, FIG. 3C3*f* plots a version of valve lift versus crank angle, for various operational configurations. The top plot of FIG. 3C3*f* shows that by operation of the timing mechanism to change the absolute position of the closing cam pair, the duration of the valve dwell or valve open time can be controlled.

The middle plot of FIG. 3C3*f* shows that by operation of the timing mechanism to change the absolute positions of both the Opening and Closing cam pairs the same amount, the point of commencement of valve operation (here P), can be controlled without affecting the dwell time. The bottom plot of FIG. 3C3*f* shows that by operation of the timing mechanism to change the absolute positions of the opening and closing cam pairs independently (e.g. moved different amounts), both the dwell time and the point of valve opening can be controlled.

The following Figures provide more detail regarding the structure of the high pressure valve actuating mechanism. FIG. 3C4*a* is a perspective view showing portions of the dedicated high pressure side valve according to an embodiment. Linkage 314 interacts via torsionally stiff pivoting cam follower 316, with two (upper and lower) cam assemblies 317 and 318. FIG. 3C4*b* and 3C4*c* are perspective and enlarged perspective views, respectively, showing the location of the pivoting cam follower between the cam assemblies.

Figure 4E:
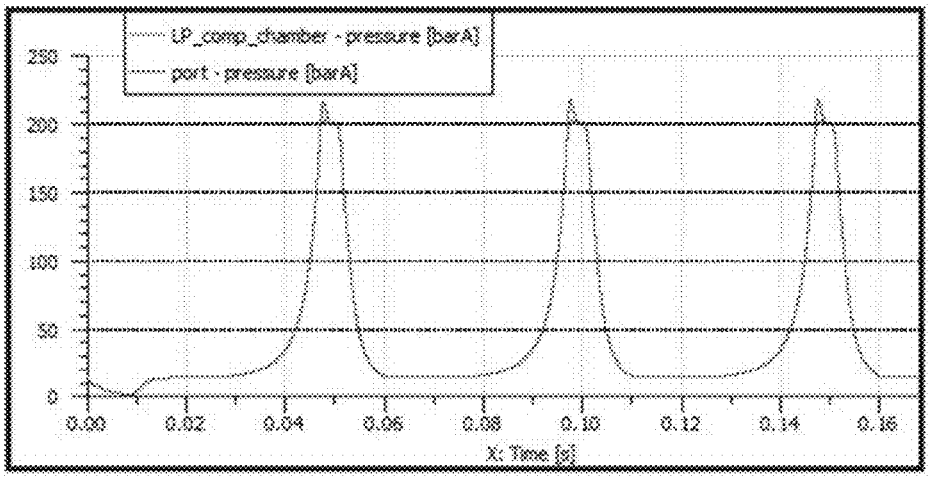
Figure 4E:
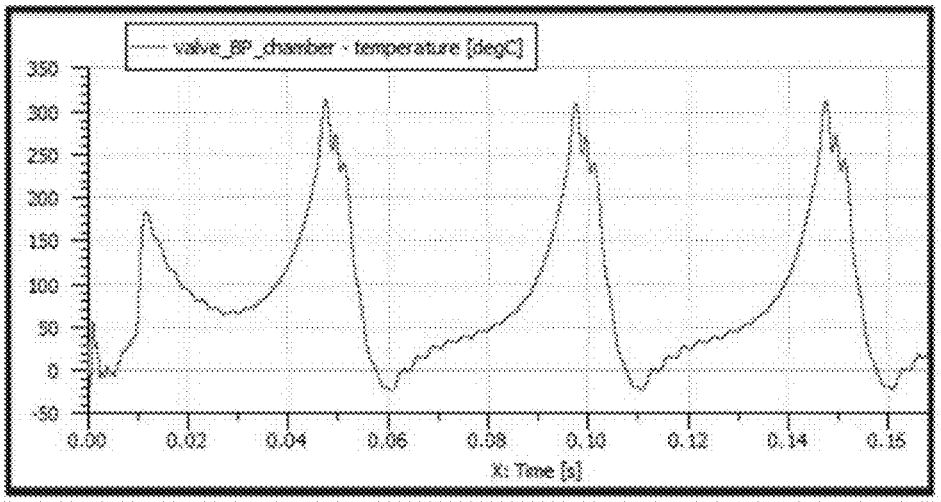
Figure 4E:
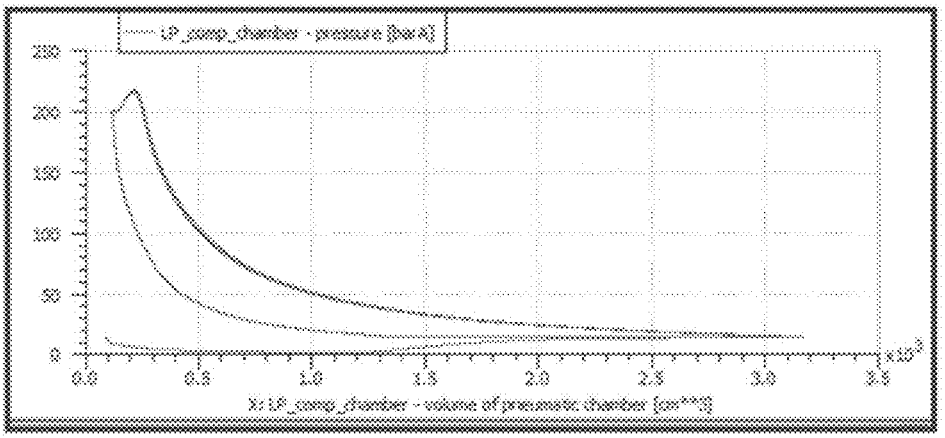
Figure 4E:
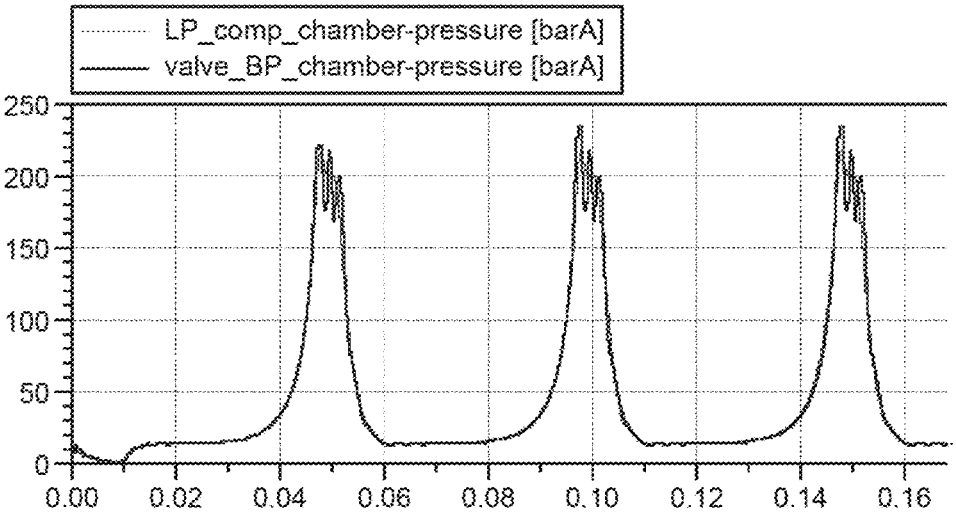
Figure 4F:
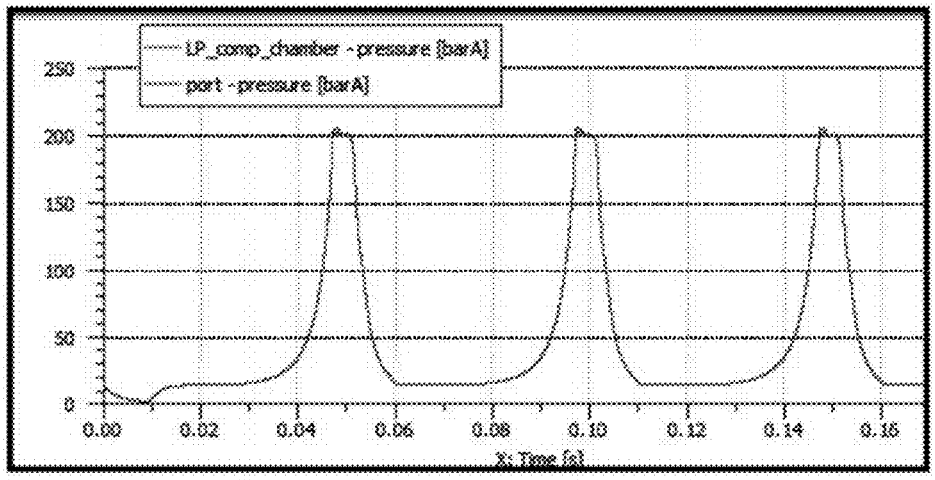
Figure 4F:
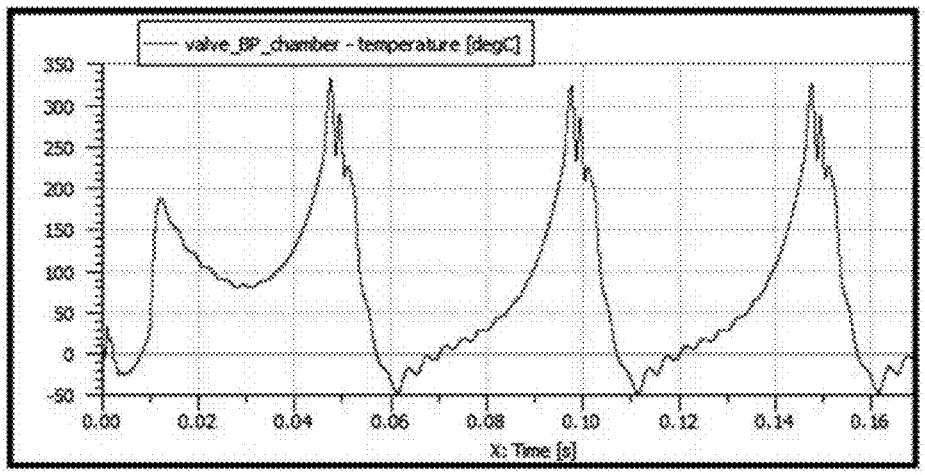
Figure 4F:
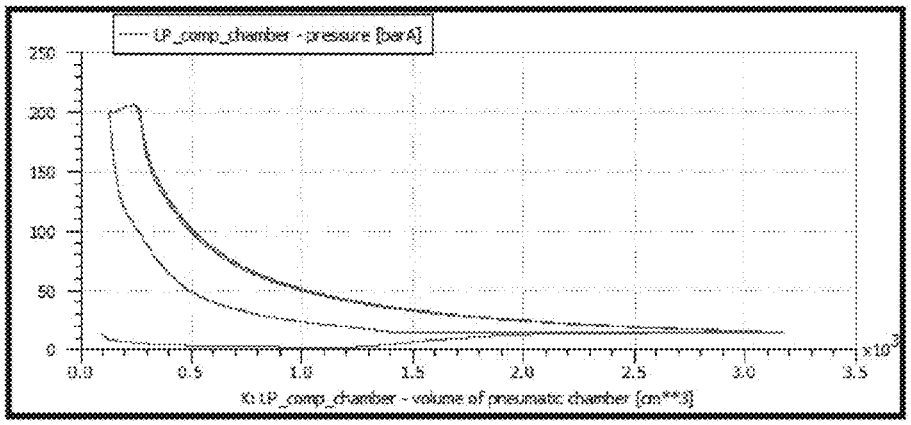
Figure 4F:
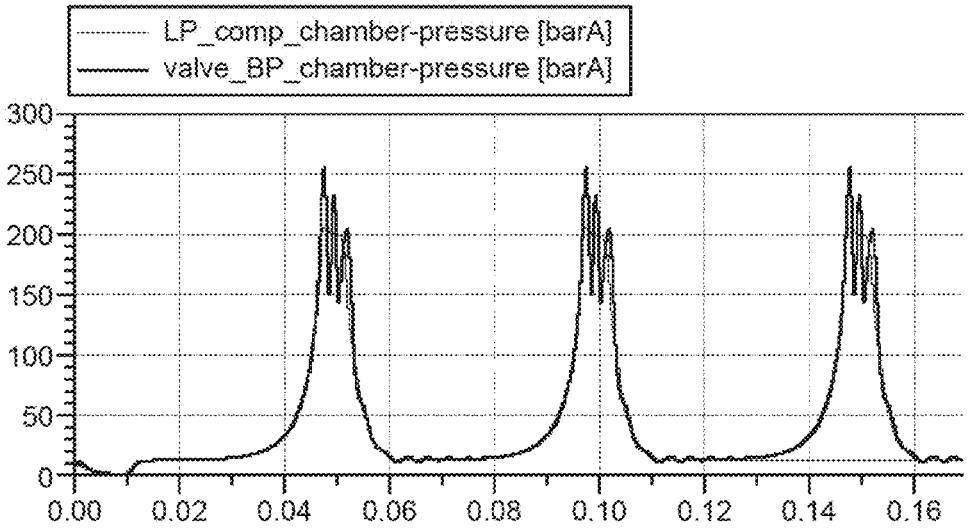

FIG. 3C4*d* shows a perspective view of an embodiment of the upper cam assembly 317 of the high pressure side valve. FIG. 3C4*e* shows a cross-sectional view of the upper cam assembly. FIG. 3C4*f* shows an exploded view of the cam assembly 317 of FIG. 3C4*d*.

While these figures show a particular cam assembly arranging the cam elements in a concentric manner, this is not required. Alternative embodiments could employ cam elements arranged separately.

This upper cam assembly of the high pressure side may be designed to maximize stiffness, for ease of serviceability, and/or to maximize cam timing variation.

FIG. 3C4*g* shows an exploded view of a cam timing mechanism 323 for the high pressure side valve. FIG. 3C4*h* shows a cross-section of an embodiment of the cam timing mechanism 323 of FIG. 3C4*g*.

While these figures show the cam elements being driven by a mechanical phasing mechanism in the form of planetary gearboxes, this is not required. Alternative embodiments could employ other arrangements, including but not limited to helical drive elements.

FIG. 3C4*i* shows an embodiment of the linkage to the cam follower of an HP valve, including a flexure 315 and a collet 320. The presence of the flexure avoids the mass of a pin joint. In certain embodiments, the flexure is 2.5 mm thick, and the tensile load in the eye is 5000N tensile and 6N lateral to give 0.443 mm sideways deflection, +/−0.25 mm required.

FIG. 3C4*j* is an enlarged view of an embodiment of the collet 320 of the interface of FIG. 3C4*i*. The collet 320 with a safety groove clamps on the valve stem without a stress riser feature in the stem.

The collet design of FIG. 3C4*j* may reflect one or more design aims. One objective is to keep the stem small in order to reduce "floating open" forces. Another objective may be to minimize stress risers (e.g. threads or grooves to allow a smaller stem). The collet design may also provide a safety failure in case of valve mis-timing in order to spare the cam mechanism.

Other approaches can also be used to connect the valve to the mechanism. One example is a pin joint.

Figure 5A:
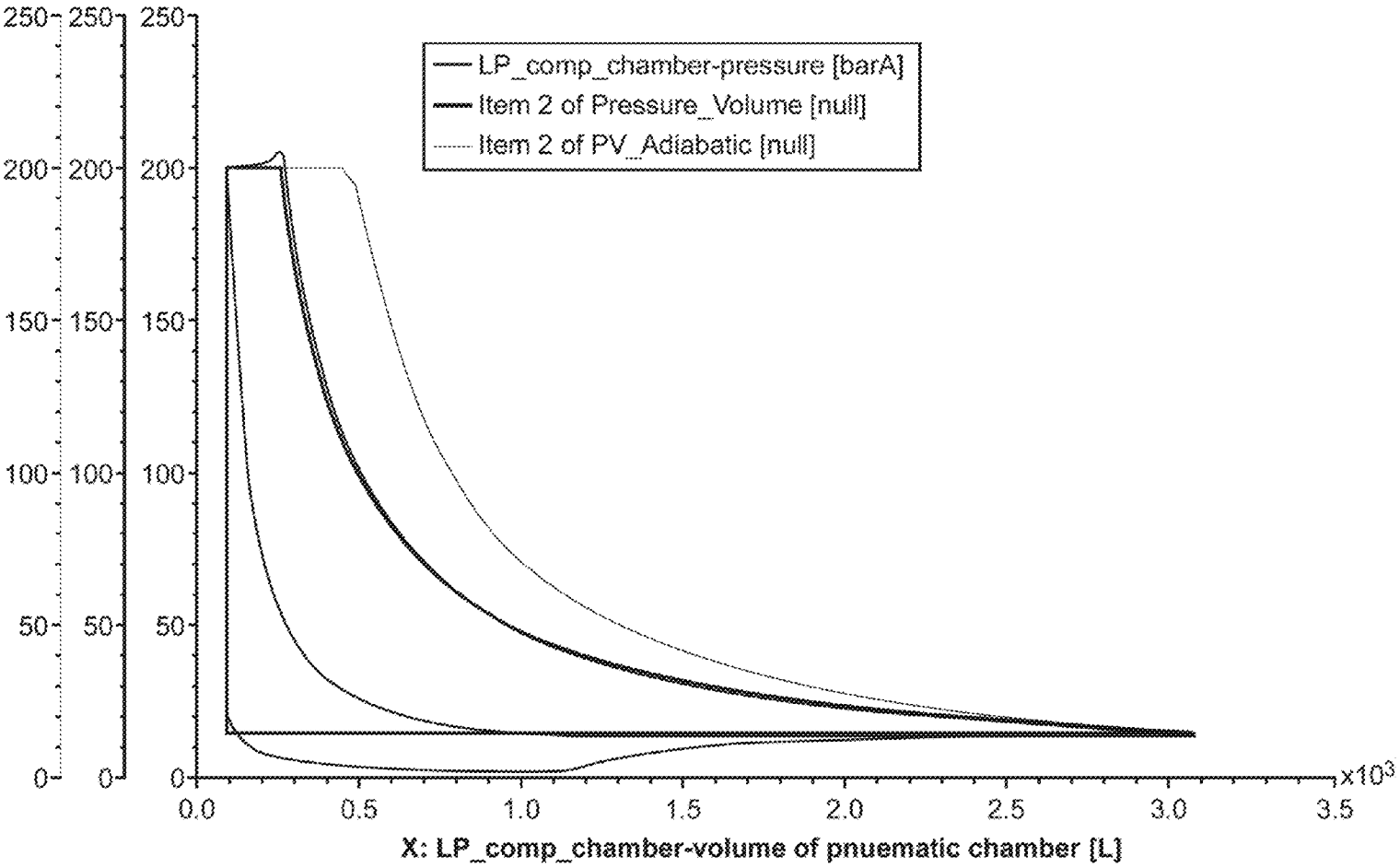

FIGS. 3C5*a-e* show various views of an embodiment of a dedicated low pressure (LP) side valve including the actuation mechanism. In particular, FIG. 3C5*a* shows a perspective view of a low pressure side valve 306 including spring 313 pressing against plate 319 and causing rod 311 and arm 312 to be biased upward such that the poppet engages the valve seat from below in the closed position.

Figure 5B:
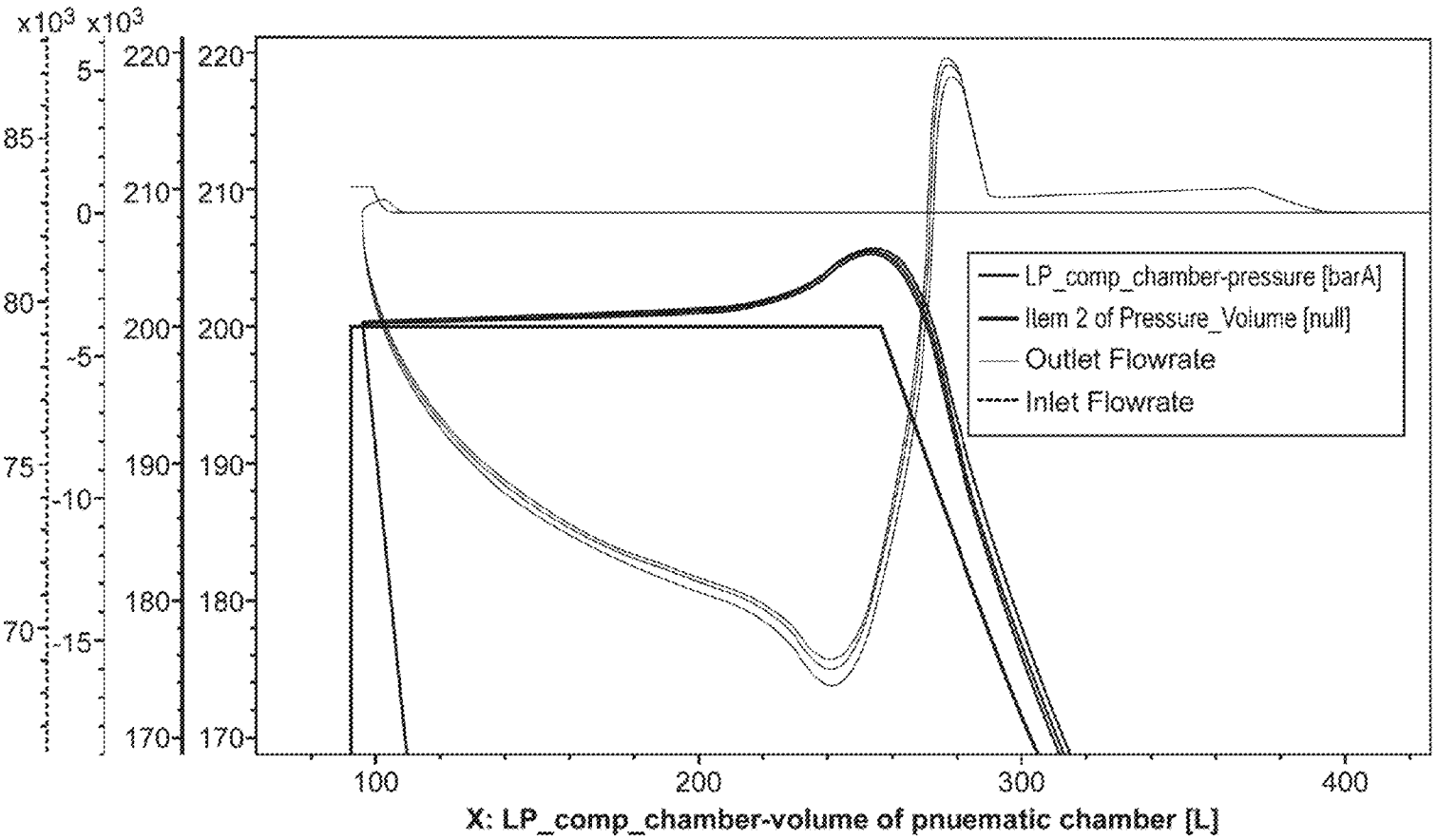

FIG. 3C5*b* shows a cross-sectional view of the low pressure side valve of FIG. 3C5*a*. This view shows the oil seal and guide bush package protect 330, and a seal pack 331 that is removable with the head on the machine.

The oil seal prevents lubricating oil from leaking out of the valve mechanism housing. The seal pack prevents the escape of air. These two functions can also be carried out by one seal. The guide bush, 330 also reacts the sideward force of the follower.

Figure 5C:
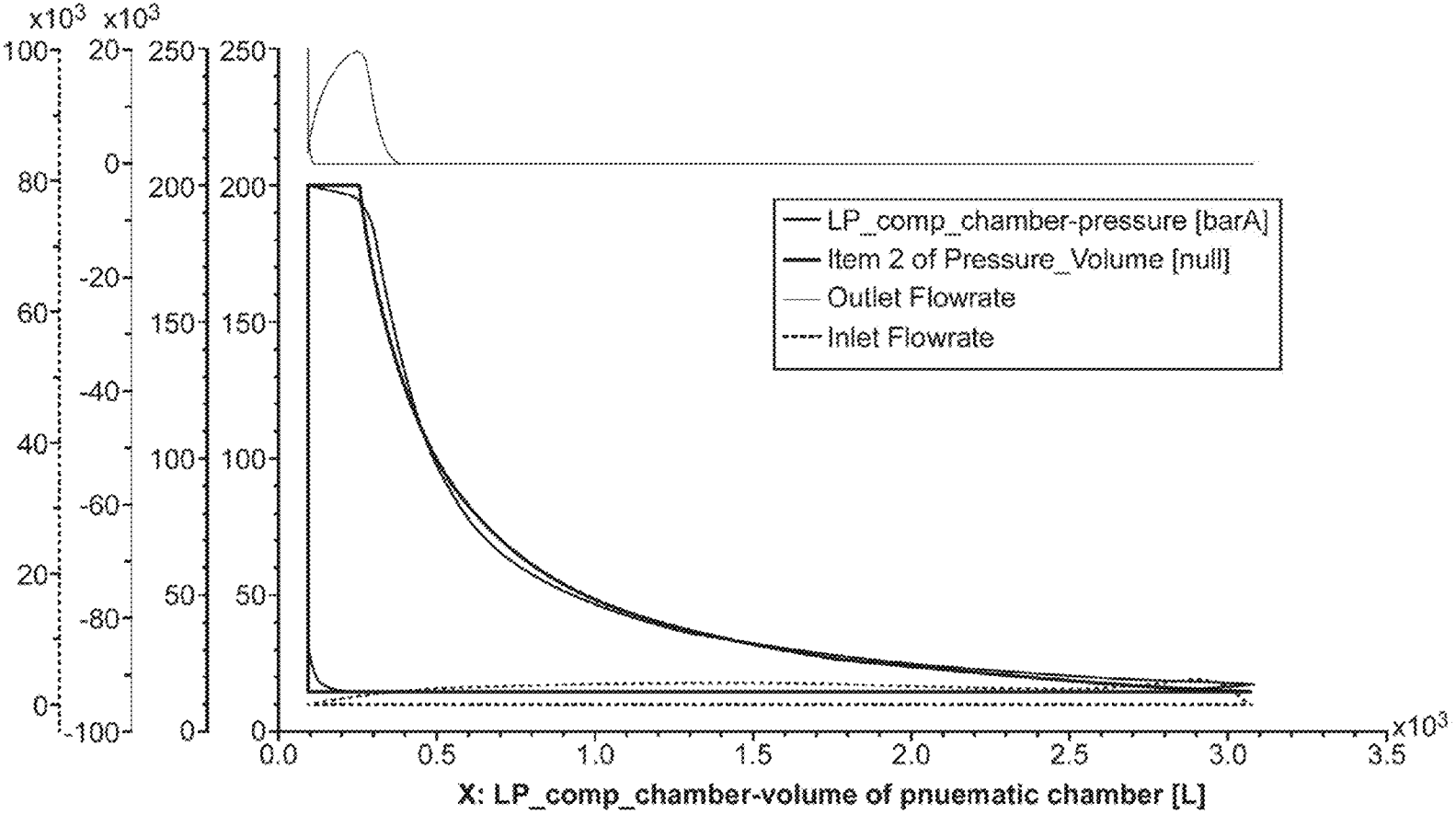
Figure 5D:
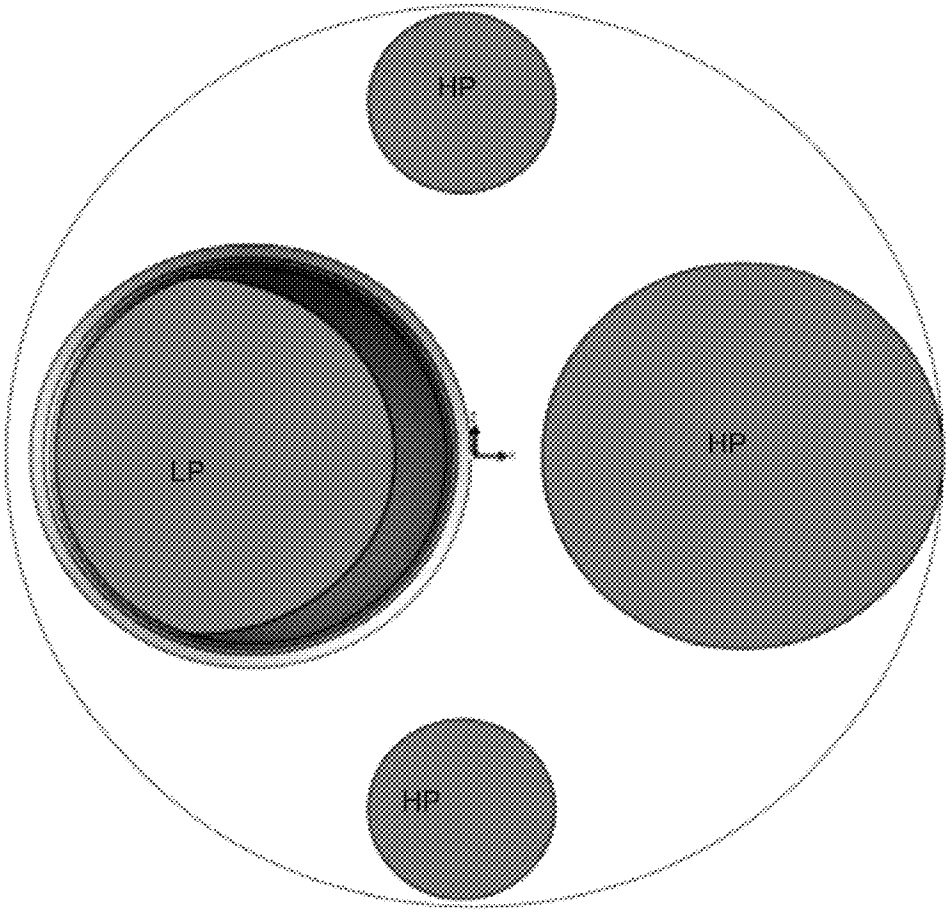
Figure 5D:
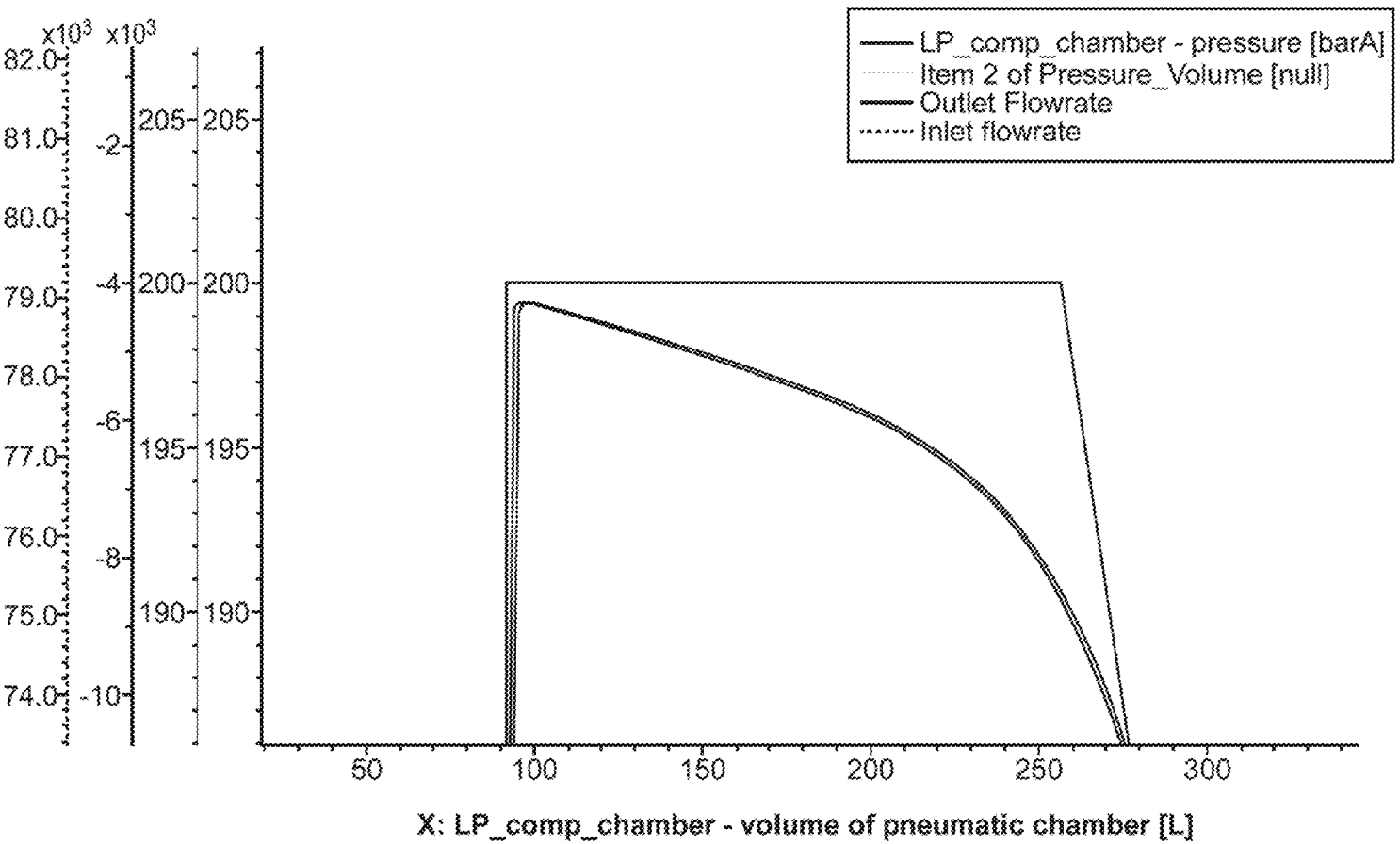
Figure 5D:
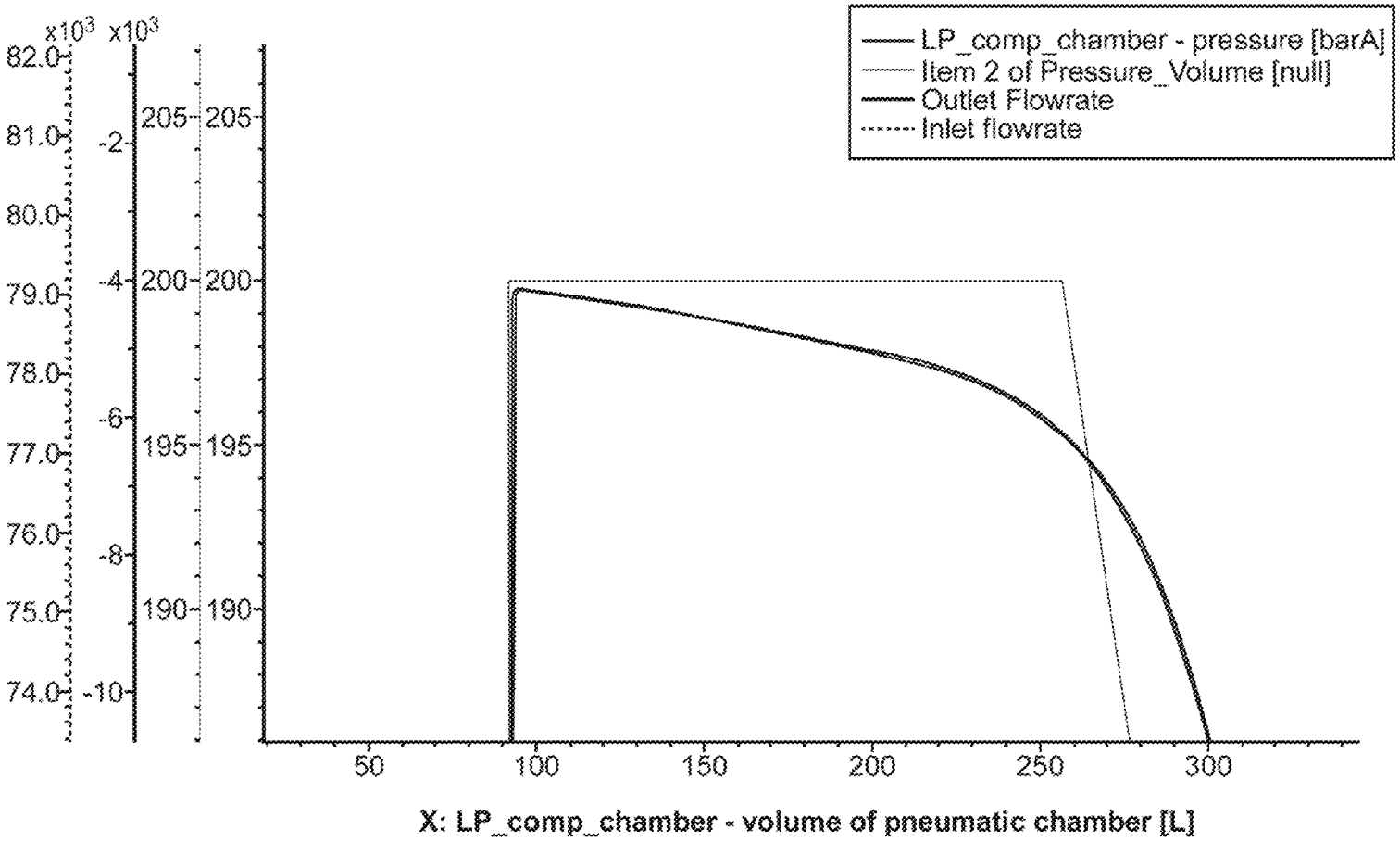

FIG. 3C5*c* shows an end view of an embodiment of an actuation mechanism 325 of the low pressure side valve, including independently rotatable cams 326, 327 that are configured to engage arm 312, move the rod down, and compress the spring to open the LP valve. FIG. 3C5*d* shows a perspective view of the LP valve actuation mechanism.

FIG. 3C5*e* shows a cross-sectional view of a valve timing mechanism for the LP valve. A planetary phasing mechanism on the LP valve cams allows changes to dwell time and/or phasing.

In a manner analogous to the timing mechanism for the high pressure valve, LP valve actuation is effected by two cams whose relative lobe positions are controlled by phase change devices (such as a planetary gearboxes or helical members). These two cams, in conjunction with spring and/or pressure return for the cam follower, independently control the opening and closing event timing. A flat or curved translating cam follower may be used, depending upon the particular embodiment.

Returning now to the specific embodiment shown in FIG. 3C1, FIG. 3DA is a plot showing operation of the valves of FIG. 3C1 in the compressive mode. FIG. 3DB is a plot showing operation of the valves of FIG. 3C1 in the expansion mode.

FIG. 4A1*a* shows a simplified view of one embodiment of such a gas flow valve which may be suited for a high pressure stage, in the closed position. FIG. 4A1*b* shows a simplified view of this valve embodiment in the open position.

The valve 400 comprises a poppet 402 between the chamber (at pressure $P_c$) and a high pressure side (at pressure $P_h$). The poppet comprises an upper portion 403 that is configured to engage with a valve seat to create a seal, and a lower shroud 405 that is configured to project within an opening of the valve seat. The shroud functions to occupy the opening in the valve seat at times when the poppet is experiencing lower acceleration (e.g. immediately after the opening poppet disengages from the valve seat, and immediately before the closing poppet engages with the valve seat). In this manner, the shroud serves to sharpen an opening/closing profile of the valve (e.g. as shown above in FIG. 3B).

A stem portion 404 links the poppet to an upper plate portion 406 present within an internal space 408 that is in fluid communication with the chamber through channel 410. A rod 412 is in communication with the outside, and is exposed to ambient pressure ($P_a$). Seal 420 blocks gas flow around the upper plate portion (and hence between the chamber and the high pressure side when the valve is closed).

The valve 400 is designed to operate such that along an actuation axis Z, it experiences forces due to pressure that are substantially balanced. This allows for valve actuation with a reduction in force and hence energy consumed.

FIG. 4A1*a* indicates particular dimensions (areas A#) of specific portions of this gas flow valve. In particular area A1 of the upper plate, and a shroud area A5 of the poppet, are exposed to chamber pressure. Only smaller area A2 of the rod is exposed to the external ambient pressure. Upper area A4-A3 on the poppet is exposed to high pressure side pressure ($P_h$), as is the lower side of plate 406, area A1-A3.

Performance of this valve embodiment in compression/expansion environments was modeled. In particular, the modeling was of a cylinder having the following characteristics:

200 mm stroke;

140 mm bore diameter;

High Pressure (HP) valve diameter: 60 mm;

HP valve lift: 18 mm;

DeadVolume/SweptVolume=0.03;

1200 RPM.

The simple model of cylinder pressure was developed utilizing certain assumptions:

no leakage, no heat exchange with walls;

polytropic indices of compression and expansion curves are set to 1.05 (model does not account for water drop, heat transfer, etc);

valves are either fully open or fully closed (discontinuous valve area profile);

air flow rate through the valve is determined based on piston motion;

pressure drop across valves were determined based on air flow rate and effective valve flow area, and discharge coefficient;

pressure in the chamber (above the poppet) is exactly equal to cylinder pressure;

line contact between poppet and seat;

no valve advanced/delayed opening/closing (either 0° or 180°).

FIGS. 5A-C, which are PV diagrams showing chamber conditions under this model, are discussed further below.

FIGS. 4A1*c-j* plot various system properties under this model. For example, FIG. 4A1*c* plots cylinder pressure versus crank angle in compression.

An analysis of resulting forces on the high pressure valve at various points in the compression or expansion cycle, was then undertaken. As indicated above, the valve was assumed to be either fully open or fully closed.

Dynamics of the system was not considered and simplified fluid thermodynamics was assumed. Drag force on the valve varies as the valve position changes, though its effect was neglected. Friction force was also neglected.

This simplified model was used to determine how much force is required to keep the valve open or keep it closed. It also showed whether the force on the valve is applied by the cam or the valve seat.

When fully closed, the resultant force on the poppet due to pressure followed the following ideal pressure profile:

$$\text{Force}=(P_h-P_c)*(A4-A1)-(P_c-P_a)*A_2 \quad (1)$$

Here, the crossed-out terms are of negligible magnitude as compared with the other terms. For example, ϵ represents the magnitude of the pressure drop through the conduit connecting the internal valve chamber with the chamber.

When the valve was fully open with air flowing into/out of the cylinder, the resultant force on the poppet due to pressure followed the following ideal pressure profile:

$$\text{Force}=-(P_h-P_c)*A1-(P_c-P_a)*A2+ \quad (2)$$

Again, the crossed-out terms are of negligible magnitude compared with the first two terms.

These equations (1) and (2) show the ability to design a valve with components having areas exposed to various pressures, in a manner that balances the forces experienced by the valve. Such valve designs can substantially reduce actuation force(s) and thereby enhance efficiency of a compressed gas energy storage system.

In FIGS. 4A1*d-j*, solid lines indicate conditions within the chamber with no valve open thereto; dashed lines indicate the chamber with at least one valve open. FIG. 4A1*d* plots force on a valve embodiment versus crank angle, in compression. In this valve embodiment, the valve dimension (area) A1=A2. This corresponds to a typical poppet valve lacking a balancing chamber. The forces on the valve in this configuration are seen to be higher than those in a balanced valve embodiment.

FIG. 4A1*e* plots net pressure force acting on an embodiment of a closed balance valve (A1=0.95A4) versus crank angle in compression. FIG. 4A1*f* plots force on this closed valve versus crank angle on expansion.

FIG. 4A1*g* plots force on this open valve versus crank angle on compression. FIG. 4A1*h* plots force on this open valve versus crank angle on expansion.

Force on the valve may depend on line contact versus surface contact. FIG. 4A1*i* plots force on an open valve versus crank angle with line contact (60 mm diameter of contact line). FIGS. 4A1*j* plots force on an open valve versus crank angle with surface contact (58 mm and 60 mm diameters of inner and outer contact circles). Comparison of FIGS. 4A1*i* and 4A1*j* indicates that the force needed to lift/push the poppet changes by only about 20 N.

FIG. 4A2*a* shows a simplified cross-section of another embodiment of a gas flow valve which may be suited for a high pressure stage, in the closed position. FIG. 4A2*b* shows this gas flow valve embodiment in the open position.

This particular embodiment also utilizes balancing characteristics, but with revised geometry. Specifically, the stem is as big as the balance piston, and the balance piston seal is external rather than internal. Under certain conditions, the balance chamber could receive water to reduce the dead volume.

The gas flow valve embodiment 450 includes a shroud 451, whose function is as described previously. The gas flow valve embodiment 450 is also of a curtain design, wherein actuation of the valve along the axis Z, results in flow of gas through the valve in a different direction that is opened or blocked by the presence of a curtain portion 452. As in the embodiment of 4A1*a-b* previously described, the internal space 454 of this valve is in fluid communication with the chamber through passage 455, and hence is configured to experience substantially the same pressure ($P_c$) as in the chamber, thereby reducing energy required for actuation. A seal S prevents unwanted leakage of gas between the internal space and the high pressure side along the curtain portion, when the valve is in the closed position.

FIG. 4A3*a* shows a simplified cross-section of still another embodiment of a gas flow valve which may be suited for a high pressure stage, in the closed position. FIG. 4A3*b* shows this gas flow valve embodiment in the open position.

The gas flow valve embodiment 460 includes a shroud 480, whose function is as described previously. The particular gas flow valve 460 of FIGS. 4A3*a-b* is of a vented curtain design, wherein the passageway to the chamber of previous embodiments has been replaced instead by vent(s) 462 present in the poppet portion 461 of the valve. In a manner similar to those previous embodiments, the vent(s) serve to substantially equalize the pressure difference between the valve interior and the chamber, thereby reducing the amount of energy required for valve actuation along the axis Z (which is different from the direction of gas flow through the valve). As with the previous embodiment, curtain portion 464 is selectively moveable to allow or block gas flow between the chamber and the high pressure ($P_h$) side.

The valve design of FIGS. 4A3*a-b* further includes a shroud member 480. The shroud serves to change the profile of effective valve area versus time as the valve opens, to attain a sharper opening profile.

The gas flow valve embodiment of FIGS. 4A3*a-b* offers one or more possible benefits as compared to the previous valve embodiments. One is simplified design, in that the channel equalizing pressure between chamber and valve interior, can be eliminated.

Another potential benefit offered by this embodiment is reduction in valve dead volume. Specifically, the valve portions 470 project into the interior valve space 472 to substantially occupy its entire volume in the valve open condition (as shown in FIG. 4A3*b*).

According to certain embodiments, a gas flow valve may be equipped with sprayer to promote gas-liquid heat exchange within the compressor or expander. FIGS. 4BA-BB show views of a valve embodiment as in FIGS. 4A3*a-b*, that is equipped with spray nozzles.

According to some embodiments, it may be desirable to reduce a height of the port to the valve, in order to minimize valve height and reduce dead volume. FIGS. 4CA-CB show flow through valves having different port heights. FIG. 4CC plots flow rate versus port height for different embodiments.

In particular embodiments, it may be desirable to increase valve stem diameter in order to reduce stem load and stresses. FIGS. 4DA-DD show the results of a CFD investigation of the effect of valve skirt diameter versus flow. In particular, FIGS. 4DA-DC show flows through valves having different valve bodies. FIG. 4DD plots flow rate versus valve body for different embodiments.

Acceleration and any effect of valve motion on machine operation may be checked. FIGS. 4EA-ED show various characteristics of a valve embodiment utilizing 8 mm lift, 220 Bar overshoot, 25° valve half period, mild shrouding, −20 to +310° C. Temp change in the upper (balance) chamber, and no HT coefficient applied. FIGS. 4FA-FD show various characteristics of a valve embodiment utilizing 15 mm lift, 210 Bar overshoot, 25° valve half period, mild shrouding, −20 to +310° C. Temp change, and no HT coefficient applied PV Diagrams The pressure-volume profile within the cylinder according to certain embodiments may be understood with reference to the following PV diagrams.

In particular, FIG. 5A plots pressure versus volume for the compressor mode according to an embodiment. FIG. 5A specifically provides a comparison between: n=1.05, n=1.4, and the Modeled result. This figure shows that the low pressure (LP) valve delta P was achieved fairly easily.

FIG. 5B shows an enlarged view of pressure versus volume at the low volume/pressure conditions of FIG. 5A. In FIG. 5B, the LP Valve area=0.2×Bore area or 62 mm. The actuated HP Valve Area=LP Valve area, and the automatic HP Valve=25 mm×2.

HP Valve timing may be important to prevent pressure overshoot or excessive back flow if only passive valves are used. The presence of automatic, passive high pressure valves can provide a safety feature and additional flow during compression.

FIG. 5C is a PV curve with the expander mode running In this Figure, Heat transfer is modeled as proportional to water volume in the cylinder, at HP valve open and TDC there is not much water available, so the heat transfer coefficient (HTC) must be increased from 0.7 (Compressor Mode) to 2 and result still does not match target n=1.05 perfectly. Water inlet temp matches air in temp and is 3 degree higher on exit for Compressor mode, Expander mode is 20 degrees higher at start to allow some heat engine advantage. The PV diagram is much closer to the simple idealized PV with much more area than compressor mode with dead volume losses. LP Valve opening was 80 degrees for Compressor Mode but needs faster opening (60 degrees) otherwise cylinder pressure drops below LP reservoir at BDC.

FIG. 5D shows valve sizing according to an embodiment. In particular, FIG. 5D shows the cylinder head from the perspective of the piston, with the low pressure valve (LP) opening in the direction of the chamber, and hence located in a recess so as not to interfere with the piston. The active high pressure (HP) valve opens in a direction away from the chamber, and hence is not recessed.

Slight valve timing errors can affect the cylinder pressure a lot in Compressor mode. For safety need automatic HP valves. These may be combined with actuated valve heads or separate as currently schemed. Accordingly the smaller circles in the view of FIG. 5D show two passively operated HP valves. The use of automatic as well as actuated HP valves, provides for safety and improved overshoot performance in compressor mode.

For expander operation the PV diagram has much more area, so the HP valve timing is shorter than in compressor mode plus delta P is larger.

A possible method is to size the min valve size and shortest timing for expander operation. Then add automatic valves for compressor mode operation (140 Bore×200 Stroke needs 0.18×Bore area=HP Valve area Expander operation), Bore Area=15393 $mm^2$. Minimum Expander valve diameter=60 mm.

Need to confirm proposed acceleration is feasible with pressure loads+final part masses.

There may be some pressure drop due to small diameter reservoir line, as shown in the following figures. In particular, FIG. 5DA shows a PV curve in expansion where the area of the HP Valve=0.18×Bore Area. FIG. 5DB shows a PV curve in expansion where the area of the HP Valve=0.3×Bore Area.

Pump

Embodiments may employ a pump and/or oscillating water column to flow liquid for heat exchange with gas being compressed or expanding. In certain embodiments the liquid that is flowed for heat exchange may be water.

A water pump according to such an embodiment may be designed to meet certain requirements and design goals. One embodiment of a water pump may provide water flow at 1.526 kg/s or 0.0763 L/rev, based upon 3:1 MF. The pump embodiment may exhibit a pressure up to 270-285 bar. The cost of an embodiment may be plant cost—driven by initial design simplicity. The life time cost may reflect serviceability and longevity, with a service interval of 4250 hours—6 months continuous running. A pump embodiment may exhibit low or high inlet supply pressure capability. A small size for the pump may result in ease of shipping, and reduced material costs and packaging.

One type of water pump design may use an inline cam and follower type arrangement. Such a configuration may offer packaging issues with overall length.

A horizontally opposed configuration improves packaging, but bearing loads are still an issue leading to overly large bearings and higher friction losses. A conventional cam type pump needs a pressurized supply to return the followers.

Accordingly, certain pump designs use a Carrier type cam follower with opening and closing cams. Opposed plungers balance the pressure forces and allows inlet suction (i.e. no feed pump). Candidate materials for the plungers include but are not limited to silicon nitride, alumina, sapphire, other ceramics, stainless steel, titanium, and other alloys.

Figure 6A:
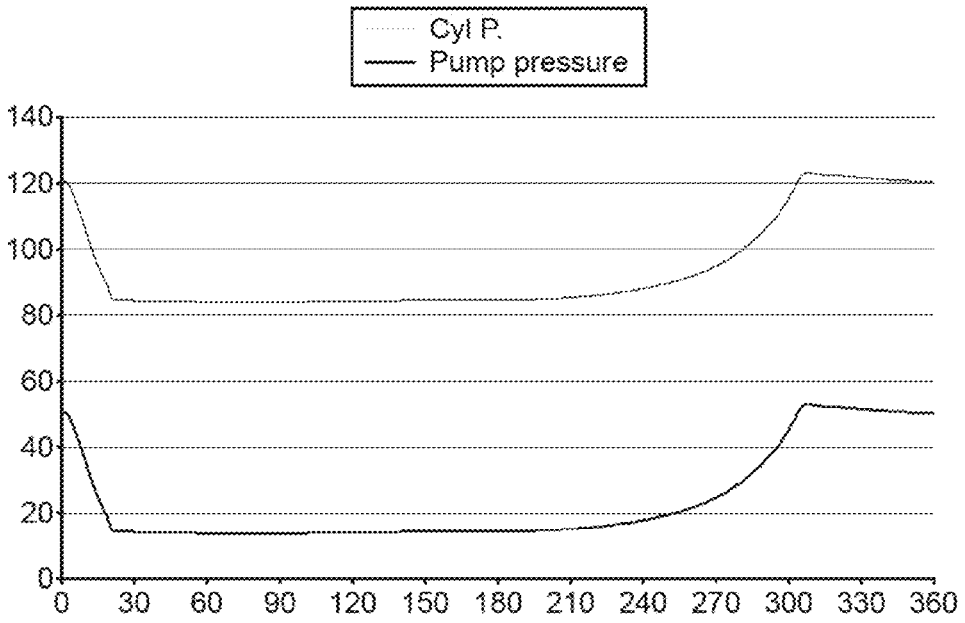
FIG. 6A plots cylinder pressure and pump pressure versus crank angle for one embodiment.
Figure 6B:
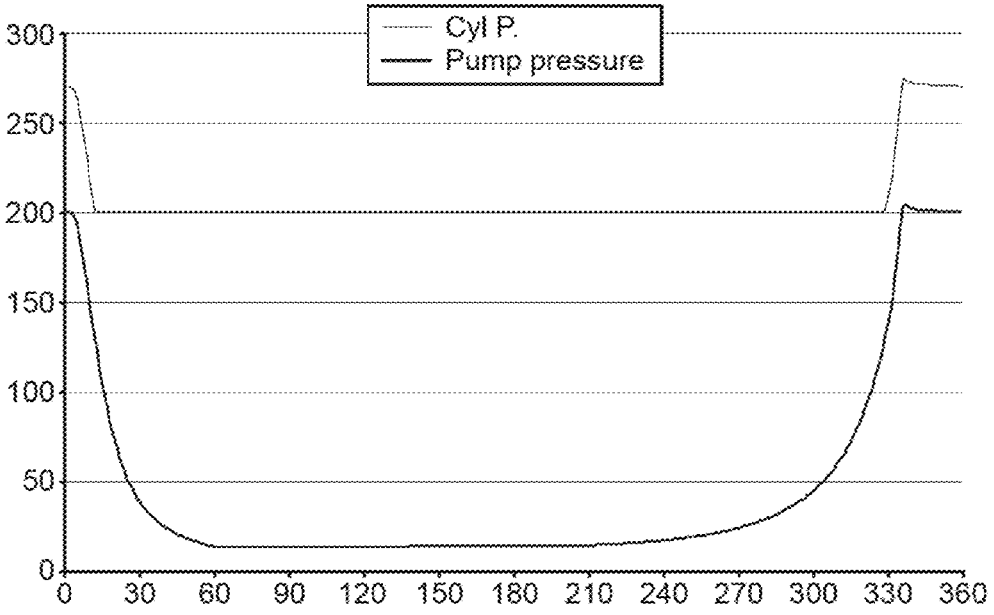
FIG. 6B plots cylinder pressure and pump pressure versus crank angle for another embodiment.

FIG. 6A plots 50 Bar reservoir pressure where a pump embodiment supplies water 0-360 degrees mass fraction (MF) 2.75:1. In some embodiments it may be desirable to store and reuse the separated water maintained at high pressure for re-injection (e.g. the system of FIG. 7B). Accordingly, FIG. 6B plots 200 Bar reservoir pressure where a pump embodiment supplies water from 329-11 degrees mass fraction (MF) 4.2:1

Figure 6C:
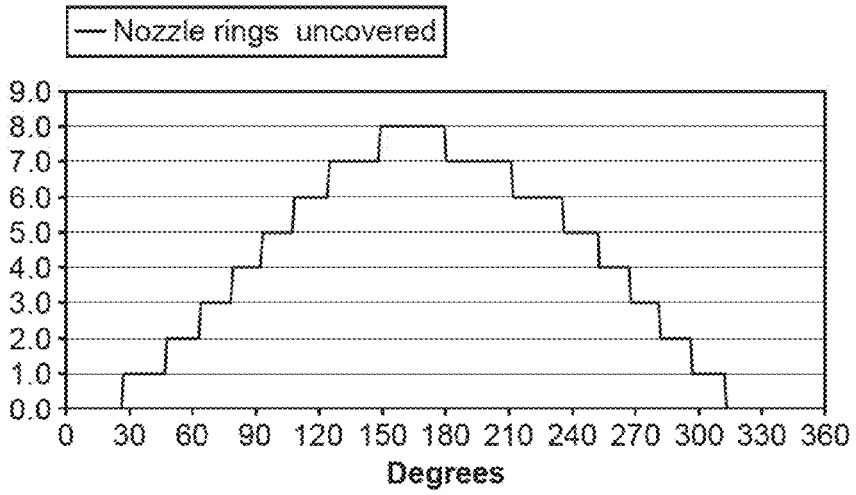
FIG. 6C shows the degrees of spray versus nozzle rings uncovered.
Figure 6D:
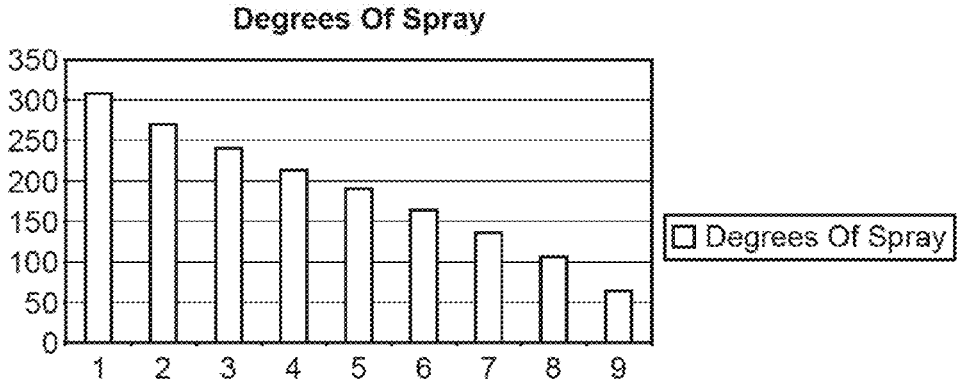
FIG. 6D is a bar chart showing degrees of spray per nozzle ring.

According to one embodiment, the displacement pump is sized to provide a flow rate that results in a 70-85 Bar delta P across the spray nozzles and a Min mass fraction (MF) of 2.75:1 at low reservoir pressures. FIG. 6C plots nozzle ring number per degrees of spray. FIG. 6D plots degrees of spray versus nozzle ring number.

FIG. 7A is a simplified diagram showing a liquid flow system according to one embodiment. In particular, in this embodiment the water is separated and stored in a reservoir at a pressure of between 15-30 bar. A priming pump may ensure correct inlet pressure for the water pump at start up.

FIG. 7B is a simplified diagram showing a liquid flow system according to another embodiment, wherein water separated at 200 Bar is then re-injected. The system of FIG. 7B may be considered an improvement in certain respects, in that there is no valving on the separator water drain, there is no priming pump, and there is lower frictional HP.

FIG. 8A is a cross-sectional view of an embodiment of a high pressure water pump concept. The water pump according to this embodiment employs a ceramic plunger and plunger sleeve. FIG. 8B is an enlarged view showing water pump size relative to the HP piston assembly.

FIG. 8C is a simplified cross-sectional view of a balanced plunger water pump arrangement.

Figure 8D:
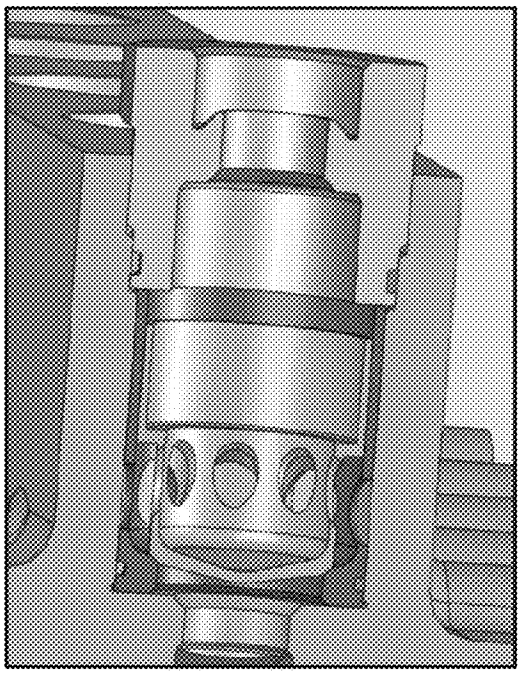
FIG. 8DA shows a simplified cross-sectional view of an inlet pump valve according to an embodiment.
Figure 8D:
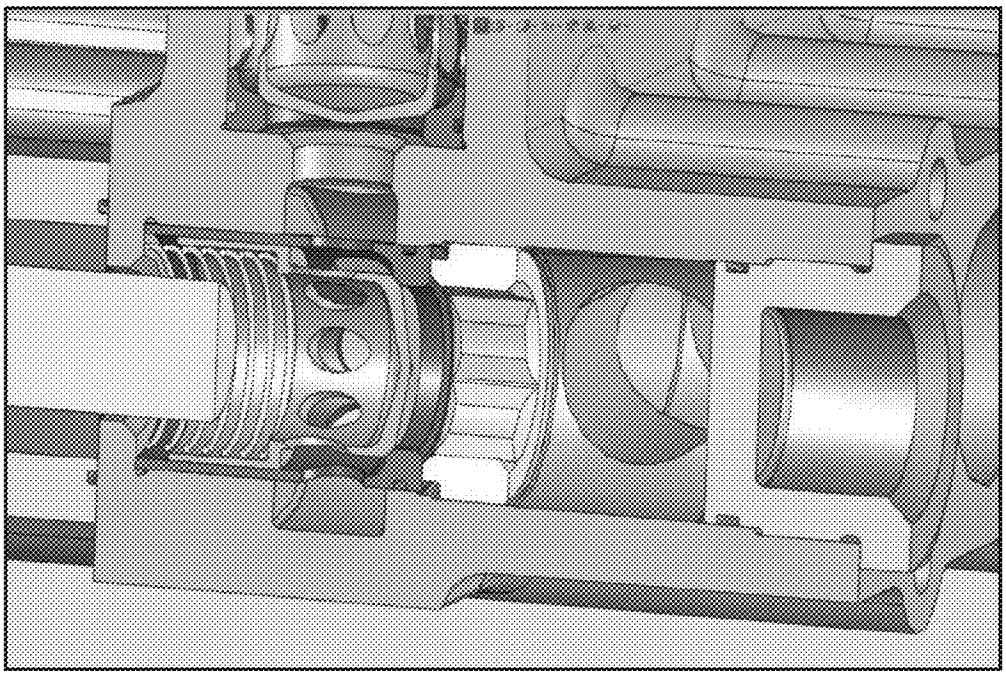

According to certain embodiments, check valves may be conservatively sized to reduce pressure drop and risk of degassing in the plunger chamber. FIG. 8DA shows a simplified cross-sectional view of an inlet valve according to an embodiment. FIG. 8DB shows a simplified cross-sectional view of an outlet valve according to an embodiment.

Figure 8E:
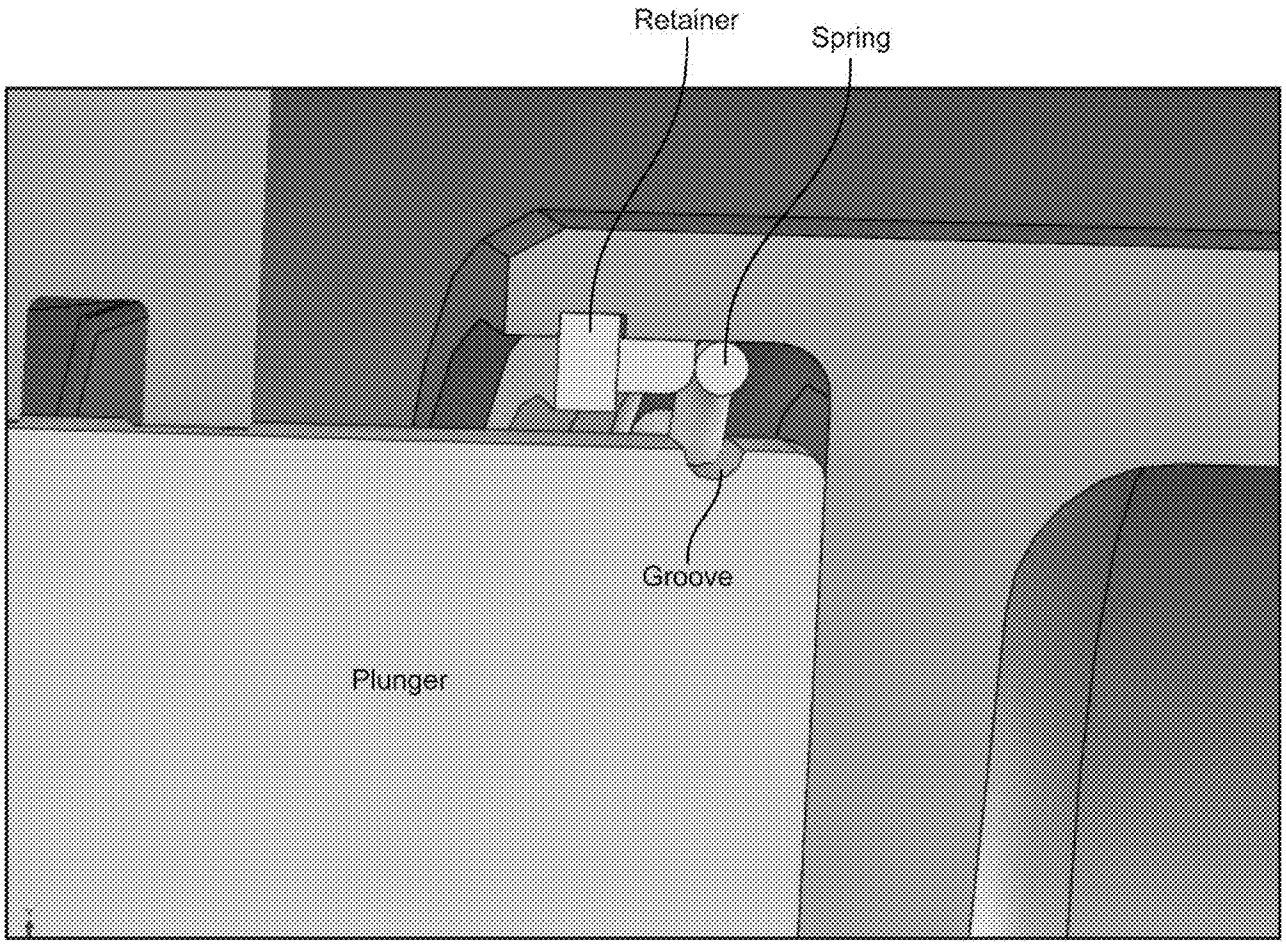
FIG. 8E shows an enlarged view with retention detail.

FIG. 8E shows an enlarged view with retention detail to avoid needing a feed pump. In particular, the plunger is secured with a spring and a retainer secured within a groove.

The structure of the liquid pumps is now described in detail below in connection with FIGS. 9-9HI. In particular, FIG. 9 is a simplified perspective view of an embodiment of a liquid pump.

FIG. 9A is a simplified cross-section of half of an embodiment of a liquid pump. As shown in this figure, the pump is operated based upon movement of a cam. FIG. 9B plots lift versus cam position.

Figure 9C:
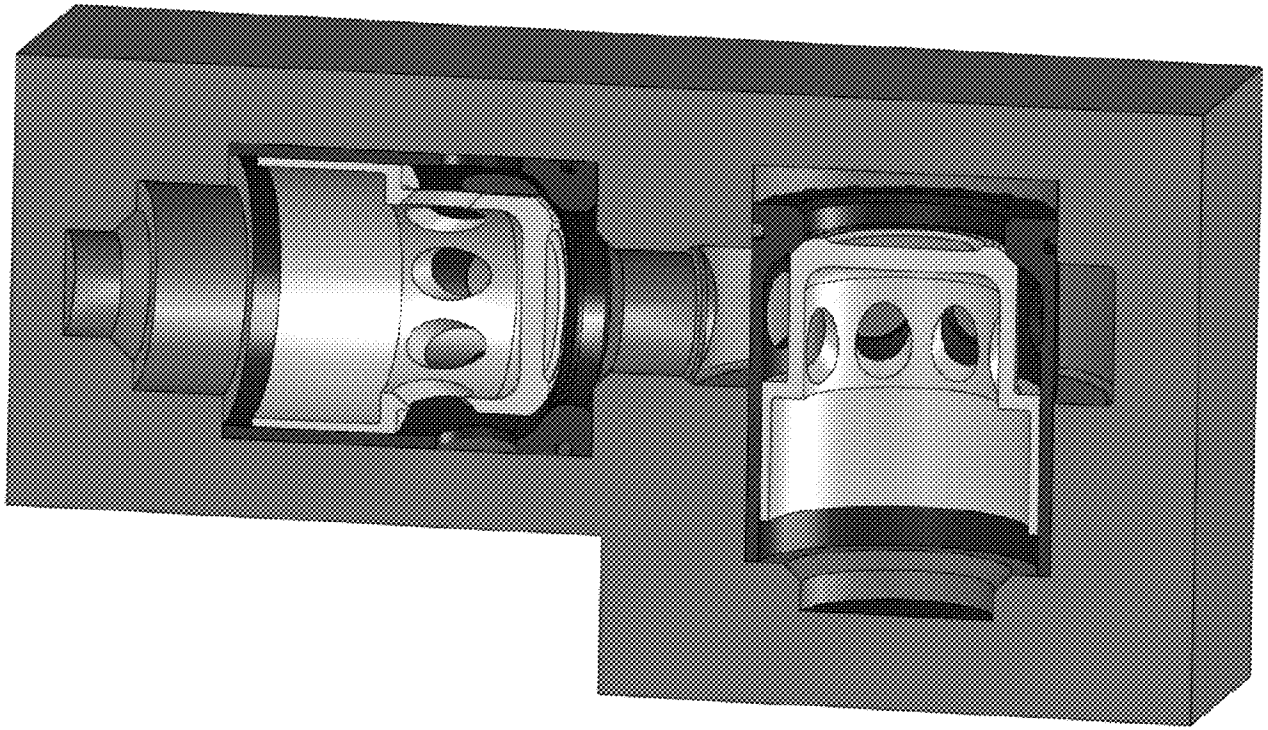
FIG. 9C shows a cross-sectional view of a check valve computational fluid dynamics (CFD) model.
Figure 9D:
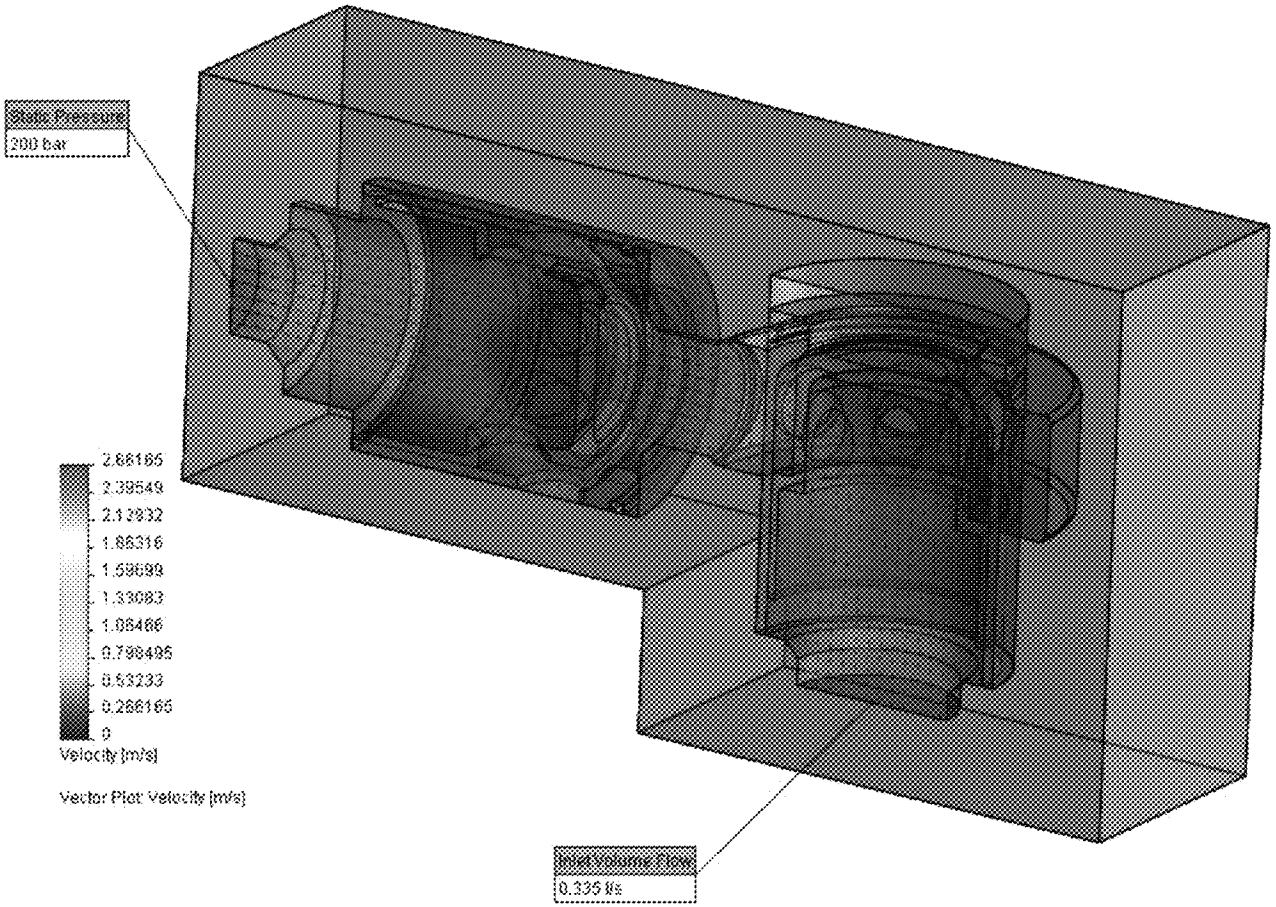
FIG. 9D shows a flow velocity plot.
Figure 9E:
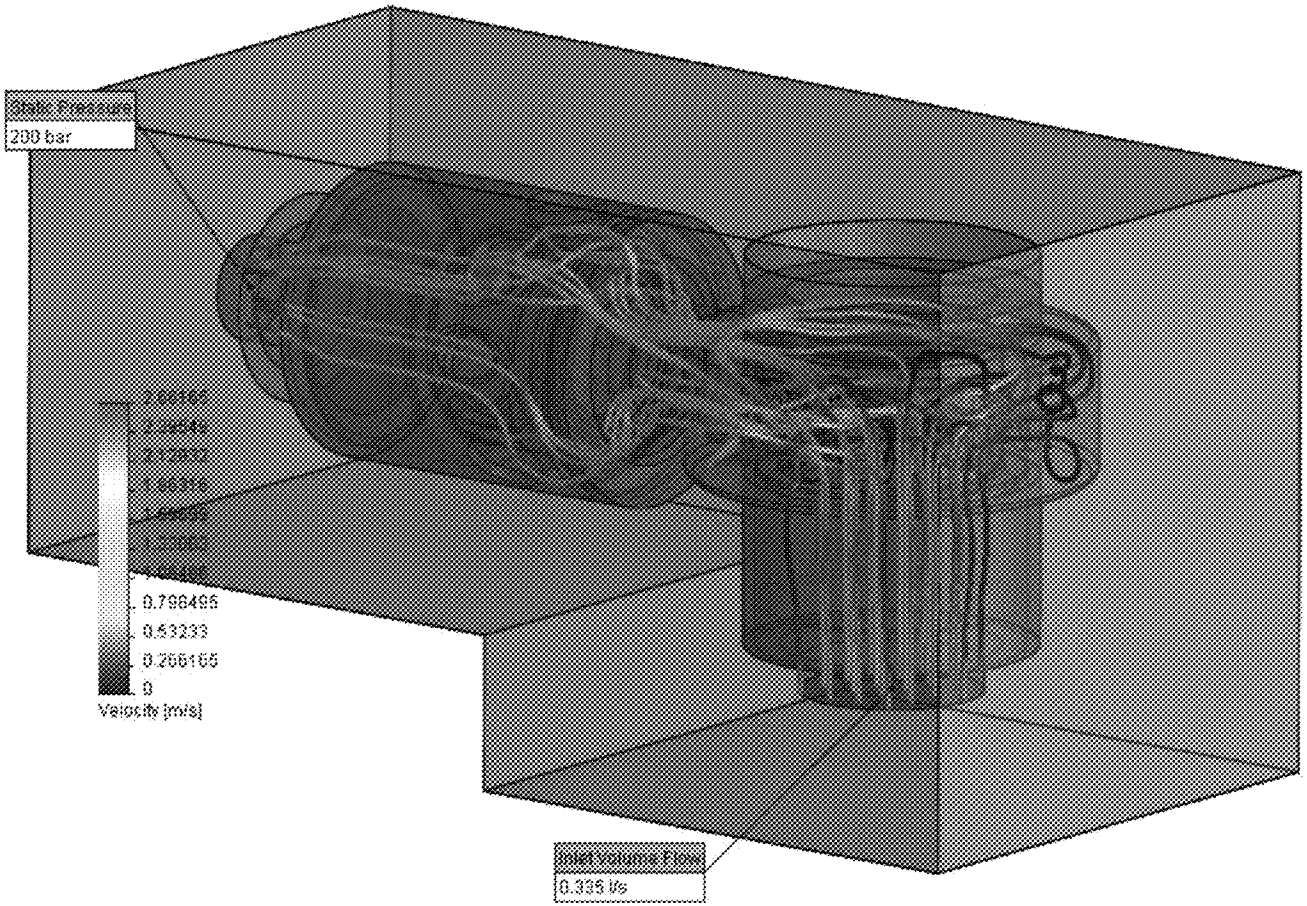
FIG. 9E is a flow velocity plot showing flow path.
Figure 9F:
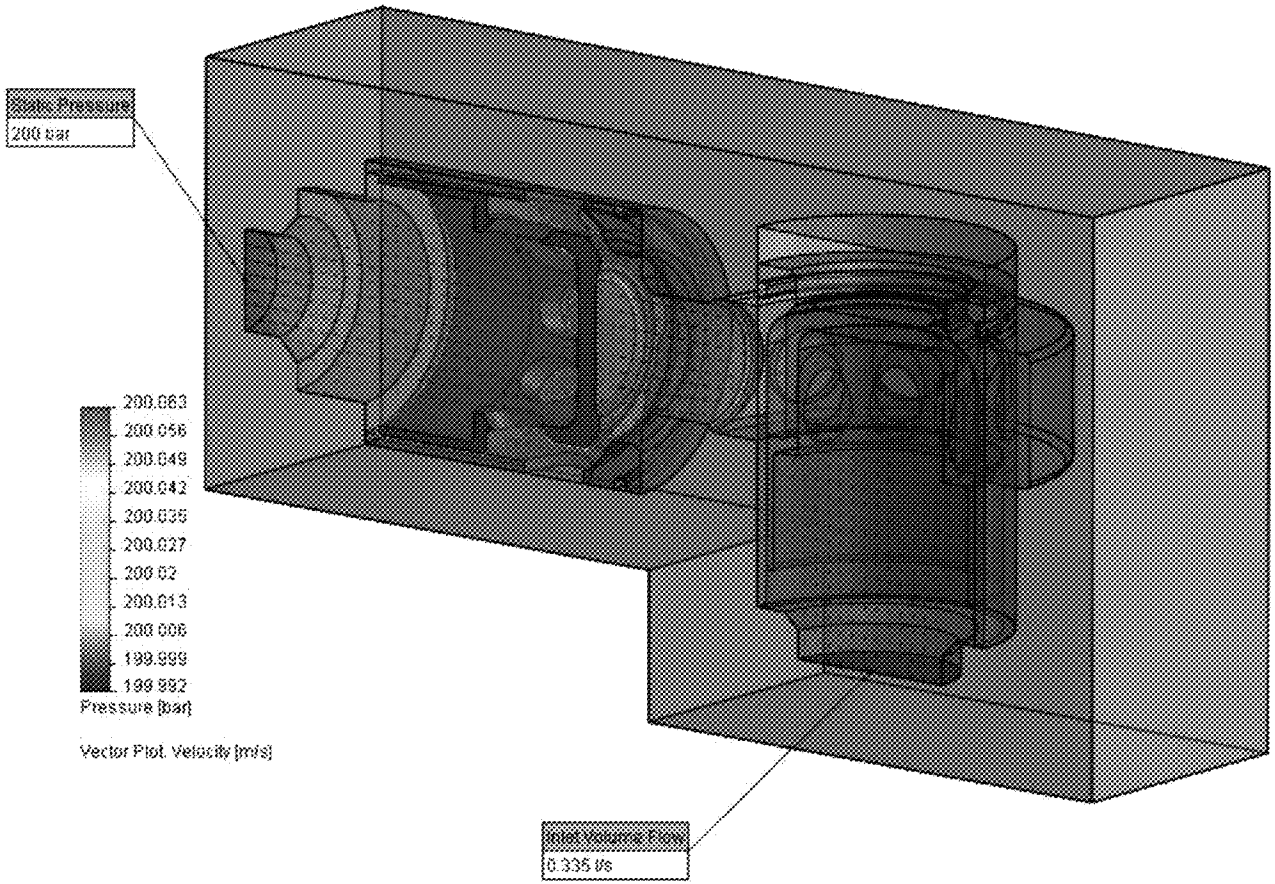
FIG. 9F shows a pressure drop plot.

FIG. 9C shows a cross-sectional view of a computational fluid dynamics (CFD) model for a check valve of the liquid pump. FIG. 9D shows a flow velocity plot. FIG. 9E is a flow velocity plot showing flow path. FIG. 9F shows a pressure drop plot.

Figure 9G:
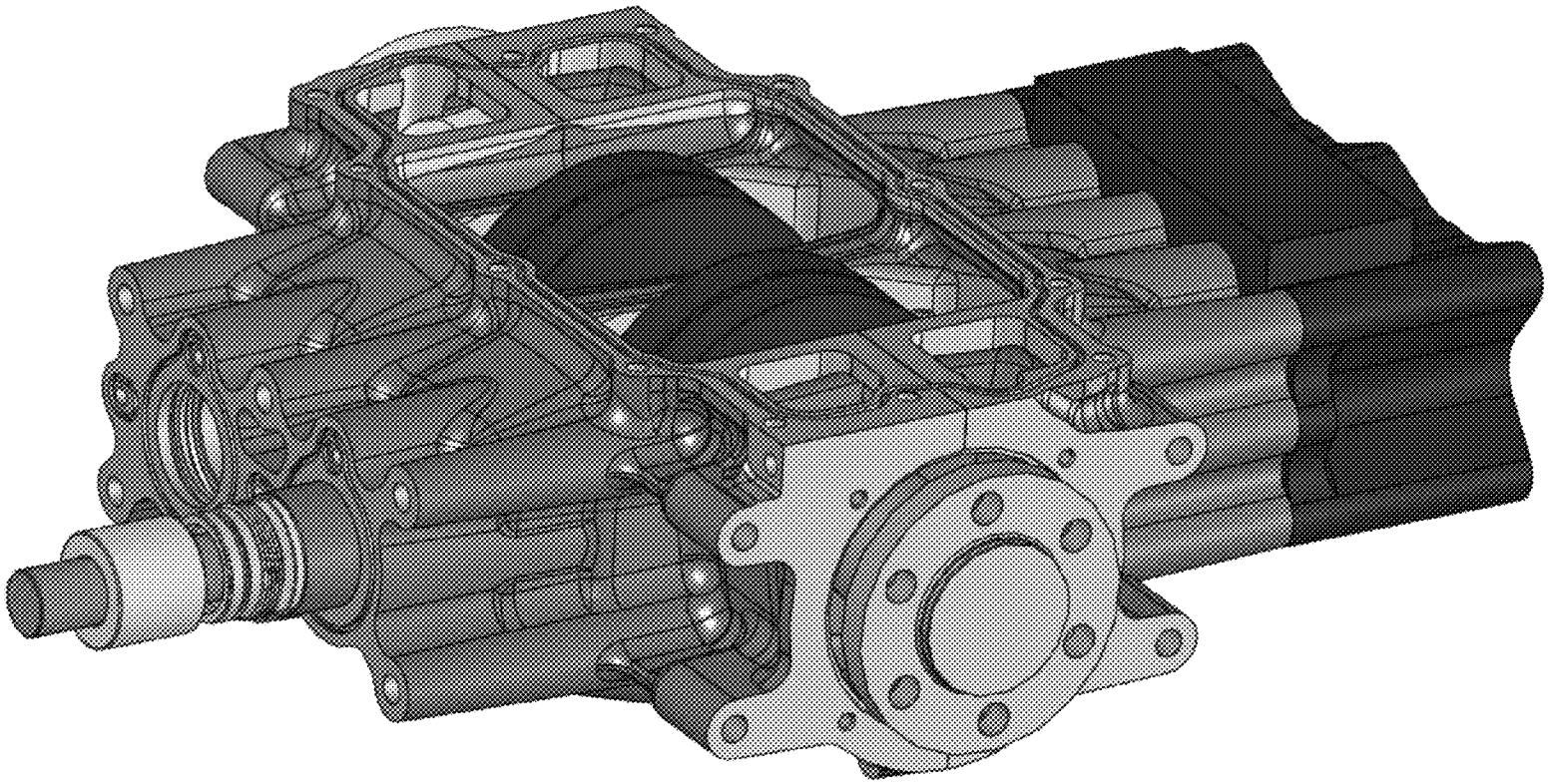
FIG. 9G shows a perspective view of an embodiment of a four plunger water pump.

FIG. 9G shows a perspective view of an embodiment of a four plunger water pump. FIG. 9H shows a cross-section of a liquid pump embodiment. FIG. 9I shows an enlargement of the liquid pump embodiment of FIG. 9H.

Figure 9H:
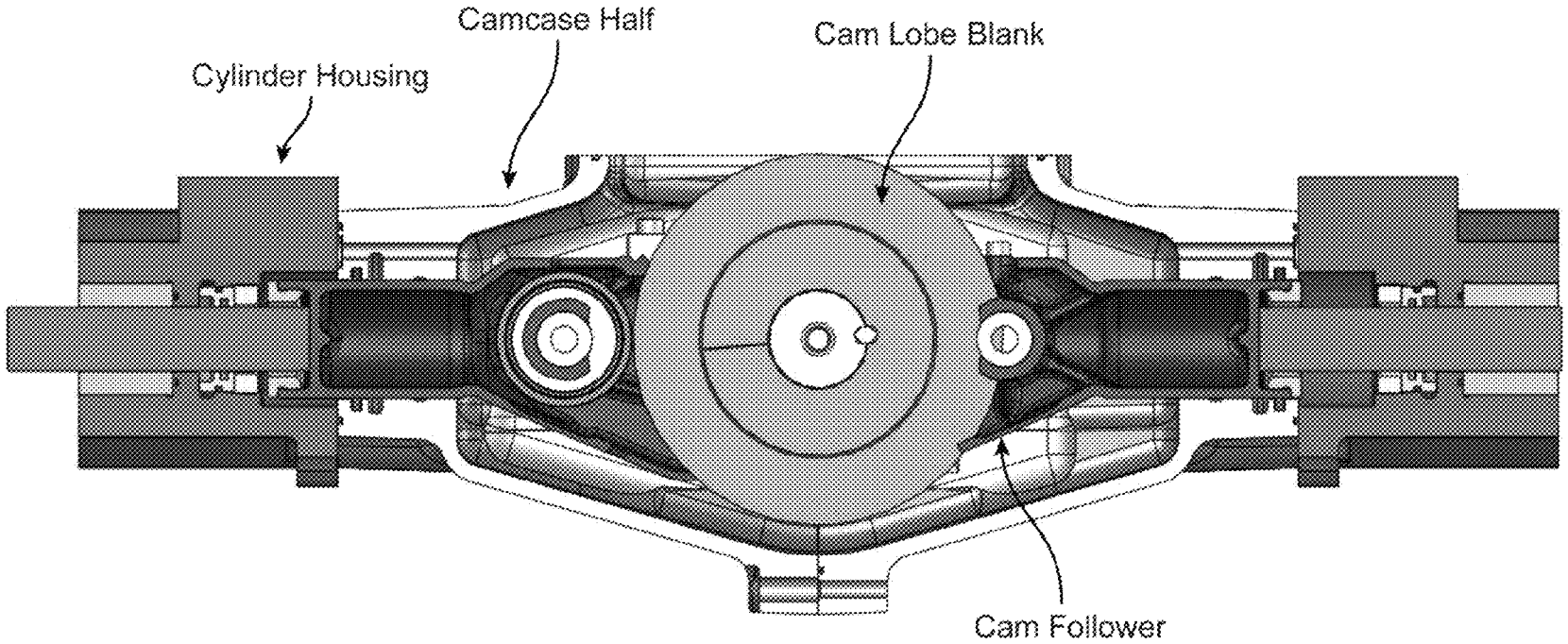
FIG. 9H shows a cross-section of a liquid pump embodiment.
Figure 9I:
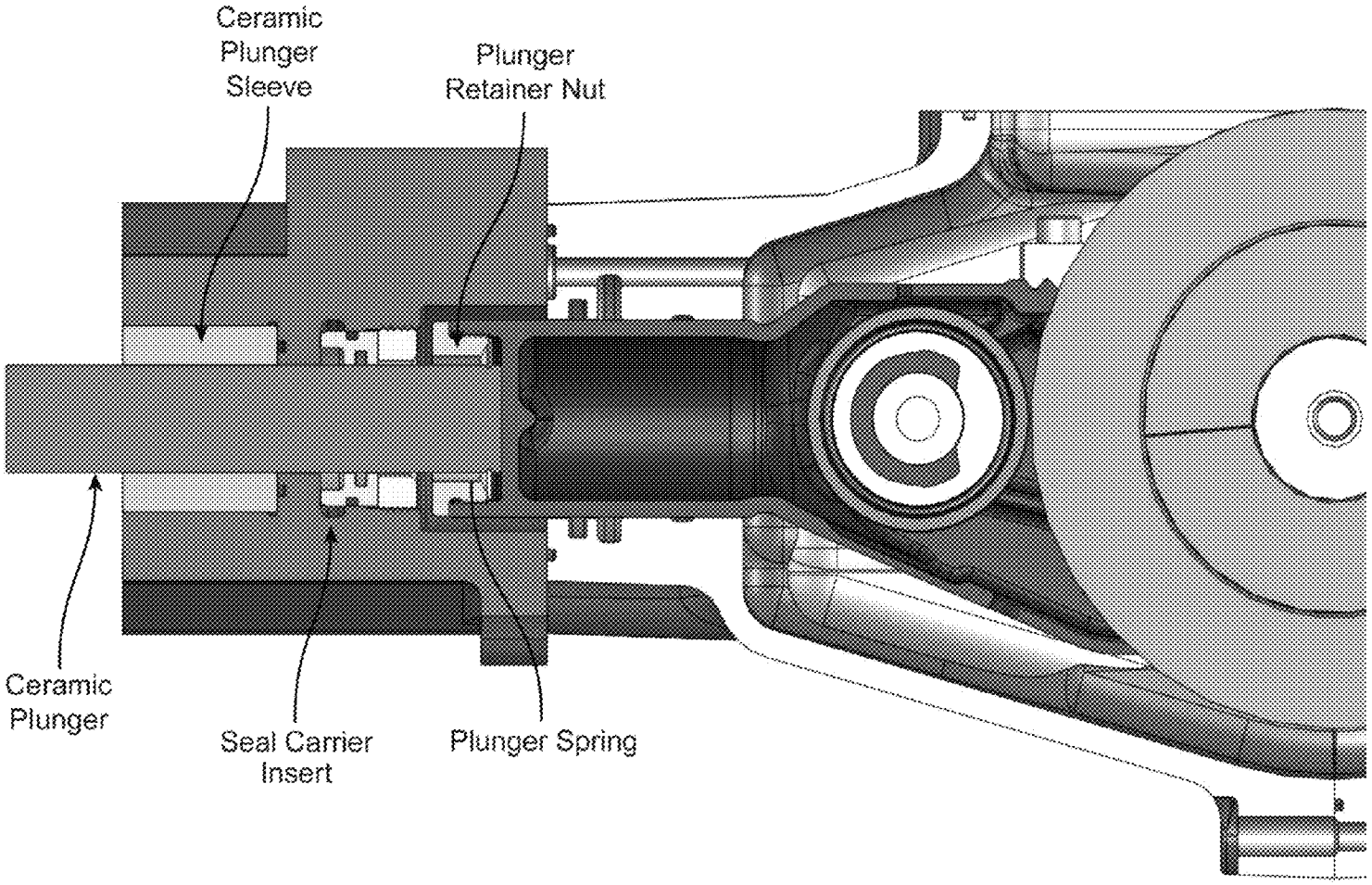
FIG. 9I shows an enlargement of the liquid pump embodiment of FIG. 9H.
Figure 9J:
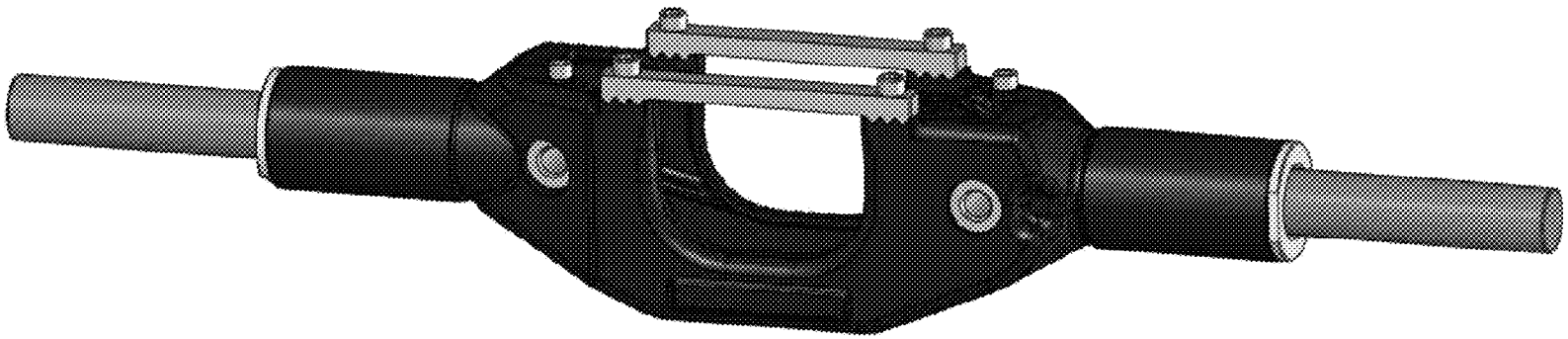
FIG. 9J show a simplified perspective view of the plungers and cam followers of the embodiment of FIGS. 9H-I.

FIG. 9J show a simplified perspective view of the plungers and cam followers of the embodiment of FIGS. 9H-I. In particular, this Figure shows the use of a Carrier type cam follower.

Figure 9K:
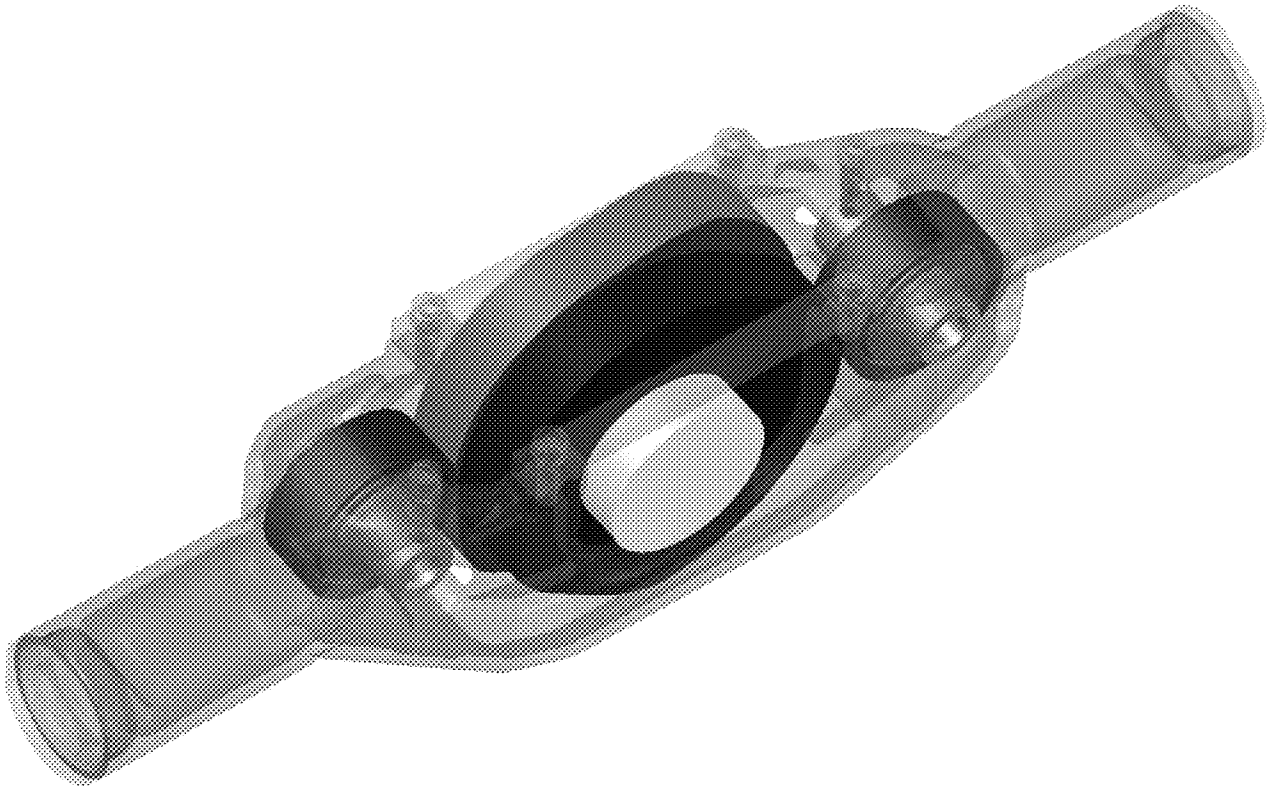
FIG. 9K shows a view including the cams of the embodiment of FIGS. 9H-I.

FIG. 9K shows a view including the cams of the embodiment of FIGS. 9H-I.

Liquid displaced by the plungers may be flowed to respective orifice(s) in the liquid spray rings. One or more pairs of plungers may feed a spray ring. The top ring might be fed by three pairs, and the next ring by two pairs, down to the bottom ring fed by one pair. The upper rings may be fed by more pairs as they are spraying for more time during a cycle.

Figures 10A, 10B, 10C:
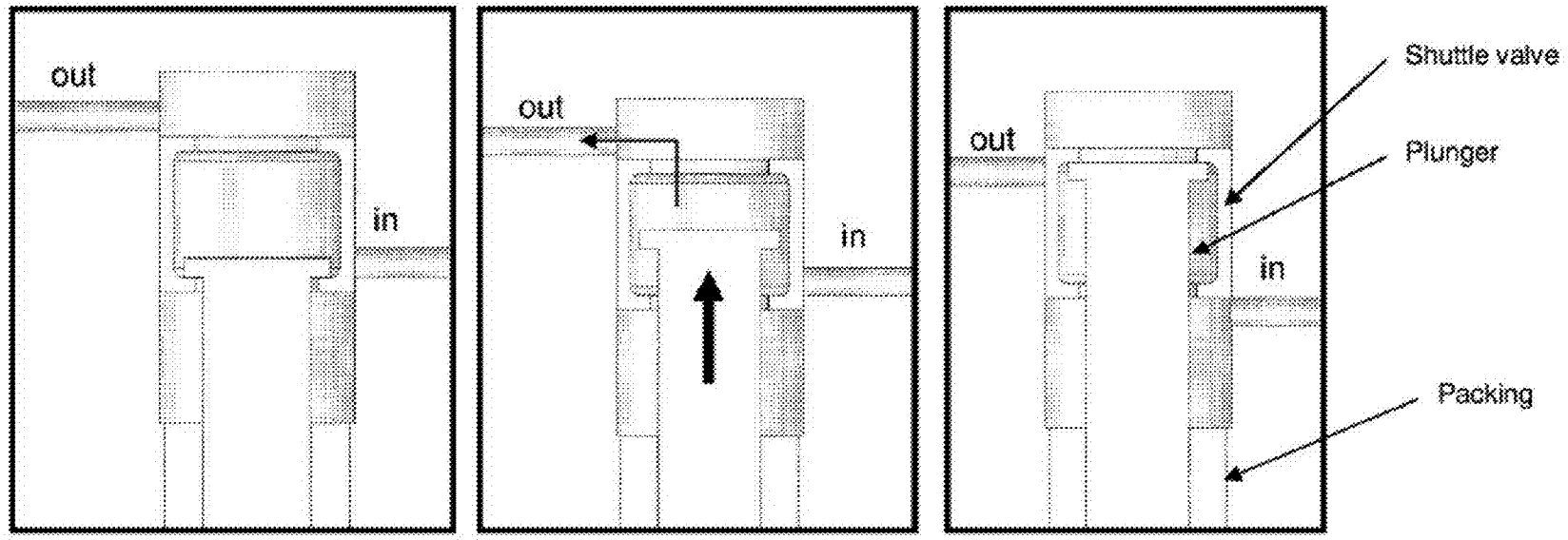
FIGS. 10A-C show views of a shuttle valved water pump concept.

FIGS. 10A-C show views of a shuttle valved water pump concept in which energy may be recovered from pressurized liquid. In particular, FIG. 10A shows the Piston at BDC with the Outlet just opened and the Inlet just closed. FIG. 10B shows the Piston going up with the Outlet Open and the Water going to sprays. FIG. 10C shows the Piston at TDC with the Outlet just closed and the Inlet just opened.

The shuttle valved water concept may exhibit certain features. Water is valved into the cylinder and work is extracted. The cam follower may see higher force due to 200-15-70 bar instead of 70 bar max. The valve overlap may give rise to some through leakage. Valve clearance may give rise to some leakage. Contact between piston and valve is impact with damping provided by the working fluid. Water may be persuaded to act as a dashpot fluid between the flat contact surfaces. Other embodiments may use a solenoid for shuttle valve control instead of plunger motion or a combination of solenoid and plunger movement for control.

Returning now to FIG. 2, the embodiment of the energy storage system includes a crankcase configured to receive the cranks of the two stages. FIGS. 11A-M show various views of one particular embodiment of a crankcase.

Figure 11A:
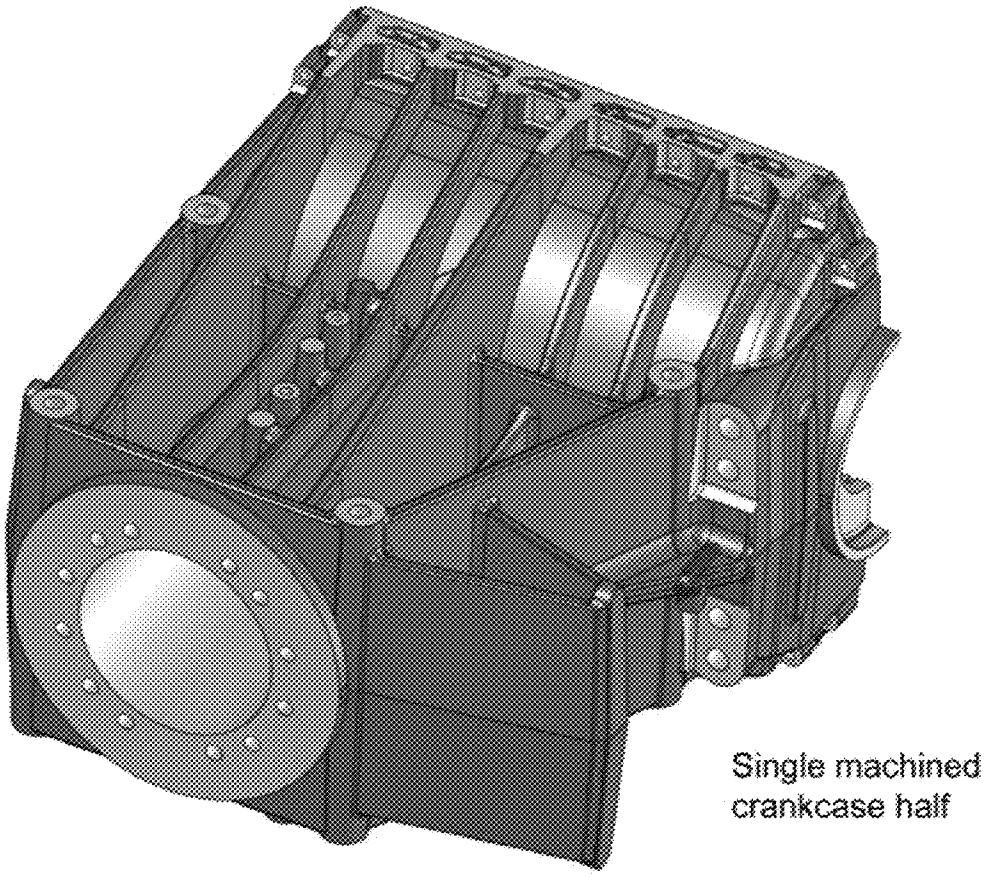
FIGS. 11A-J show various views of a crankcase design.
Figure 11B:
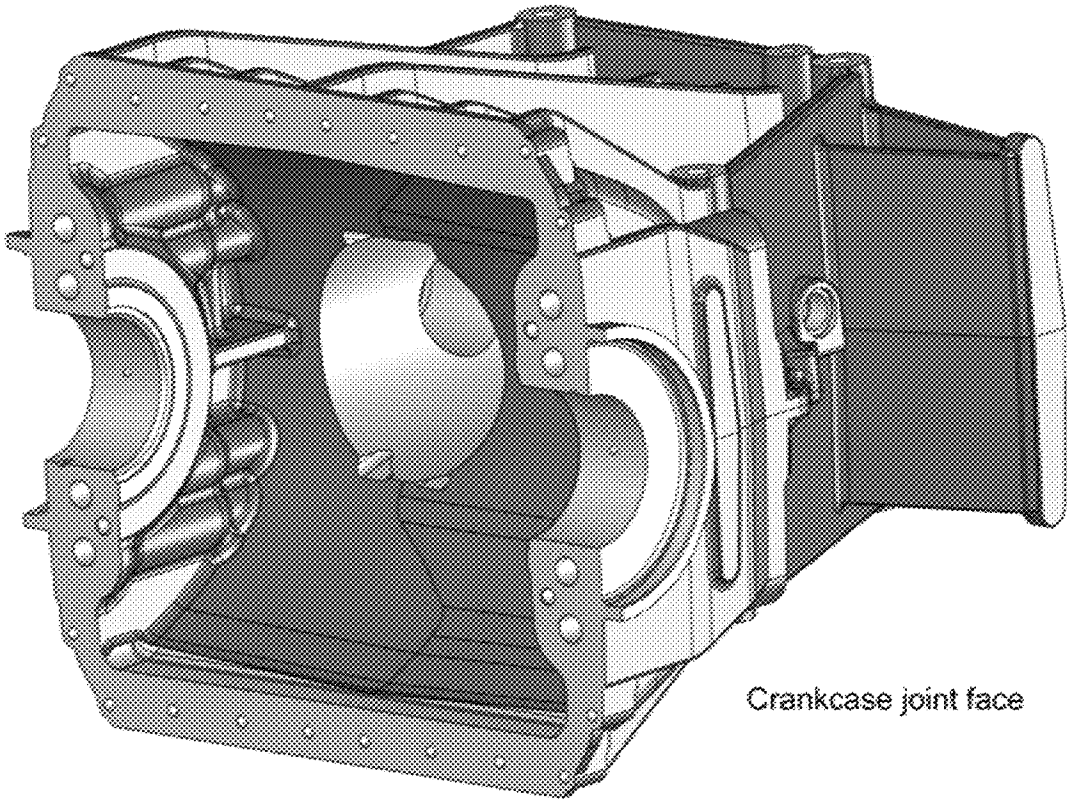

In particular, FIG. 11A shows a perspective view of one half of a crankcase 1100 according to an embodiment. FIG. 11B shows a perspective view of the crankcase of FIG. 11A showing the joint face.

Figure 11C:
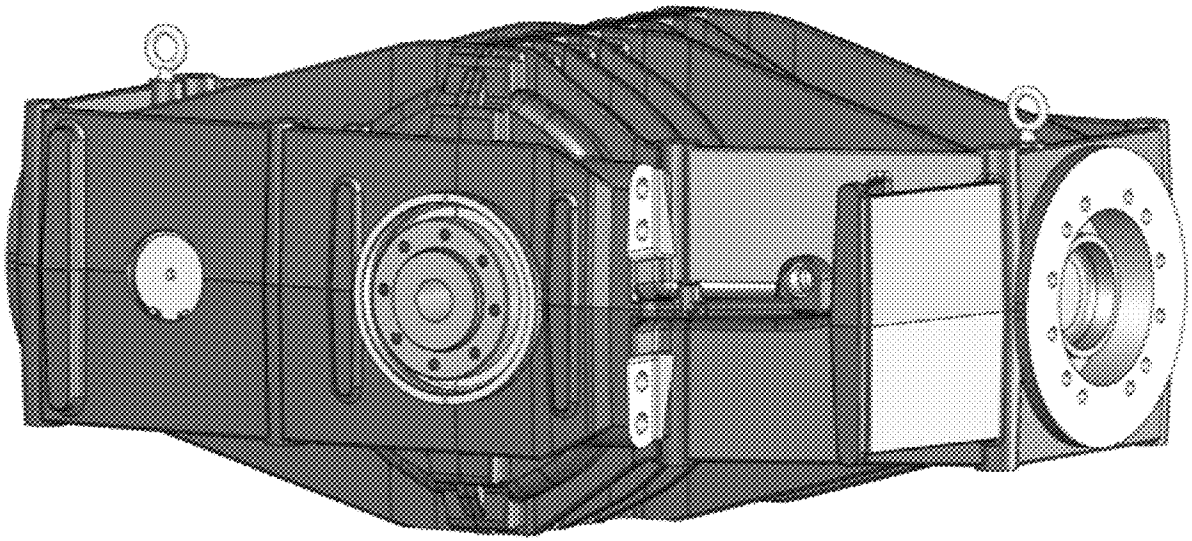
Figure 11D:
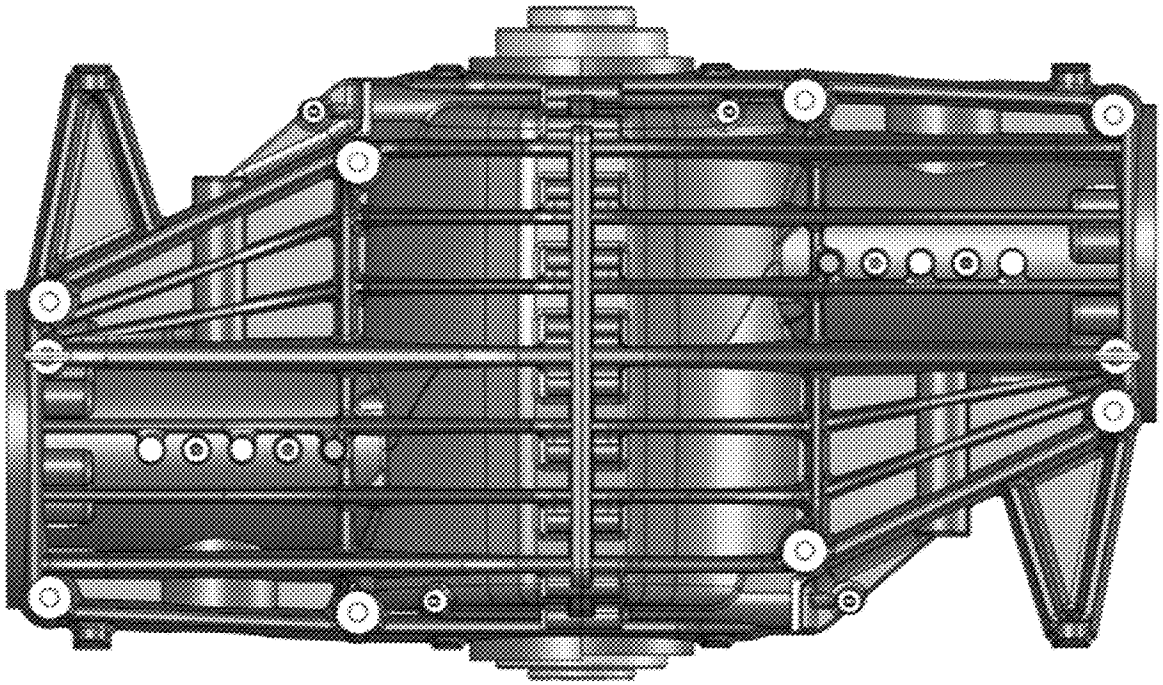
Figure 11E:
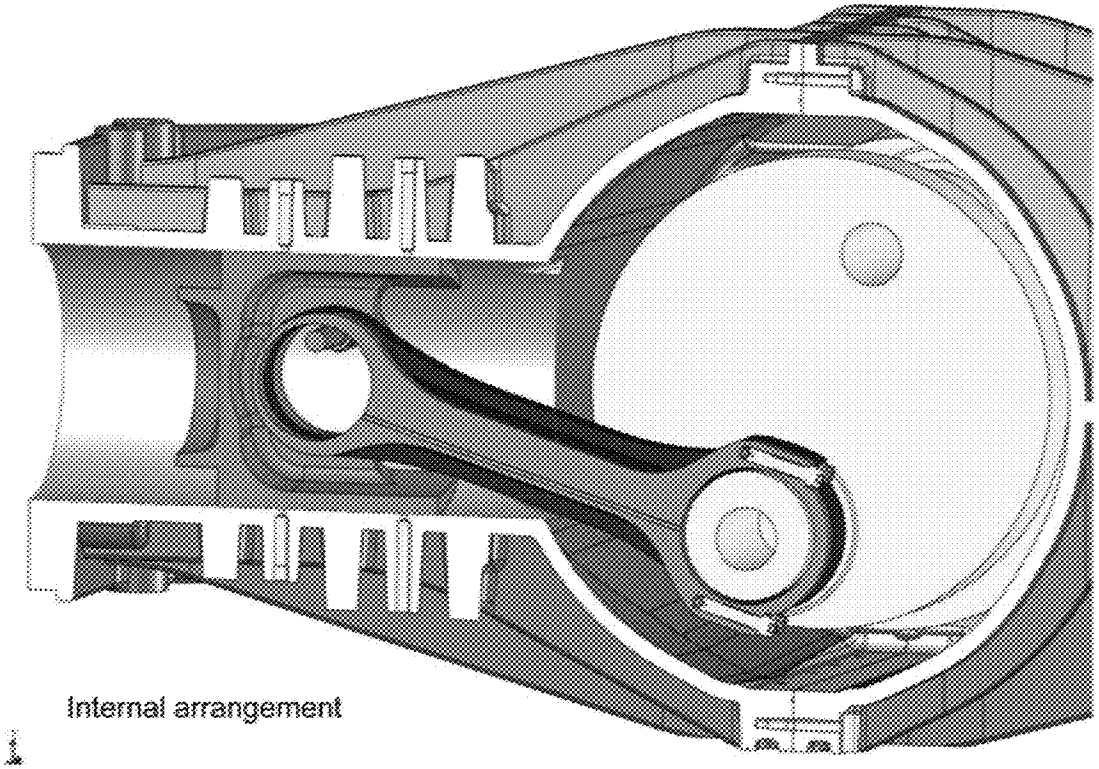

FIG. 11C shows a perspective view of an assembled crankcase. FIG. 11D shows a top view of an assembled crankcase. FIG. 11E shows a cross-sectional view of a crankcase and the oil feed locations to lubricate the cross head bearings.

Figure 11F:
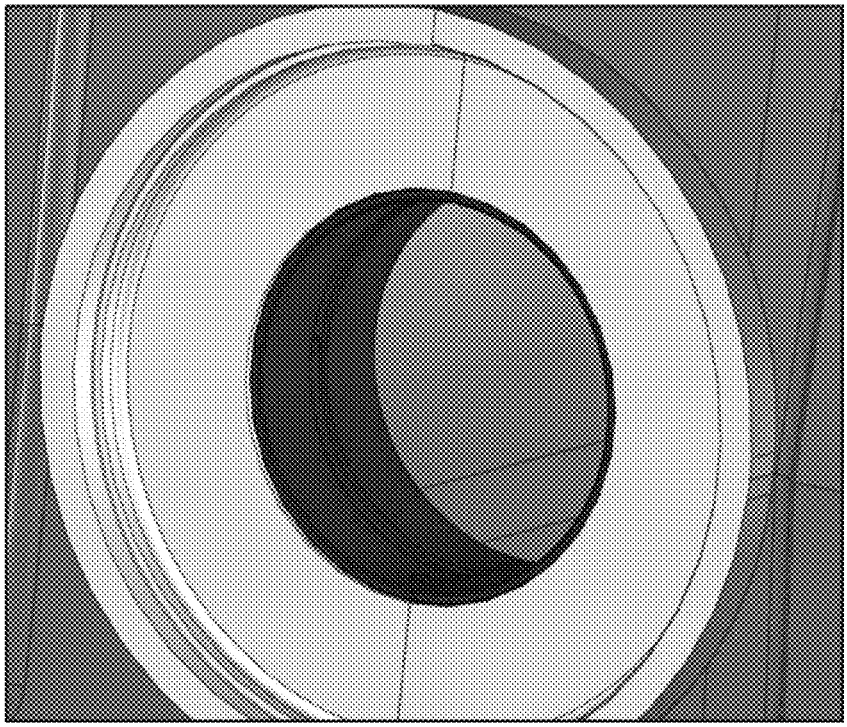
Figure 11G:
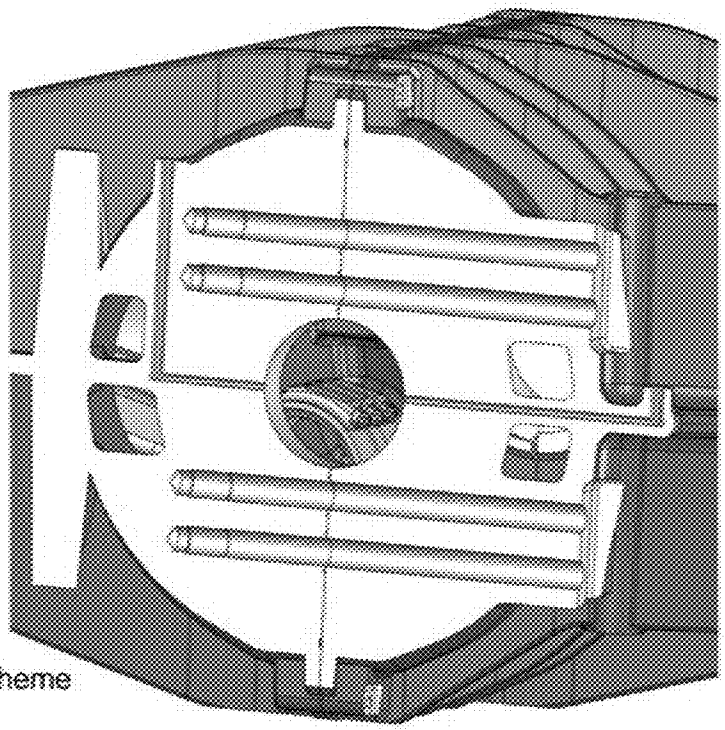
Figure 11H:
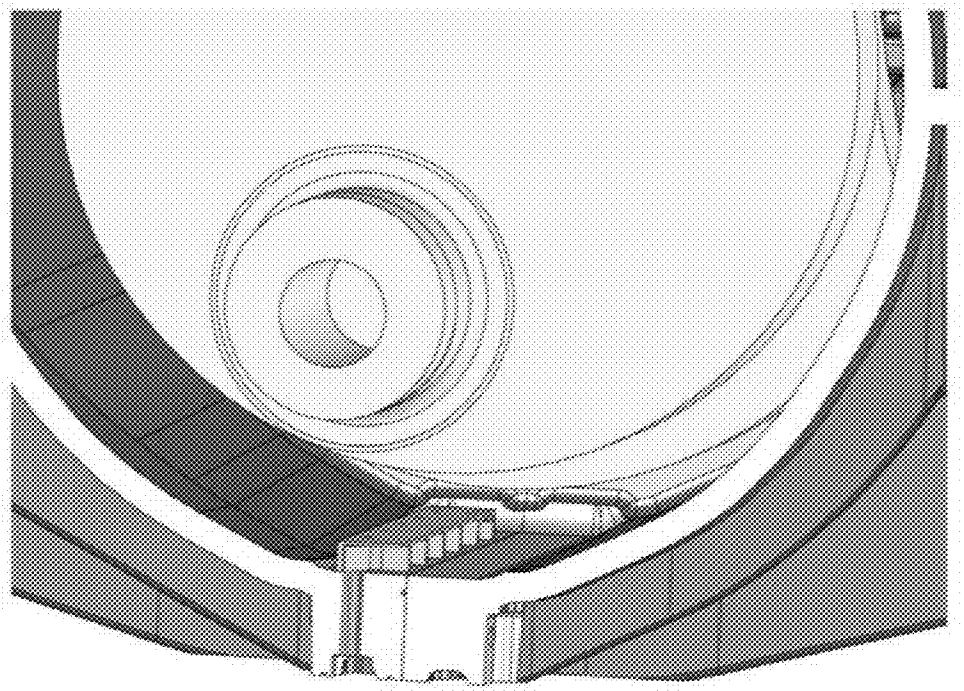

FIGS. 11F-H show enlarged views of various portions of the crankcase.

Figure 11I:
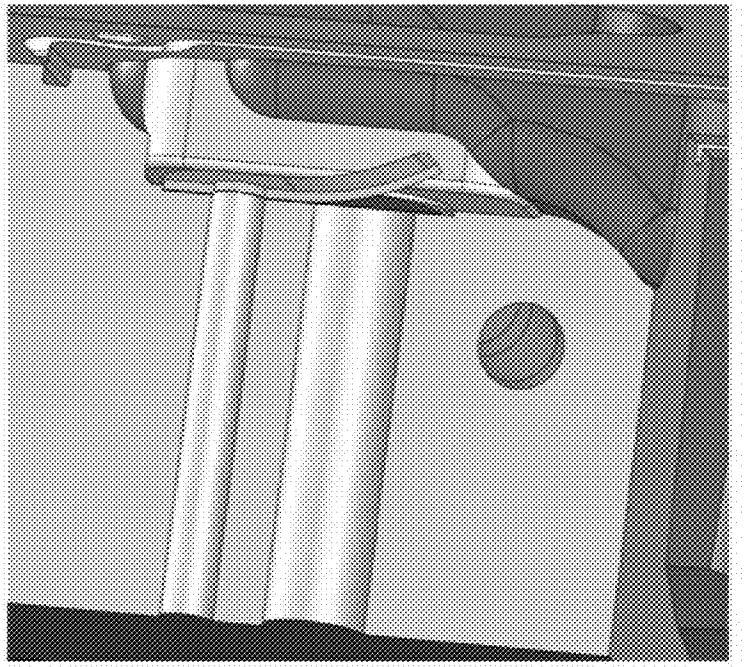

FIG. 11I is an enlarged view showing a valve and backing plate according to an embodiment. The oil is removed from the crankcase using the displacement of the piston. As the piston travels toward the crankshaft the crankcase volume is reduced and oil and air exit the crankcase via the scraper and reed valve or valves. When the piston travels away from the crankshaft air is drawn in via a separate orifice and reed valve and the cycle repeats.

Figure 11J:
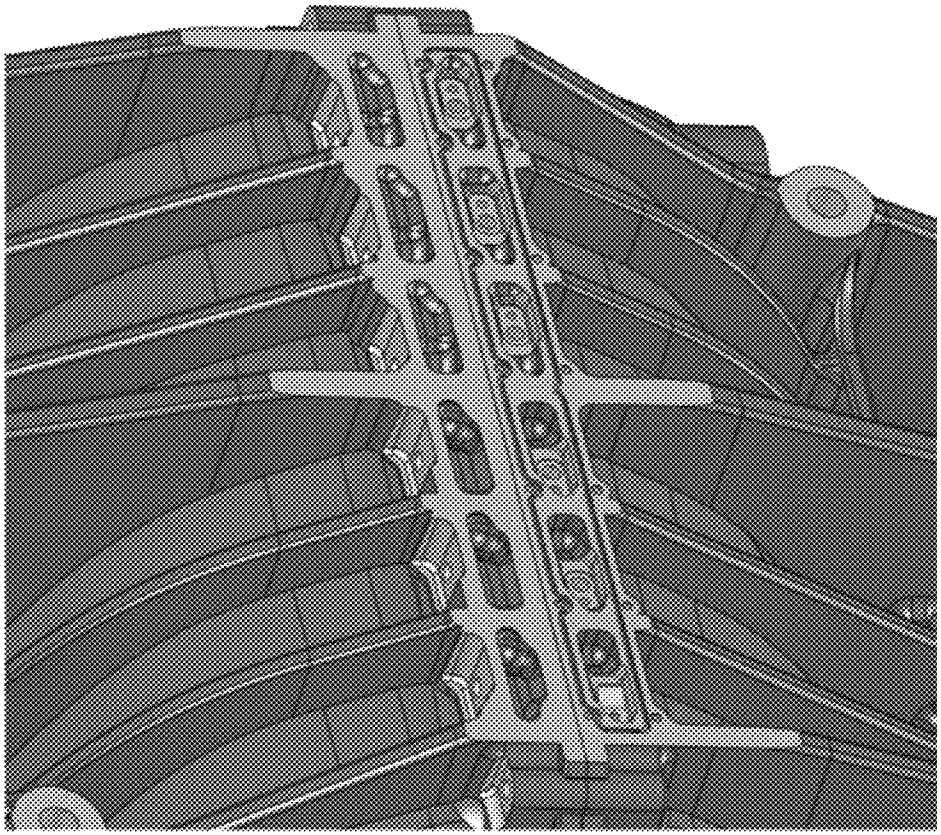

FIG. 11J is an enlarged view showing reed locations according to an embodiment. In this embodiment there are six reeds, fastened in place with an adjacent screw, but any number may be utilized with the same principle of operation.

Embodiments may employ a gudgeon pin assembly tool for the purpose of removing and replacing the gudgeon pin without fully disassembling the machine. This may be done in development to monitor surface condition.

Figure 12A:
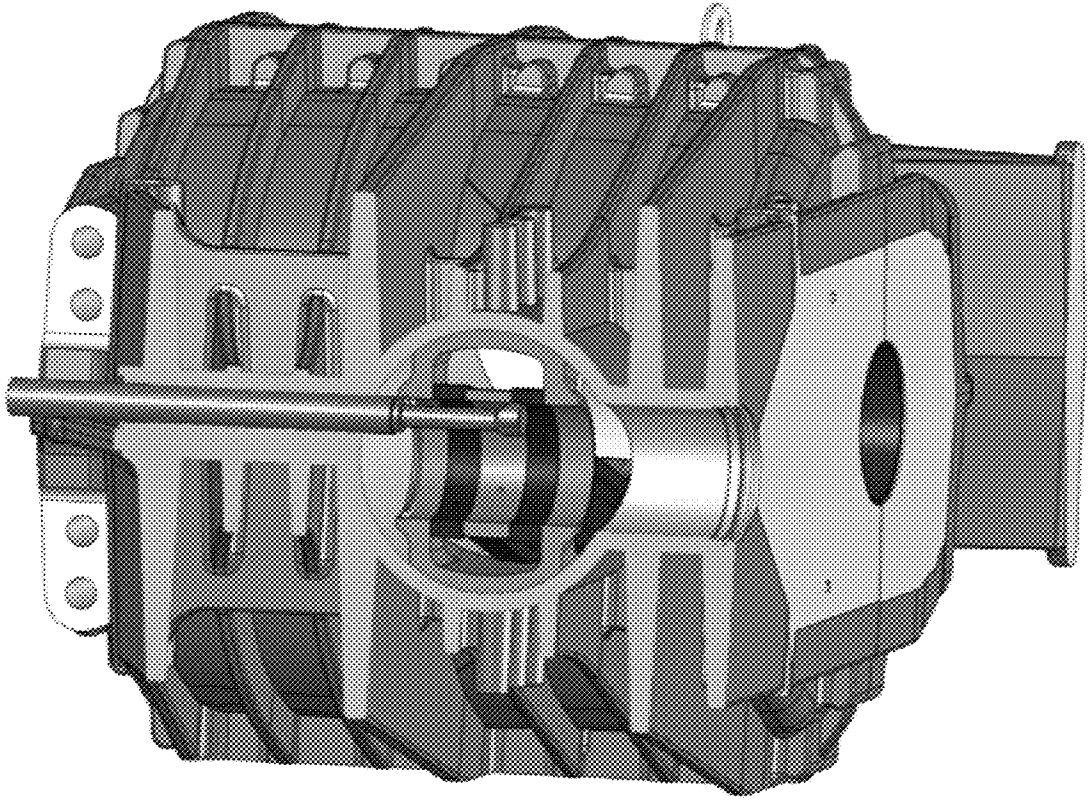
FIGS. 12A-C show various views of a gudgeon assembly pin device.
Figure 12B:
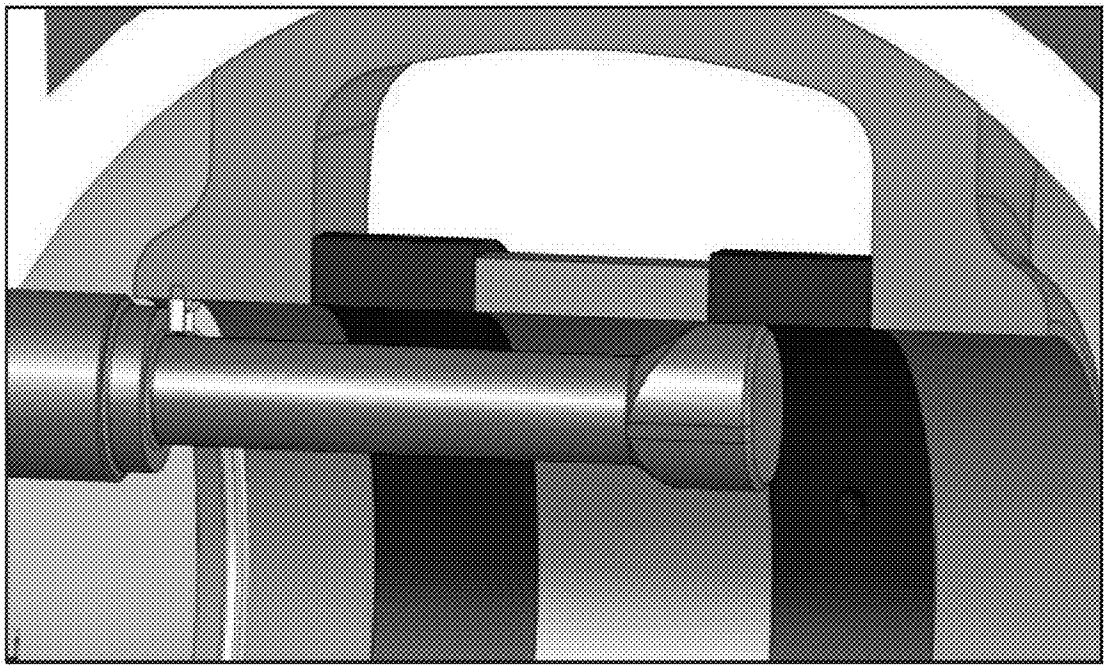

FIG. 12A shows a view of a crankcase and a gudgeon pin assembly tool according to an embodiment. FIG. 12B shows an enlarged view of the gudgeon pin assembly tool.

Figure 12C:
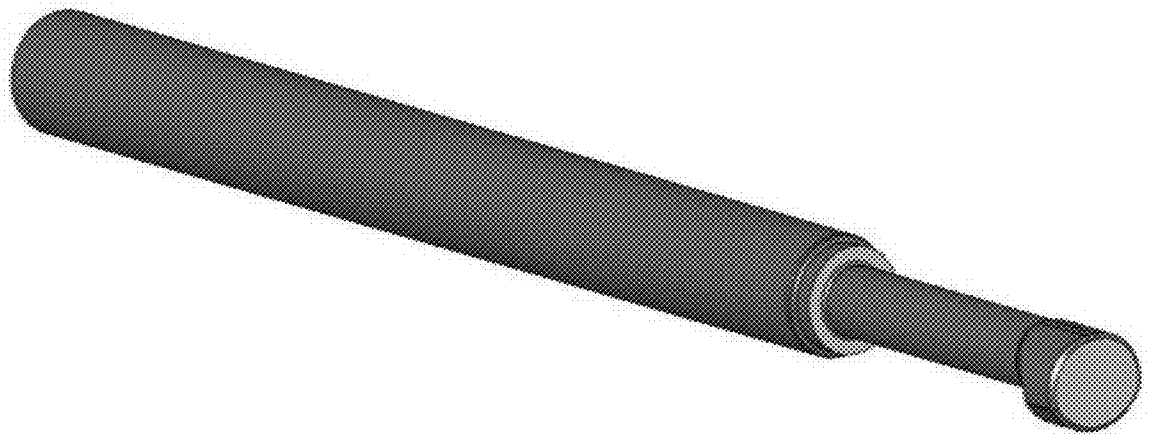

FIG. 12C shows another view of the gudgeon pin assembly tool.

1. A system comprising:

a low pressure reversible compressor/expander comprising a first piston moveable within a first chamber defined within a first plurality of liquid sprayers;

a high pressure reversible compressor/expander comprising a second piston moveable within a second chamber defined within a second plurality of liquid sprayers;

a first mechanical linkage between the first piston and a shaft;

a second mechanical linkage between the second piston and the shaft;

a first liquid pump in fluid communication with the first plurality of liquid sprayers;

a second liquid pump in fluid communication with the second plurality of liquid sprayers; and a high pressure valve comprising a poppet portion and a curtain portion, configured to selectively control fluid communication of gas with the second chamber.

1A. A system as in clause 1 wherein the first plurality of liquid sprayers are arranged in one or more spray rings.

2. A system as in clause 1 wherein the first liquid pump comprises a plurality of plungers in communication with a rotating cam.

3. A system as in clause 2 wherein liquid displaced by each of the plungers is flowed to a respective orifice of one of the first liquid spray rings.

4. A system as in clause 1 wherein the high pressure valve comprises a liquid sprayer.

5. A system as in clause 1 wherein the high pressure valve defines an interior space configured to substantially match a pressure of the second chamber.

6. A system as in clause 5 wherein the poppet portion defines a vent between the second chamber and the interior space.

7. A system as in clause 6 further comprising a liquid sprayer configured to introduce liquid to the interior space and to the second chamber via the vent.

8. A moveable element of a gas flow valve, the moveable element comprising:

a poppet portion selectively actuable in a first direction between a pressure chamber and an internal valve chamber having substantially a same pressure as the pressure chamber; and a shroud portion configured to project within an opening of a valve seat.

9. A moveable element as in clause 8, further comprising:

a curtain portion moveable between the pressure chamber and a high pressure side to allow a flow of gas between the pressure chamber and the high pressure side in a second direction different from the first direction.

10. A moveable element as in clause 8 wherein the poppet portion defines a vent allowing fluid communication between the pressure chamber and the internal valve chamber.

11. A moveable element as in clause 9 wherein the vent is configured to allow communication of liquid to the pressure chamber from a spray nozzle in liquid communication with the internal valve chamber.

12. A moveable element as in clause 8 wherein the curtain portion is integral with the poppet portion.

13. A moveable element as in clause 8 wherein:

the high pressure side lies in a plane surrounding the internal chamber;

the first direction is substantially orthogonal to the plane; and the second direction comprises a radial direction substantially within the plane.

Embodiments may be suited to work in conjunction with compressed gas energy systems. Various examples of such energy systems are described in the Publication.

Figure 13:
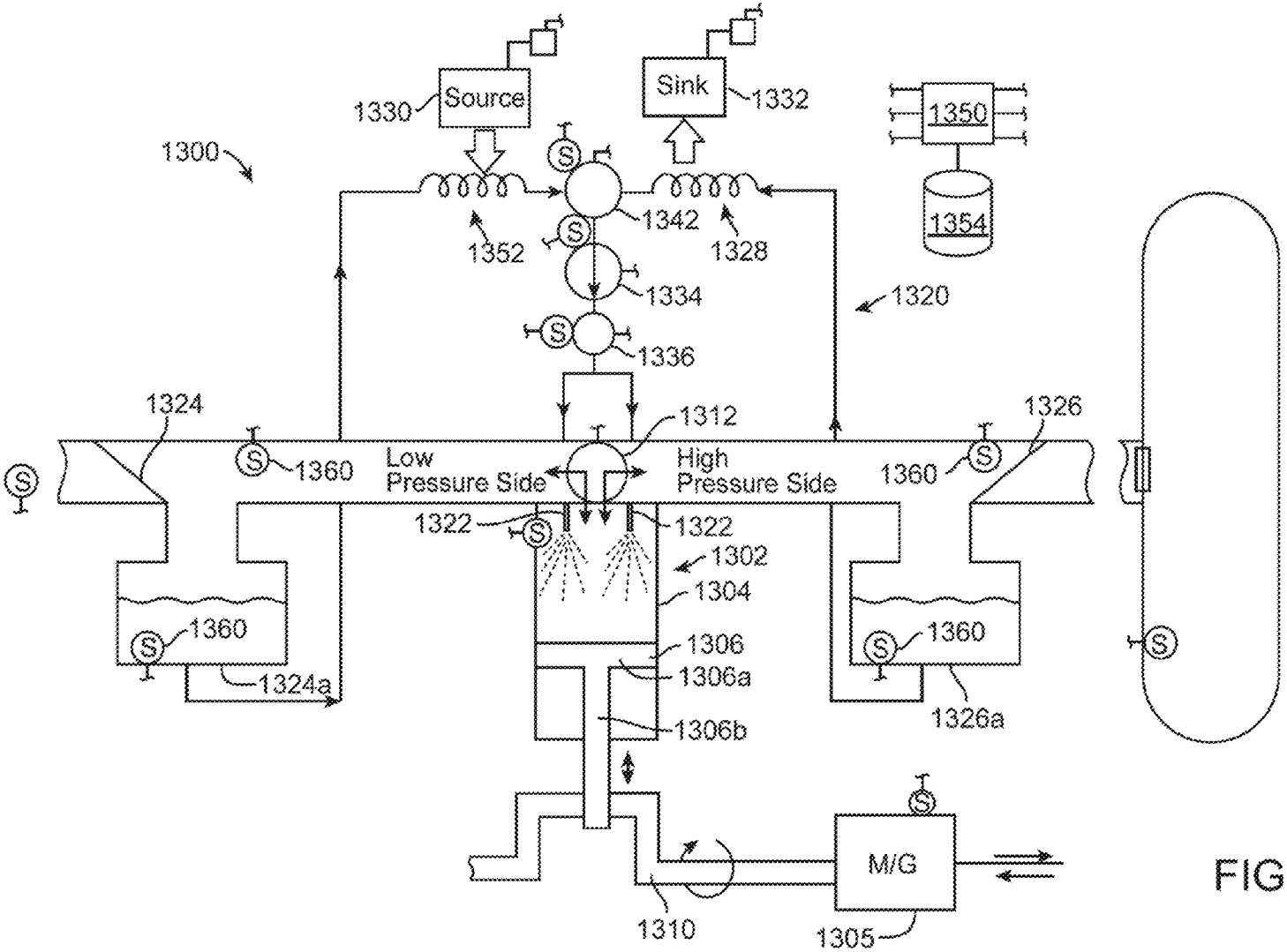
FIG. 13 shows a simplified view of an embodiment of an energy storage system.

FIG. 13 shows a simplified view of one embodiment of such a compressed gas energy system. In particular, the system 1300 includes a compressor/expander 1302 comprising a cylinder 1304 having piston 1306 moveably disposed therein. The head 1306*a* of the piston is in communication with a motor/generator 1308 through a piston rod 1306*b* and a linkage 1310 (here a crankshaft).

In a compression mode of operation, the piston may be driven by the motor/generator 1305 acting as a motor to compress gas within the cylinder. The compressed gas may be flowed to a gas storage tank 1370, or may be flowed to a successive higher-pressure stage for additional compression.

In an expansion mode of operation, the piston may be moved by expanding gas within the cylinder to drive the motor/generator acting as a generator. The expanded gas may be flowed out of the system, or flowed to a successive lower-pressure stage for additional expansion.

The cylinder is in selective fluid communication with a high pressure side or a low pressure side through valving 1312. In this particular embodiment, the valving is depicted in a simplified manner as a single multi-way valve. However, various embodiments may employ valves specifically dedicated to fluid communication with the high- and low-pressure sides. Particular embodiments of such dedicated high- and low-pressure side valves have been described above.

Some embodiments may include the arrangement of multiple one-way, two-way, or three-way valves in series. Examples of valve types which could be suitable for use in accordance with various embodiments include but are not limited to spool valves, gate valves, cylindrical valves, needle valves, pilot valves, rotary valves, poppet valves (including cam operated poppet valves), hydraulically actuated valves, pneumatically actuated valves, and electrically actuated valves (including voice-coil actuated valves).

When operating in the compression mode, gas from the low pressure side is first flowed into the cylinder, where it is compressed by action of the piston. The compressed gas is then flowed out of the cylinder to the high pressure side.

When operating in the expansion mode, gas from the high pressure side is flowed into the cylinder, where its expansion drives the piston. The expanded gas is subsequently exhausted from the cylinder to the low pressure side.

Embodiments may utilize heat exchange between liquid and gas that is undergoing compression or expansion, in order to achieve certain thermodynamic efficiencies. Accordingly, the system further includes a liquid flow network 1320 that includes pump 1334 and valves 1336 and 1342.

In general, liquid that is introduced to a gas to accomplish heat exchange according to various embodiments is not expected to undergo combustion within the chamber. Thus while the liquid that is being injected to perform heat exchange may be combustible (for example an oil, alcohol, kerosene, diesel, or biodiesel), in many embodiments it is not anticipated that the liquid will combust within the chamber. In at least this respect, liquid introduction according to embodiments may differ from cases where liquids are introduced into turbines and motors for combustion.

The liquid flow network is configured to inject liquid into the cylinder to perform heat exchange with expanding or compressing gas. In this embodiment, the liquid is injected through nozzles 1322 directly into the chamber where gas compression and/or expansion is taking place. However, this is not necessarily required and alternative embodiments could feature the introduction of liquid to gas in a mixing chamber located upstream of the compression or expansion chamber, with the gas-liquid mixture then being flowed into the chamber. And, as described herein, liquid may be injected within a valve itself. Various embodiments may employ liquid introduction directly into a chamber, upstream of a chamber, through a valve, or in some combination of these approaches.

While the particular embodiment of FIG. 13 shows the introduction of liquid for heat exchange by spraying into a gas, this approach is also not necessarily required. Various embodiments could utilize a bubbler may be used, with the gas introduced as bubbles through the liquid. Some embodiments could employ liquid spraying in combination with bubbling.

The liquid that has been introduced into the cylinder to exchange heat with compressed gas or expanding gas, is later recovered by gas-liquid separators 1324 and 1326 located on the low- and high-pressure sides respectively. Examples of gas-liquid separator designs include vertical type, horizontal type, and spherical type. Examples of types of such gas-liquid separators include, but are not limited to, cyclone separators, centrifugal separators, gravity separators, and demister separators (utilizing a mesh type coalescer, a vane pack, or another structure).

Liquid that has been separated may be stored in a liquid collector section (1324*a* and 1326*a* respectively). A liquid collector section of a separator may include elements such as inlet diverters including diverter baffles, tangential baffles, centrifugal, elbows, wave breakers, vortex breakers, defoaming plates, stilling wells, and mist extractors.

The collected separated liquid may be stored under conditions maintaining or even enhancing its thermal properties. For example, the collected and separated liquid may be stored in an insulated storage vessel to preserve its warmth or coolness.

The collected and separated liquid may also be placed into thermal communication with a heat source or heat sink. Examples of possible heat sources include sources of heat internal to the apparatus, for example heat from motors, generators, and/or pumps. Other examples of possible heat sources include source of heat external to the apparatus, for example combustion turbines or heat from renewable energy such as solar or geothermal. Examples of possible heat sinks include cooling towers, natural bodies of water, ocean depths, and the external environment at high altitudes or latitudes.

The stored liquid may be thermally conditioned for reinjection. This thermal conditioning may take place utilizing a thermal network. Examples of components of such a thermal network include but are not limited to liquid flow conduits, gas flow conduits, heat pipes, insulated vessels, heat exchangers (including counterflow heat exchangers), loop heat pipes, thermosiphons, heat sources, and heat sinks.

For example, in an operational mode involving gas compression, the heated liquid collected from gas-liquid separator 1326 is flowed through heat exchanger 1328 that is in thermal communication with heat sink 1332. The heat sink may take one of many forms, including an artificial heat sink in the form of a cooling tower, fan, chiller, or HVAC system, or natural heat sinks in the form of the environment (particularly at high latitudes or altitudes) or depth temperature gradients extant in a natural body of water.

In an operational mode involving gas expansion, the cooled liquid collected from gas-liquid separator 1324 is flowed through heat exchanger 1352 that is in thermal communication with heat source 1330. Again, the heat source may be artificial, in the form of heat generated by industrial processes (including combustion) or other man-made activity (for example as generated by server farms). Alternatively, the heat source may be natural, for example geothermal or solar in nature (including as harnessed by thermal solar systems).

Flows of liquids and/or gases through the system may occur utilizing fluidic and/or pneumatic networks. Examples of elements of fluidic networks include but are not limited to tanks or reservoirs, liquid flow conduits, gas flow conduits, pumps, vents, liquid flow valves, gas flow valves, switches, liquid sprayers, gas spargers, mixers, accumulators, and separators (including gas-liquid separators and liquid-liquid separators), hydraulic motors, hydraulic transformers, and condensers. Examples of elements of pneumatic networks include but are not limited to pistons, accumulators, gas chambers liquid chambers, gas conduits, liquid conduits, and pneumatic motors.

As shown in FIG. 13, the various components of the system are in electronic communication with a central processor 1350 that is in communication with non-transitory computer-readable storage medium 1354, for example relying upon optical, magnetic, or semiconducting principles. The processor is configured to coordinate operation of the system elements based upon instructions stored as code within medium 1354.

The system also includes a plurality of sensors 1360 configured to detect various properties within the system, including but not limited to pressure, temperature, volume, humidity, and valve state. Coordinated operation of the system elements by the processor may be based at least in part upon data gathered from these sensors.

Figure 14A:
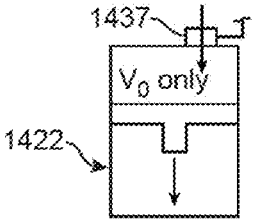
FIGS. 14A-I show various active valve actuation schemes.
Figure 14D:
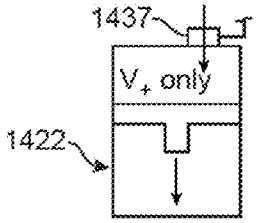
Figure 14G:
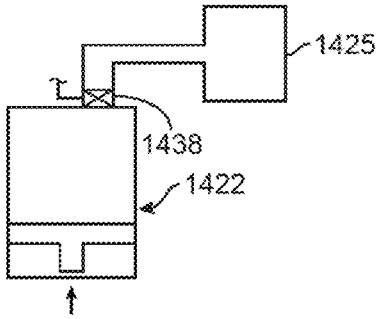
Figure 14B:
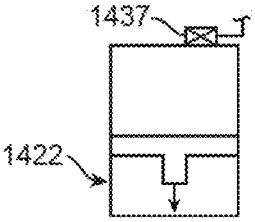
Figure 14E:
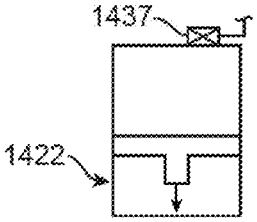
Figure 14H:
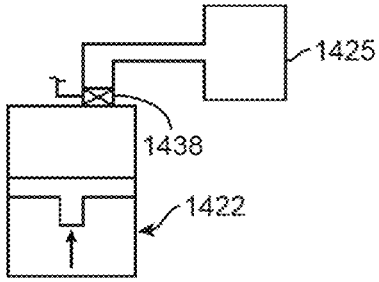
Figure 14C:
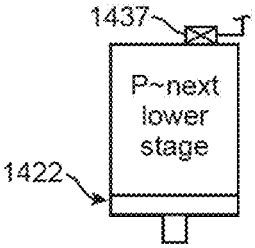

For example, one form of operation of system elements that may be coordinated by a processor is active control over gas flow valve timing. FIGS. 14A-C show closure of the gas flow valve 1437 in an expansion cycle, prior to the reciprocating piston reaching BDC. This valve timing serves to limit an amount of compressed gas ($V_0$) admitted to the cylinder, to less than the full volume of the cylinder. Inlet of such a reduced quantity ($V_0$) of compressed gas can desirably enhance an efficiency of energy recovery, by lowering a differential at BDC between the pressure of gas expanded within the chamber, and the pressure of the low pressure side. This low pressure side can be of a successive lower-pressure stage (in the case of a multi-stage expander), or can be of an outlet (in the case of a final stage or single-stage expander).

Figure 14F:
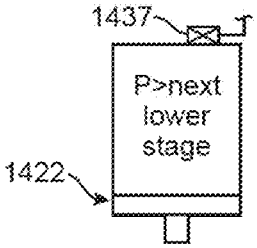

Active valve actuation can also enhance the power recovered from the expansion of compressed gas. For example, FIGS. 14D-F show closure of the gas flow valve 1437 in an expansion cycle. Here, this valve timing serves to admit an amount of compressed gas ($V_+$) to the cylinder, that is greater than ($V_0$). The expansion of a larger volume of gas results in the piston being driven downward with higher energy, resulting in a greater amount of power being output from the system.

Active valve actuation to control power output during expansion, may be particularly relevant to stand-alone energy storage units that are not connected to the grid. Such control can allow maintenance of electrical output at a fixed frequency while the load and gas pressure are changing. In a technique known as "cut-off", active valve control has previously been used to control steam engines, where steam pressure and load vary. According to certain embodiments, a simple speed sensor feedback could be used for such valve control.

A larger power output from expansion may occur at the expense of efficiency, as the inlet compressed gas expands to a pressure greater than that of the low pressure side. This can reduce system efficiency by not extracting the maximum amount of energy from the compressed gas. This can also reduce system efficiency by creating a pressure differential at the end of the expansion stroke.

In a manner analogous to that described above for expansion, active valve actuation can also enhance the efficiency of a gas compression cycle. For example, as shown in FIGS. 14G-H, during the addition of gas and compression, the valve 1438 between the cylinder device 1422 and the storage unit 1425 (high pressure side) remains closed, and pressure builds up within the cylinder.

In conventional compressor apparatuses, accumulated compressed gas may be contained within the vessel by a check valve, that is designed to mechanically open in response to a threshold pressure. Such use of the energy of the compressed air to actuate a check valve, detracts from the efficiency of energy recovery by consuming energy to perform work.

Figure 14I:
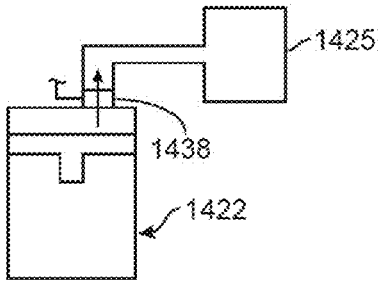

By contrast, as shown in FIG. 14I, embodiments of the present invention may actively open outlet gas flow valve 1438 under desired conditions, for example where the built-up pressure in the cylinder matches or is near the pressure on the high pressure side. In this manner, energy from the compressed air within the cylinder is not consumed by the valve opening process, and efficiency of energy recovery is enhanced.

Active control of a gas inlet valve during a compression cycle, can serve to increase the flow rate of compressed gas. For example, where the compressed gas supply is low but there exists a high expected need for stored energy (e.g., the night preceding onset of a forecasted heat wave), the timing of opening of an inlet valve may be prolonged to admit more gas than can be compressed with the greatest efficiency. Such a mode of operation results in a higher flow rate of compressed gas, allowing the compressed gas storage unit to be replenished more rapidly in order to meet the expected future demand.

A larger flow rate may take place at the expense of efficiency, as compression results in a greater pressure differential between the chamber and high pressure side at the conclusion of the compression stroke. Efficiency of the compression process could also be eroded by an increase in temperature of the gas being compressed to a higher pressure.

Active valve actuation schemes may facilitate active valve actuation to achieve one or more of the aims described in connection with FIGS. 14A-14I.

Figure 14J:
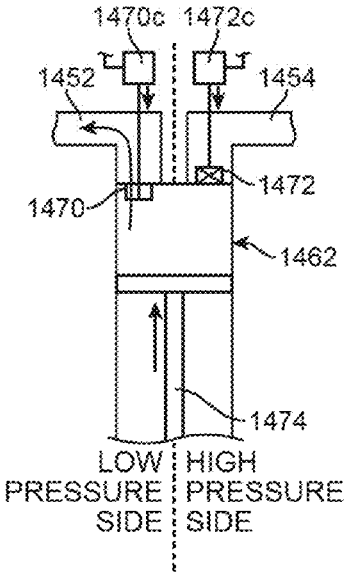
FIGS. 14JA-E are simplified schematic representations showing operation of a valve and cylinder configuration.
Figure 14J:
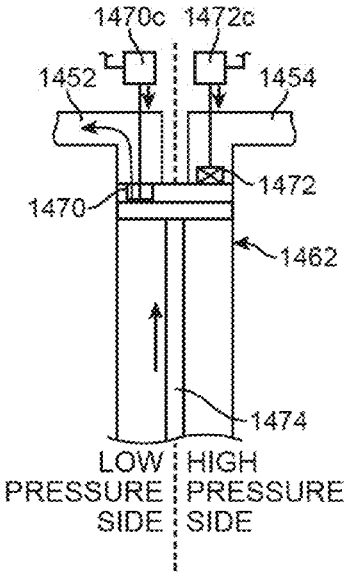
Figure 14J:
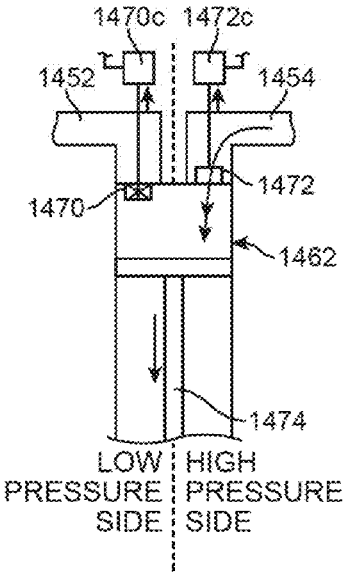
Figure 14J:
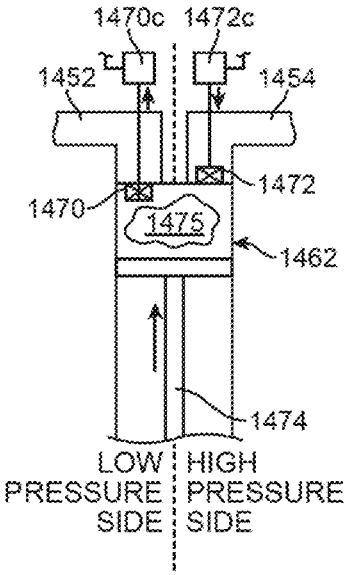
Figure 14J:
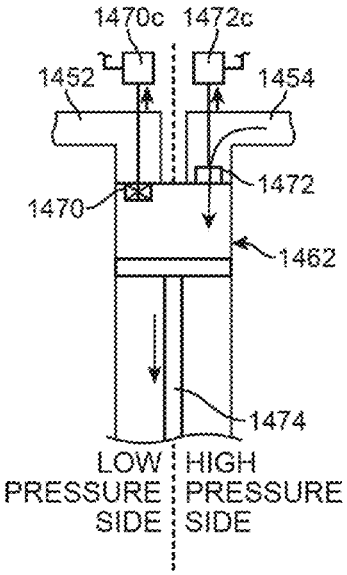

FIGS. 14JA-JE show timing of opening and closing of valves during expansion mode in accordance with an embodiment. FIGS. 14JA-JE show the valves in an end wall of the cylinder for purposes of illustration, but the valves could be positioned anywhere in the chamber proximate to the maximum upward extent of the piston head.

In FIG. 14JA, the piston 1474 is approaching the top of the cylinder 1462, and gas expanded during the previous piston stroke is now being exhausted to the low pressure side through open valve 1470. As shown in FIG. 14JB, in one approach valve 1470 may be maintained open until the piston reaches the very end of its expansion stroke, thereby exhausting all of the expanded air.

Such timing of actuation of valve 1470, however, could result in the loss of energy from the system. As specifically shown in FIG. 14JC, at the beginning of the next (downward) stroke of the piston, valve 1472 in communication with the high pressure side would open, and high pressure gas would rush into the chamber. The energy associated with such rapid flow of the high pressure gas would be lost to subsequent expansion, thereby reducing the power output.

According to the alternative valve timing approach of FIG. 14ED, this energy loss may be avoided by closing valve 1470 prior to the piston head reaching the top of the cylinder. In this configuration, the remaining expanded gas 1475 within the cylinder would be compressed by continued upward movement of the piston. This compression would elevate the pressure in the top of the cylinder, reducing the pressure differential as valve 1472 is subsequently opened in FIG. 14JE. In this manner, the incoming gas would flow at a lower rate, reducing energy losses associated with pressure differentials.

The approach of FIGS. 14JD-14JE would also reduce the energy consumed by valve actuation. In order to open, solenoid 1472*c* must move the plate of valve 1472 against the pressure exerted by the high pressure side. However, the increased backpressure within the cylinder resulting from early closing of valve 1470, would provide additional bias to assist this movement of the valve plate during opening of valve 1472.

The compression ratio of a stage can determine the magnitude of a temperature change experienced by that compression stage. Such control over compression ratio may be achieved in several possible ways.

In one approach, the compression ratio may be determined by controlling $V_{closed}$. For example $V_{closed}$ may be controlled through the timing of actuation of valves responsible for admitting flows of gas into the chamber for compression.

A controller may be in electronic communication with various elements of a gas compression system. Based upon the results of the calculation, the controller may instruct operation of system elements to ensure that even temperature changes are maintained at the different stages.

Figure 14K:
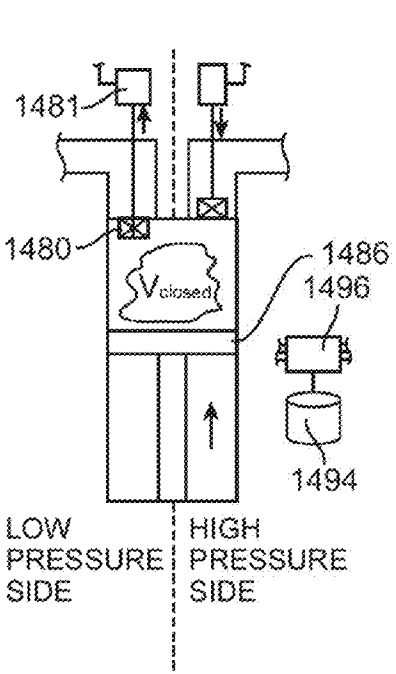
FIGS. 14KA-KC show views of a stage operating as a compressor.
Figure 14K:
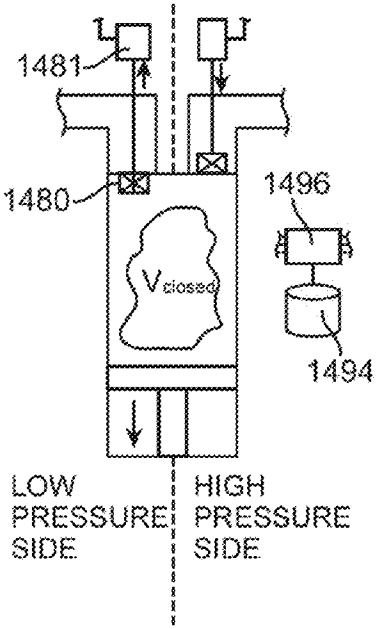
Figure 14K:
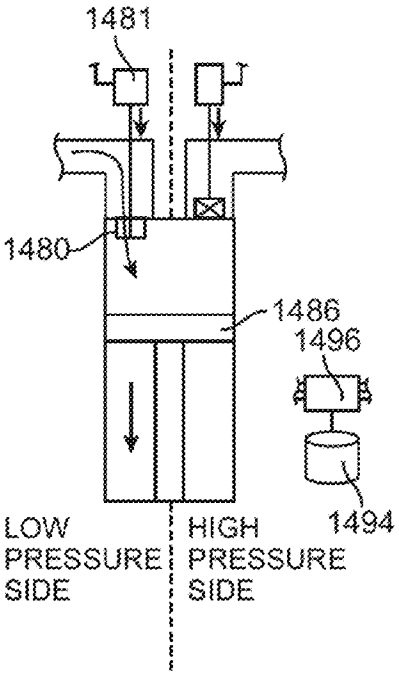

For example, in certain embodiments the controller may actuate a valve responsible for admitting gas into a compression chamber. FIGS. 14KA-KC show an example of such inlet valve actuation in the case of compression. Specifically, Figures KA-KB show a compression stage 6300 where piston 6306 is undergoing a stroke prior to compression, and then FIG. 63C shows the initial portion of the compression stroke.

FIG. 14KA shows valve 1492 closed with piston 1486 moving downward, and valve 1480 open to admit a flow of gas into the chamber for compression. In FIG. 14KB, valve 1480 is closed to halt the inlet of gas prior to the piston 1486 reaching BDC, thereby limiting to $V_{closed}$ the quantity of gas that may be compressed in the subsequent stroke of the piston. FIG. 14KC shows that in the subsequent compression stroke, as piston 1486 moves upward to compress the gas quantity $V_{closed}$.

By regulating the timing of closing of valve 1480, the quantity of gas which is compressed in the cylinder is determined. Specifically, because in FIG. 14KB the valve 1480 is closed prior to the piston reaching BDC, the effective volume of gas in the cylinder for compression is limited, and the compression ratio (r) of the stage is also limited.

The timing of actuation of the inlet valve 1480, may be regulated by a controller or processor. Accordingly, FIGS. 14KA-KC show the actuating element 1481 of valve 1480 as being in electronic communication with a controller 1496. Controller 1496 is in turn in electronic communication with a computer-readable storage medium 1494, having stored thereon code for instructing actuation of valve 1410.

As described in detail above, certain valve embodiment are particularly suited for implementation in conjunction with a host computer including a processor and a non-transitory computer-readable storage medium. Such a processor and non-transitory computer-readable storage medium may be embedded, and/or may be controlled or monitored through external input/output devices.

Figure 15:
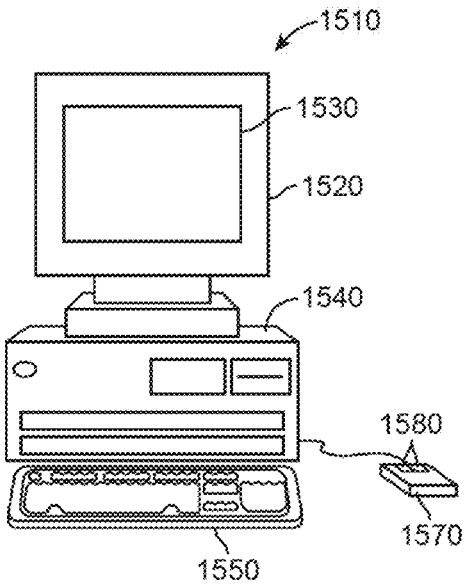
FIG. 15 shows a simplified view of a computer system suitable for use in controlling valve embodiments.

FIG. 15 is a simplified diagram of a computing device for processing information. This diagram is merely an example, which should not limit the scope of the claims herein. One of ordinary skill in the art would recognize many other variations, modifications, and alternatives. Embodiments can be implemented in a single application program such as a browser, or can be implemented as multiple programs in a distributed computing environment, such as a workstation, personal computer or a remote terminal in a client server relationship.

FIG. 15 shows computer system 1510 including display device 1520, display screen 1530, cabinet 1540, keyboard 1550, and mouse 1570. Mouse 1570 and keyboard 1550 are representative "user input devices." Mouse 1570 includes buttons 1580 for selection of buttons on a graphical user interface device. Other examples of user input devices are a touch screen, light pen, track ball, data glove, microphone, and so forth. FIG. 15 is representative of but one type of system for embodying the present invention. It will be readily apparent to one of ordinary skill in the art that many system types and configurations are suitable for use in conjunction with the present invention. In an embodiment, computer system 1510 includes a Pentium™ class based computer, running Windows™ XP™ or Windows 7™ operating system by Microsoft Corporation. However, the apparatus may use other operating systems/architectures.

As noted, mouse 1570 can have one or more buttons such as buttons 1580. Cabinet 1540 houses familiar computer components such as disk drives, a processor, storage device, etc. Storage devices include, but are not limited to, disk drives, magnetic tape, solid-state memory, bubble memory, etc. Cabinet 1540 can include additional hardware such as input/output (I/O) interface cards for connecting computer system 1510 to external devices external storage, other computers or additional peripherals, further described below.

Figure 15A:
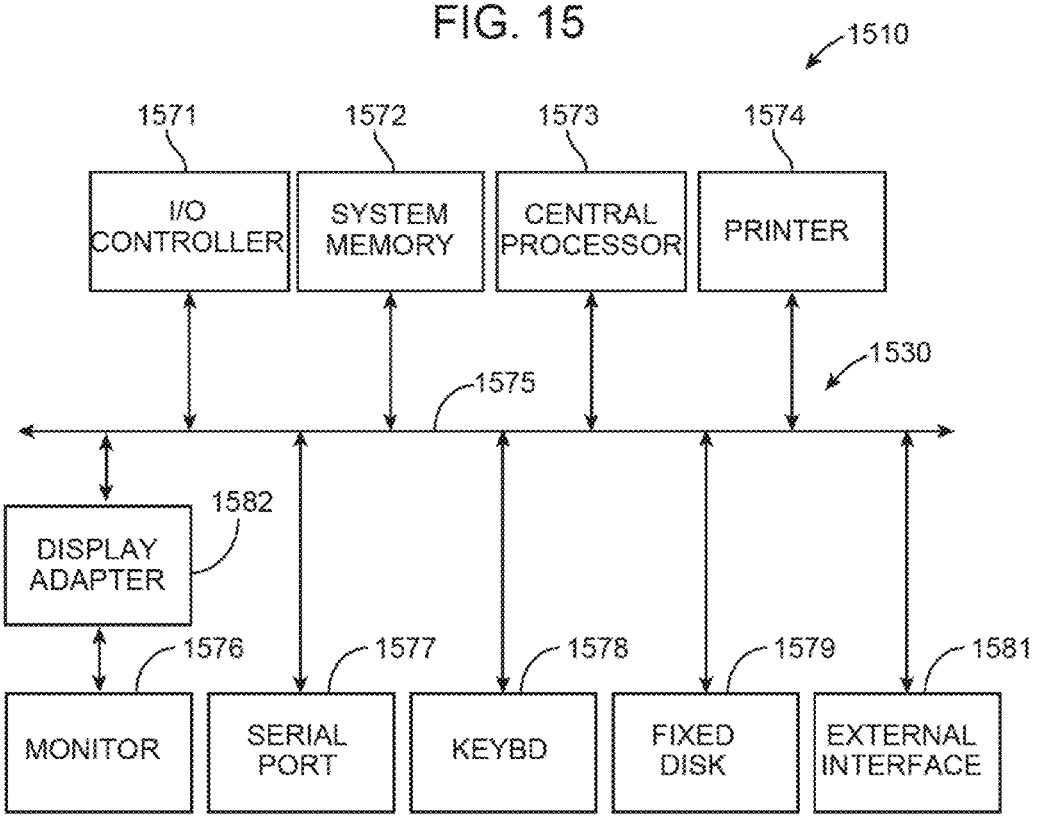
FIG. 15A is an illustration of basic subsystems in the computer system of FIG. 15.

FIG. 15A is an illustration of basic subsystems in computer system 1510 of FIG. 15. This diagram is merely an illustration and should not limit the scope of the claims herein. One of ordinary skill in the art will recognize other variations, modifications, and alternatives. In certain embodiments, the subsystems are interconnected via a system bus 1575. Additional subsystems such as a printer 1574, keyboard 1578, fixed disk 1579, monitor 1576, which is coupled to display adapter 1582, and others are shown. Peripherals and input/output (I/O) devices, which couple to I/O controller 1571, can be connected to the computer system by any number of approaches known in the art, such as serial port 1577. For example, serial port 1577 can be used to connect the computer system to a modem 1581, which in turn connects to a wide area network such as the Internet, a mouse input device, or a scanner. The interconnection via system bus allows central processor 1573 to communicate with each subsystem and to control the execution of instructions from system memory 1572 or the fixed disk 1579, as well as the exchange of information between subsystems. Other arrangements of subsystems and interconnections are readily achievable by those of ordinary skill in the art. System memory, and the fixed disk are examples of tangible media for storage of computer programs, other types of tangible media include floppy disks, removable hard disks, optical storage media such as CD-ROMS and bar codes, and semiconductor memories such as flash memory, read-only-memories (ROM), and battery backed memory.

Figure 16:
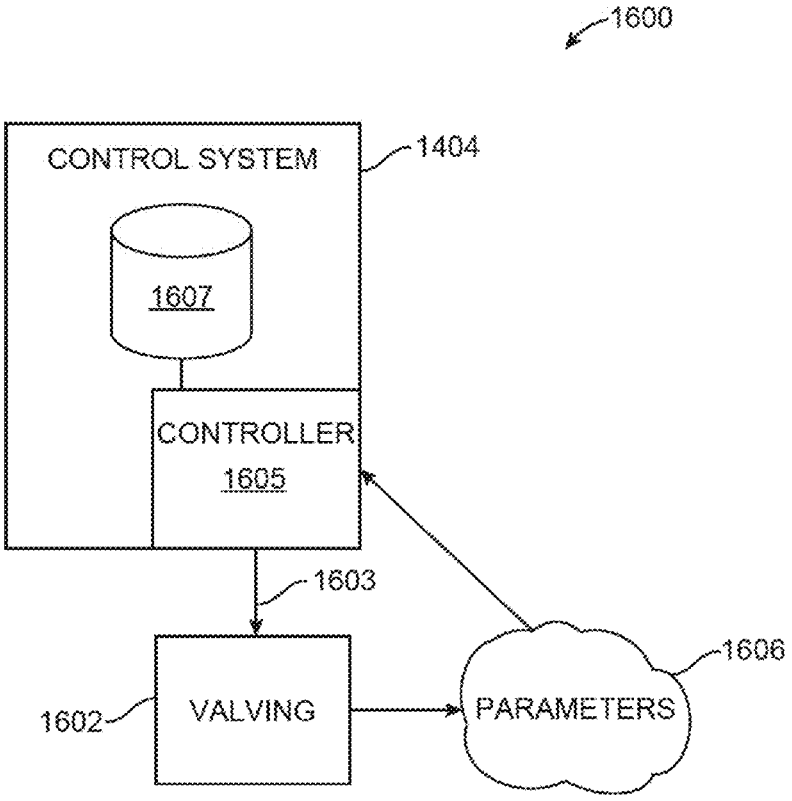
FIG. 16 shows a simplified view of a control loop for active valve control.

According to particular embodiments, active valve control may be part of a control loop based upon various parameters. Such a control loop may be implemented through a host computer as just described. FIG. 16 shows a simplified view of a control loop embodiment.

In particular, the active control loop 1600 comprises valving 1602 that is controlled based upon input signal(s) 1603 received from control system 1604 comprising a processor 1605 in communication with a non-transitory computer-readable storage medium 1607. Such a computer-readable storage medium can be based upon magnetic, optical, semiconductor, or other principles, as is well known in the art.

According to certain embodiments, such inputs from the control system could comprise voltages supplied to a motor (such as a stepper motor), that is responsible for actuating the valve. In particular embodiments, the timing and/or magnitude of the input signal(s) may be determined by the controller.

Performance of a gas compression (energy storage) or gas expansion (energy recovery) event, may occur according to one or more parameters 1606, including parameters that can be sensed. Examples of sensed parameters include but are not limited, to temperature of the compressed or expanded gas exhausted through the valving, pressure of the compressed or expanded gas exhausted through the valving, temperature of liquid separated from exhaust through the valving, speed of a shaft transmitting power (such as a crankshaft), and torque of a shaft transmitting power.

The sensed parameters are in turn communicated back to the control system. Based upon these parameters and/or other factors, relevant instructions stored in the form of computer code in the storage medium, may cause the processor to actively change the inputs to the valving.

For example, sensed parameters indicating a high pressure of gas exhausted through the valving after performance of gas expansion, may indicate less efficient performance. Accordingly, the processor could instruct change in the valve timing to reduce a duration of openness of the valve responsible for intake of the compressed gas prior to expansion. This will in turn reduce the quantity of gas available for expansion within a fixed volume of a cylinder, and hence the final output pressure differential, thereby improving efficiency.

In another example, sensed parameters indicating a high temperature of gas exhausted through the valving after performance of gas compression, may also indicate less efficient performance. Accordingly, the processor could instruct change in the valve timing to reduce a duration of openness of the valve responsible for intake of the gas prior to compression. This will in turn reduce the quantity of gas available for compression within a fixed volume of a cylinder, but improve thermodynamic efficiency of the compression process.

In still another example, sensed parameters indicating a high torque of the shaft communicating power from expanding gas, may also indicate less efficient performance. Based upon this sensed data, the processor could instruct change in the valve timing to reduce a duration of openness of the valve responsible for intake of compressed gas for expansion. This will in turn reduce the quantity of gas available for expansion and hence the power of the output, while improving efficiency.

As indicated previously, efficiency of operation of the system may be balanced with an output of power (expansion), or of compressed gas (compression). Thus active valve control according to embodiments of the present invention is certainly not limited to the particular examples given above, and alternatives could be utilized to favor output over efficiency.

Moreover, certain embodiments may provide other forms of desired output (such as control over temperature). Accordingly, various embodiments could focus upon active valve control approaches to achieve those desired outputs, while balancing efficiency versus power.

Ideally efficient operation generally occurs when the valves are opened with the pressure being equal across the valve. In a practical system, perturbing the opening and closing times around this ideal can improve efficiency.

Thus various control loops may be employed based upon sensed quantities including but not limited to, inlet pressure, in-chamber pressure, and outlet pressure, in order to adjust these parameters. Additionally, efficiency may be estimated from such values as shaft RPM and torque, and air flow rate in conjunction with the pressures and temperatures mentioned earlier.

In certain situations, a goal may be to maximize efficiency. However, in other situations other goals are possible, for example maximizing power output, or matching a desired power output, or some desired combination of these. The required output power could come from additional computation that may consider factors as time of day, time of year, weather, electricity pricing models, and/or historical demand patterns of a particular user or consumer population.

Figure 16A:
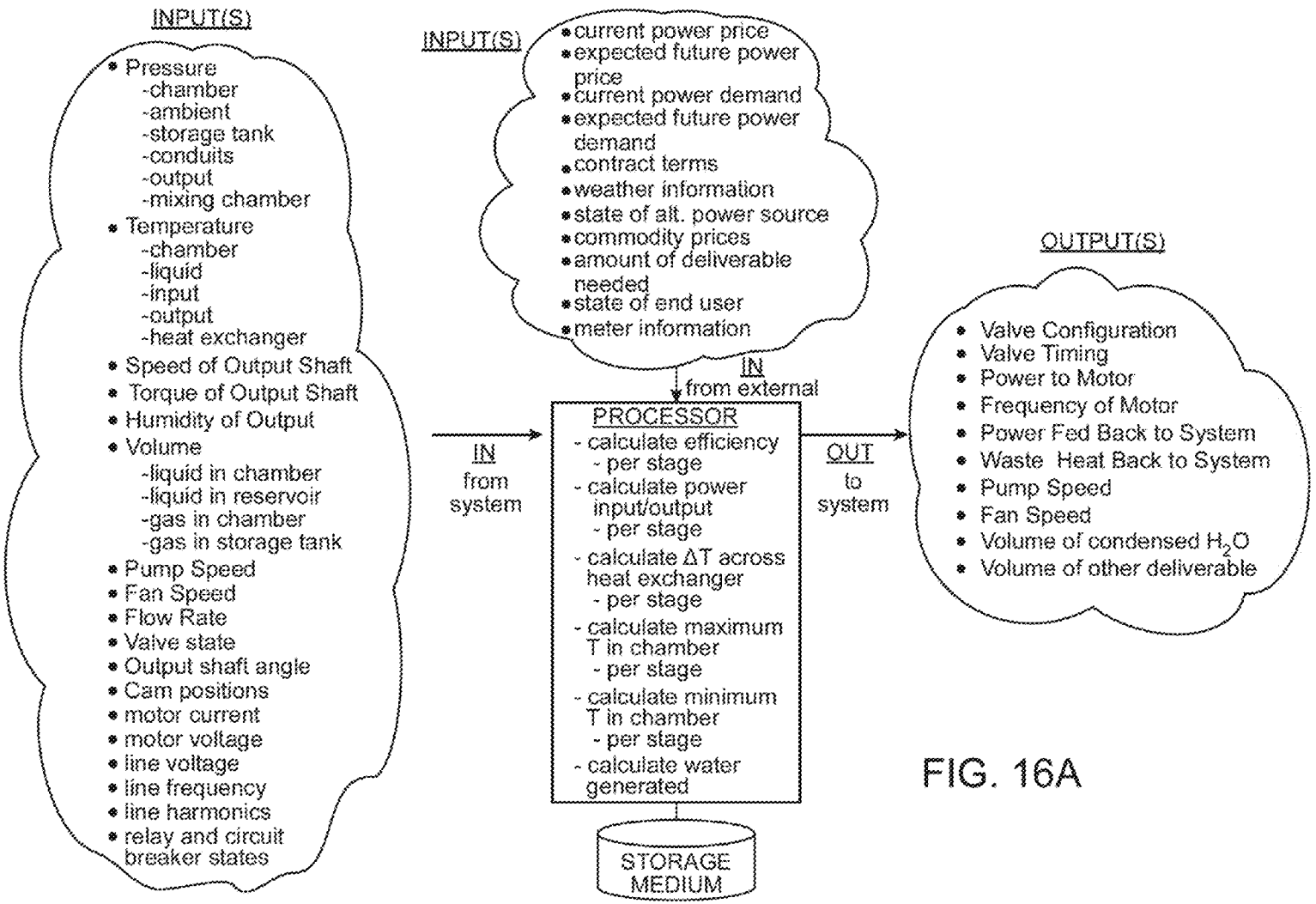
FIG. 16A is a block diagram showing inputs and outputs to a controller responsible for controlling operation of various elements according to embodiments.

FIG. 16A is a schematic diagram showing the relationship between a processor/controller, and the various inputs received, functions performed, and outputs produced by the processor controller. As indicated, the processor may control various operational properties of the apparatus, based upon one or more inputs. Examples of such inputs include but are not limited to output shaft angle, cam positions, motor current, motor voltage, line voltage, line frequency, line harmonics, relay and circuit breaker states. Operational parameters include but are not limited to the timing of opening/closing of gas flow valves and liquid flow valves, as described in detail herein.

Based upon input received from one or more system elements, and also possibly values calculated from those inputs, a controller/processor may dynamically control operation of the system to achieve one or more objectives, including but not limited to maximized or controlled efficiency of conversion of stored energy into useful work; maximized, minimized, or controlled power output; an expected power output; an expected output speed of a rotating shaft in communication with the piston; an expected output torque of a rotating shaft in communication with the piston; an expected input speed of a rotating shaft in communication with the piston; an expected input torque of a rotating shaft in communication with the piston; a maximum output speed of a rotating shaft in communication with the piston; a maximum output torque of a rotating shaft in communication with the piston; a minimum output speed of a rotating shaft in communication with the piston; a minimum output torque of a rotating shaft in communication with the piston; a maximum input speed of a rotating shaft in communication with the piston; a maximum input torque of a rotating shaft in communication with the piston; a minimum input speed of a rotating shaft in communication with the piston; a minimum input torque of a rotating shaft in communication with the piston; or a maximum expected temperature difference of air at each stage.

While the above has discussed valve timing as one example of a parameter that can be controlled by the processor, others may be controlled. One is the amount of liquid introduced into the chamber. Based upon one or more values such as pressure, humidity, calculated efficiency, and others, an amount of liquid that is introduced into the chamber during compression or expansion, can be carefully controlled to maintain efficiency of operation. For example, where an amount of air greater than $V_0$ is inlet into the chamber during an expansion cycle, additional liquid may need to be introduced in order to maintain the temperature of that expanding air within a desired temperature range.

The central controller or processor may be in communication with one or more sources of information, which may be internal or external. Examples of internal information sources include various system sensors. Examples of external information sources include but are not limited to a smart grid, the internet, or a LAN.

Based upon instructions in the form of computer code stored on non-transitory computer-readable storage medium, the controller or processor may operate to control various elements of the system. This control may be based upon data received from various sensors in the system, values calculated from that data, and/or information received by the controller or processor from sources such as a co-situated end user or external sources.

According to embodiments, a gas compression and/or expansion system may be configured to operate in response to data received from one or more outside sources, such as a smart grid. Based upon the external information, a controller or processor of the processor may regulate operation of system elements in a particular manner. Examples of such external information which may be received include but are not limited to, a current price of electricity, a future expected price of electricity, a current state of demand for electricity, a future state of demand for electricity, meteorological conditions, and information regarding the state of the power grid, including the existence of congestion and possible outages.

In certain circumstances, operation of the system may be halted based upon information that is received. For example, where the information received indicates a high demand for electricity, operation of the system to compress air may be halted by the controller, in order to reduce a load on the grid.

Alternatively, energy received by the system controller or processor may result in commencement of operation of the system. For example, an embodiment of a system may function in the role of an uninterruptible power supply (UPS), such that it is configured to provide energy on a continuous basis in certain applications where interruption in power could have harmful results, such as industrial processes (for example a semiconductor fabrication facility), transportation nodes (for example harbors, airports, or electrified train systems), or healthcare (hospitals), or data storage (server farms). Thus receipt of information indicating either an imminent reduction (brownout) or loss (blackout) of power from the grid, or even the risk of such an event, may cause the processor or controller to instruct the compressed gas energy storage and recovery system to operate to provide the necessary power in an uninterrupted manner.

Under certain circumstances, information provided to a controller or processor may determine operation of a compressed gas storage and recovery system in a particular mode, for example a compression mode, an expansion mode, or a combined compression and expansion mode. Under certain circumstances, information received by the controller may indicate a reduced price for power, causing the energy storage and recovery system to operate in compression mode in order to store energy at low cost.

Moreover, a compressed gas energy storage and recovery system typically operates at some balance between an efficiency of energy storage/recovery, and an amount of power that is stored/produced over a given time frame. For example, an apparatus may be designed to generate power with maximum efficiency based upon expansion of compressed gas in particular volume increments. Expansion of other volume increments may result in a greater power output, but at a reduced efficiency. Similarly, compression of gas volumes in increments outside of a particular range, may result in less efficient conversion of energy into the form of compressed gas for storage.

Under certain circumstances, embodiments of systems in accordance with the present invention may be operated under conditions of optimized efficiency. For example, where the grid indicates ordinary prices and/or demand for power, a controller may instruct components of the system to operate to compress or expand gas with maximum efficiency.

Alternatively, based upon information received from the grid or from other sources such as the internet, the controller or processor may instruct the system to operate under conditions deviating from maximum efficiency. Thus where the smart grid indicates a relatively low price for electricity (for example outside of peak demand times between 7 AM-5 PM on weekdays), the processor or controller may instruct compression of gas in a manner calculated to consume larger amounts of power for energy storage while the price is low.

According to certain embodiments, information relevant to operation of the energy storage and recovery system may be available on an ongoing basis from the external source. In such circumstances, code present in the non-transitory computer-readable storage medium may instruct the system processor or controller to actively monitor the external source to detect information availability or changes in information, and then to instruct elements of the system to operate accordingly.

In some embodiments, relevant information may be actively communicated from the external source to the controller of the energy storage and recovery system. One instance of such active communication is under control of a governor."

Another instance of such active communication are solicitations of a demand response system. Specifically, in certain embodiments a processor or controller of a storage system may receive from the operator of the power grid, an active solicitation to reduce demand during peak periods as part of a demand response system. Thus, the controller or processor may instruct operation of the system to output sufficient power to compensate for an end user's reduced load on the grid as part of such a demand response system.

When received information indicates a relatively low price for electricity (such as in the middle of the night), the processor or controller may instruct compression of gas in a manner calculated to consume larger amounts of power—for example compression of gas in large volume increments while a price is low. In such cases, the extra cost associated with the inefficiency of such compression, may be offset by the low cost of the energy that is available to perform compression.

Factors other than present demand, may influence the terms at which energy is bought and sold. For example, future power demand or future price may be considered by the controller or processor in determining conditions of operation of the apparatus.

Thus under certain circumstances where a future price of energy is expected to be particularly high, the controller or processor may operate the system in a particular manner. One example of this may be a heat wave, where demand is expected to spike based upon a meteorological forecast. In view of such an expectation, the controller or processor may instruct the system to prepare for the future conditions, for example by operating to compress additional gas—possibly with reduced efficiency—in advance of the expected spike in demand.

Other factors potentially influencing system operation, include specific contractual terms between the power network operator and the system owner. Such terms can include a maximum load (and/or minimum power output in distributed generation schemes) required over a particular time frames, and incremental or tier-based bonuses, penalties, and multipliers for power output or consumption. Conformity or divergence from these contract terms can be an important factor in dictating operation of the energy storage and recovery system by the controller or processor.

Thus in certain embodiments, the controller or processor may take such contractual terms into consideration in operating the apparatus. For example, the contract between the end user and the grid operator may establish a maximum load able to be drawn by the user from the network over a particular time frame. Thus where this baseline quantity is in danger of being exceeded, the controller or processor may instruct operation of the system under conditions of higher power output and lower efficiency to ensure satisfaction of the contractual obligation.

Still another type of information potentially influencing system operation, is the expected availability of sources of energy to the power grid. For example, where information received indicates a forecast for future cloudy conditions at the site of a solar energy farm known to provide energy to the network, a processor or controller of the apparatus could instruct the system to operate in compression and at low efficiency to store large amounts of compressed gas in advance of the expected later higher energy prices.

Yet another type of information which may be considered by a system controller or processor, is the potential availability of other sources of power. For example, the system may be configured to receive energy in different forms from a plurality of sources (e.g. turbine, renewable energy resource). In particular, the system may receive energy in the form of electrical power directly from the grid itself, or from operation of a local energy source such as a rooftop array of photovoltaic cells. The system may receive energy in physical form (such mechanical, hydraulic, or pneumatic) from the local source, for example a proximately-located wind turbine or turbine. The system may receive energy in thermal form from the local source, for example a thermal solar apparatus.

Thus where information regarding favorable wind conditions is received from the local generator, the controller or processor could instruct the system to operate in compression to store compressed gas, owing to the ready availability of power directly from the wind turbine. Upon abatement of the winds, the energy stored in this compressed gas could later be recovered by operating in an expansion mode to output power to an end user directly, to the grid through the network, or to both. A similar situation may exist where energy from favorable solar conditions provide energy for the compression of gas.

Under certain circumstances, favorable solar conditions could result in operation of the system in expansion. For example, favorable solar conditions could allow the communication of heat from a thermal solar apparatus to enhance the power output from expanding gas, or to enhance the efficiency of energy recovery from expanding gas.

In certain embodiments the local energy source may be non-renewable, such as a combustion turbine or motor. Thus where a supply of compressed gas in the storage unit has been exhausted by prior expansion activities and power is still required, the controller may instruct the generator to create power from operation of the local turbine or motor that is consuming power from an energy source other than the grid (i.e. a natural gas distribution network).

Still other types of information that may be available to a controller or processor of an energy storage system, include profiles of congestion on a power grid. Thus where information is received indicating difficulty (or expected future difficulty) in transmitting power through certain local areas of the grid, the processor or controller could instruct operation of the system accordingly.

For example, prior to expected periods of grid congestion information, a controller or processor could configure the system to store energy transmitted through particular grid nodes. Later, the system could be instructed to operate in an expansion mode to output this power on the un-congested side of the node, allowing demand to be met.

Information received by the system controller or processor can take several forms. In some embodiments, the controller may receive information directly from the power grid, for example pursuant to the Smart Grid Interoperability Standards being developed by the National Institute for Standards and Technology (NIST). Incorporated by reference herein for all purposes, are the following documents: "NIST Framework and Roadmap for Smart Grid Interoperability Standards, Release 1.0*", dated January 2010; and "SmartGrid: Enabler of the New Energy Economy", Electricity Advisory Committee (December 2008). Information expected to be available over such a smart grid includes but is not limited to, current prices for power, expected future prices for power, readings of metered power consumption or output onto the power grid including historical peaks of consumption, indications of grid congestion, grid brown-outs, or grid black-outs.

The controller or processor may also configure the system based upon information other than as directly available over a smart power grid. For example, according to some embodiments the controller may receive other types of information over the internet that could influence system operation, including but not limited to as weather forecasts or longer-term price futures for power, or for commodities such as coal or oil that are used in the generation of power. Based upon such information, the controller or processor can also control operation or non-operation of the system, a mode of operation of the system, and/or balance of efficiency versus power consumed or output over a given time frame.

Another possible source of information is a meter indicating current and historical consumption of electricity off of the power grid by a particular user. For example, in certain embodiments a compressed gas energy storage and recovery system may be situated with an end user that is a large consumer of power, such as an industrial complex. Based upon information received from the electrical meter for that site, the controller or processor may configure the system to operate in a certain manner. One example of such information is historical peak load data for the end user.

The expected power demand of an end user is another example of information that may be used as a basis for controlling the energy storage and recovery system. For example, where an industrial facility expects to operate at enhanced or reduced capacity, that information could be utilized to determine system operation In addition to information from external sources, the controller or processor also receives information internal to the system. Such internal information may include data from sensors configured to measure physical parameters within the system, including but not limited to valve state, temperature, pressure, volume, humidity, flow rates of liquids and gases, and speeds and torques of moveable elements within the system, such as fans, pumps, pistons, and shafts in communication with pistons. Additional examples of internal information which may be provided to the controller or processor include but are not limited to power drawn by the operation of motors such as pumps or fans.

In the broadest sense, the controller or processor may regulate the function of a system element to determine whether the system operates at all. An example of such an element is the valving between the compressed gas storage unit and the compressor/expander. Closure of this valve would prevent operation of the system in compression mode to flow gas into the storage unit. Closure of this valve would also prevent operation of the system in expansion mode to flow gas from the storage unit for energy recovery. Thus where a pressure within a storage vessel indicates near-depletion of the compressed gas, the controller or processor may halt operation of the system until conditions allow replenishment of the gas supply under economically favorable conditions.

When the system is operating, the controller or processor may regulate a system element to determine the operational mode. An example of this kind of system element is a valve such as a three-way valve. The state of such a valve could be regulated by the controller to control flows of liquids or gases within the system in a manner corresponding to a particular mode of operation. Thus where a pressure within a storage vessel indicates near-depletion of the compressed gas, the controller or processor may instruct operation of the system in a compression mode to replenish the gas supply.

Compressed gas energy systems according to embodiments may be incorporated into the generation layer of a power network to levelize output of renewable energy sources that are variable in nature. For example, the output of a wind turbine is tied to the amount of wind that is blowing. Wind speed can rise or fall over relatively short periods, resulting in a corresponding rise and fall in the power output. Similarly, the output of a solar energy harvesting apparatus is tied to the amount of available sunshine, which can change over relatively short periods depending upon such factors as cloud cover.

Conventionally however, power networks have relied upon energy sources such as fossil fuel power plants, that exhibit an output that is substantially constant and controllable over time. This difference between renewable energy sources and those traditionally relied upon by power networks, may pose a barrier to the adoption renewable energy sources such as solar and wind power that are intermittent and/or variable in nature.

Figure 16B:
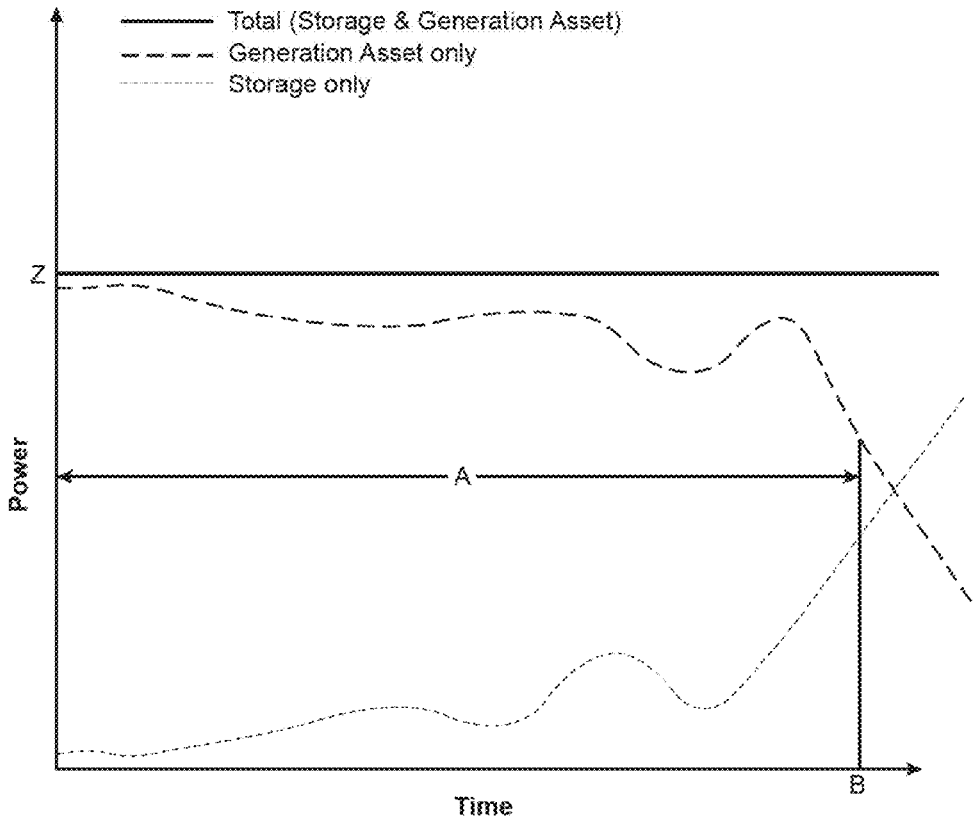
FIG. 16B shows a simplified view of the levelizing function that may be performed by a compressed gas energy storage and recovery system according to an embodiment.

Accordingly, embodiments of compressed gas energy storage and recovery systems of the present invention may be coupled with renewable energy sources, in order to levelize their output onto the power network. FIG. 16B shows a simplified view of such a levelizing function.

For example, over the time period A shown in FIG. 16B, the compressed gas energy storage and recovery system provides sufficient output to make up for differences between the variable output of the renewable alternative energy resource and a fixed value Z. This fixed value may be determined, for example, based upon terms of a contract between the owner of the generation asset and the network operator.

Moreover, at the time period starting at point B in FIG. 16B, the energy provided by the renewable generation asset falls off precipitously, for example based upon a complete loss of wind or an approaching storm front. Under such circumstances, the compressed gas energy storage and recovery system may be configured to supply energy over a time period following B, until another generation asset can be ramped up to replacement energy coverage over the longer term.

In certain embodiments, the compressed gas energy storage and recovery system could be configured to transmit a message to the replacement generation asset to begin the ramp-up process. Such a message could be carried by a wide area network such as the internet or a smart grid, where the compressed gas energy storage and recovery system is not physically co-situated with the replacement generation asset.

Operation of an embodiment of a system according to embodiments with a power grid could be coordinated by a central processor receiving inputs and producing outputs based upon a control algorithm. An example of such operation is now described in connection with FIGS. 16C-16CA.

Figure 16C:
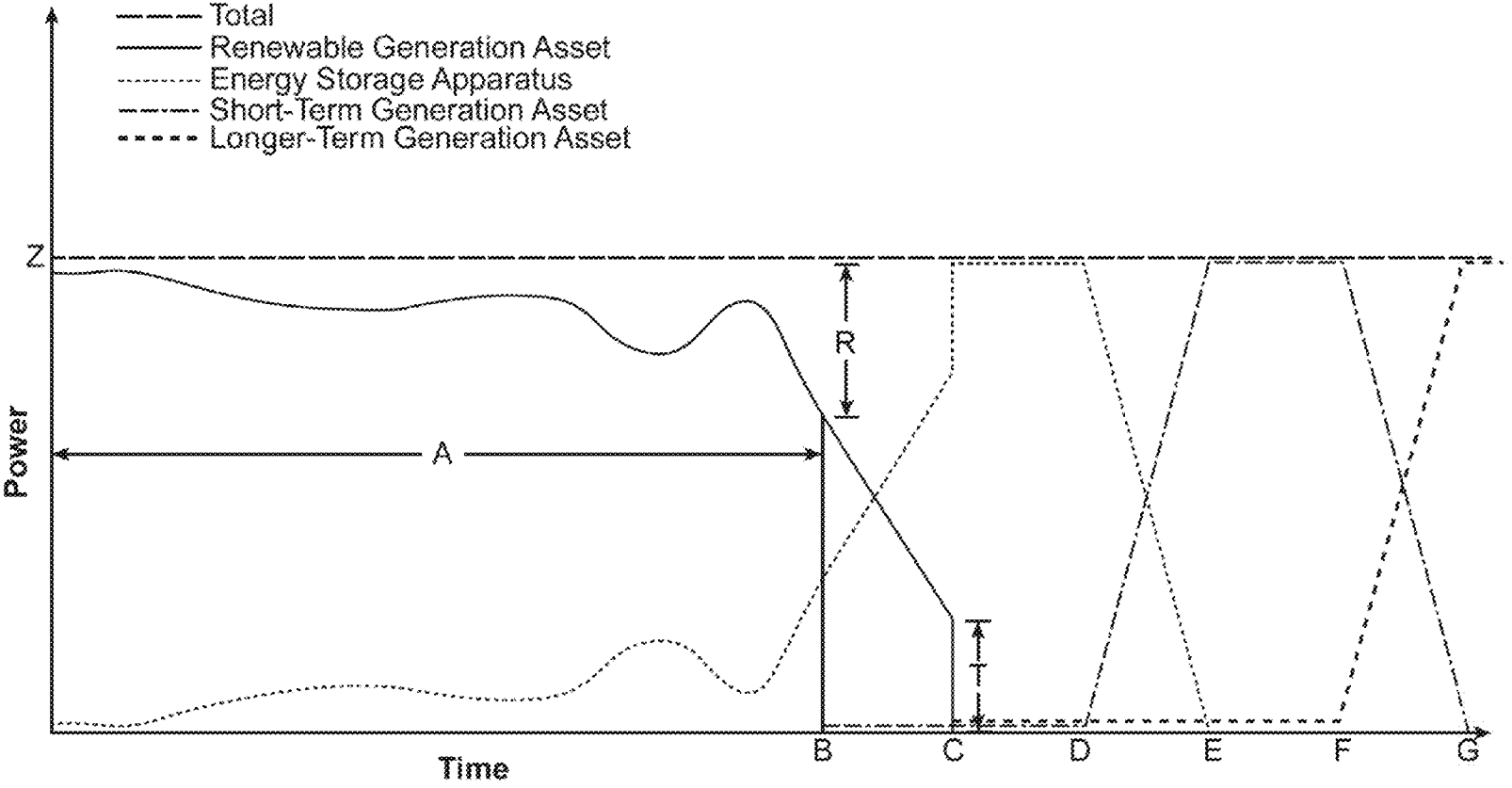
FIG. 16C plots power over time showing an example of a transition of grid capacity from a renewable energy source to a long-term generation asset.
Figure 16C:
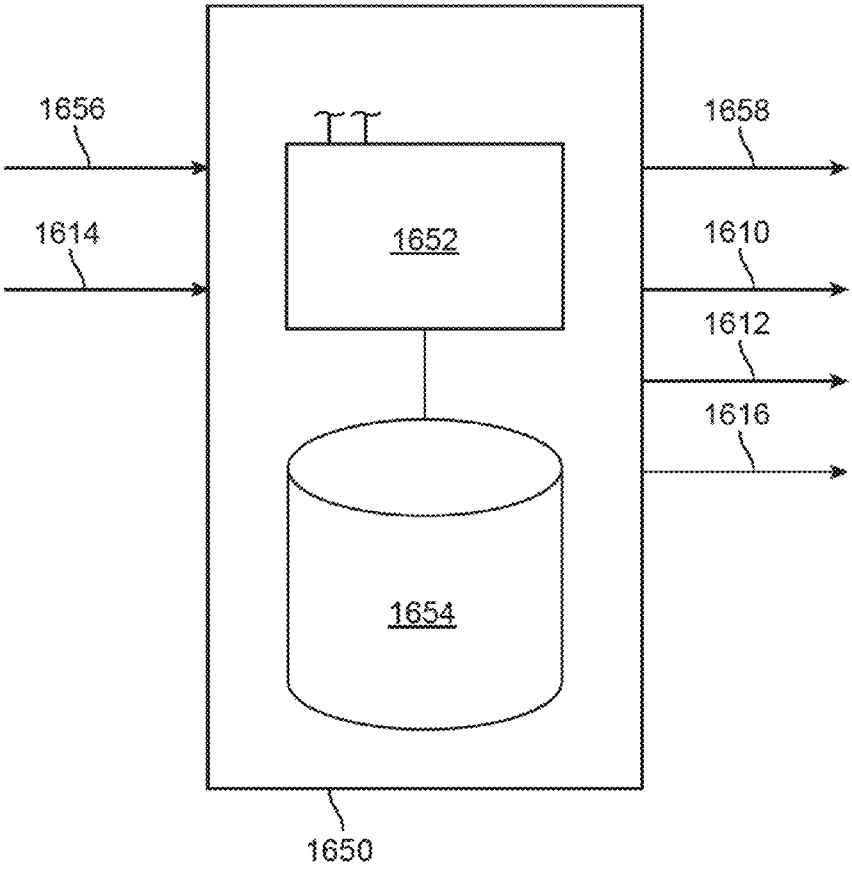

FIG. 16C plots power output over time, of various elements of a power supply network. A first element is a renewable energy source (such as wind farm), whose output is variable depending upon natural forces. A second element is a system according to an embodiment.

A third element whose power output is shown in FIG. 16C, is a short-term generation asset. Such a short-term generation asset may be configured to provide power on short notice, but at low efficiency and/or relatively high cost. An example of such a short-term generation asset is a diesel generator, or even another energy storage apparatus.

A fourth element whose power output is shown in FIG. 16C, is a longer-term generation asset. Such a longer-term generation asset may be configured to provide efficient power at relatively low cost, but requiring longer term notice. An example of such a longer-term generation asset is a natural gas turbine.

Operation of these various elements may be coordinated by a central processor, in order to maintain a stable supply of power on the network while ensuring efficient utilization of available resources. FIG. 16A shows a simplified view of an example of a system 1650 comprising a processor 1652 in electronic communication with a power supply network and with an energy storage apparatus, the system further comprising a non-transitory computer-readable storage medium 1654 in electronic communication with the processor and having stored thereon code configured to cause the processor to:

- receive an input 1656 relating to a predicted change in a load of the power supply network, or a change in generation capacity available to the power supply network,
- process the input according to a control algorithm,
- communicate a first signal 1658 either automatically causing the energy storage apparatus to operate to output electrical power, or recommending a human operator to instruct the energy storage apparatus to operate to output electrical power, and
- communicate a second signal 1610 either automatically causing ramp-up of a generation asset of the power supply network, or recommending the human operator to instruct ramp-up of a generation asset of the power supply network.

According to certain embodiments, the input may originate from the power supply network, for example a demand response command). In some embodiments, the input may originate from the meter, for example indicating consumption approaching or exceeding a historic peak.

In certain embodiments, the input may be a predicted change in wind or solar energy at a renewable generation asset of the power supply network. The input may comprise an environmental temperature change indicative of the changed load, or may comprise a weather disturbance predictive of disruption of the power supply network.

In certain embodiments, the energy storage apparatus may be configured to output the electrical power directly to a consumer located behind a meter of the power supply network. According to particular embodiments, the energy storage apparatus may be configured to output the electrical power onto the power supply network, for example to a distribution or transmission layer through a transformer, or to a generation layer through a busbar.

In certain embodiments the energy storage system may store energy in electrical form, for example a battery or capacitor bank. In some embodiments, the energy storage apparatus is configured to generate the electrical power from expansion of compressed gas in a presence of a liquid to drive a physical linkage such as a crankshaft. Particular embodiments may introduce the liquid by spraying with a rotational motion followed by impingement upon a deflection surface.

According to some embodiments, the non-transitory computer readable storage medium may further include code stored thereon to cause the processor to communicate a signal 1612 either automatically halting operation of the energy storage apparatus, or recommending the human operator to instruct halting of operation of the energy storage apparatus, in response to a signal 1614 indicating completion of the ramp-up of the generation asset.

A system according to particular embodiments may have the non-transitory computer readable storage medium further including code stored thereon to communicate a signal 1616 either automatically causing replenishment of the energy storage apparatus, or recommending the human operator to instruct replenishment of the energy storage apparatus.

Returning to the particular example shown in FIG. 16C, over the time interval A the renewable energy source provides a power output that varies within an expected range R. Over this same time interval A, the system according to an embodiment provides sufficient power to compensate for this variable power output and thereby maintain power at a level Z. Here, Z may represent the total power on the grid, or a portion of that total power (for example a power commitment from the wind farm established by contract). Accordingly, over the time period A neither the short-term nor the long-term generation assets are required to be used.

At a time B, the central processor receives information indicative of a long term loss of power from the renewable generation asset. For example, the renewable generation asset may communicate information indicating a pattern of changed wind velocity conforming to historical trends of substantial wind loss. Such historical trends may also be influenced by other factors, such as the time of year, the time of day, the particular geographic location of the wind turbine, and meteorological models of current and future weather activity. One possible source of predictive wind modeling is True Wind Solutions LLC of Albany, N.Y.

Accordingly, at time B the processor sends a signal to the short-term generation asset, instructing its ramp-up to begin to supply power replacing that of the renewable generation asset. As such ramp-up is not instantaneous, the processor also notifies the compressed gas storage system to expect to maintain or even increase its output in order to cover the ramp-up period of the short-term generation asset.

As predicted at time C the wind velocity drops below a threshold T, below which no power is generated from the wind turbine. At this point C the compressed gas energy storage system assumes the entire load Z.

The ability of the system according to an embodiment of the present invention to provide power, may ultimately be limited by one or more factors, including the size of its generator, the size of its storage capacity, and the current state of its existing storage capacity. In addition, the system may provide power at a certain cost that may be higher than that available from the long-term generation asset. These pieces of information are available as inputs to the processor. In response, at time C the central processor notifies the longer-term generation asset to prepare to come on-line to meet the load over the longer term.

At time D the short-term generation asset has warmed up and comes on-line, and rapidly begins to generate power to meet the full demand by time E. Over the period from D to E, the compressed gas storage system correspondingly ramps down its output.

By time F, the prolonged ramp-up period for the long-term generation asset has been reached, and that asset also now comes on-line and begins to provide increasing power to meet the load. Over the period from F to G, the short-term generation asset correspondingly ramps down its output.

The transition of FIG. 16C (from the grid receiving power primarily from the renewable energy source, to its receiving power from a longer-term generation asset), is coordinated by the central processor based upon information received from various sources. This transition is accomplished with desirable efficiency from available resources, without imperiling the stability of power on the network.

The particular transition shown in FIG. 16C, represents a highly simplified case. For example, at any given time multiple generation assets of different types (i.e. variable (renewable), baseline, peak, load following) would be contributing power to meet demand. Moreover, multiple storage apparatuses would be deployed at different points in the network, with more than one storage apparatus being used to satisfy demand at any given point in time.

The specific scenario shown in FIG. 16C is also simplified in that it shows only the activation of resources to meet demand. In a variant of these events, the wind speed could unexpectedly pick back up in a manner indicating continued dependable supply. In such a scenario, based upon this newly received information the processor could instruct/recommend suspension of ramp-up of generation assets, or other steps accommodating the now-available dependable supply of renewable energy.

The scenario shown in FIG. 16C is simplified in that the overall load is shown as unchanging. In reality, the load on the grid will experience changes over time in ways that are both predictable (e.g. daily patterns, scheduled maintenance) and unpredictable (storm damage, unscheduled maintenance). The ability of the processor to rapidly respond to such changing conditions (in the form of varying inputs), can aid a human operator in the decision-making process.

The scenario of FIG. 16C is simplified in that it presents only one particular chain of events (loss of generation capacity available from a renewable resource). A myriad of other events is of course possible, influenced by factors including but not limited to:

- weather patterns;
- demand patterns;
- energy pricing structures/agreements;
- availability of transmission and/or distribution assets;
- conditions of other interconnected power grids.

Of course, embodiments are not limited to use with renewable energy sources, or with particular energy storage systems. Rather, various embodiments could employ a central processor to control (or recommend control decisions to a human user) various assets of a power supply network to coordinate activity with different types of energy storage, of which compressed gas is only one example. Thus according to alternative embodiments, a central processor could execute a control algorithm to integrate a storage system comprising a battery, with non-renewable generation assets of a grid, for example to meet changing demands A compressed air energy storage system could be combined with batteries, capacitors, or other energy storage technology to meet short-time needs as well as long-time storage size and cost targets Examples of inputs to such a control algorithm executed by a central processor, include but are not limited to:

- existing/expected future load;
- price of power from generation asset;
- ramp-up time of generation asset;
- available storage capacity;
- storage recharge requirements;
- status of generation asset (i.e. spinning, stand-by);
- market (wholesale, A/S) price for power;
- status of renewable power sources (i.e. current/future meteorological conditions);
- transmission capacity.

Examples of decisions made or recommended to a human operator based upon inputs to a control algorithm, include but are not limited to:

- activating/de-activating generation assets;
- discharging/charging storage apparatuses;
- altering transmission/distribution pathways; and
- purchasing power from wholesale or ancillary services markets.
- reducing/shifting demand;

In connection with reducing/shifting of demand, an energy storage apparatus could perform this function without actually outputting electricity onto the network through a busbar or transformer. Specifically, an energy storage apparatus positioned behind a meter with an end user, could output power (in electrical or other forms) directly to that end user. Such power output from the storage device would effectively replace the electricity drawn by the consumer from the grid, thereby reducing the load on the power supply network.

Figure 16D:
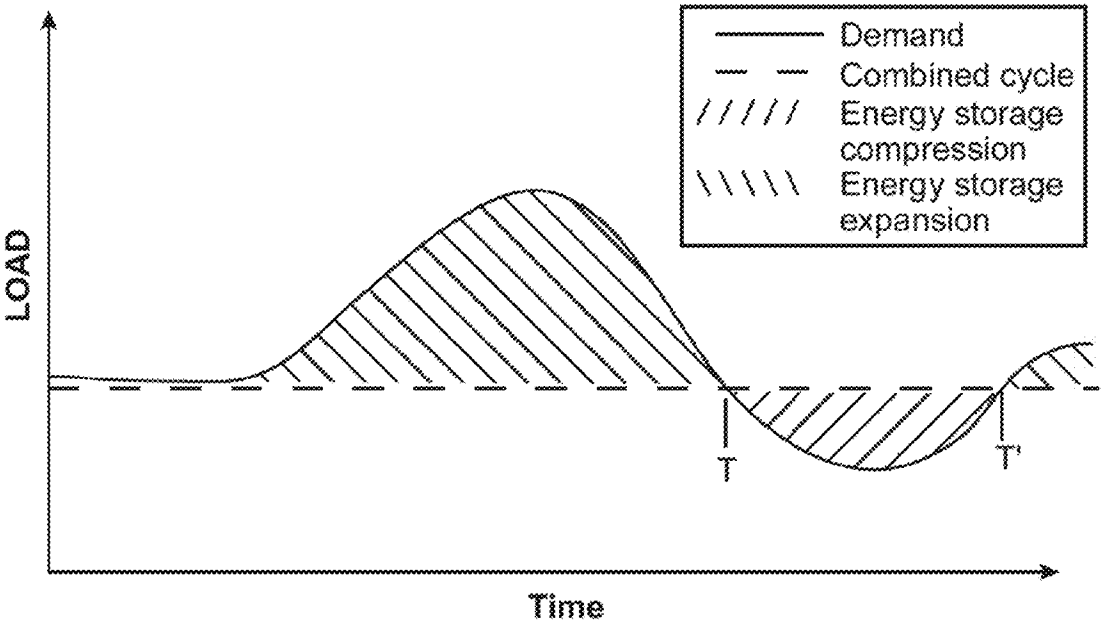
FIG. 16D plots energy output of an energy storage system and of a baseline combined cycle turbine apparatus over time, according to an embodiment.

As discussed herein, a compressor and/or expander operating as part of an energy system according to embodiments, may be throttleable based at least upon an amount of gas introduced to the chamber for compression, or an amount of compressed gas admitted to the chamber for expansion. Thus as shown in FIG. 16D a combined cycle generation asset may be operated at peak efficiency to provide baseline power to meet a load while a reversible compressor/expander of a compressed gas energy storage system throttles up or down to provide sufficient additional power to meet changes in load attributable to fluctuation in demand.

When the load in fact actually falls below the baseline load (e.g. T'>time>T), excess power output by the combined cycle generation asset may be harnessed to operate the compressor to store compressed gas for future expansion. Again, the throttleability of the energy storage system, allows this compression to occur with the combined cycle power plant continuing to maintain the baseline power output.

The controller or processor may regulate an element of the system to determine a manner of operation within a particular operational mode. For example, the efficiency of operation of the compressor/expander may depend upon the volume increments of gas which are compressed or expanded.

Regulation of operation of system elements by the controller may be based upon considerations in addition to, or in lieu of, output electrical power or efficiency. For example, in some applications, the system may function in a temperature control role, providing deliverable quantities in the form of heating or cooling capacity. Under such circumstances, the controller may control system operating parameters such as the injection or non-introduction of liquid in one or more stages, the conditions of liquid introduction in one or more stages, compression or expansion ratios of one or more stages, and other parameters in order to determine the end temperature of gases and/or liquids output from the system that may be used for such temperature control.

Cost is another example of a such a consideration for system operation. For example, actuation of a valve by the controller to compress gas in smaller volume increments, may be dictated by the controller where conditions warrant compression but a price of energy available from the power grid is relatively high. In another example, operation of a valve by the controller such that gas is expanded in smaller volume increments, may be dictated by the controller where conditions warrant expansion but a price for energy supplied to the power grid is relatively low.

Available capacity for storage of compressed gas represents is another factor that may be considered in system operation. For example, valve timing could be regulated for compression in smaller volume increments where the storage unit is nearing its capacity. Under other circumstances, valve timing could be regulated for expansion in smaller volume increments where the storage unit is nearing depletion.

Still another possible consideration in operating system elements by controller, is coordination of activity between individual stages of a multi-stage apparatus. Thus in embodiments comprising multiple stages, certain system elements may be operated by the controller in order to allow effective coordination between those stages.

One example is the timing of actuation of inlet or outlet valves to compression/expansion chambers, which may be regulated by a controller in order to allow effective operation across multiple stages. Timing of actuation of valves responsible for flows of liquid between stages, is another example of an operational parameter that may be regulated by a system controller.

Moreover, in some embodiments the individual stages of certain systems may be in fluid communication with each other through intermediary structures, including but not limited to pressure cells, heat exchangers, valves/valve networks, gas vessels, gas/liquid separators, and/or liquid reservoirs. In such embodiments, elements governing flows of materials into and/or out of such intermediary structures, may be regulated by a system controller in order to coordinate system operation. In some cases, it may be advantageous to control the relative phase of cyclically moving members in various stages to minimize pressure differentials seen by valves between those stages.

In certain embodiments, the transfer of thermal energy between the warmer atmospheric air and the expansion chamber (or heat exchanger in thermal communication therewith), may result in the formation of liquid water by condensation. Such liquid water could be made available for certain uses (for example drinking or irrigation), and hence may offer yet another type of material that is deliverable by a system. Liquid water may also be available from desalinization carried out utilizing energy derived from system embodiments.

Thus in certain embodiments, a processor or controller could be configured to regulate system operation based upon the amount of liquid water that is to be delivered by the system. Examples of other forms of deliverables include but are not limited to electrical power, compressed gas flows, carbon dioxide, cooling capacity, and heating capacity.

A valve according to various embodiments may function as an inlet valve and/or as an outlet valve to a gas expansion and/or compression chamber. Where the same chamber serves for both compression and expansion of gas, the valve may be configured to operate in a bi-directional manner.

In certain embodiments, the valve may be configured to allow the flow of a gas-liquid mixture that has been created in an upstream mixing chamber. In such a configuration, embodiments of the valve design desirably offer an unobstructed straight path to the flowing gas-liquid mixture. This discourages coalescence of entrained liquid droplets, allowing their passage to effect the desired heat exchange with compressing/expanding gas within the chamber.

The particular system shown in FIG. 13 represents only one possible embodiment, and alternatives thereto may be created. For example, while FIG. 13 shows an embodiment with compression and expansion occurring in the same cylinder, with the moveable element in communication through a linkage with a motor/generator, this is not required.

Figure 17A:
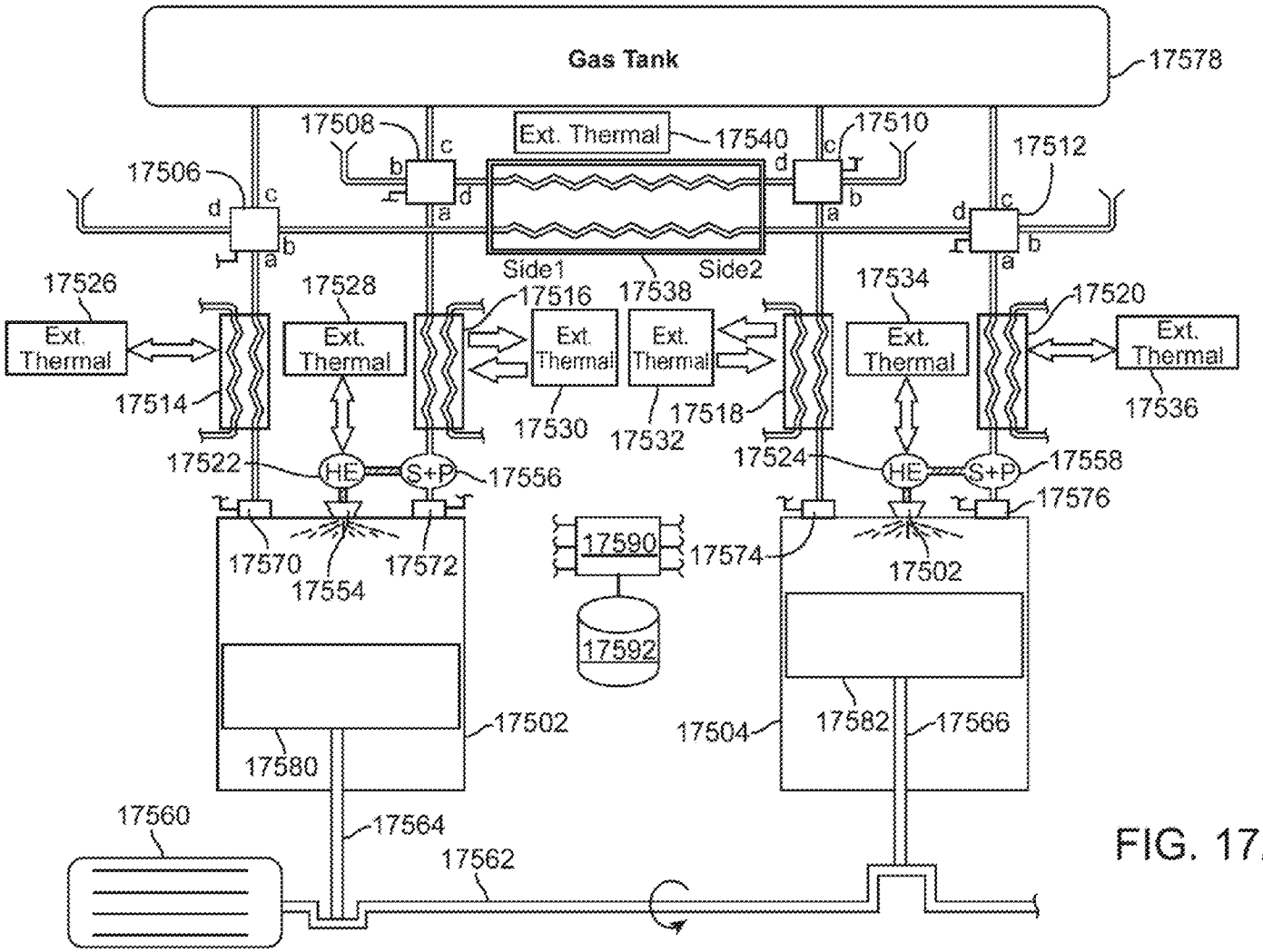
FIG. 17A shows a simplified view of an alternative energy storage system embodiment.

FIG. 17A shows an alternative embodiment utilizing two cylinders, which in certain modes of operation may be separately dedicated for compression and expansion. Embodiments employing such separate cylinders for expansion and compression may, or may not, employ utilize a common linkage (here a mechanical linkage in the form of a crankshaft) with a motor, generator, or motor/generator.

Figure 17B:
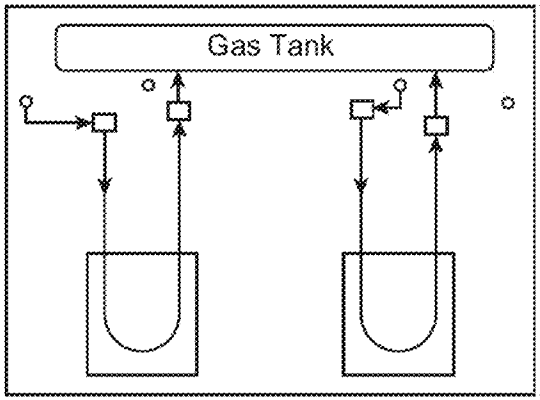
FIG. 17BA shows various basic operational modes of the system of FIG. 17A.
Figure 17B:
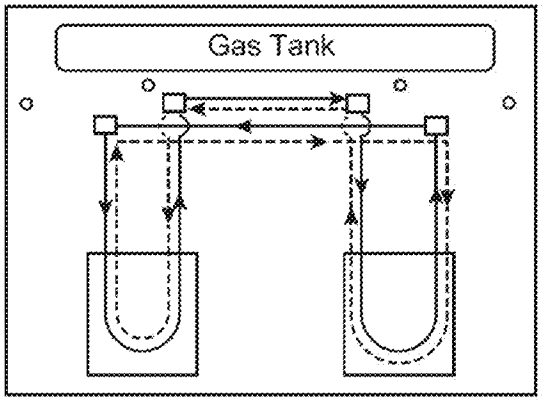
Figure 17B:
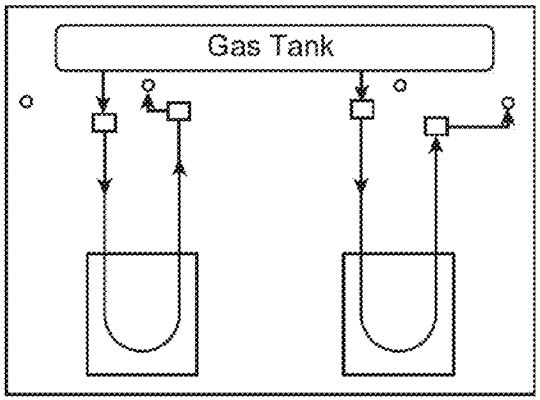
Figure 17B:
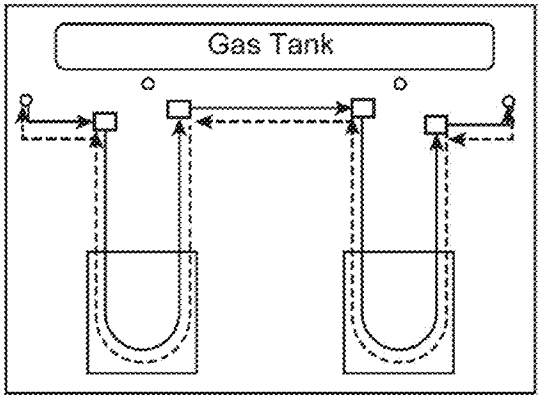
Figure 17B:
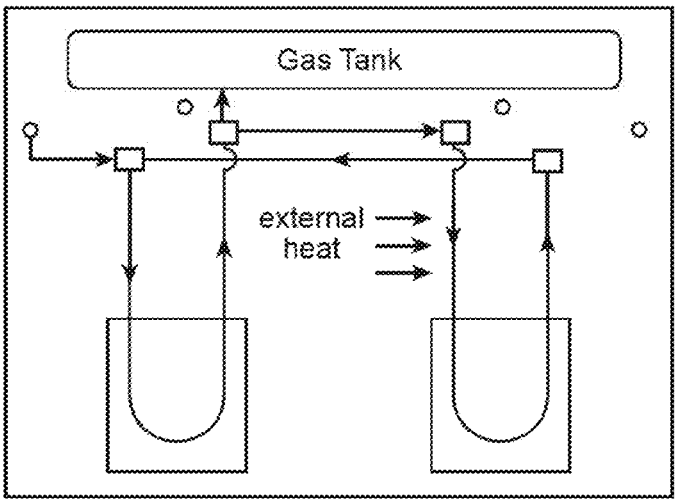
Figure 17B:
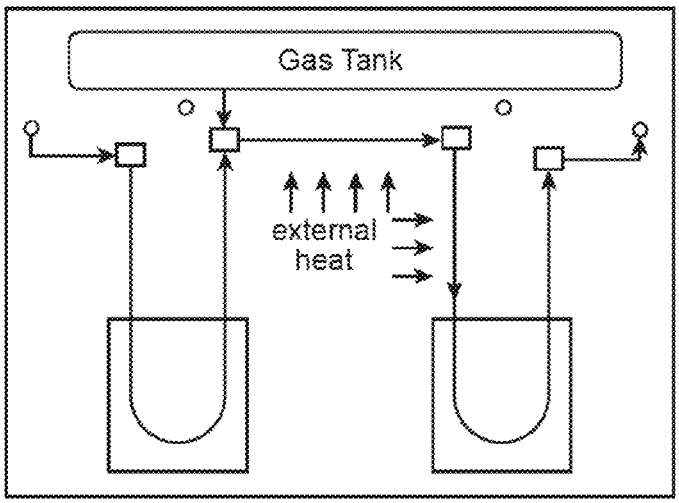

For example, FIG. 17BA is a table showing four different basic configurations of the apparatus of FIG. 17A. The table of FIG. 17BA further indicates the interaction between system elements and various thermal nodes 1725, 1728, 1730, 1732, 1734, 1736, and 1740, in the different configurations.

Such thermal nodes can comprise one or more external heat sources, or one or more external heat sinks, as indicated more fully in that table. Examples of such possible such external heat sources include but are not limited to, thermal solar configurations, geothermal phenomena, and proximate heat-emitting industrial processes. Examples of such possible such external heat sinks include but are not limited to, the environment (particularly at high altitudes and/or latitudes), and geothermal phenomena (such as snow or water depth thermal gradients).

FIGS. 17BB-17BE are simplified views showing the various basic operational modes listed in FIG. 17BA. The four different basic modes of operation shown in FIG. 17BA may be intermittently switched, and/or combined to achieve desired results. FIGS. 17BF-BG show operational modes comprising combinations of the basic operational modes.

One possible benefit offered by the embodiment of FIGS. 17A-BG is the ability to provide cooling or heating on demand. Specifically, the change in temperature experienced by an expanding or compressed gas, or an injected liquid exchanging heat with such an expanding or compressed gas, can be used for temperature control purposes. For example, gas or liquid cooled by expansion could be utilized in an HVAC system. Conversely, the increase in temperature experienced by a compressed gas, or a liquid exchanging heat with a compressed gas, can be used for heating.

By providing separate, dedicated cylinders for gas compression or expansion, embodiments according to FIG. 17A may provide such temperature control on-demand, without reliance upon a previously stored supply of compressed gas. In particular, the embodiment of FIG. 17A allows cooling based upon immediate expansion of gas compressed by the dedicated compressor.

While FIGS. 13 and 17A show embodiments involving the movement of a solid, single-acting piston, this is not required. Alternative embodiments could utilize other forms of moveable elements. Examples of such moveable elements include but are not limited to double-acting solid pistons, liquid pistons, flexible diaphragms, screws, turbines, quasi-turbines, multi-lobe blowers, gerotors, vane compressors, scroll compressors, and centrifugal/axial compressors.

Moreover, embodiments may communicate with a motor, generator, or motor/generator, through other than mechanical linkages. Examples of alternative linkages which may be used include but are not limited to, hydraulic/pneumatic linkages, magnetic linkages, electric linkages, and electro-magnetic linkages.

While the particular embodiments of FIGS. 13 and 17A show a solid piston in communication with a motor generator through a mechanical linkage in the form of a crankshaft, this is not required. Alternative embodiments could utilize other forms of mechanical linkages, including but not limited to gears such as multi-node gearing systems (including planetary gear systems). Examples of mechanical linkages which may be used include shafts such as crankshafts, gears, chains, belts, driver-follower linkages, pivot linkages, Peaucellier-Lipkin linkages, Sarrus linkages, Scott Russel linkages, Chebyshev linkages, Hoekins linkages, swashplate or wobble plate linkages, bent axis linkages, Watts linkages, track follower linkages, and cam linkages. Cam linkages may employ cams of different shapes, including but not limited to sinusoidal and other shapes. Various types of mechanical linkages are described in Jones in "Ingenious Mechanisms for Designers and Inventors, Vols. I and II", The Industrial Press (New York 1935), which is incorporated by reference in its entirety herein for all purposes.

What is claimed is:

1. An apparatus comprising:

a chamber defined within a plurality of liquid sprayers;

a plunger piston having a first end moveable in response to gas expanding within the cylinder in an absence of combustion, the plunger piston having a second end in communication with a crank;

a dedicated active high pressure valve comprising a poppet moveable relative to a port of the cylinder;

a channel between the dedicated high pressure valve and the chamber to substantially balance a pressure during valve actuation; and a piston seal located on a chamber wall rather than on the plunger piston.

2. An apparatus as in claim 1 wherein the plurality of liquid sprayers are arranged in at least one liquid spray ring.

3. An apparatus as in claim 1 wherein the channel comprises a vent through the poppet, and the valve further comprises a curtain portion.

4. An apparatus as in claim 1 wherein the valve further comprises a shroud.

5. An apparatus as in claim 1 further comprising a passive high pressure valve in communication with the chamber.

6. An apparatus as in claim 1 further comprising a cam assembly configured to operate the dedicated high pressure valve via a physical connection to the crank.

7. An apparatus as in claim 6 wherein the physical connection comprises a planetary gear.

8. An apparatus as in claim 6 wherein the cam assembly comprises a first cam pair and a second cam pair.

9. An apparatus as in claim 1 further comprising a dedicated low pressure valve comprising a second poppet moveable relative to a second port of the cylinder.

10. An apparatus as in claim 9 wherein the dedicated low pressure valve is spring actuated.

11. An apparatus as in claim 1 further comprising a liquid pump in fluid communication with a liquid sprayer, the liquid pump comprising opposing plungers in communication with a rotating cam via a carrier cam follower.

12. An apparatus as in claim 1 wherein the plunger piston is in communication with the crank through a mechanical linkage.

13. An apparatus as in claim 12 wherein the mechanical linkage comprises a crosshead having a central portion connected to an eccentric in order to move relative to end portions of the crosshead.

14. An apparatus as in claim 1 wherein the plurality of liquid sprayers are supplied with liquid only when they are not covered by the plunger piston.

15. A method comprising:

actively controlling a dedicated high pressure valve via a rotating cam assembly to flow compressed gas into a chamber from a high pressure side;

allowing the compressed gas to expand against a plunger piston in an absence of combustion within the chamber in order to drive a mechanical linkage;

causing a liquid pump to flow liquid into the chamber through a plurality of sprayers for heat exchange;

generating electricity from movement of the mechanical linkage; and a piston seal located on a chamber wall rather than on the plunger piston.

16. A method as in claim 15 wherein the plurality of sprayers are arranged in at least one liquid spray ring.

17. A method as in claim 15 wherein actively controlling the dedicated high pressure valve comprises changing a position of a first cam pair and a second cam pair.

18. A method as in claim 17 wherein the position is changed utilizing a stepper motor.

19. A method as in claim 15 wherein the dedicated high pressure valve is controlled via desmodromic actuation.

20. A method as in claim 15 wherein the liquid pump comprises a carrier type cam follower with opening and closing cams, and opposed plungers.

21. A method as in claim 15 wherein a pressure across the dedicated high pressure valve is balanced by a channel between the dedicated high pressure valve and the chamber.

22. A method as in claim 21 wherein the dedicated high pressure valve comprises a poppet and a curtain portion, and the channel comprises a vent through the poppet.

23. A method as in claim 15 wherein the dedicated high pressure valve comprises a shroud.

24. A method as in claim 15 wherein the plurality of liquid sprayers are supplied with liquid only when they are not covered by the plunger piston.

* * * * *